US009617065B2

(12) United States Patent
Allegretti et al.

(10) Patent No.: US 9,617,065 B2
(45) Date of Patent: Apr. 11, 2017

(54) BULK MATERIAL SHIPPING CONTAINER

(71) Applicant: Arrows Up, LLC, Elk Grove Villiage, IL (US)

(72) Inventors: C. John Allegretti, Barrington Hills, IL (US); Anthony M. Raso, West Dundee, IL (US); Lyndon Just, Elgin, IL (US)

(73) Assignee: Arrows Up, LLC, Elk Grove Village, IL (US)

( * ) Notice: Subject to any disclaimer, the term of this patent is extended or adjusted under 35 U.S.C. 154(b) by 110 days.

(21) Appl. No.: 14/516,292

(22) Filed: Oct. 16, 2014

(65) Prior Publication Data

US 2015/0069052 A1 Mar. 12, 2015

Related U.S. Application Data

(63) Continuation of application No. 13/249,688, filed on Sep. 30, 2011, now Pat. No. 8,887,914, which is a (Continued)

(51) Int. Cl.
*B65D 19/00* (2006.01)
*B65D 88/10* (2006.01)
(Continued)

(52) U.S. Cl.
CPC ..... *B65D 88/10* (2013.01); *B65D 19/06* (2013.01); *B65D 77/061* (2013.01);
(Continued)

(58) Field of Classification Search
CPC ..... B65D 88/10; B65D 19/06; B65D 77/061; B65D 90/0033; B65D 90/16; B65D 90/0046; B65D 90/0026; B65D 90/10
(Continued)

(56) References Cited

U.S. PATENT DOCUMENTS 572,468 A 12/1896 Brown
2,622,771 A 12/1952 Tulou
(Continued)

FOREIGN PATENT DOCUMENTS

DE 4008147 9/1990
DE 4008147 A1 9/1990
(Continued)

OTHER PUBLICATIONS

Kristy International, Inc., corner Castings and Fittings, printed from http://www.krisryinc.com/products/cornercastings.html , printed Jun. 20, 2016, available before Oct. 28, 2009. (6 pgs.).
(Continued)

*Primary Examiner* — Jacob K Ackun
*Assistant Examiner* — Rafael Ortiz
(74) *Attorney, Agent, or Firm* — Neal, Gerber & Eisenberg LLP

(57) ABSTRACT

A bulk material shipping container in one embodiment including a pallet, a bottom compartment mounted on the pallet, a top compartment mounted on the bottom compartment and movable from a retracted position relative to the bottom compartment to an expanded position relative to the bottom compartment, a plurality of top compartment supporting assemblies configured to support the top compartment in the expanded position relative to the bottom compartment, and configured to release the top compartment from the expanded position to enable the top compartment to move downwardly into the retracted position, a material unloading assembly, a material loading assembly, and an extension assembly.

6 Claims, 114 Drawing Sheets

Related U.S. Application Data continuation-in-part of application No. 12/914,075, filed on Oct. 28, 2010, now Pat. No. 8,616,370.

(51) Int. Cl.

| | |
|---|---|
| ***B65D 19/06*** | (2006.01) |
| ***B65D 77/06*** | (2006.01) |
| ***B65D 90/00*** | (2006.01) |
| ***B65D 90/10*** | (2006.01) |
| ***B65D 90/16*** | (2006.01) |

(52) U.S. Cl.

CPC ..... *B65D 90/0033* (2013.01); *B65D 90/10* (2013.01); *B65D 90/16* (2013.01); *B65D 2519/00024* (2013.01); *B65D 2519/00029* (2013.01); *B65D 2519/00034* (2013.01); *B65D 2519/00044* (2013.01); *B65D 2519/00064* (2013.01); *B65D 2519/00069* (2013.01); *B65D 2519/0086* (2013.01); *B65D 2519/00164* (2013.01); *B65D 2519/00199* (2013.01); *B65D 2519/00268* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00338* (2013.01); *B65D 2519/00432* (2013.01); *B65D 2519/00502* (2013.01); *B65D 2519/00562* (2013.01); *B65D 2519/00572* (2013.01); *B65D 2519/00621* (2013.01); *B65D 2519/00666* (2013.01); *B65D 2519/00716* (2013.01); *B65D 2519/00786* (2013.01); *B65D 2519/00805* (2013.01); *B65D 2519/00975* (2013.01)

(58) Field of Classification Search

USPC ..... 206/386, 600, 595, 598, 599; 220/1.5, 220/601, 1.6; 108/55.1, 55.11, 57.12

See application file for complete search history.

(56) References Cited

U.S. PATENT DOCUMENTS

| | | | | |
|---|---|---|---|---|
| 2,802,603 | A | | 8/1957 | McCray |
| 2,865,521 | A | | 12/1958 | Fisher et al. |
| 2,894,666 | A | | 7/1959 | Campbell, Jr. |
| 3,270,921 | A | | 9/1966 | Nadolske |
| 3,294,306 | A | | 12/1966 | Areddy |
| 3,318,473 | A | | 5/1967 | Jones et al. |
| 3,406,995 | A | | 10/1968 | McCarthy |
| 3,407,971 | A | | 10/1968 | Oehler |
| 3,602,400 | A | | 8/1971 | Cooke |
| 3,785,534 | A | | 1/1974 | Smith |
| 3,797,727 | A | | 3/1974 | Downing et al. |
| 3,904,105 | A | | 9/1975 | Booth |
| 3,955,703 | A | | 5/1976 | Zebarth |
| 3,999,290 | A | | 12/1976 | Wood |
| 4,019,634 | A | | 4/1977 | Bonnot |
| 4,019,635 | A | | 4/1977 | Boots |
| 4,056,295 | A | | 11/1977 | Downing |
| 4,247,228 | A | | 1/1981 | Gray et al. |
| 4,280,640 | A | | 7/1981 | Daloisio |
| 4,282,988 | A | | 8/1981 | Hulbert, Jr. |
| 4,331,252 | A | | 5/1982 | Carren |
| 4,397,406 | A | | 8/1983 | Croley |
| 4,398,653 | A | | 8/1983 | Daloisio |
| 4,448,296 | A | | 5/1984 | Tabler |
| 4,466,541 | A | | 8/1984 | Tabler et al. |
| 4,470,518 | A | | 9/1984 | Stein |
| 4,485,910 | A | | 12/1984 | Tabler |
| 4,572,368 | A | | 2/1986 | Miller et al. |
| 4,573,577 | A | | 3/1986 | Miller |
| 4,574,962 | A | | 3/1986 | Tabler et al. |
| 4,600,103 | A | | 7/1986 | Tabler |
| D285,219 | S | | 8/1986 | Stein |
| 4,620,644 | A | | 11/1986 | Miller |
| 4,626,166 | A | | 12/1986 | Jolly |
| 4,643,310 | A | | 2/1987 | Deaton et al. |
| 4,648,199 | A | | 3/1987 | Deaton et al. |
| 4,648,200 | A | | 3/1987 | Miller et al. |
| D289,788 | S | | 5/1987 | Deaton et al. |
| D290,778 | S | | 7/1987 | Tabler |
| 4,688,675 | A | | 8/1987 | Miller et al. |
| D292,718 | S | | 11/1987 | Stein |
| 4,724,976 | A | | 2/1988 | Lee |
| 4,756,420 | A | | 7/1988 | Deaton |
| 4,760,922 | A | | 8/1988 | Northgrave |
| 4,779,751 | A | | 10/1988 | Munroe |
| 4,804,082 | A | | 2/1989 | Stein |
| 4,809,851 | A | | 3/1989 | Oestreich, Jr. et al. |
| 4,832,200 | A | | 5/1989 | Deaton et al. |
| RE32,966 | E | | 6/1989 | Miller et al. |
| 4,848,605 | A | | 7/1989 | Wise |
| D304,120 | S | | 10/1989 | Buchanan et al. |
| 4,890,740 | A | | 1/1990 | Tabler |
| 4,917,255 | A | | 4/1990 | Foy et al. |
| 4,919,583 | A | | 4/1990 | Speakman, Jr. |
| D307,718 | S | | 5/1990 | Tabler |
| 4,936,458 | A | | 6/1990 | Tabler et al. |
| 4,946,068 | A | | 8/1990 | Erickson et al. |
| 4,948,186 | A | | 8/1990 | Pruitt |
| RE33,384 | E | | 10/1990 | Miller et al. |
| 4,960,207 | A | | 10/1990 | Tabler et al. |
| 4,966,310 | A | | 10/1990 | Hawkins |
| 4,974,737 | A | | 12/1990 | Miller |
| 4,995,522 | A | | 2/1991 | Barr |
| 5,036,979 | A | | 8/1991 | Selz |
| 5,094,356 | A | | 3/1992 | Miller |
| 5,224,635 | A | * | 7/1993 | Wise ..... B65D 88/10 206/508 |
| 5,232,120 | A | | 8/1993 | Dunken et al. |
| 5,269,455 | A | | 12/1993 | Grigsby et al. |
| 5,277,014 | A | | 1/1994 | White |
| 5,330,069 | A | | 7/1994 | Jamison et al. |
| 5,339,996 | A | | 8/1994 | Dubbert et al. |
| 5,373,961 | A | | 12/1994 | Harris et al. |
| 5,402,915 | A | | 4/1995 | Hogan |
| 5,439,113 | A | | 8/1995 | Elvin-Jensen |
| 5,441,321 | A | | 8/1995 | Karpisek |
| 5,445,289 | A | | 8/1995 | Owen |
| 5,524,750 | A | | 6/1996 | Miller |
| 5,564,599 | A | | 10/1996 | Barber et al. |
| 5,667,090 | A | | 9/1997 | Langham, Jr. et al. |
| 5,673,791 | A | | 10/1997 | Jamison |
| 5,715,962 | A | | 2/1998 | McDonnell |
| 5,722,550 | A | | 3/1998 | Ficker |
| 5,788,121 | A | | 8/1998 | Sasaki et al. |
| 5,803,296 | A | | 9/1998 | Olson |
| 5,829,616 | A | * | 11/1998 | Daniel ..... B65D 19/08 206/518 |
| 5,836,480 | A | | 11/1998 | Epp et al. |
| 5,845,799 | A | | 12/1998 | Deaton |
| 5,878,903 | A | | 3/1999 | Ung |
| 5,927,558 | A | | 7/1999 | Bruce |
| 5,971,219 | A | | 10/1999 | Karpiesek |
| 6,010,022 | A | | 1/2000 | Deaton |
| 6,112,929 | A | | 9/2000 | Ota |
| 6,205,938 | B1 | | 3/2001 | Foley et al. |
| 6,247,594 | B1 | | 6/2001 | Garton |
| 6,253,948 | B1 | | 7/2001 | Ficker |
| 6,328,183 | B1 | | 12/2001 | Coleman |
| 6,491,343 | B2 | | 12/2002 | Yamazaki |
| 6,547,127 | B2 | * | 4/2003 | Bradford ..... B65D 5/0055 220/4.28 |
| 6,776,300 | B2 | | 8/2004 | Walsh et al. |
| 6,783,032 | B2 | | 8/2004 | Fons |
| 6,968,946 | B2 | | 11/2005 | Shert |
| 7,008,163 | B2 | | 3/2006 | Russell |
| 7,032,765 | B2 | | 4/2006 | Miller et al. |
| 7,100,791 | B2 | | 9/2006 | Berger |
| 7,240,681 | B2 | | 7/2007 | Saik |
| 7,252,309 | B2 | | 8/2007 | Eng Soon et al. |
| 7,284,579 | B2 | | 10/2007 | Elgan et al. |

(56) References Cited

U.S. PATENT DOCUMENTS

| | | | | |
|---|---|---|---|---|
| 7,353,962 | B2 | 4/2008 | Parnall et al. | |
| D575,062 | S | 8/2008 | Wolf | |
| 7,431,173 | B2 | 10/2008 | Thorpe | |
| 7,475,796 | B2 * | 1/2009 | Garton | B65D 88/128 211/153 |
| 7,543,539 | B2 | 6/2009 | Miller | |
| 7,556,166 | B2 | 7/2009 | Parnall et al. | |
| 7,762,281 | B2 | 7/2010 | Schuld | |
| 8,201,520 | B2 | 6/2012 | Meritt | |
| 2001/0022308 | A1 | 9/2001 | Epp et al. | |
| 2002/0023994 | A1 | 2/2002 | De Shann | |
| 2002/0070215 | A1 | 6/2002 | Walsh et al. | |
| 2003/0019875 | A1 | 1/2003 | Woram | |
| 2003/0024971 | A1 | 2/2003 | Jones et al. | |
| 2004/0118725 | A1 | 6/2004 | Shuert | |
| 2004/0222222 | A1 | 11/2004 | Parnall et al. | |
| 2004/0232146 | A1 | 11/2004 | Kessler et al. | |
| 2006/0266747 | A1 | 11/2006 | Stolzman | |
| 2007/0210080 | A1 * | 9/2007 | Hooper | B65D 88/121 220/1.5 |
| 2007/0241104 | A1 | 10/2007 | Huizingh et al. | |
| 2007/0278223 | A1 | 12/2007 | Ficker | |
| 2007/0290471 | A1 | 12/2007 | Sexton | |
| 2008/0029546 | A1 | 2/2008 | Schuld | |
| 2008/0029553 | A1 | 2/2008 | Culleton | |
| 2008/0169285 | A1 | 7/2008 | Marazita et al. | |
| 2008/0179054 | A1 | 7/2008 | McGough et al. | |
| 2008/0179322 | A1 | 7/2008 | Parnall et al. | |
| 2008/0179324 | A1 | 7/2008 | McGough et al. | |
| 2008/0226434 | A1 | 9/2008 | Smith et al. | |
| 2009/0000527 | A1 | 1/2009 | Ficker | |
| 2009/0078410 | A1 | 3/2009 | Krenek et al. | |
| 2011/0011893 | A1 | 1/2011 | Cerny | |

FOREIGN PATENT DOCUMENTS

| | | |
|---|---|---|
| EP | 0 016 977 | 10/1980 |
| EP | 1598288 A1 | 11/2005 |
| FR | 2 640 598 | 6/1990 |
| GB | 2 066 220 | 7/1981 |
| JP | 2007-84151 | 4/2007 |
| JP | 2007084151 A | 4/2007 |
| NL | 8105283 | 6/1983 |
| WO | WO 01/76960 | 10/2001 |
| WO | WO 03/024815 | 3/2003 |
| WO | WO 03024815 A1 | 3/2003 |
| WO | WO03024815 A1 | 3/2003 |
| WO | WO 2007/081556 | 7/2007 |
| WO | WO 2009/087338 | 7/2009 |
| WO | WO 2009087338 A1 | 7/2009 |
| WO | WO2009087338 A1 | 7/2009 |

OTHER PUBLICATIONS

Supplementary Partial European Search Report dated Jun. 15, 2015, for European Application No. EP11836876 related to International Patent Application No. PCT/US2011056728.

Home Page of CDF Corporation's web site (http://www.cdf1.com), printed Jul. 15, 2009, copyright 2009 to CDF1 Corporation (2 pages).

Cheertainer Bag in Box Page of CDF Corporation's web site (http://www.cdf1.com/cheertainer.php), printed Jul. 15, 2009, copyright 2009 to CDF1 Corporation (3 pages).

Cheertainer image from CDF Corporation's web site (http://www.cdf1.com/images/banner_image/banner_cheertainer1.jpg), printed Jul. 15, 2009 (1 page).

Center Flow Container Page of Buckhorn Inc.'s web site (http://www.buckhorninc.com/products/collapsible-bulk-boxes/collapsible-bulk-boxes_11.asp), printed Oct. 11, 2010, copyright 1997-2010 to Buckhorn Inc. (3 pages).

Collapsible Bulk Containers brochure written by Buckhorn Inc. (12 pages).

Redacted Monsanto and Pallet Technologies Seed Bin Presentation dated Jun. 8, 2009, presented by John Allegretti.

PCT Search Report and Written Opinion for International Application No. PCT/US2011/056728 dated Oct. 18, 2011.

Office Action for U.S. Appl. No. 12/914,075 dated Jan. 4, 2013.

Office Action for U.S. Appl. No. 12/914,075, dated Mar. 19, 2013.

Supplementary European Search Report dated Jun. 15, 2015, for European Patent Application No. EP11836876.

* cited by examiner

BULK MATERIAL SHIPPING CONTAINER

PRIORITY CLAIM

This application is a continuation patent application of, claims priority to, and the benefit of U.S. patent application Ser. No. 13/249,688, filed Sep. 30, 2011, which is a continuation-in-part patent application of, claims priority to, and the benefit of U.S. patent application Ser. No. 12/914,075, filed Oct. 28, 2010, which issued on Dec. 31, 2013, as U.S. Pat. No. 8,616,370, the entire contents of which are incorporated herein by reference.

BACKGROUND

Various bulk material shipping containers are known. Such known material bulk shipping containers, sometimes referred to herein for brevity as known containers or as known bulk containers, are used to transport a wide range of products, parts, components, items, and materials such as, but not limited to, seeds, shavings, fasteners, and granular materials. These are sometimes called loose materials. There are various disadvantages with such known bulk material shipping containers.

For example, one known and widely commercially used known bulk container for shipping materials (such as shipping seeds to farms) is sold by Buckhorn Industries. This known bulk container is made from plastic, weighs about 338 pounds (151.9 kilograms), and holds a maximum of 58.3 cubic feet of material. This known container has a bottom section, a top section, and a cover. To use this known container, loaders at a bulk material supplier must remove the cover, remove the top section from the bottom section, flip the top section upside down, place the flipped top section on the bottom section, fill the container, and then place the cover on the flipped top section. This process requires at least two people and a relatively significant amount of time when filling a large quantity of these containers. In certain instances, specifically configured forklift attachments are required to fill and handle this known container. After this known container is shipped to its ultimate destination (such as a farm), the bulk material (such as seed) is unloaded from the container, and the empty container must be shipped back to the material supplier. However, prior to and for shipping back to the supplier, the cover is removed, the flipped top section is removed from the bottom section, the flipped top section is then flipped back over and placed on the bottom section, and the cover is then placed on the top section and fastened with zip ties. This process also requires at least two people and is relatively time consuming especially for a large quantity of such containers.

Another disadvantage of this known container is that this container is made from plastic and if one of the three sections (i.e., the bottom, the top, or the cover) is damaged or cracked, that entire section typically must be replaced (instead of being repaired). This adds additional cost, time out of service for the damaged container, and additional material and energy waste.

Another disadvantage of this known container is that when disassembled (for shipping empty), only two of these containers can be stacked on top of each other and still fit in a conventional shipping container or truck. This tends to leave wasted space in such shipping containers and trucks, and thus increases the overall cost of shipping (including related fuel costs) and energy waste.

Additional disadvantages of this known container are that: (a) the cover can be easily lost or misplaced; (b) the cover can be easily damaged; (c) this known container is less weather resistant because the cover is readily removable and only attached by zip ties; (d) the insides and outside surfaces are difficult to clean; and (e) a material holding bag is not readily usable with this container, such that this container can not be used for certain types of loose materials.

For purposes of brevity, (a) the people who assemble and/or put a container in the position for receiving materials for transport and who load the material in a container are sometimes referred to herein as the "loaders," and (b) the people who remove the materials from a container and who disassemble and/or put a container in the position for sending back to the supplier are sometimes referred to herein as the "unloaders."

Accordingly, there is a need for better bulk material shipping containers which overcome these disadvantages.

SUMMARY

Various embodiments of the present disclosure provide a bulk material shipping container which overcomes the above described disadvantages with previously known commercially available bulk shipping containers.

One embodiment of the bulk material shipping container of the present disclosure includes: (a) a pallet; (b) a bottom compartment mounted on and supported by the pallet at numerous different support points; (c) a top compartment mounted on the bottom compartment and movable from a retracted position relative to the bottom compartment (for efficient shipping when not holding materials or holding a relatively small amount of materials) to an expanded position relative to the bottom compartment (for holding extra materials during shipping); (d) a plurality of top compartment supporting assemblies configured to support the top compartment in the expanded position relative to the bottom compartment, and to release the top compartment from the expanded position to enable the top compartment to move downwardly into the retracted position; (e) a material unloading assembly supported by bottom compartment and the pallet; (f) a material loading assembly attached to the top compartment; and (g) an extension assembly attached to the top compartment which enables a user to move the top compartment from the retracted position to the expanded position. The shipping container of the present disclosure is configured to directly hold materials or to receive a suitable plastic bag which holds the materials in the container. It should thus be appreciated that the expandable and retractable bulk material shipping container of the present disclosure can be used with a bag or without a bag. It should also be appreciated that when a plastic bag is used to hold the materials in the container, the material unloading assembly includes a knife which cuts the bottom of the bag open for unloading of the materials. The bulk material shipping container of the present disclosure is sometimes referred herein for brevity as the container or as the shipping container.

One embodiment of the shipping container of the present disclosure is primarily made from stainless steel or galvanized steel, except for the pallet which is made from wood. If one of the sections of this embodiment of the container is damaged or cracked, that section can typically be repaired which reduces: (a) cost; (b) time out of service for the container; and (c) additional material and/or energy waste. In alternative embodiments, the pallet of the bulk material shipping container, or certain parts thereof, can be made from a suitably strong plastic material such as a composite material or a fiber glass material.

One embodiment of the container of the present disclosure can also be stacked three high (when empty) for shipping in conventional transport containers or trucks. This reduces wasted space in such transport containers and trucks and decreases shipping cost and fuel consumption, and thus energy waste.

One embodiment of the container of the present disclosure holds 72 cubic feet of material and up to about 3125 pounds (1417.5 kilograms). This embodiment of the shipping container has several advantages over the above described known bulk container. Specifically, this embodiment of the bulk container is approximately 65 pounds (29.49 kilograms) lighter, holds approximately 14 cubic feet of additional materials which is approximately 25% more material (such as seeds), is readily repairable, can be stacked three high for more efficient transport to the supplier, and can be moved from the transport or retracted position to the loading or expanded position by one person.

To load the presently disclosed container, the loaders do not need to remove a cover, remove the top compartment from the bottom compartment, flip the top compartment over, place the flipped top compartment on the bottom compartment, or place any cover on the flipped top compartment. Additionally, the unloaders do not need to remove the cover, remove the flipped top compartment, flip the top compartment, place the top compartment on the bottom compartment, and then place the cover on the top compartment for returning the empty container.

In another embodiment, the bulk material shipping container of the present disclosure is not expandable or retractable. In one such embodiment, the shipping container includes: (a) a pallet; (b) a bottom compartment mounted on and supported by the pallet at numerous different support points; (c) a top compartment mounted on the bottom compartment; (d) a material unloading assembly supported by the bottom compartment and the pallet; and (e) a material loading assembly attached to the top compartment. In this embodiment, the top compartment is fixed such as by welding to the bottom compartment, and thus this embodiment does not need to include the plurality of top compartment supporting assemblies or the extension assembly attached to the top compartment. In this embodiment, the bulk material shipping container of the present disclosure can be used with a bag or without a bag.

In another embodiment, the shipping container includes: (a) a pallet; (b) a single compartment mounted on and supported by the pallet at numerous different support points; (c) a material unloading assembly supported by the single compartment and the pallet; and (d) a material loading assembly attached to the single compartment. In this embodiment, since there is a single compartment, this embodiment does not need to include the plurality of top compartment supporting assemblies or the extension assembly attached to a top compartment. In this embodiment, the bulk material shipping container of the present disclosure can also be used with a bag or without a bag.

In further multi-compartment and single compartment embodiments, instead of a bag, a sleeve is employed in the bulk material shipping container of the present disclosure. In further multi-compartment and single compartment embodiments, the pallet supports the compartments, but does not directly support the material unloading assembly.

In further embodiments, the bulk material shipping container of the present disclosure is configured without the top wall to provide an open top end.

It is therefore an advantage of the present disclosure to provide a new and improved bulk material shipping container.

Additional features and advantages of the present invention are described in, and will be apparent from, the following Detailed Description of Exemplary Embodiments and the figures.

DETAILED DESCRIPTION OF EXEMPLARY EMBODIMENTS

Figure 1:
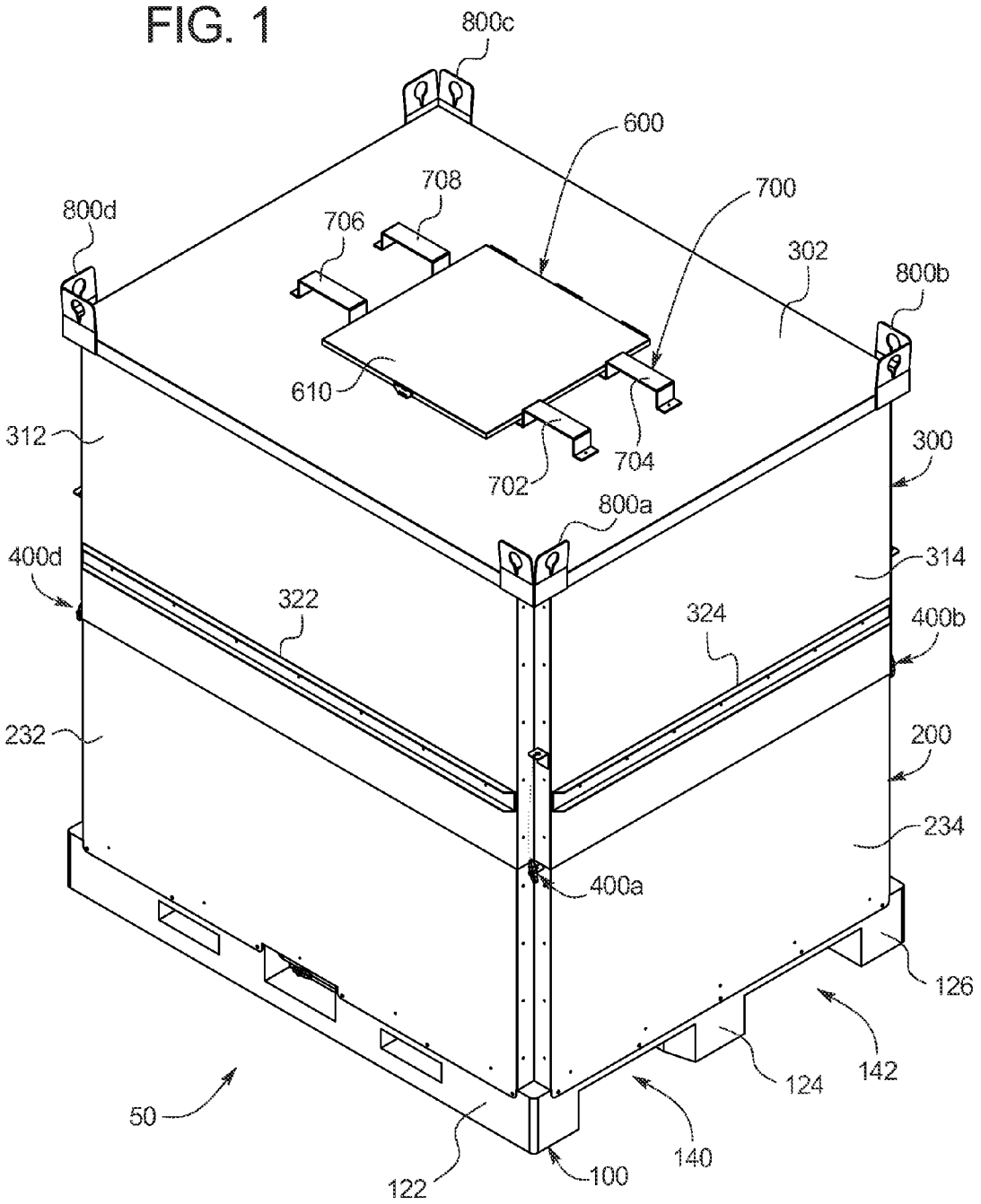
FIG. 1 is a top perspective view of the shipping container of one embodiment of the present disclosure, illustrating the top compartment in the expanded position relative to the bottom compartment.
Figure 2:
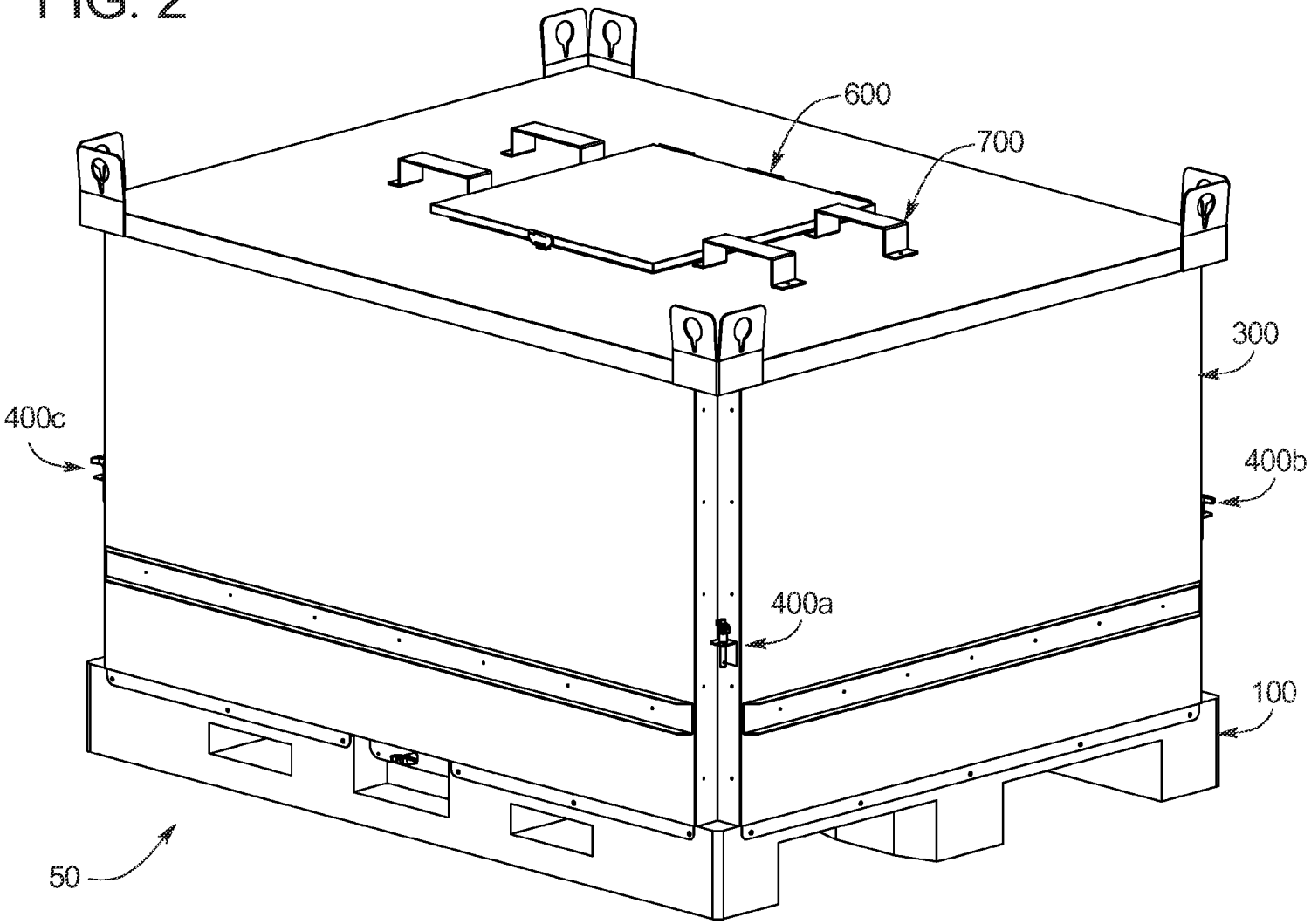
FIG. 2 is a top perspective view of the shipping container of FIG. 1, illustrating the top compartment in the retracted or collapsed position relative to the bottom compartment.
Figure 3:
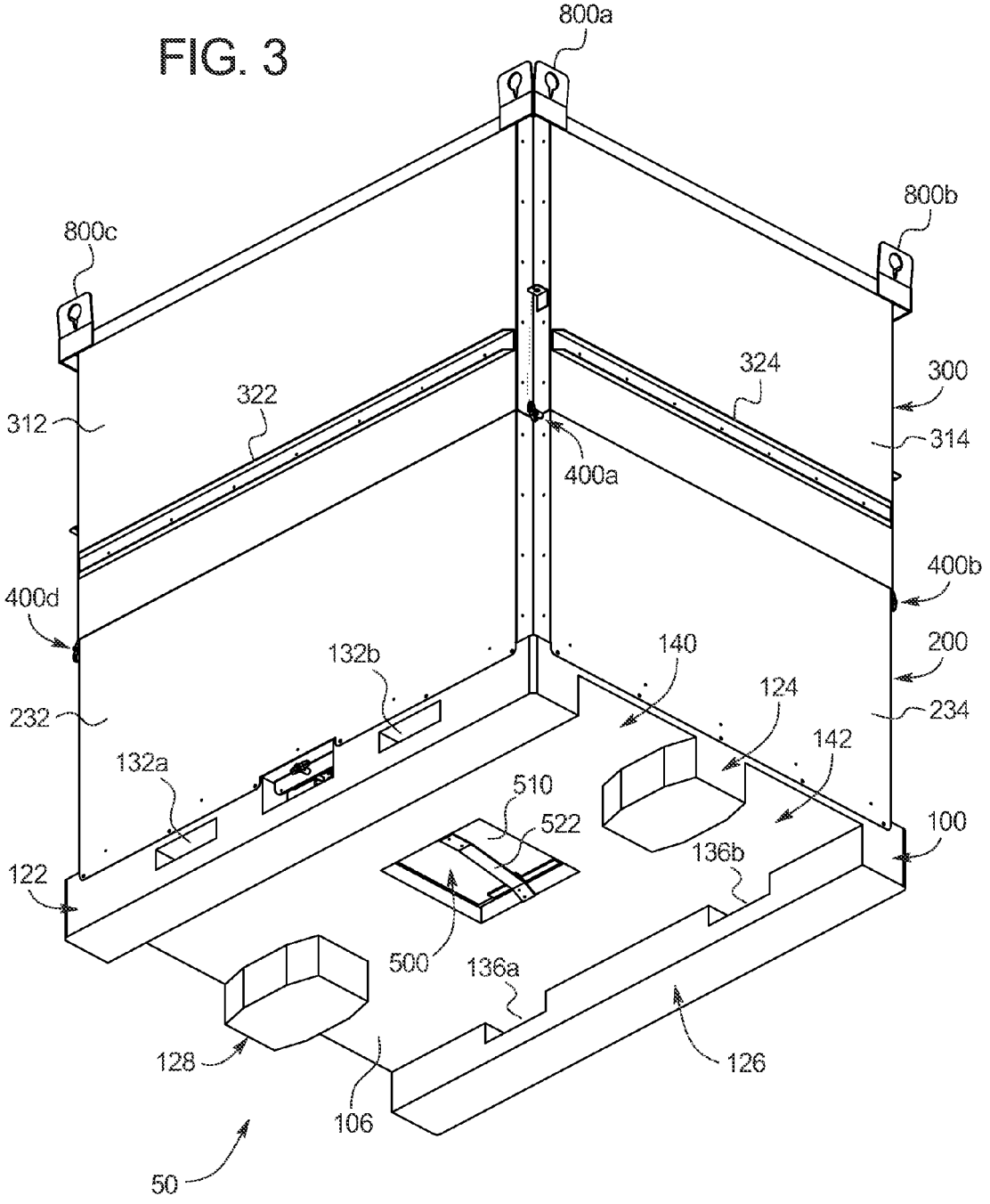
FIG. 3 is a bottom perspective view of the shipping container of FIG. 1, illustrating the top compartment in the expanded position relative to the bottom compartment, and illustrating the legs of the pallet, the fork lift tine receiving channels defined by the pallet, and pallet jack tine receiving channels defined by the pallet.
Figure 4:
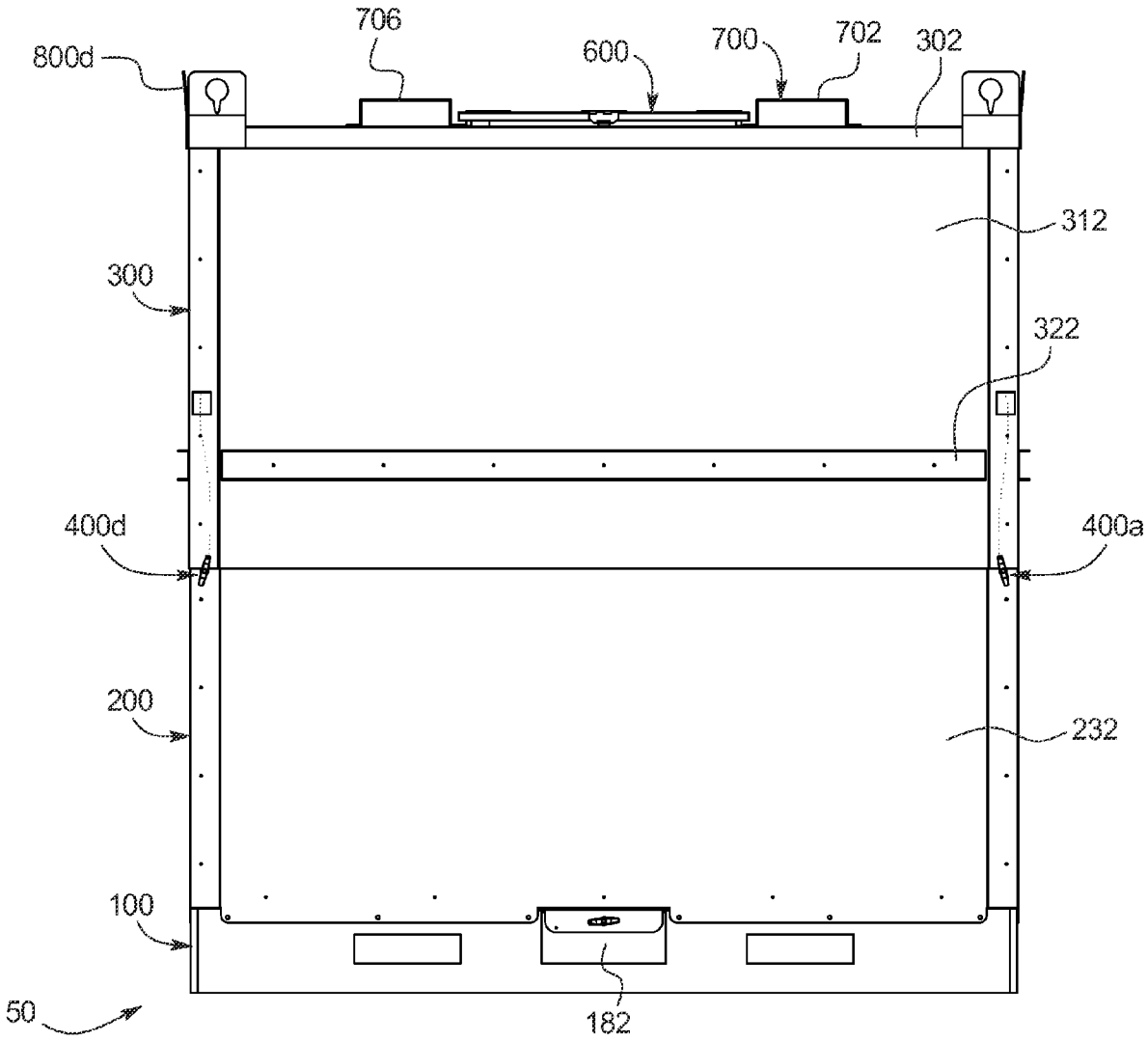
FIG. 4 is a front view of the shipping container of FIG. 1, illustrating the top compartment in the expanded position relative to the bottom compartment.
Figure 5:
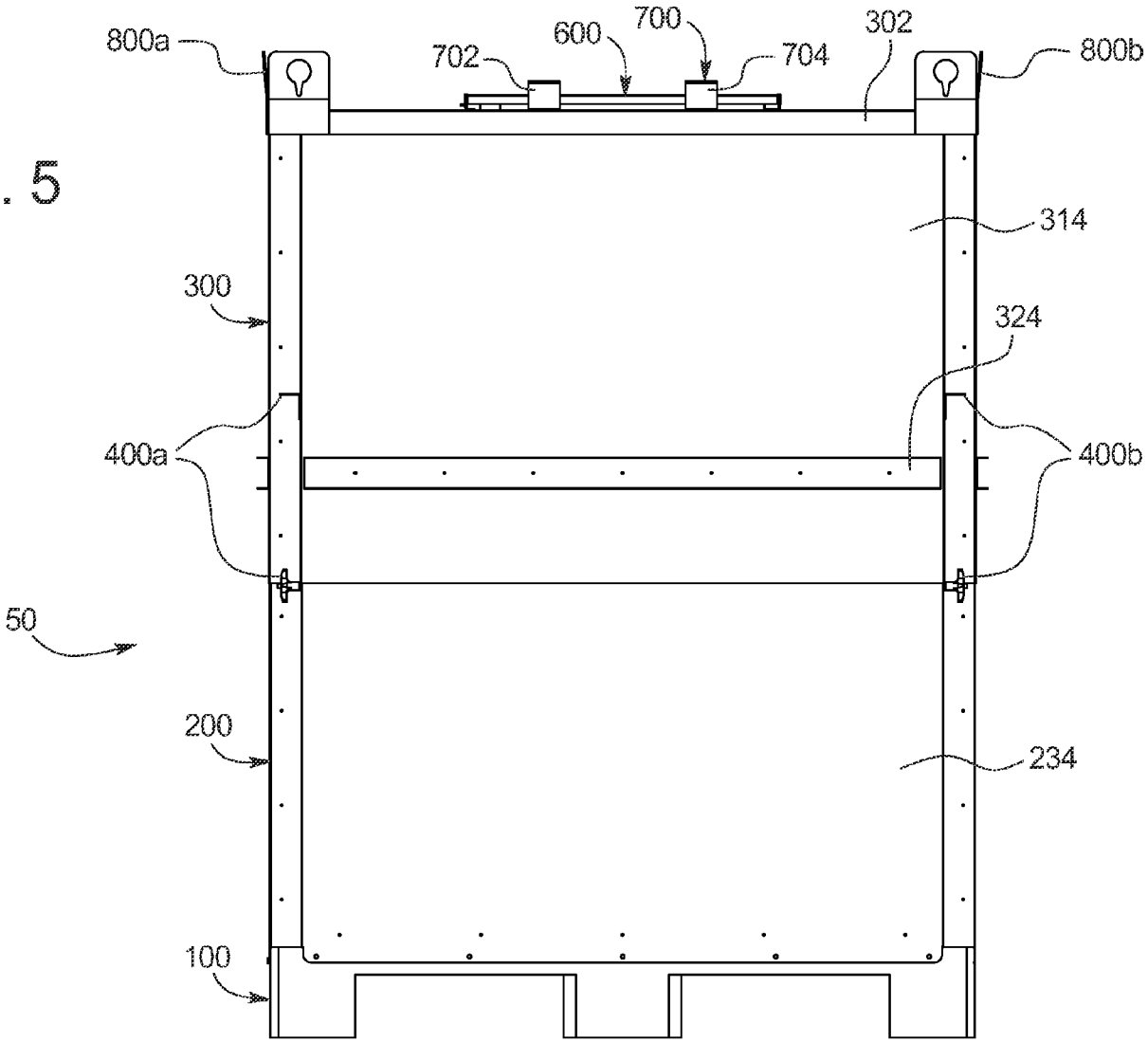
FIG. 5 is a left side view of the shipping container of FIG. 1, illustrating the top compartment in the expanded position relative to the bottom compartment.
Figure 6:
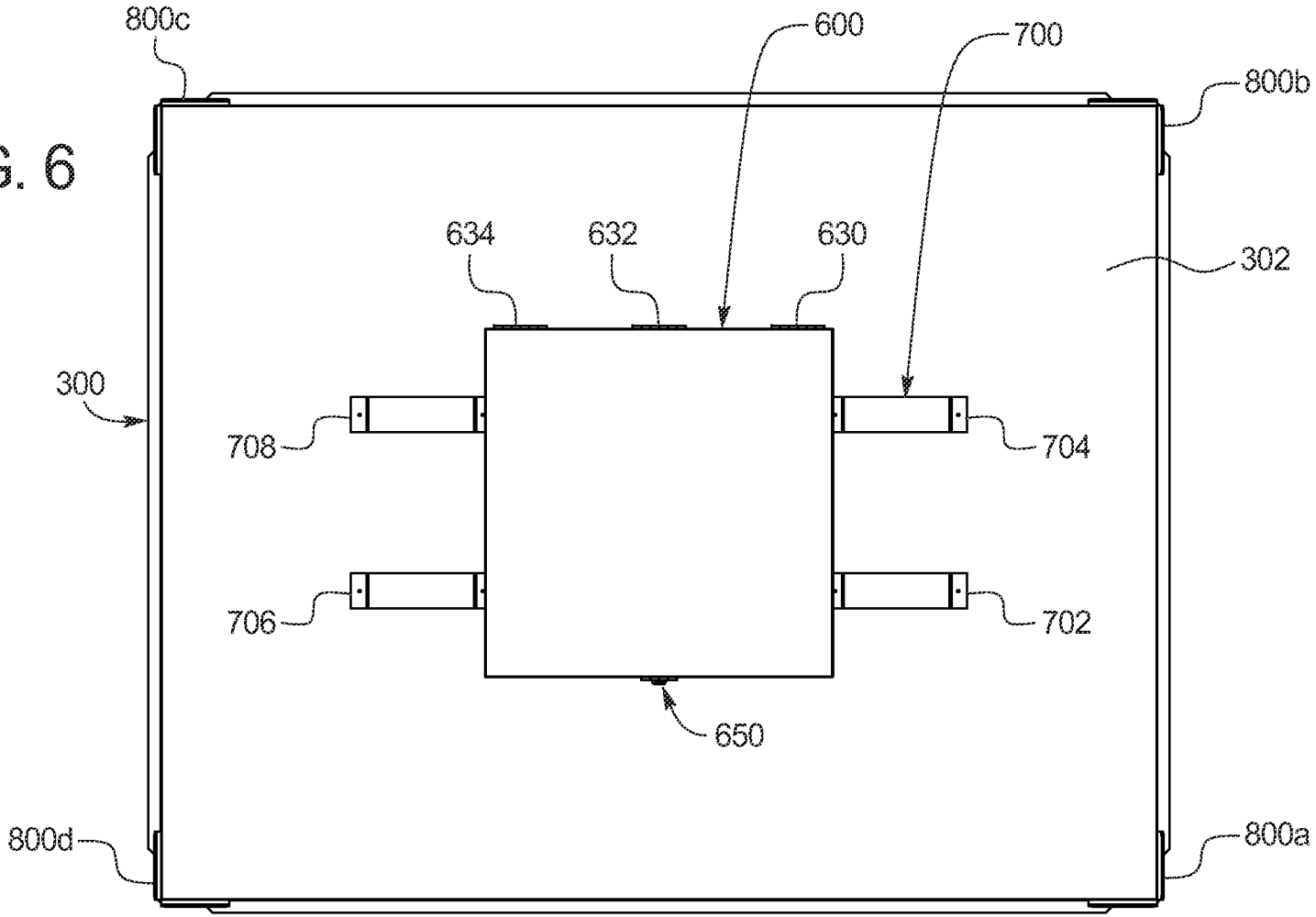
FIG. 6 is a top view of the shipping container of FIG. 1, illustrating the cover of the material loading assembly of the shipping container in the closed position and the extension assembly attached to the top compartment.
Figure 7:
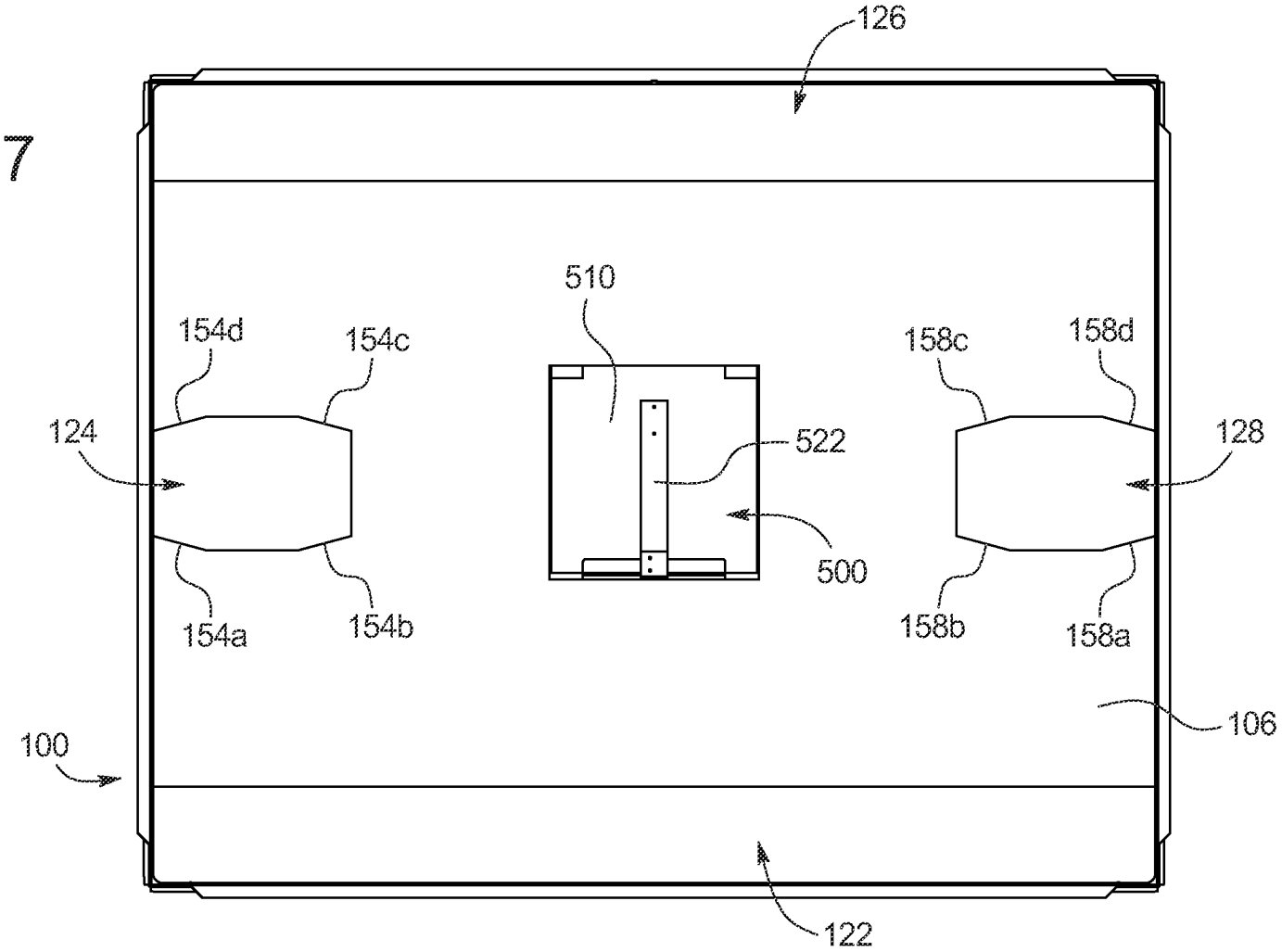
FIG. 7 is a bottom view of the shipping container of FIG. 1, illustrating the legs of the pallet, the pallet jack tine receiving channels defined by the pallet, and illustrating the chute door or gate of the material unloading assembly in the closed position, and the knife attached to the bottom of the chute door or gate.
Figure 8:
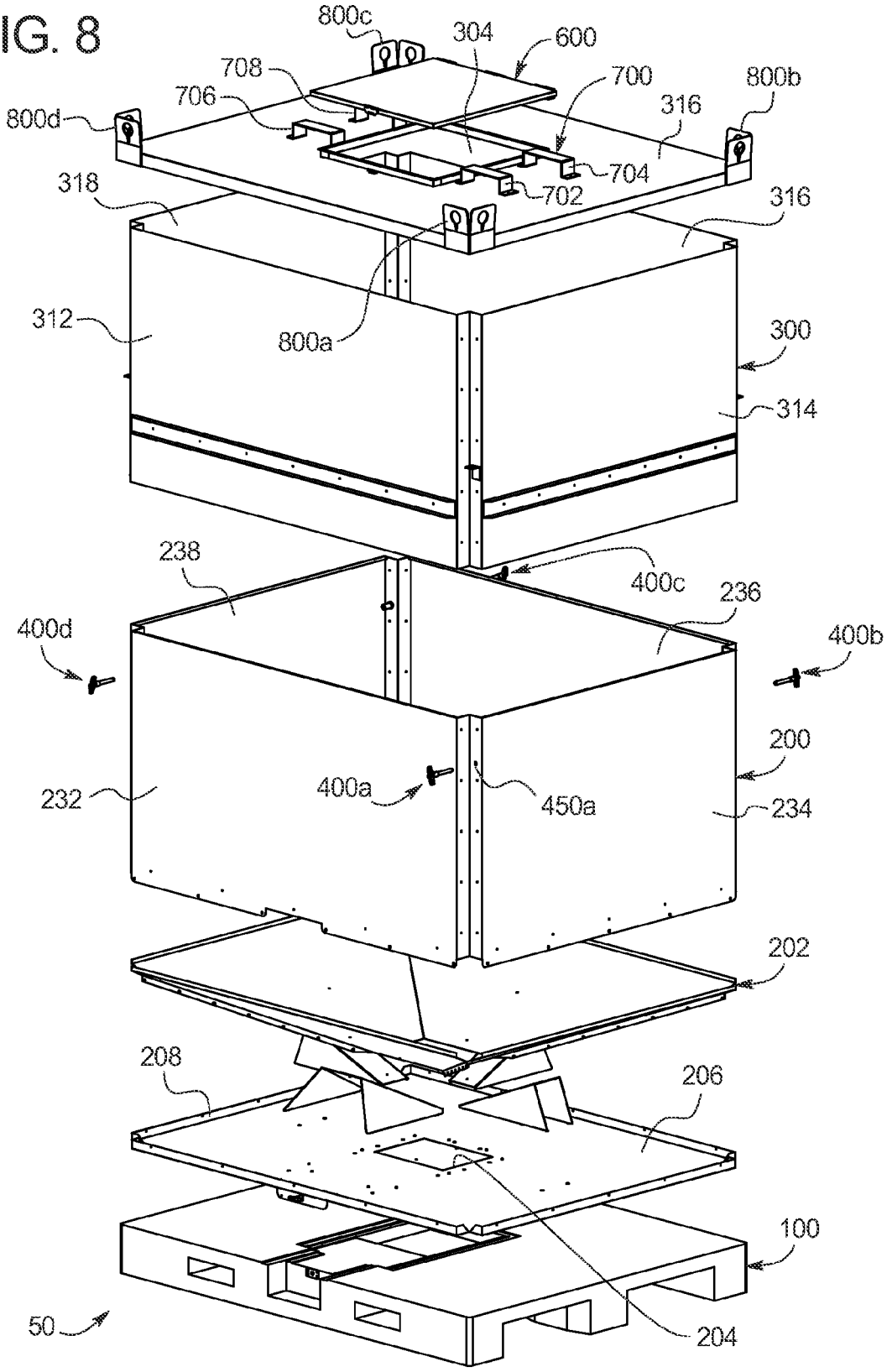
FIG. 8 is an exploded perspective view of the shipping container of FIG. 1 with certain of the smaller components such as the tether removed for ease of illustration.

Referring now to the drawings, FIGS. 1 to 40 illustrate one example embodiment of the bulk material shipping container of the present disclosure. This shipping container, which is generally indicated by numeral 50, has an expanded position for holding materials during shipping and a retracted position for efficient shipping when the container is not holding materials or when the container is holding a smaller amount of materials. More specifically, FIG. 2 illustrates the shipping container 50 in the retracted position, and FIGS. 1, 3, 4, 5, 34 illustrate the shipping container 50 in the expanded position. It should thus be appreciated that in the retracted position (as shown in FIG. 2), the shipping container 50 can be used for efficient transport as further described below, and that this provides substantial savings in shipping cost and energy use.

Generally, as shown in FIGS. 1 to 9B, this illustrated embodiment of the shipping container 50 includes: (a) a pallet 100 (as partially shown in FIGS. 1, 2, 3, 4, 5, 7, 8, 9, and 9F, and as best shown in FIGS. 10, 10A, 11, 12, 13, 14, 15, 16, 17, 17A, 18, 18A, 19, 19A, 24, 25, and 26) configured for supporting the container 50 and to facilitate movement and of the container 50 as well as the stacking of multiple containers; (b) a bottom compartment 200 (as best shown in FIGS. 1, 2, 3, 4, 5, 8, 9, 9A, 9B, 9C, 9D, 9E, 9F, and 34) mounted on the pallet 100 and configured to hold materials; (c) a top compartment 300 (as best shown in FIGS. 1, 2, 3, 4, 5, 6, 8, and 34) mounted on the bottom compartment 200 and configured to hold materials; (d) a plurality of top compartment support assemblies 400 (as partially shown in FIGS. 1, 2, 3, 4, 5, and 8, and as best shown in FIGS. 28, 29, 30, 31, and 32) configured to support the top compartment in the expanded position relative to the bottom compartment and configured to release the top compartment from the expanded position to enable the top compartment to move downwardly into the retracted position; (e) a material unloading assembly 500 (as partially shown in FIGS. 3, 4, 7, 8, 9E, and 9F and as best shown in FIGS. 9C, 9D, 10, 10A, 11, 12, 14, 15, 16, 17, 17A, 18, 18A, 19, 19A, 20, 21, 22, 23, 24, 25, and 26) attached to the bottom compartment and supported by the pallet 100 and configured to facilitate the unloading of materials from the top and bottom compartments; (f) a material loading assembly 600 (as partially shown in FIGS. 1, 2 4, 5, 6, and 8, and as best shown in FIGS. 34, 35, 36, and 37) mounted on the top compartment and configured to facilitate the loading of material into the top and the bottom compartments; and (g) a top compartment extension assembly 700 (as best shown in FIGS. 1, 2, 4, 5, 6, 8, 33, and 34) attached to the top compartment 300 and configured to enable a user to move the top compartment from the retracted position to the expanded position. It should also be appreciated that generally the container includes a front side or face, a back side or face opposite the front side, a right side or face, and a left side or face as further discussed below.

In this illustrated embodiment, (a) the pallet 100 is approximately 56 inches (142.24 centimeters) by approximately 44 inches (111.76 centimeters) by approximately 6 inches (15.24 centimeters); (b) the bottom compartment 200 is approximately 56 inches (142.24 centimeters) by approximately 44 inches (111.76 centimeters) by approximately 27 inches (68.58 centimeters); and (c) the top compartment 300 is approximately 56 inches (142.24 centimeters) by approximately 44 inches (111.76 centimeters) by approximately 27 inches (68.58 centimeters). When the container is in the retracted position, the container is approximately 56 inches (142.24 centimeters) by approximately 44 inches (111.76 centimeters) by approximately 35 inches (88.90 centimeters). When the container is in the expanded position, the container is approximately 56 inches (142.24 centimeters) by approximately 44 inches (111.76 centimeters) by approximately 62 inches (157.48 centimeters). However, it should be appreciated that the container and the components thereof may be other suitable sizes.

This embodiment of the shipping container of the present disclosure is configured to directly hold materials or to receive and hold a large plastic bag which holds the materials in the interior areas defined by bottom and top compartments. In one embodiment, the bag: (a) is approximately 60 inches (15.40 centimeters) by approximately 55 inches (139.70 centimeters) by approximately 110 inches (279.40 centimeters); (b) has a flat bottom with no bottom seal and hermetic side seals; (c) is FDA compliant; (d) has an approximately 2 millimeter thickness; (e) is clear; and (f) is made from a low density recyclable polyethylene plastic. In one alternative embodiment, the bag is also or alternatively bio-degradable. It should be appreciated that each of the bags is thus suited to hold one load of materials. However, it should be appreciated that the plastic bag may be of any suitable size, configuration, and material, provided that it fits inside of the top and bottom compartments of the container and that the bottom of the bag is able to be readily opened for unloading of the materials. It should be appreciated that the bag will be appropriately folded so that when the bag is placed above and partially in the container for filling the bag (and the container) with the materials, that the bag will properly unfold and be suitably seated in the top and bottom compartments of the container. The filling and un-filling of the bag is further discussed below.

More specifically, as best shown in FIGS. 1, 2, 3, 4, 5, 8, 9, 9A, 9B, 9C, 9D, 9E, and 9F, the bottom compartment 200 includes: (a) a lower exterior bottom wall or panel 202 defining a material release opening or chute 204; (b) an upper interior bottom wall 210 defined by four attached downwardly angled sections or chute ramps 212, 214, 216, and 218; (c) four wedge shaped interior bottom wall supports or gussets 222, 224, 226, and 228; (d) spaced apart first and second or front and back exterior walls 232 and 236; and (e) spaced apart third and fourth or left and right exterior side walls 234 and 238. The four sections 212, 214, 216, and 218 of the upper interior bottom wall 210, the front and back exterior walls 232 and 236, and the exterior side walls 234 and 238 define a bottom compartment material holding area or cavity which extends downwardly toward and to the material release opening or chute 204. In this illustrated embodiment, the lower exterior bottom wall 202, the upper interior bottom wall 210, the interior bottom wall supports 222, 224, 226, and 228, the front and back exterior walls 232 and 236, and the exterior side walls 234 and 238 are all made of stainless steel or galvanized steel to: (a) facilitate attachment or connection of these parts by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these components can be made from other suitable materials and that these components can be attached or connected in other suitable manners. The exterior bottom wall 202 of the bottom compartment 200 is suitably attached to the pallet 100 of the container 50 by suitable fasteners; however, it should be appreciated that the exterior bottom wall can be attached in other suitable manners.

More specifically, the lower exterior bottom wall 202 includes: (a) a rectangular substantially flat base 206 which defines the centrally located rectangular material release opening or chute 204; and (b) an upwardly extending lip 208 extending upwardly from each of outer edges of the base 206. This material release opening or chute 204 enables materials in the top and bottom compartments (or in a bag therein) to flow out of bottom compartment 200 when the chute door or gate 510 of the material unloading assembly for the opening or chute 204 (and the bag therein) is opened as further discussed below. The opening 204 in this illustrated embodiment is approximately 8 inches (20.32 centimeters) by approximately 11 inches (27.94 centimeters), although it should be appreciated that the opening may be of other suitable sizes. This size of the opening relative to the size of the bottom and top compartments maximizes the rate of unloading of the material from the top and bottom compartments (or in a bag therein) without sacrificing structure or strength of the bottom compartment.

The interior bottom wall supports 222, 224, 226, and 228 are attached in spaced apart locations to the top of the base 206 by fasteners, although they can also or alternatively be attached by welding. Each of the interior bottom wall supports or gussets 222, 224, 226, and 228 are of a wedge shape such that they are configured to be engaged by and support a respective one of the downwardly angled sections 212, 214, 216, and 218 of the upper interior bottom wall 210. The gusset 222 is wider than the other gussets 224, 226, and 228 in this illustrated embodiment to distribute the weight of the materials supported by gusset 222 to the pallet 100 at further spaced apart locations which are not directly over the gate 510 of the material unloading assembly 500 (which is further described below). The upper interior bottom wall 210, and specifically the four downwardly angled sections 212, 214, 216, and 218 are respectively attached to the interior bottom wall supports or gussets 222, 224, 226, and 228 by welding, although they can also or alternatively be attached by fasteners. The interior bottom wall supports or gussets 222 and 226 are some what shorter (as best seen in FIGS. 8, 9, 9E, 9F, 17, 17A, 18, 18A, 19, and 19A) than the interior bottom wall supports or gussets 224 and 288 to prevent too much weight from being placed on the material unloading assembly 500 and particularly on the gate 510. The four downwardly angled sections 212,214,216, and 218 each have a lower edge such that when such sections are attached, such sections form an opening 211 adjacent to and substantially aligned with the opening 204 of the base wall 206. In particular, the lower edges of the four downwardly angled sections 212, 214, 216, and 218 extend downwardly approximately adjacent to the material release opening or chute 204 of the base 206 of the bottom compartment. The lower edges of one or more of these four downwardly angled sections are each configured to be supported by the pallet adjacent to the top shelf of the pallet. In other words, this construction enables the central area of the pallet to provided support for part of the weight of the materials held in the top and bottom compartments. The upper interior bottom wall 210, and specifically upper portions of the four downwardly angled sections 212, 214, 216, and 218 are also respectively attached to and supported by the exterior walls 232, 234, 236, and 238. It should thus be appreciated that the upper interior bottom wall 210 of the bottom compartment 200 is supported at multiple locations including multiple points of support by the various different portions of the pallet 100. More specifically, the sections 212, 214, 216, and 218 of the upper interior bottom wall 210 are supported: (a) at their top ends by the exterior walls 232, 234, 236, and 238 of the bottom compartment 200; (b) centrally by interior bottom wall supports or gussets 222, 224, 226, and 228; (c) by attachment to each other; and (d) by the central portion of the pallet 100.

The exterior walls 232, 234, 236, and 238 of the bottom compartment 200 also each includes a skirt that extends downwardly along a respective side of the pallet 100. Suitable fasteners such as screws are used to attach each skirt to the respective side of the pallet 100 to support these exterior walls. Thus, it should be appreciated that this attachment to the side walls of the pallet 100 provides another set of support points for the bottom compartment 200. It should thus be appreciated that the upper interior bottom wall 210 is suitably angled and supported to hold the materials without deforming and to facilitate unloading of the bulk material from the material holding area of the bottom compartment.

Figure 27A:
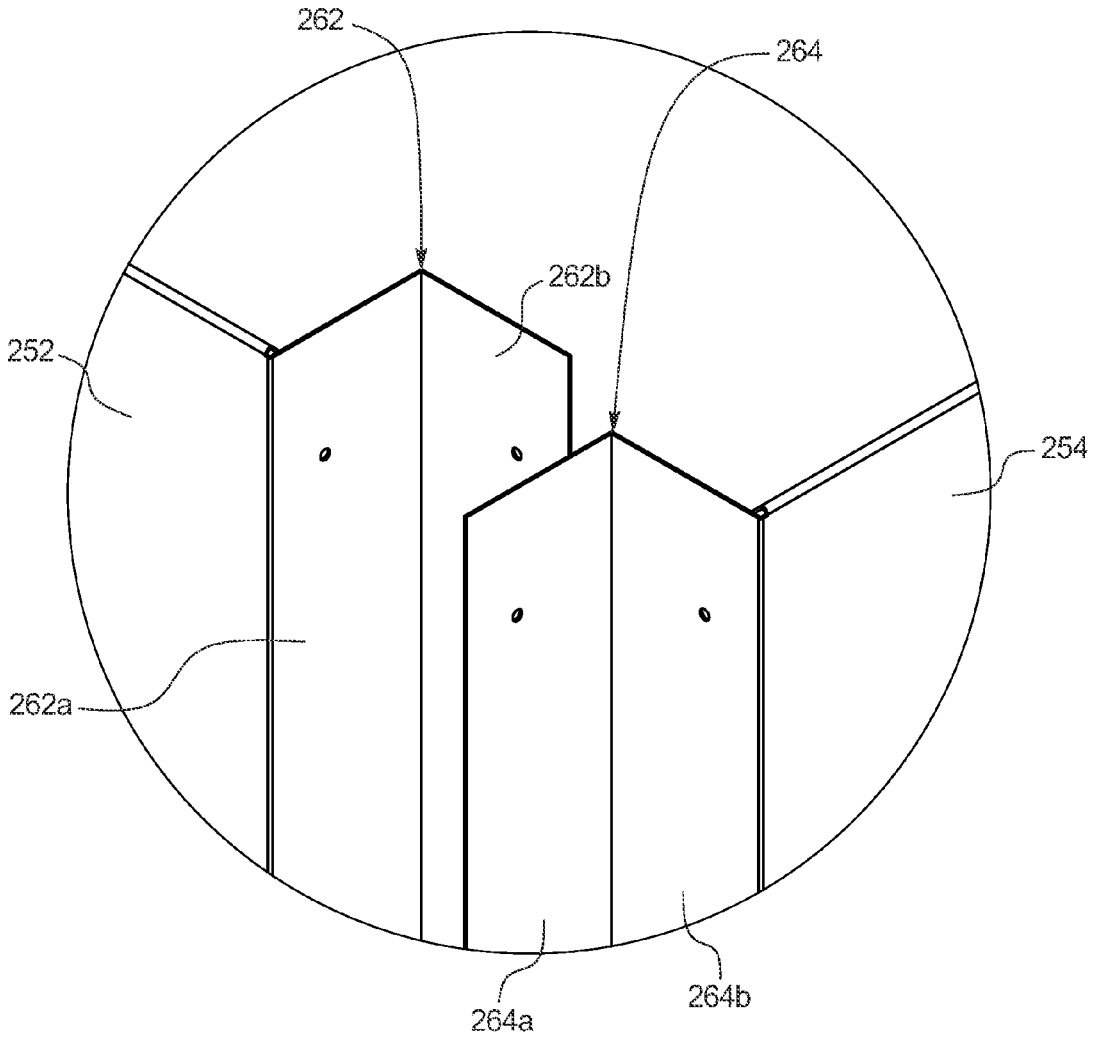
FIG. 27A is an enlarged fragmentary exploded perspective view of the corner wall construction of the bottom compartment of the shipping container of FIG. 1, and illustrating the corners before being attached.
Figure 27B:
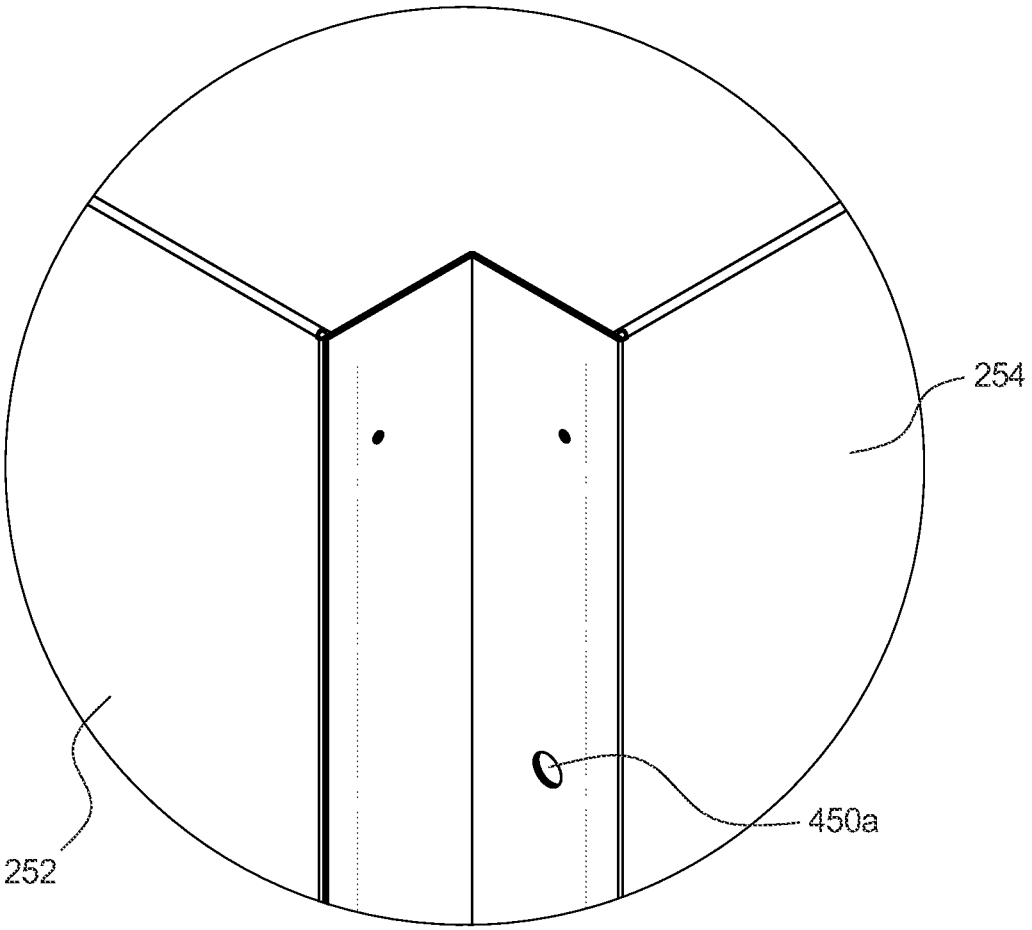
FIG. 27B is an enlarged fragmentary perspective view of the corner wall construction of the bottom compartment of the shipping container of FIG. 1, and illustrating the corners after being attached.
Figure 27C:
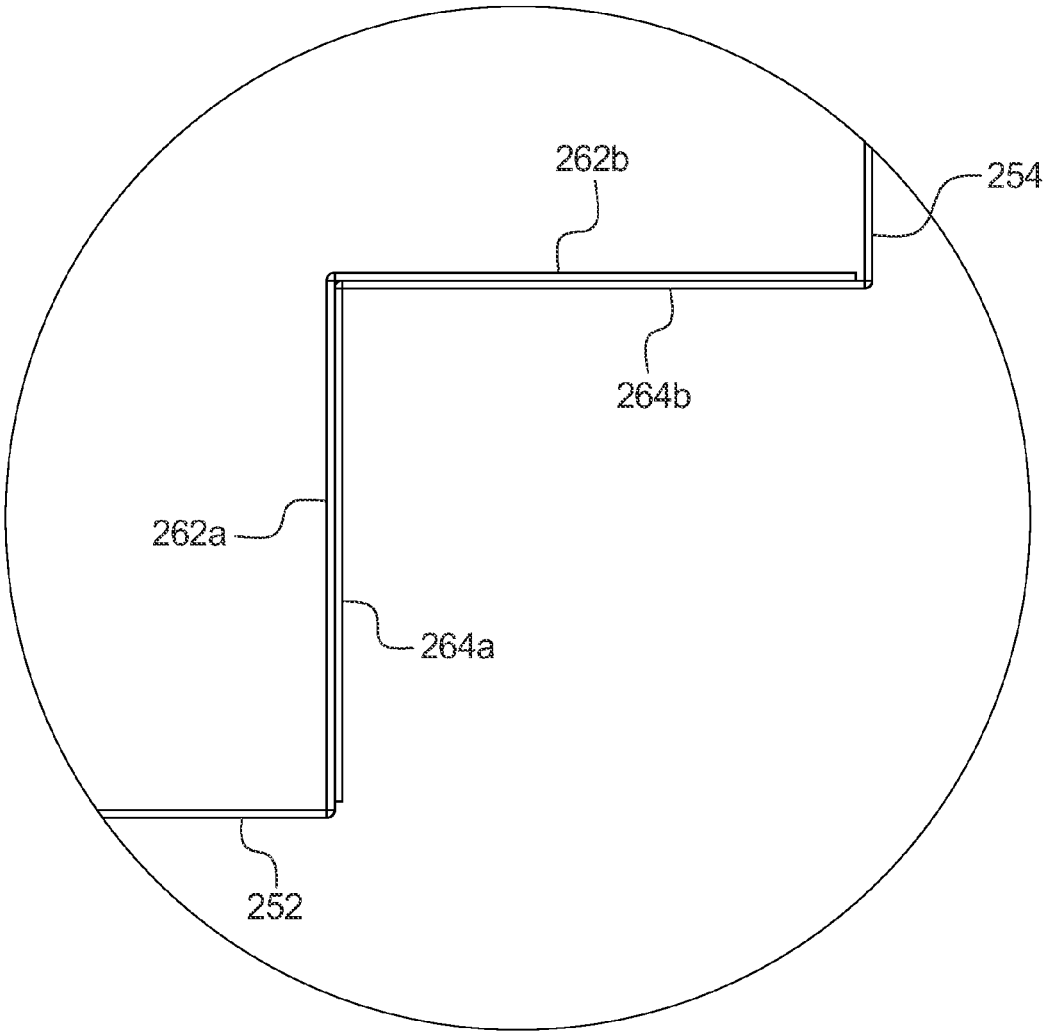
FIG. 27C is and enlarged fragmentary top plan view of the corner wall construction of the bottom compartment of the shipping container of FIG. 1, and illustrating the corners after being attached.
Figure 28:
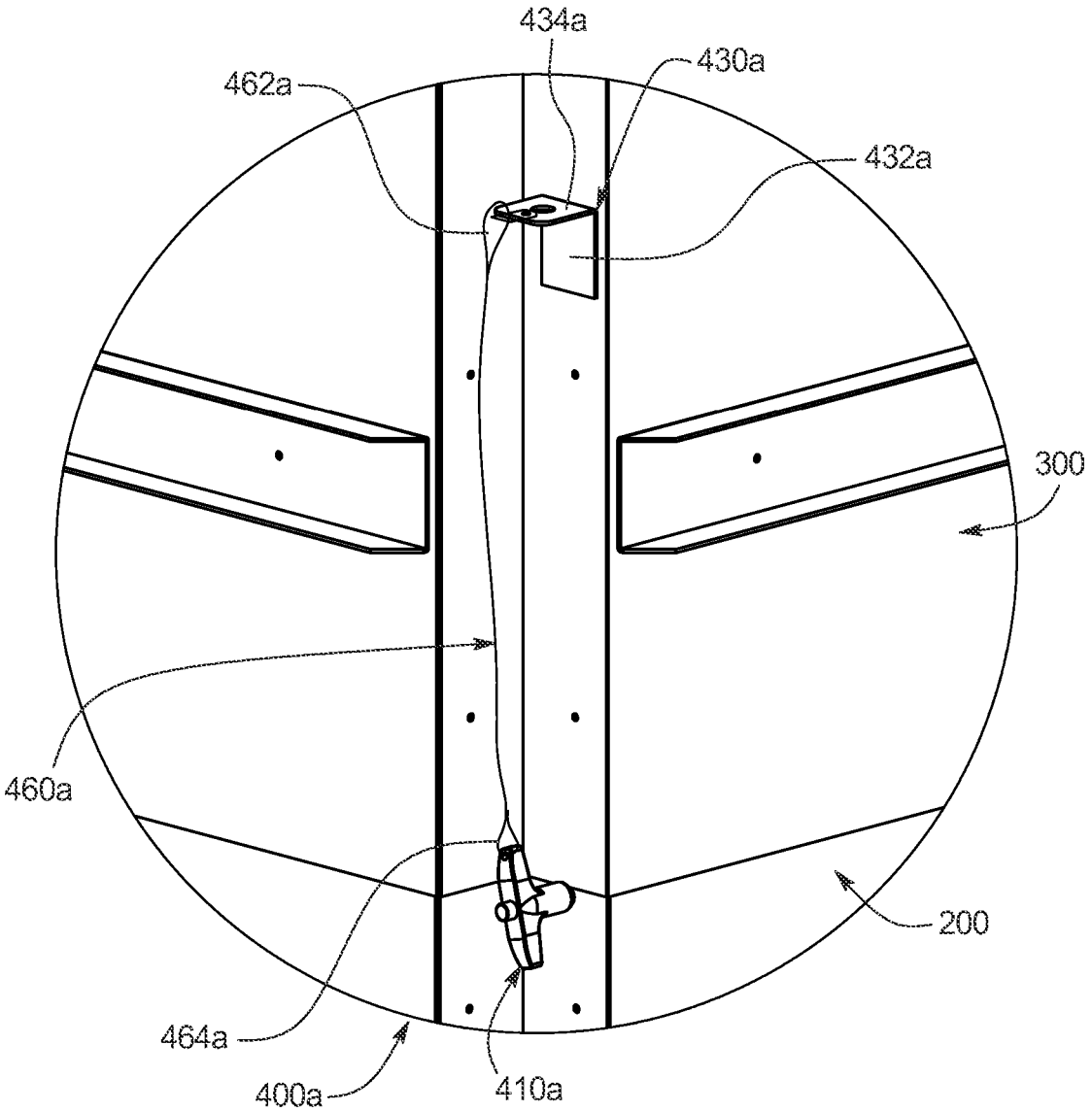
FIG. 28 is an enlarged fragmentary perspective view of one of the top compartment support assemblies of the shipping container of FIG. 1, illustrating the locking pin of the assembly inserted in the pin receipt in a corner of the bottom compartment, the pin holder attached to a corner of the top compartment, and a tether connecting the locking pin to the pin holder.
Figure 29:
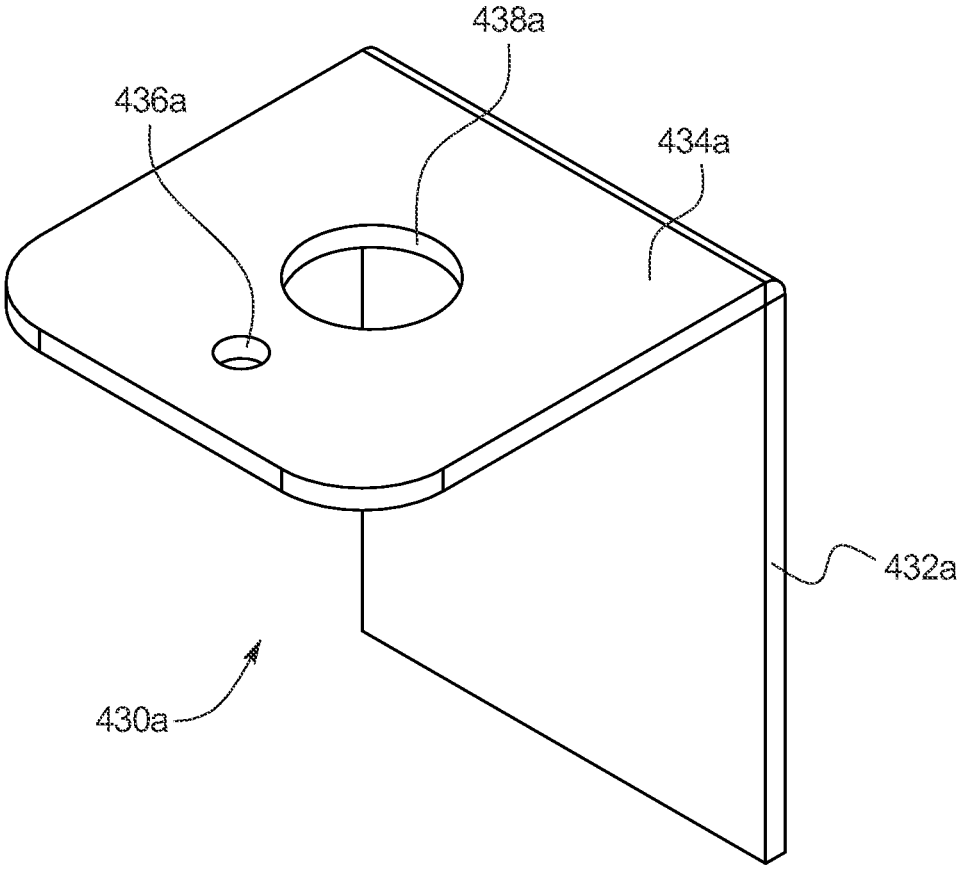
FIG. 29 is an enlarged perspective view of one of the locking pin holders of one of the top compartment support assemblies of the shipping container of FIG. 1, shown removed from the top compartment of the container.
Figure 30:
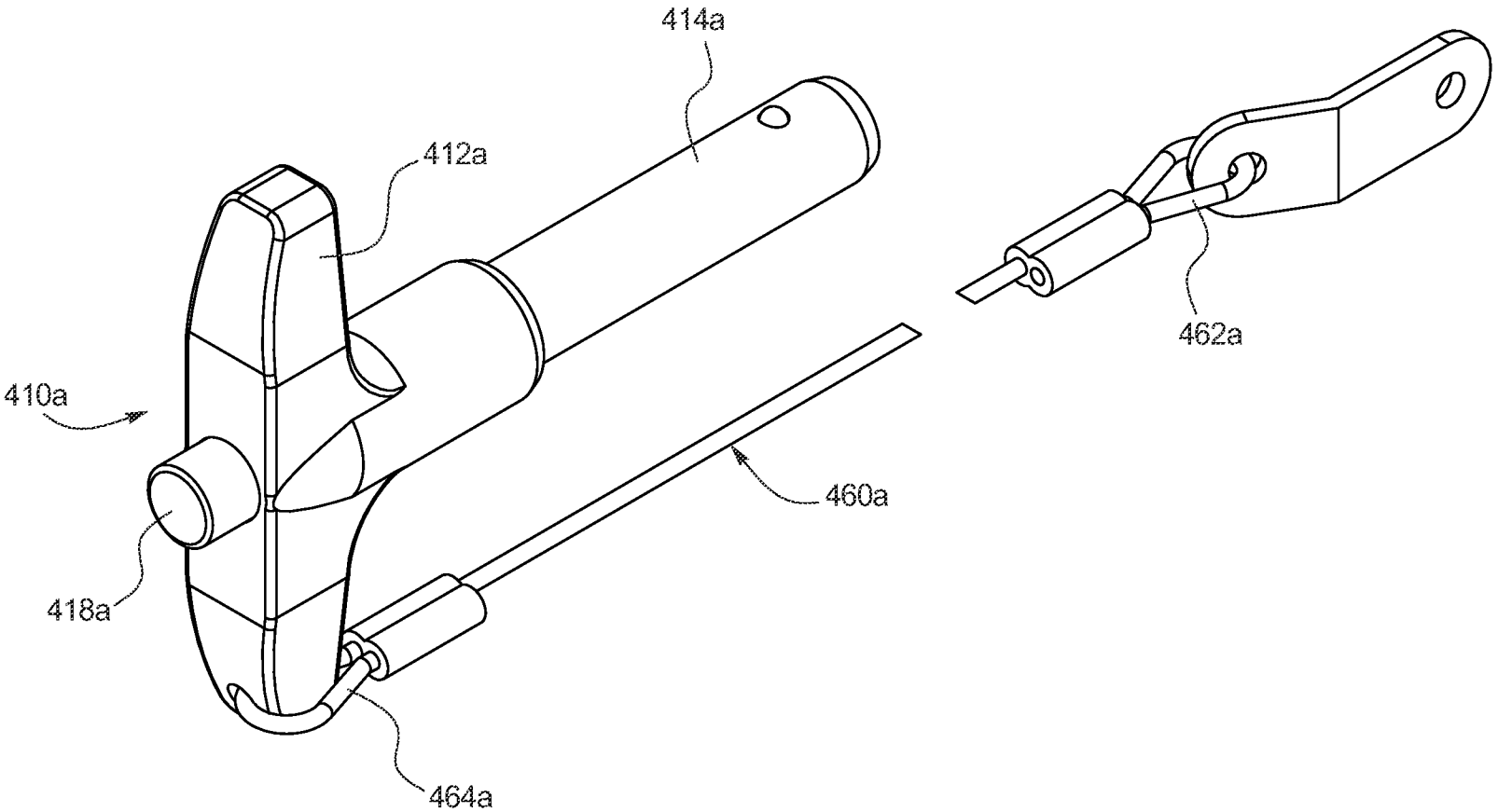
FIG. 30 is an enlarged perspective view of one of the locking pins and tethers of one of the top compartment support assemblies of the shipping container of FIG. 1.

Each of the exterior walls 232, 234, 236, and 238 of the bottom compartment 210 include a rectangular panel and two L-shaped corner sections attached to opposite ends of the panel. Each L-shaped corner section of each panel of each exterior wall is configured to mate with the L-shaped corner of an adjacent exterior wall as generally shown in FIGS. 27A, 27B, and 27C. These L-shaped corner sections of each of the exterior side wall: (a) are preferably connected by welding; (b) add structural rigidity to the bottom compartment; and (c) in conjunction with the top compartment support assemblies 400 provide support the support of the top compartment in the expanded position as further described below. More specifically, as illustrated in FIGS. 27A, 27B, and 27C, exterior side wall 232 includes panel 252 and corner 262 which includes corner sections 262*a* and 262*b*, and exterior side wall 234 includes panel 254 and corner 264 which includes corner sections 264*a* and 264*b*. Corner sections 264*a* is mated with and attached to corner section 262*a*, and corner section 264*b* is mated with and attached to corner section 262*b* to form this corner of the bottom compartment 200. It should be appreciated that each corner of the bottom compartment is configured in a similar manner; however, it should be appreciated that one or more of the corners can be differently configured. In this illustrated embodiment, each of the exterior walls 232, 234, 236, and 238 of the bottom compartment 210 also includes a top edge which is curled or bent over to provide extra strength to the bottom compartment and to minimize interference with movement of the top compartment 300 relative to the bottom compartment 200.

The top compartment 300 of the container 50, as best shown in FIGS. 1, 2, 3, 4, 5, 6, 8, 34, and 35, includes an exterior top wall 302, spaced apart exterior front and back side walls 312 and 316, spaced apart exterior side walls 316 and 318, and exterior wall support brackets 322, 324, 326, and 328 respectively attached to the exterior side walls 312, 314, 316, and 318. In this illustrated embodiment, the exterior top wall 302, exterior side walls 312, 314, 316, and 318, and exterior wall support brackets 322, 324, 326, and 328 are also all made of stainless steel or galvanized steel to: (a) facilitate attachment or connection of these parts by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these components can be made from other suitable materials and attached or connected in any suitable manner. The upper interior base wall 306 and the exterior walls 312, 314, 316, and 318 define a top compartment material holding area or cavity which extends downwardly to the bottom compartment material holding area or cavity.

The exterior top wall 302 includes a rectangular substantially flat base 306 which defines the centrally located rectangular material receipt or loading opening or chute 304. This material receipt or loading opening or chute 304 enables materials to flow into the top and bottom compartments when the cover of the material loading assembly is opened as further discussed below. The opening 304 in this illustrated embodiment is 18 inches (45.72 centimeters) by 18 inches (45.72 centimeters), although it should be appreciated that the opening may be of other suitable sizes. This size opening relative to this size bottom and top compartments maximizes the rate of loading of the material into the top and bottom compartments without sacrificing structure or strength of the top compartment 300.

The upper interior base wall 306 is suitably attached to the upper portions of the exterior walls 312,314,316, and 318 by welding. The exterior wall support brackets 322, 324, 326, and 328 are respectively attached to the exterior side walls 312, 314, 316, and 318 by welding, although they can be attached by rivets or other suitable fasteners. It should be appreciated that for embodiments of the container which will employ a bag, it is preferable to maximize the amount of welding for connecting or attaching components to reduce possible spots or points for snagging or cutting the bag. It should also be appreciated that for a container that will not employ a bag, more rivets or other fasteners can be employed. Similar to the configuration of the bottom compartment, each of the exterior walls 312, 314, 316, and 318 include a rectangular panel and two L-shaped corner sections attached to opposite ends of the panel. Each L-shaped corner section of each panel of each exterior wall is configured to mate with the L-shaped corner of the adjacent exterior wall similar to the bottom compartment. These L-shaped corner sections of each of the exterior side wall of the top compartment are preferably connected by welding and add structural rigidity to the top compartment.

It should be appreciated that in alternative embodiments, the top compartment can include one or more interior walls. These interior walls in certain embodiment are used to protect the exterior walls, and to add further structural rigidly to the top compartment.

The pallet 100 of this illustrated embodiment of the shipping container 50 of the present disclosure is specifically configured to take in account that various different lifting and moving vehicles or equipment may be used to lift and move the container 50: (a) when the container is manufactured; (b) when the container is transported to a material loading facility; (c) when the container is at a material loading facility; (d) when the container is moved and positioned in a transport vehicle at the material loading facility after loading materials in the container; (e) when the container is removed from a transport vehicle at a material unloading facility; (f) when the container is at an unloading facility; and (g) when the container is moved and positioned in a transport vehicle at the material unloading facility after unloading the materials from the container. More specifically, these facilities will typically have either a conventional pallet jack and/or a conventional fork lift. One widely commercially used conventional pallet jack has spaced apart non-movable tines or forks, where each fork is approximately 7.75 inches (19.69 centimeters) wide and the space between the tines is approximately 8.50 inches (21.59 centimeters). One widely commercially used conventional fork lift has adjustably spaced apart tines or forks, where each fork is approximately 5 inches (12.70 centimeters) wide, and the space between that tines is adjustable from approximately 4 inches (10.16 centimeters) to approximately 24 inches (60.96 centimeters). As further described below, the container 50 and specifically the pallet 100 of the container 50 is configured to account for the use of such fork lifts which can: (a) lift the containers off of the ground; (b) move the containers; (c) stack the containers on top of each other; and (d) un-stack stacked containers from each other. As also further described below, the container 50 and specifically the pallet 100 of the container 50 is also configured to account for the use of such pallet jacks which can: (a) lift the containers off of the ground; and (b) move the containers, but can not stack or unstack stacked containers.

More specifically, turning now to FIGS. 1, 3, 4, 5, 7, 8, 10, 10A, 11, 12, and 13, the pallet 100 of this illustrated embodiment of the container 50 of the present disclosure includes: (a) a rectangular body 102 having an upper surface 104, a lower surface 106, a front edge 112, a back edge 116, and opposite side edges 114 and 118; and (b) a plurality of legs 122, 124, 126, and 128 extending downwardly from the body 102. The legs 122 and 126 each respectively extend the entire width of the body 102 of the pallet 100 in this illustrated embodiment. It should be appreciated that in alternative embodiments the legs 122 and 126 do not need to extend the entire width of the body and that each of these legs can be separated into multiple legs. The legs or islands 124 and 128 extend downwardly from the central portions of the side ends of the body 102. In this illustrated embodiment, the body and the legs of the pallet are all formed from one piece of a suitable wood to: (a) provide structural strength and rigidity; and (b) minimize overall weight of the container. In this illustrated embodiment, the wood pallet is one piece of wood which is suitably formed by suitable cutting, milling and/or routing processes. However, it should be appreciated that in alternative embodiments, the pallet can be made from multiple components which are suitably attached and that one or more of these components can be made from other suitably strong materials such as composite or fiber glass materials. It should also be appreciated that different parts of the pallet may be made from different materials. For instance, the shelves may be made from a plastic, composite or fiber glass inlay part.

The pallet 100 includes or defines: (a) a first set of aligned fork lift tine receiving channels 132*a* and 136*a* in the legs 122 and 126, respectively; (b) a second set of aligned fork lift tine receiving channels 132*b* and 136*b* in the legs 122 and 126, respectively; (c) a first pallet jack tine receiving channel 140 extending from side to side; and (d) a second pallet jack tine receiving channel 142 extending from side to side. The first set of fork lift tine receiving channels 132*a* and 136*a* and the second set of fork lift tine receiving channels 132*b* and 136*b* are positioned and spaced apart such that when the forks or tines of a fork lift are inserted into these channels of the pallet 100 of the container 50 which is stacked on top of another container, the tines or forks do not engage the material loading assembly on the top compartment of the lower container or the extension assembly on the top compartment of the lower container. It should thus be appreciated that the pallet 100 is configured to enable a fork lift to move these containers when one container is stacked on another container without damaging the lower container, and particularly the cover or the extension assembly. The first pallet jack tine receiving channel 140 and the second pallet jack tine receiving channel 142 are positioned and spaced apart such that when the forks or tines of a pallet jack are inserted into these channels defined by the pallet 100 of the container 50, they can lift and move the container. It should be appreciated that a typical pallet jack does not operate like a fork lift so that the pallet jack will only be used when the container is on the floor or ground and not with stacked containers. Therefore, the tines or forks of a pallet jack will not be in a position to engage the material loading assembly on the top compartment of the lower container of stacked containers or the extension assembly on the top compartment of the lower container of stacked containers.

It should be appreciated that the first set of aligned fork lift tine receiving channels 132*a* and 136*a* and the second set of aligned fork lift tine receiving channels 132*b* and 136*b* are not configured to receive the forks or tines of a pallet jack because they are spaced apart further then the tines on a conventional pallet jack (as described above). Specifically, they are spaced apart approximately 34 inches (86.36 centimeters) in this illustrated embodiment.

It should further be appreciated that although not preferred, a fork lift with adjustable forks or tines can be inserted into the first pallet jack tine receiving channels 140 and 142 to lift and move the container 50. The pallet 50 and the channels 140 and 142 are also configured to take this into account, and specifically to account for this situation when the forks or tines of a fork lift are inserted into these channels 140 and 142 of the pallet 100 of a container stacked on another container, these tines or forks do not engage the material loading assembly on the top compartment of the lower container or the extension assembly on the top compartment of the lower container.

It should further be appreciated that in this illustrated embodiment, the legs 124 and 128 of the pallet 100 are also configured to direct the tines or forks of the pallet jack through the channels 140 and 142 if they are inserted at an angle with respect to these channels. Specifically, leg 124 includes four angled tine directing surfaces 154*a*, 154*b*, 154*c*, and 154*d*, and leg 128 includes four angled tine directing surfaces 158*a*, 158*b*, 158*c*, and 158*d*. It should further be appreciated that the legs 124 and 128 do not block the fork lift tine receiving channels 132*a* and 136*a* or the fork lift tine receiving channels 132*b* and 136*b*.

It should further be appreciated, that although not shown, the pallet can include indicator which direct a user on how to insert the tines of a fork lift into the pallet jack receiving channels 140 and 142. It should also be appreciated, that although not shown, the pallet can include hinged or pivoting flaps in the ends of the pallet jack receiving channels 140 and 142 to further direct a user on how to insert the tines of a fork lift into the pallet jack receiving channels 140 and 142.

It should also be appreciated that the shape of the legs of the pallet, which rest on the ground, and particularly the flat surfaces of the pallet, prevent the build-up of contaminants on the pallet. Specifically, in the illustrated embodiment, the bottom of the pallet does not include a series of cavities in which contaminants such as mud or dirt can build up. Therefore, the pallet provides a less contaminable bulk material container while still being relatively strong and light weight.

Turning now to FIGS. 3, 4, 7, 8, 10, 10A, 11, 12, and 13, as mentioned above, the body 102 of the pallet 100 also functions: (a) to support the upper interior bottom wall of the bottom compartment 200; and (b) to support the material unloading assembly 500. More specifically, the body 102 of the pallet 100 defines multi-level shelves including a first or bottom shelf 150 and a second or top shelf 160, and an opening or chute 170.

The first or bottom shelf 150 includes front shoulder 152, left side shoulder 154, and right side shoulder 158. These shoulders 152, 154, and 158 are sized and configured to support a bottom portion of each of the guide rails and the door or gate of the material unloading assembly which is further described below. The door or gate includes a closure member or portion and the handle member or portion (as further discussed below). The shoulders 152, 154, 32 and 158 support the guide rails (attached to the bottom compartment as described below) which in turn support the side edges of the closure member as well as the handle portion of the chute door or gate of the material unloading assembly. The shoulders 152, 154, and 158 are positioned at the same level to co-act to support the chute door or gate of the material unloading assembly such that the chute door or gate moves or slides relative to the bottom shelf 150 from a closed position to an open position for respectively closing and opening the chute 202 in the exterior bottom wall of the bottom compartment 100 as well as the opening or chute 170 in the pallet 100 as further discussed below.

The second or top shelf of the pallet 100 includes left side shoulder 164, rear shoulder 166, and right side shoulder 168 which are configured at the same level to co-act to also support a top portion of each of the guide rails and the door or gate of the material unloading assembly which is further described below. It should also be appreciated that this configuration enables the pallet to support the bottom compartment and the material unloading assembly and specifically the chute door or gate. This support reduces the amount of weight placed on the gate from the materials held in the top and bottom compartments (or the bag therein).

Figure 9:
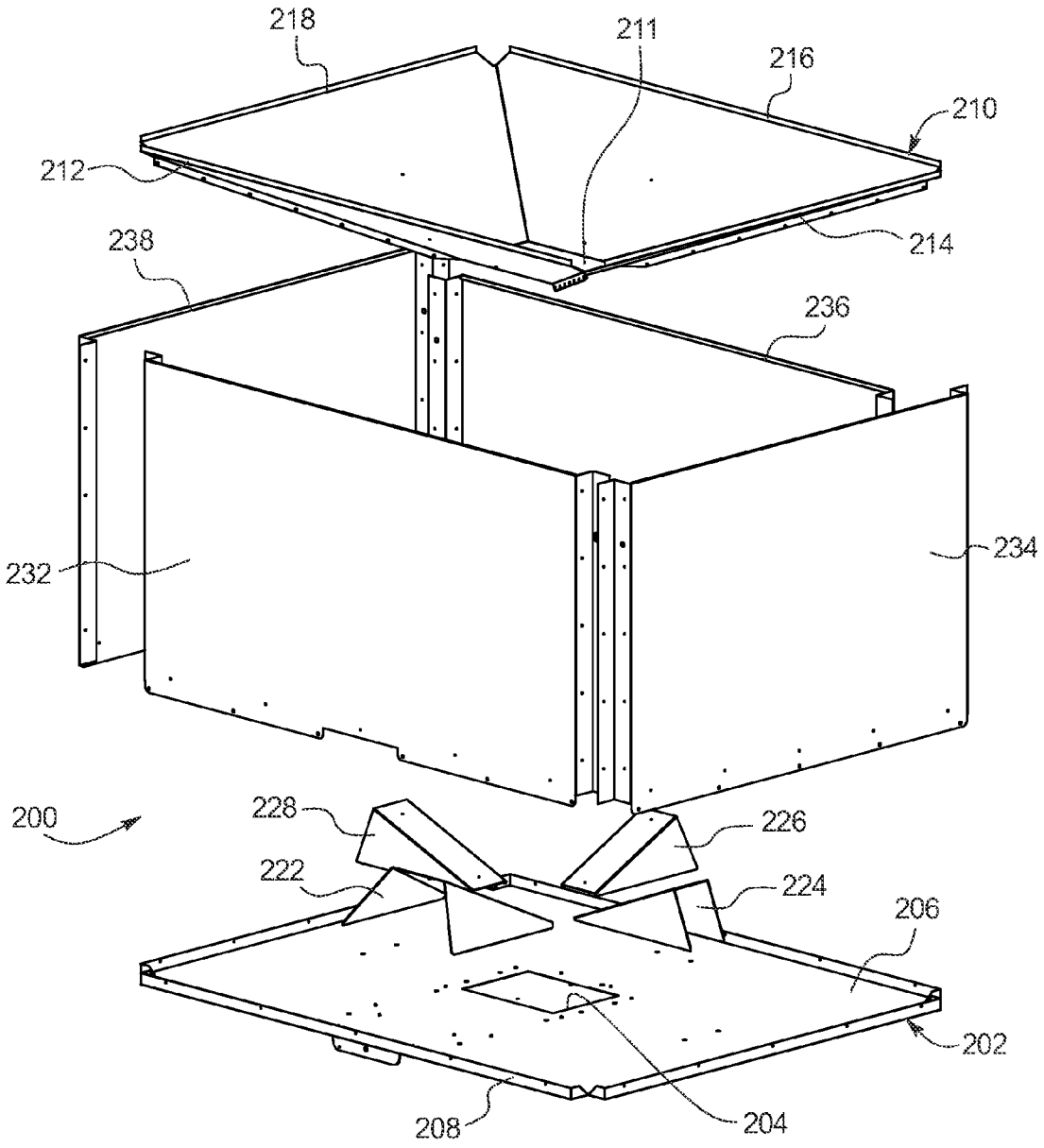
FIG. 9 is an enlarged exploded perspective view of the bottom compartment of the shipping container of FIG. 1.
Figure 9A:
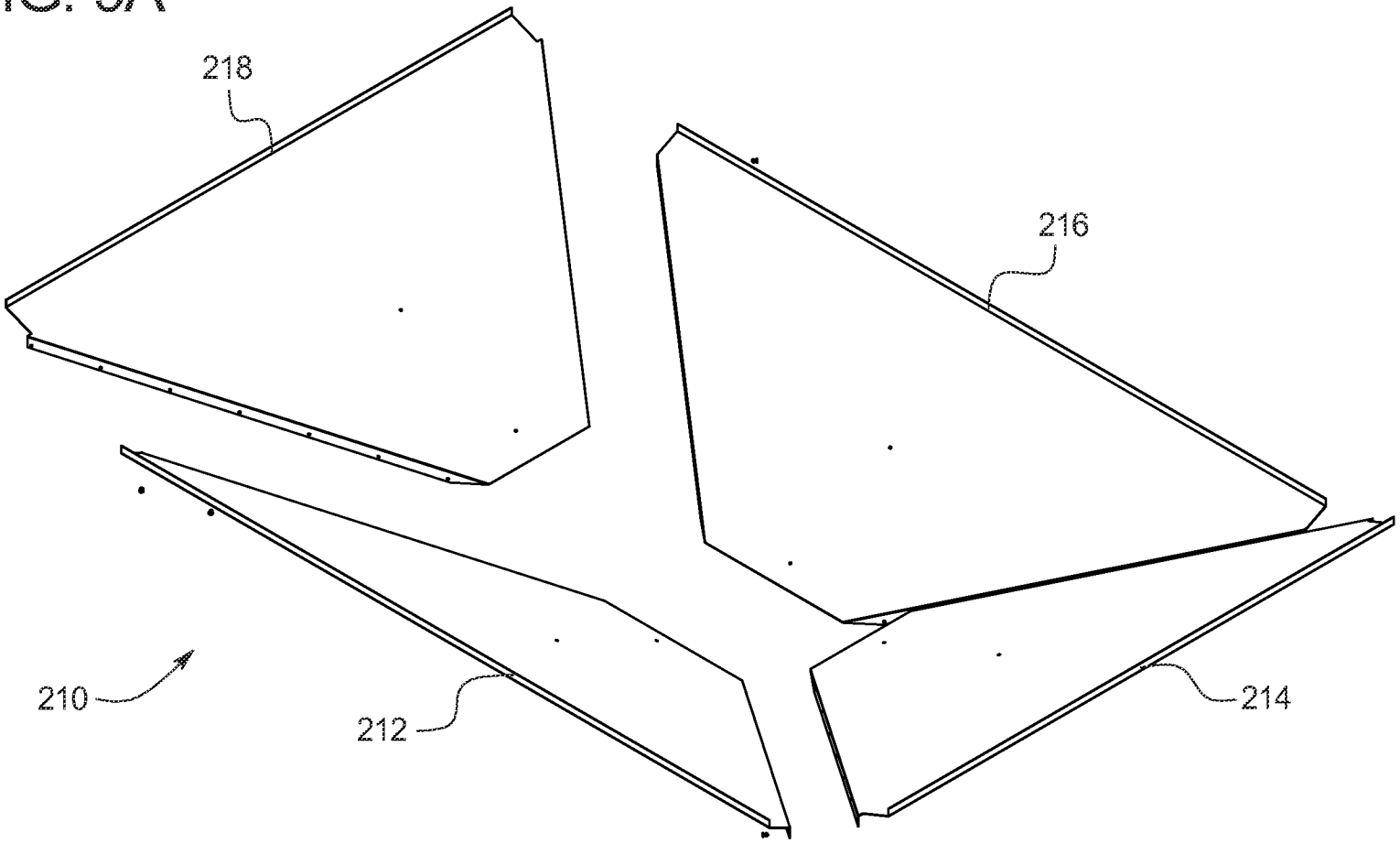
FIG. 9A is an enlarged exploded top perspective view of the sections of the upper interior bottom wall of the bottom compartment of the shipping container of FIG. 1.
Figure 9B:
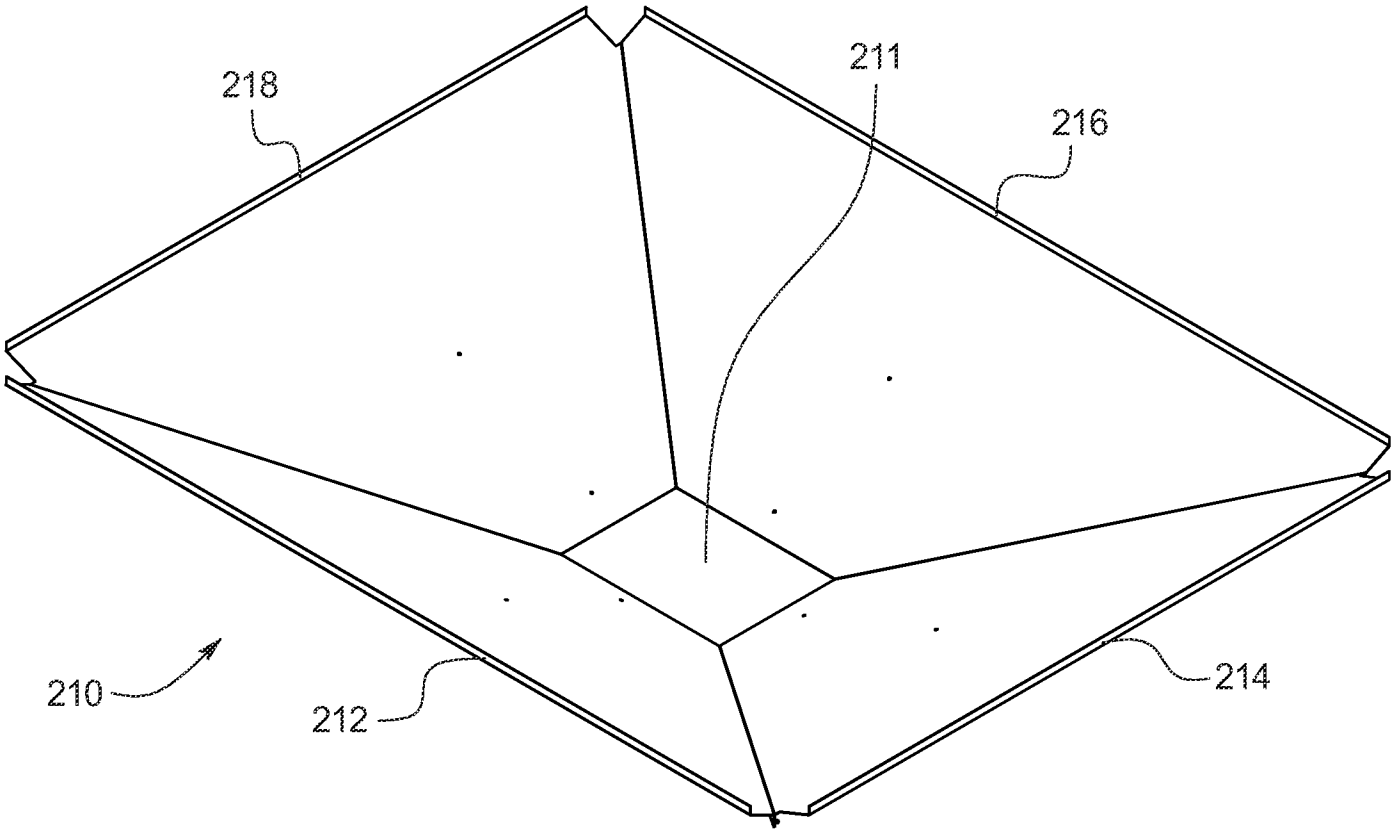
FIG. 9B is an enlarged top perspective view of the attached sections of the upper interior bottom wall of the bottom compartment of the shipping container of FIG. 1.
Figure 9C:
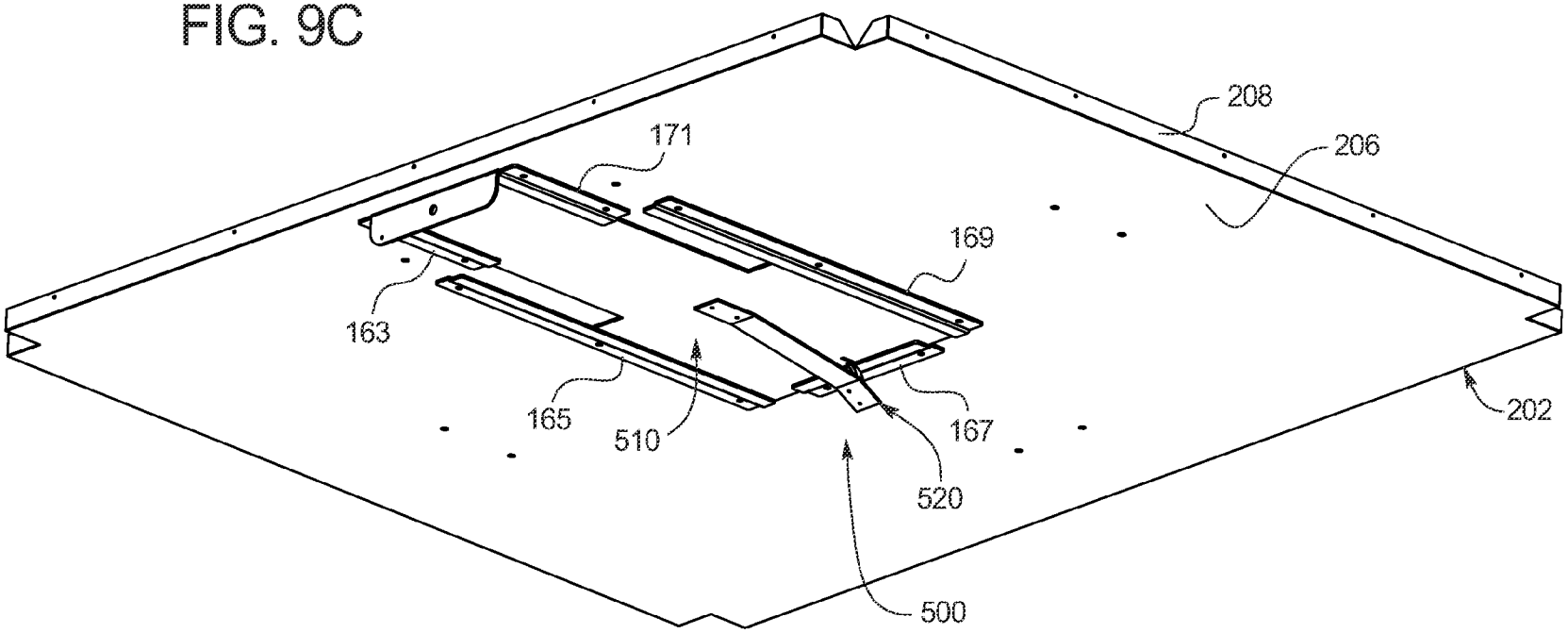
FIG. 9C is an enlarged bottom perspective view of the lower exterior bottom wall of the bottom compartment of the shipping container of FIG. 1, and illustrating the material unloading assembly attached to the bottom of the lower exterior bottom wall.
Figure 9D:
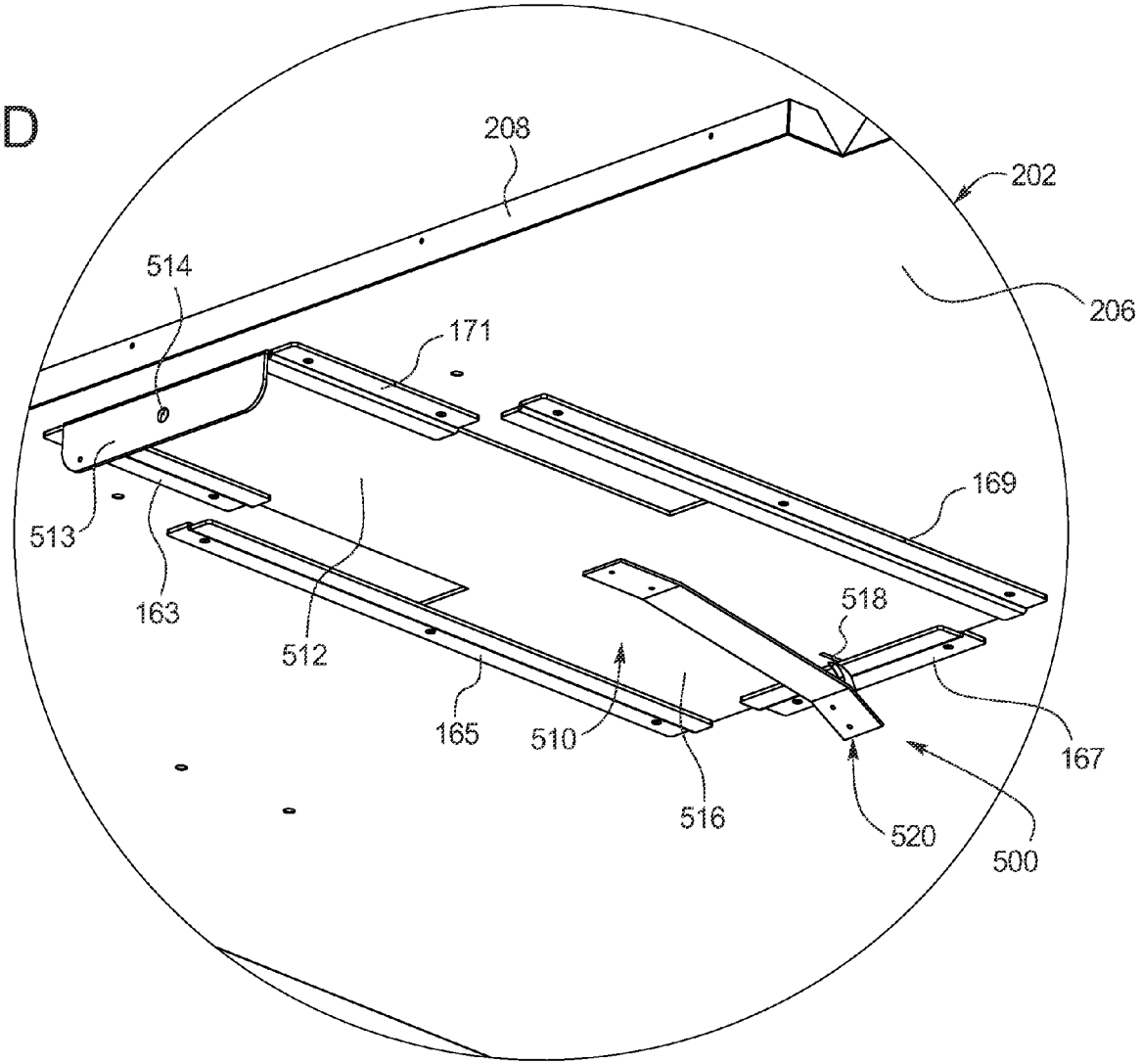
FIG. 9D is a further enlarged fragmentary bottom perspective view of the lower exterior bottom wall of the bottom compartment of the shipping container of FIG. 1, and illustrating the material unloading assembly attached to the bottom of the lower exterior bottom wall.
Figure 9E:
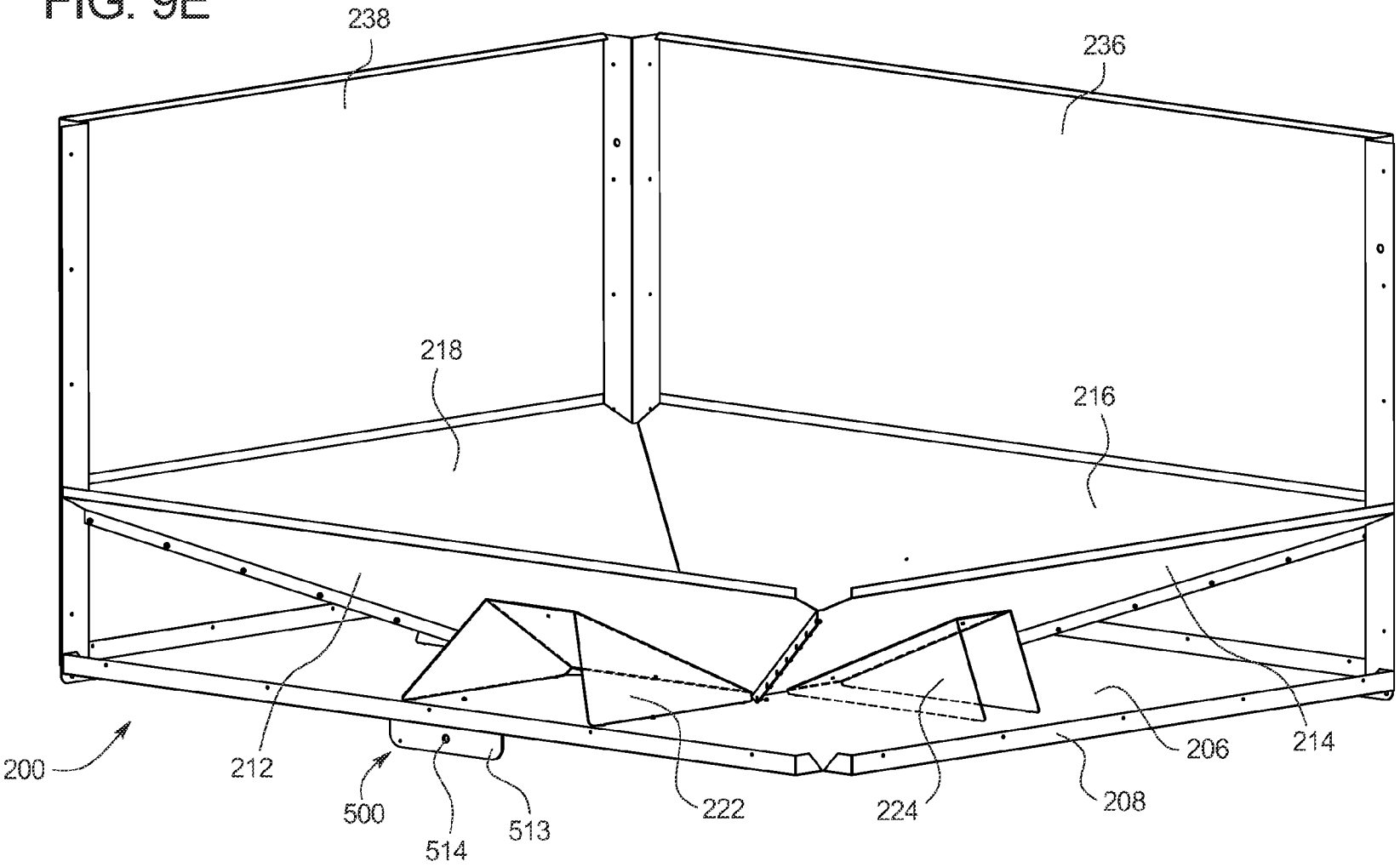
FIG. 9E is an enlarged top perspective view of the bottom compartment of the shipping container of FIG. 1 with the front and left exterior side walls of the bottom compartment removed to illustrate the lower exterior bottom wall of the bottom compartment, the support gussets of the bottom compartment, and the upper interior bottom wall of the bottom compartment.
Figure 9F:
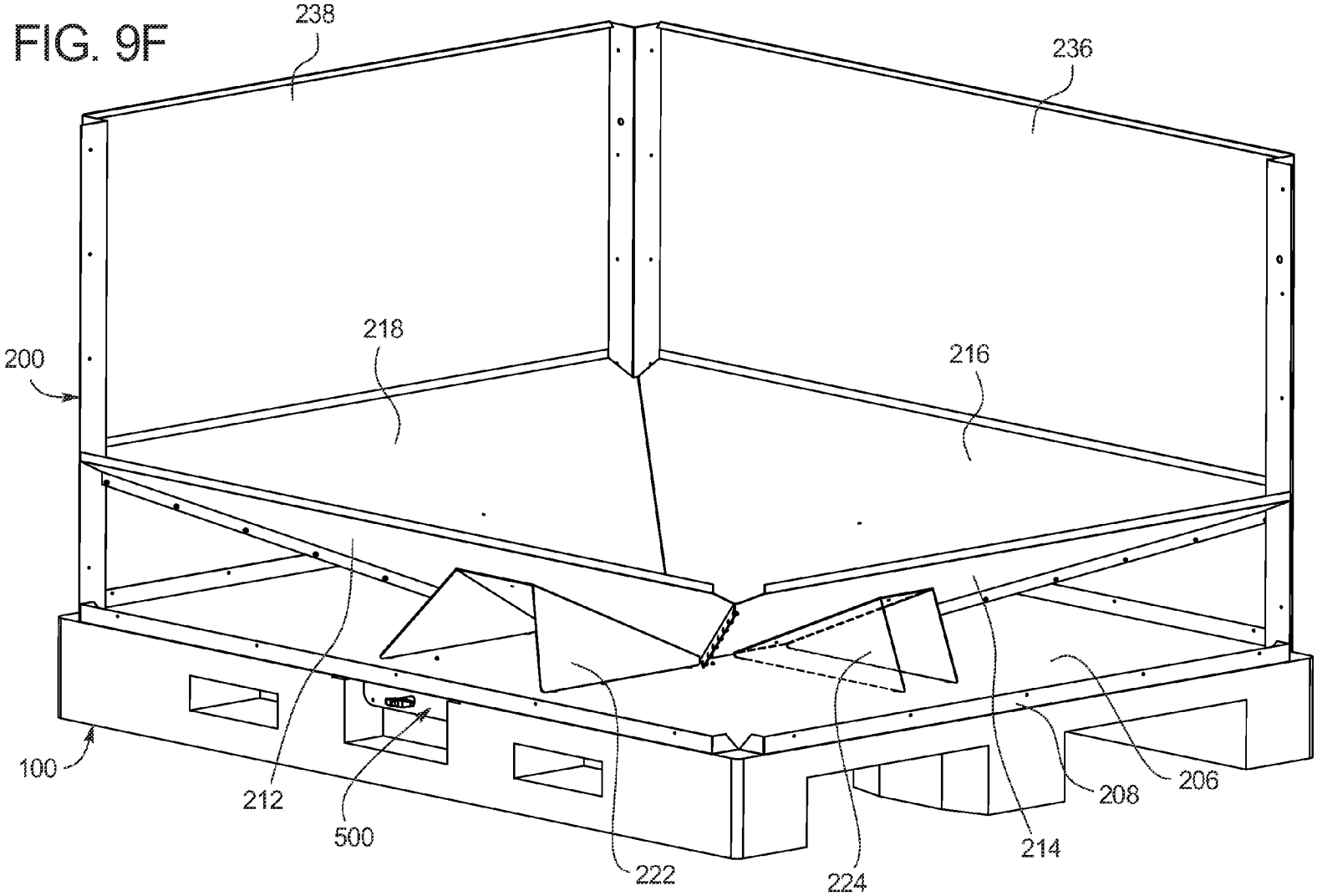
FIG. 9F is an enlarged top perspective view of the bottom compartment and the pallet of the shipping container of FIG. 1 with the front and left exterior side walls of the bottom compartment removed to illustrate the lower exterior bottom wall of the bottom compartment, the support gussets of the bottom compartment, and the upper interior bottom wall of the bottom compartment.
Figure 10:
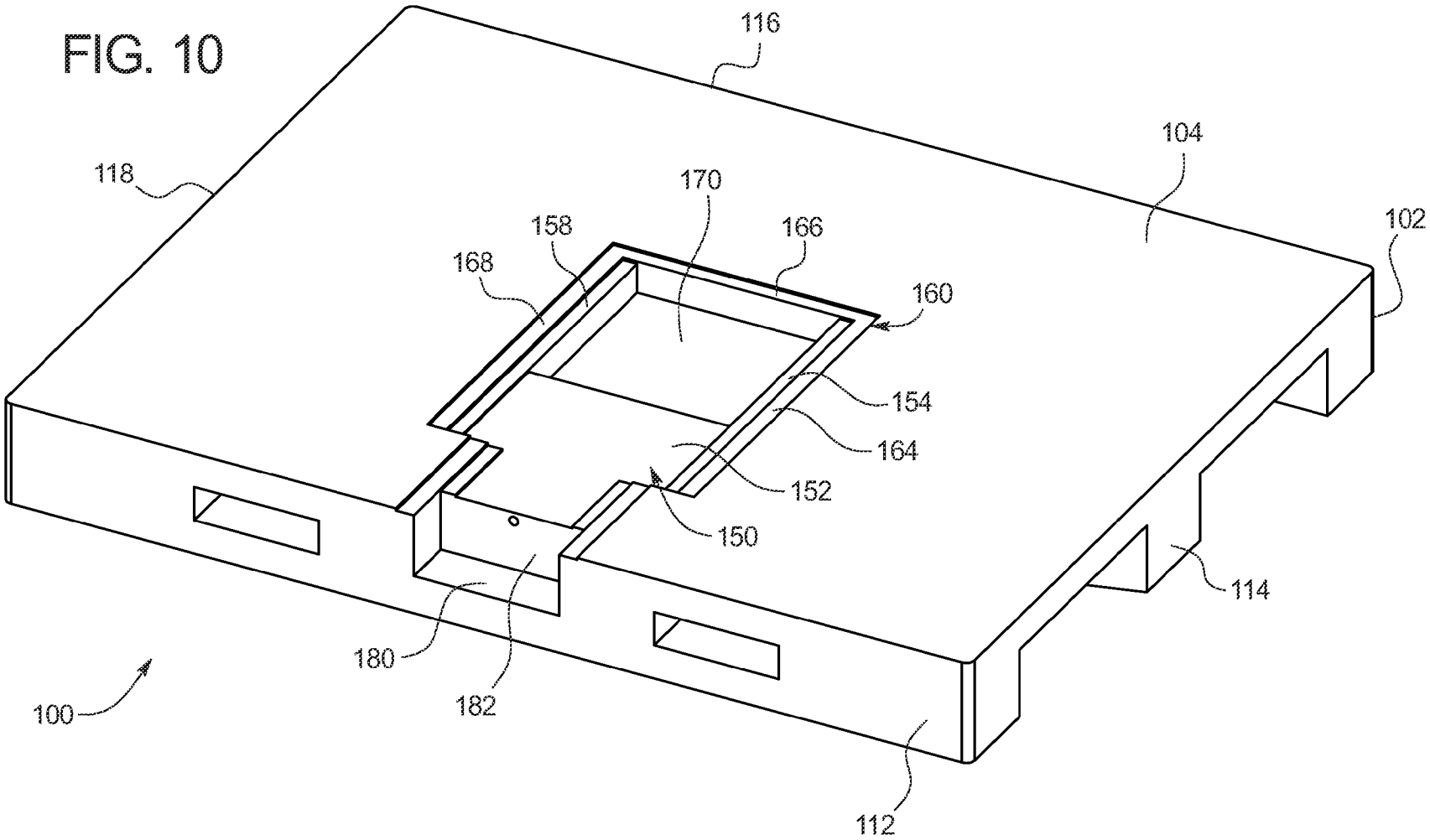
FIG. 10 is an enlarged top perspective view of the pallet of the shipping container of FIG. 1, shown removed from the container.
Figure 10A:
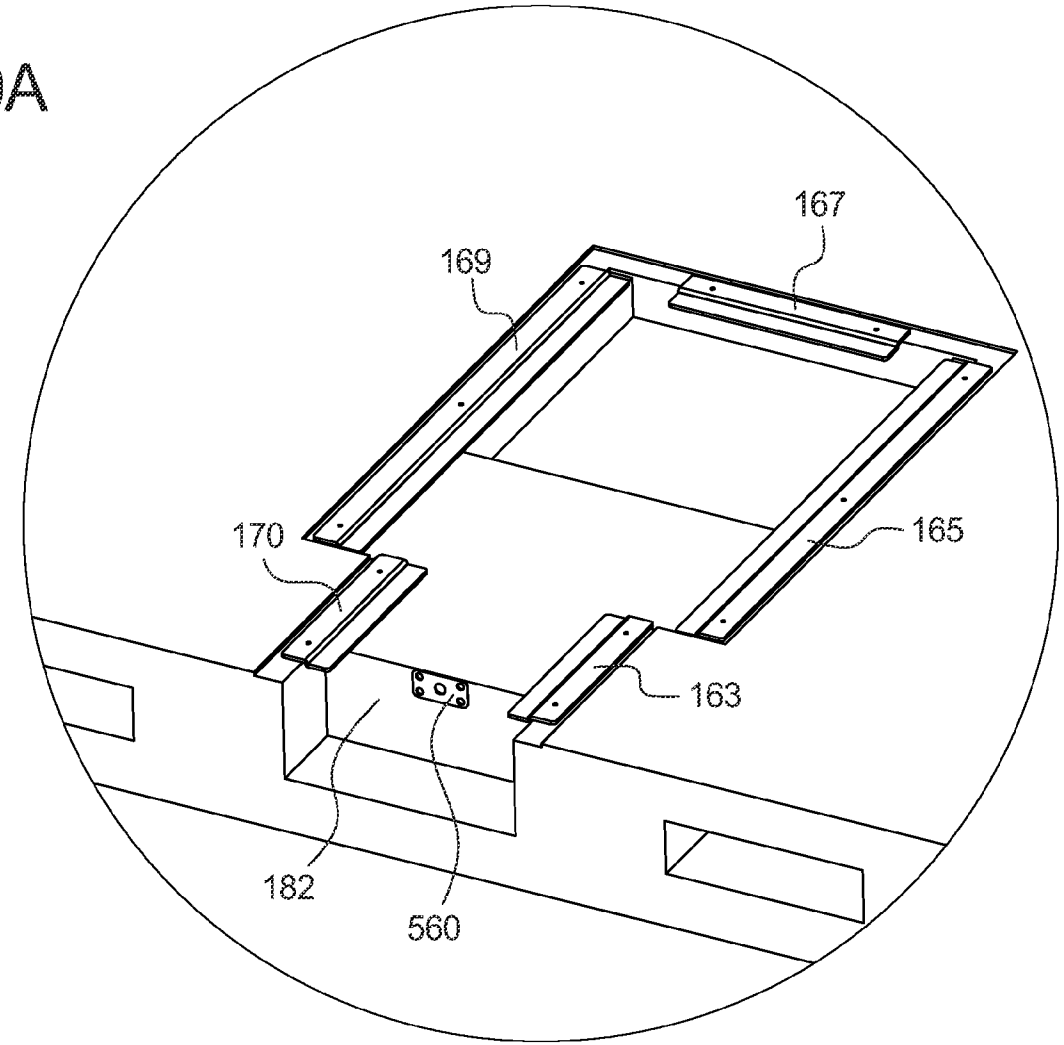
FIG. 10A is an enlarged fragmentary top perspective view of the pallet of the shipping container of FIG. 1, shown removed from the container and without the gate of the material unloading assembly, but with the guide rails of the material unloading assembly shown in the position at which they rest on and are supported by the pallet.
Figure 11:
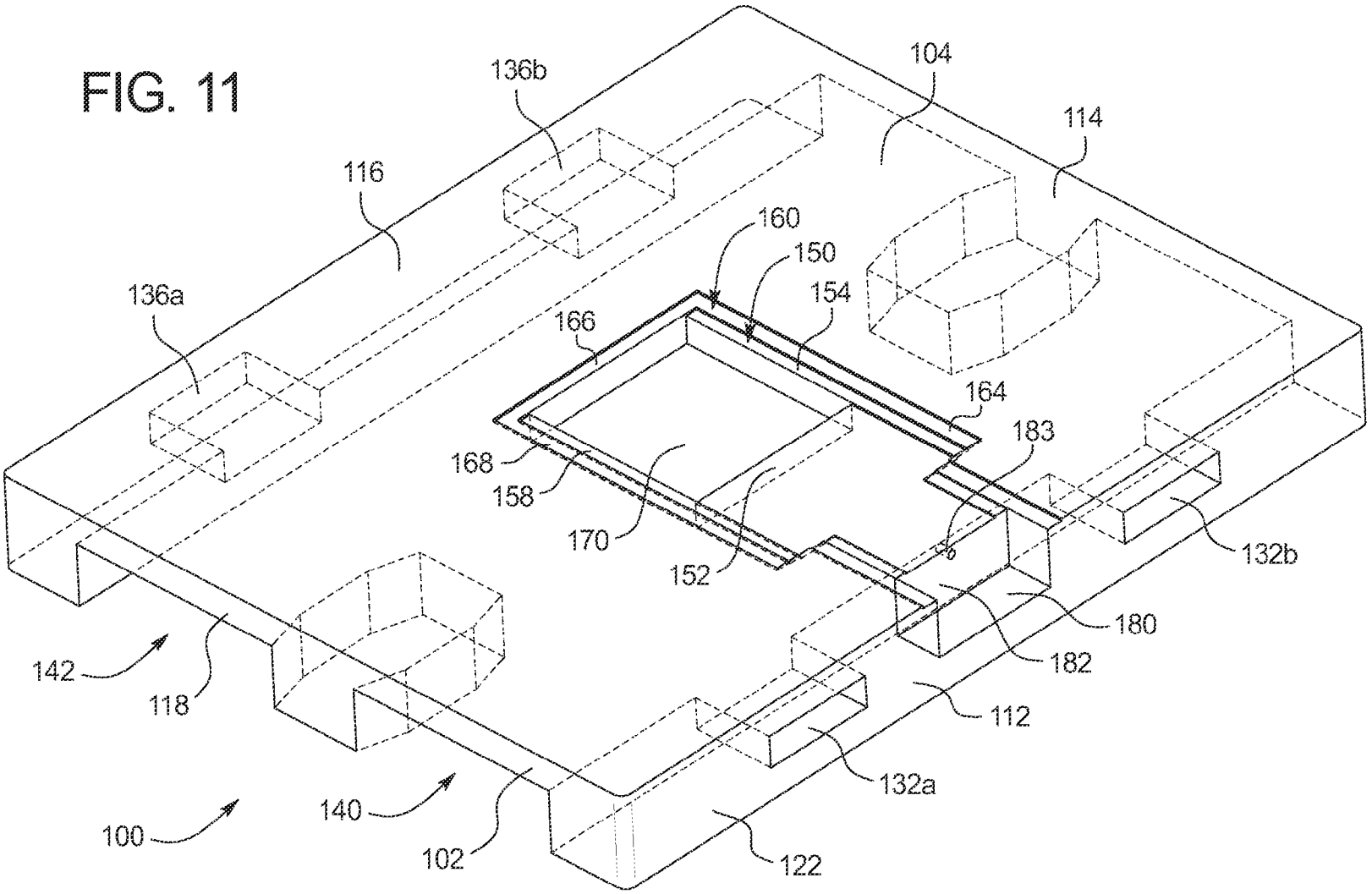
FIG. 11 is an enlarged top perspective view of the pallet of the shipping container of FIG. 1, shown removed from the container, and illustrating the certain of the legs of the pallet in phantom, certain portions of the fork lift tine receiving channels of the pallet in phantom, and certain portions of the pallet jack tine receiving channels defined by the pallet in phantom.
Figure 12:
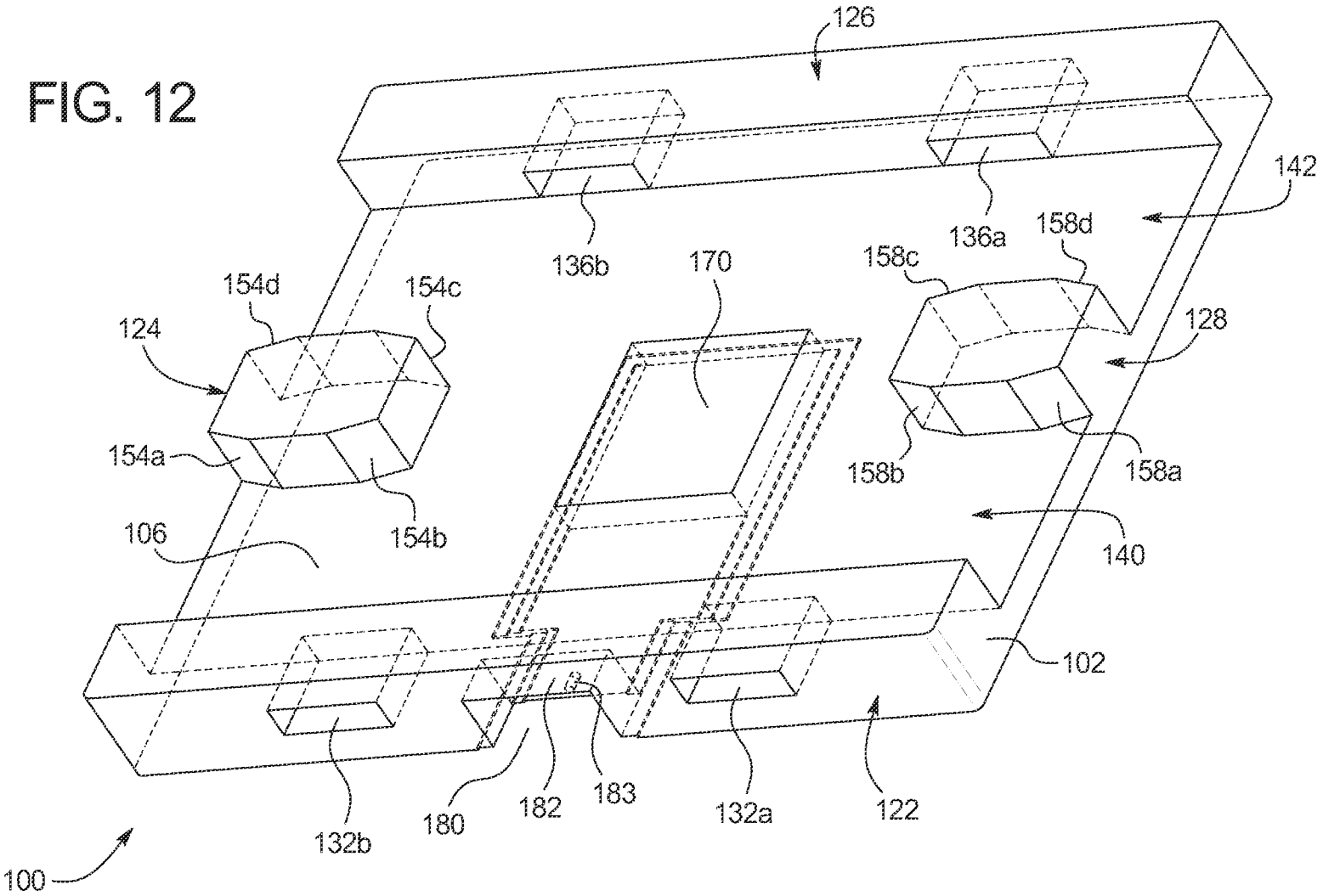
FIG. 12 is an enlarged bottom perspective view of the pallet of the shipping container of FIG. 1, shown removed from the container and flipped upside down, and illustrating the certain of the legs of the pallet, certain portions of the fork lift tine receiving channels defined by the pallet in phantom, and the pallet jack tine receiving channels defined by the pallet.
Figure 13:
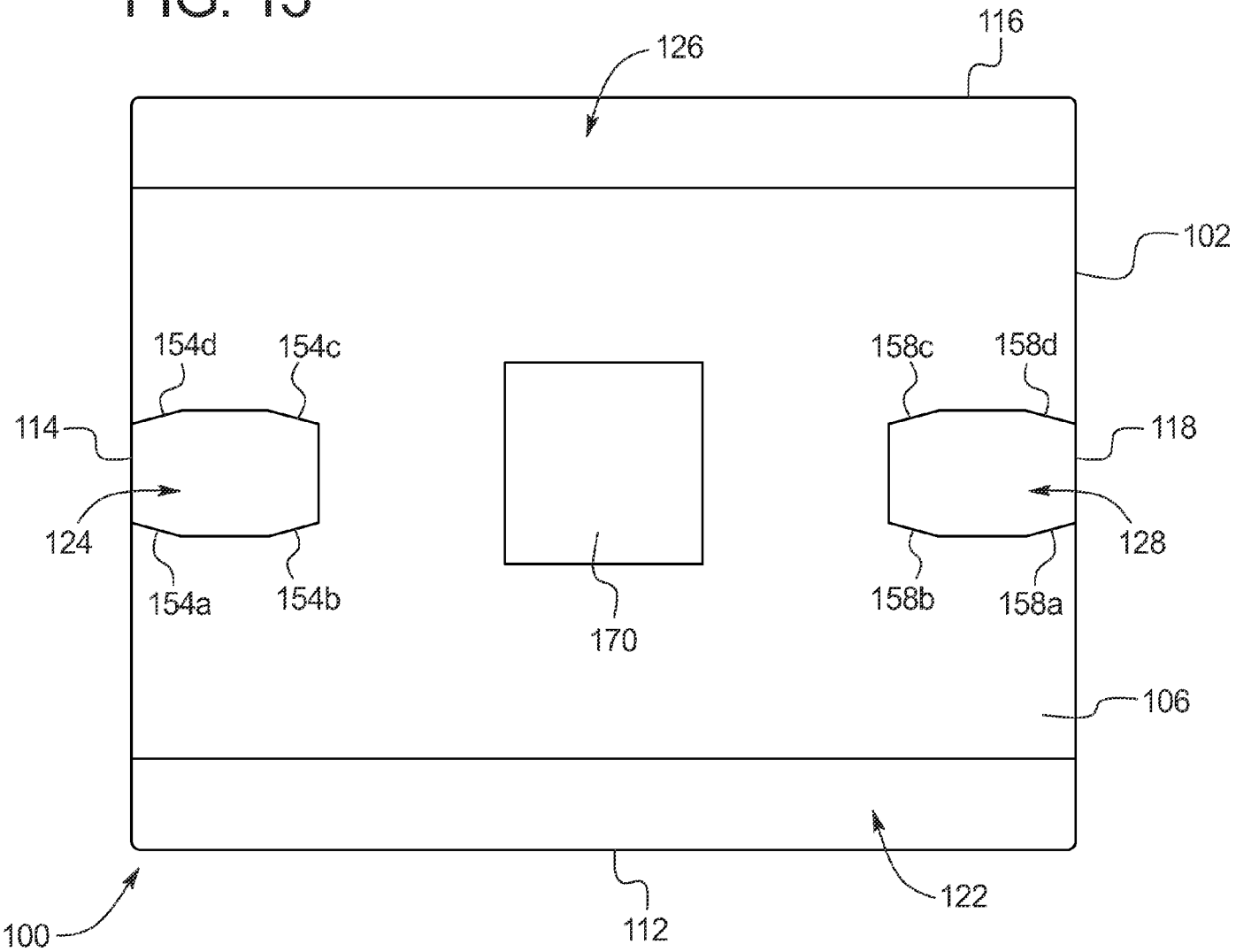
FIG. 13 is an enlarged bottom view of the pallet of the shipping container of FIG. 1, shown removed from the container and illustrating certain of the legs of the pallet, and the pallet jack tine receiving channels defined by the pallet.
Figure 14:
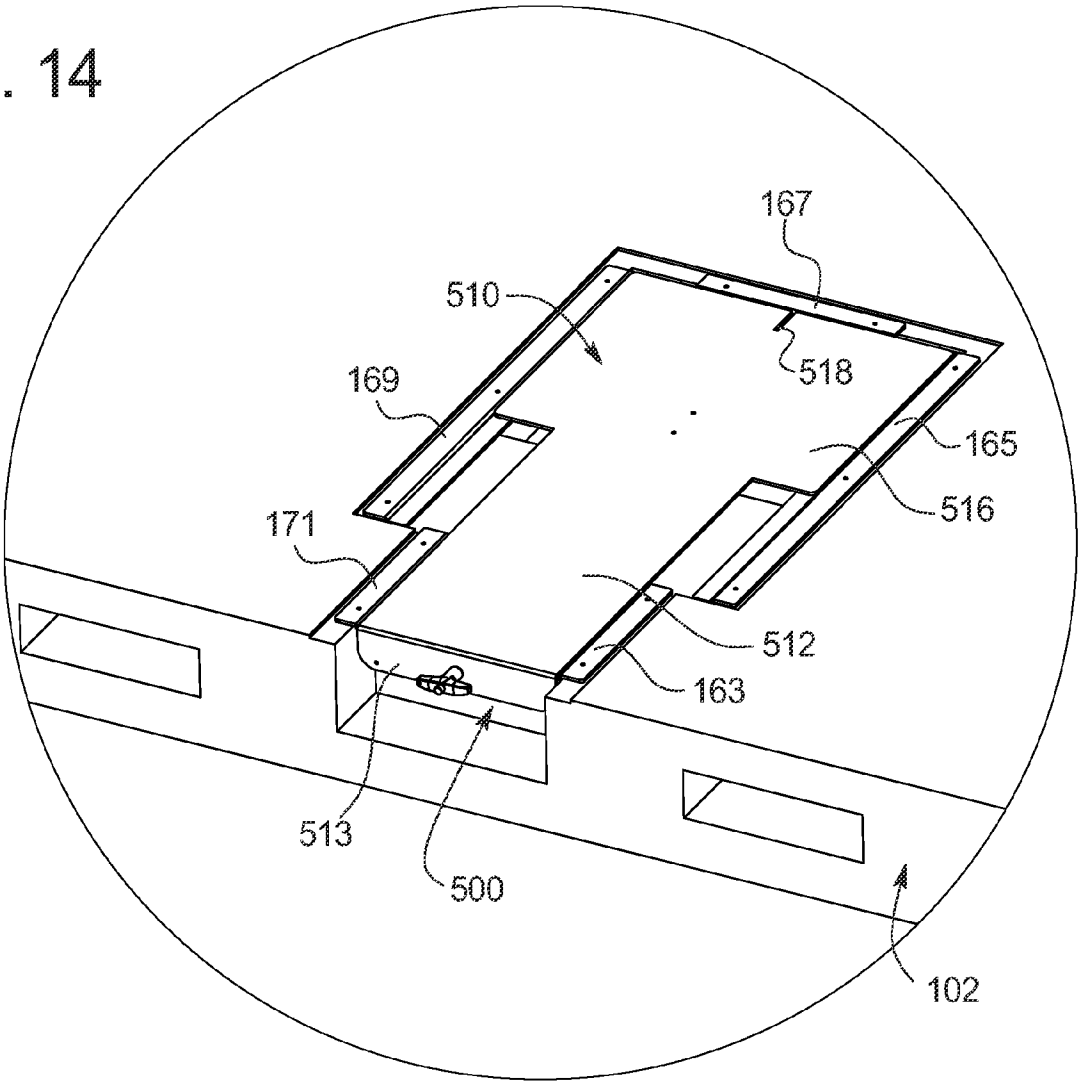
FIG. 14 is an enlarged top fragmentary perspective view of a part of the central portion of the pallet of the shipping container of FIG. 1, shown removed from the container, and illustrating the position of the guide rails and the gate of the material unloading assembly detached from the bottom compartment, in the closed position, and in the position at which they rest on and are supported by the pallet.

In the illustrated embodiment, and as particularly illustrated in FIGS. 9C and 9D, the container 50 and in particular the material unloading assembly 500 includes a plurality of guide rails 163, 165, 167, 169, and 171. Guide rail 163 is secured to the exterior bottom wall 206 and is configured and positioned to be supported by the front portions of shoulders 154 and 164. Guide rail 165 is secured to the exterior bottom wall 206 and is configured and positioned to be supported by the central and rear portions of the shoulders 154 and 164. Guide rail 167 is secured to the exterior bottom wall 206 and is configured and positioned to be supported by the rear shoulders 156 and 166. Guide rail 169 is secured to the exterior bottom wall 206 and is configured and positioned to be supported by the central and rear portions of shoulders 158 and 168. Guide rail 171 is secured to the exterior bottom wall 206 and is configured and positioned to be supported by the front portions of the shoulders 158 and 168. It should be appreciated that FIGS. 10A, 14, 15, and 16 illustrate these guide rails 163, 165, 167, 169, and 171 detached from or without the exterior bottom wall 206 and in the positions where they rest on and are supported by these shoulders of the pallet 100. It should also be appreciated that these guide rails function in multiple ways. The guide rails 163, 165, 167, 169, and 171 support and guide the movement of closure portion and the handle portion of the chute door or gate 510 of the material unloading assembly 500. The gate slides or moves on or above these guide rails 163, 165, 167, 169, and 171, and these guide rails prevent the downward movement of the chute door or gate and also prevent loose materials being held in the top and bottom compartments from accumulating on or adjacent to the chute door or gate or the shoulders. The guide rails 165, 167, and 169 also rest on the shoulders to provide additional support for the bottom compartment.

The body 102 of the pallet 100 also includes defines a handle chamber 180 and a stopping wall 182 for the handle of the material unloading assembly (as described below). The handle chamber 180 and the stopping wall 182 of the pallet 100 are further discussed below in conjunction with the discussion of the material unloading assembly 500.

Turning now to FIGS. 3, 4, 7, 9C, 9D, 9E, 9F, 14, 15, 16, 17, 17A, 18, 18A, 19, 19A, 20A, 20B, 20C, 20D, 21, 22, 23, 24, 25, and 26, the material unloading assembly 500 of the container 50 is supported by both bottom wall 206 of the bottom compartment 200 and the body 102 of the pallet 100 under and adjacent to the opening or chute 204 in the bottom compartment 200 and above the opening or chute 170 in the pallet 100. The material unloading assembly 500 includes a chute door or gate 510 slidably positioned on the guide rails 163, 165, 167, 169, and 171, and partially supported by the shoulders 152, 154, and 158 defined by the body 102 of the pallet 100 as discussed above. The gate 510 includes a handle member or portion 512 and a closure member or portion 516 extending from the handle member or portion 512. The gate 510 is movable or slidable from a closed position as shown in FIGS. 9C, 9D, 9E, 9F, 14, 17, and 17A to a plurality of different partially open positions (such as the partially open position shown in FIGS. 15, 18 and 18A), and then to a fully open position shown in FIGS. 16, 19, and 19A. It should also be appreciated that the body 102 of the pallet 100 defines a plurality of stopping walls that prevent the gate 510 from moving too far outwardly and also keeps the handle portion 512 of the gate 510 relatively close to the pallet 100. In this embodiment, the gate and the guide rails are made of stainless steel or galvanized steel to: (a) provide structural strength and rigidity; (b) facilitate ease of cleaning; (c) facilitate ease of repair; (d) prevent rusting; (e) minimize overall weight of the container; and (f) prevent contamination. However, it should be appreciated that in alternative embodiments, the gate and the guide rails can be made from other suitable materials.

The material unloading assembly 500 further includes a knife 520 attached to the bottom surface of the gate 510. Specifically, the knife 520 includes a biasing member in the form of a leaf spring 522 having an attachment end 524 attached to the bottom surface of the gate 510 and a fin shaped blade 530 attached to the top side of the opposite or free end 526 of leaf spring 522. As best shown in FIGS. 17A, 18A, 19A, 21, 22, and 23, the fin shaped blade 530 includes: (a) an attachment base 532 attached to the top of the free end 526 of the leaf spring 522; and (b) a cutting member 534 attached to and extending from the attachment base 532. The cutting member 534 includes an accurate shaped cutting edge 536 and back edge 538 opposite the cutting edge 536. The leaf spring 522 biases the blade 530 upwardly such that the blade 530 is biased upwardly and the cutting member 534 and extends through a vertically extending slot 518 (see FIGS. 20A and 20B) in the closure portion 516 of the gate 510 toward a fully expanded position. In this illustrated embodiment, the knife is made of stainless steel or galvanized steel to: (a) facilitate attachment or connection of these parts by welding and/or suitable fasteners; (b) facilitate ease of cleaning; (c) facilitate ease of repair; (d) prevent rusting; (e) minimize overall weight of the container; and (f) prevent contamination. However, it should be appreciated that in alternative embodiments, the knife can be made from other suitable materials. In this illustrated embodiment, the leaf spring is made of stainless steel or galvanized steel; however, it should be appreciated that in alternative embodiments, the leaf spring can be made from other suitable materials and in other configurations.

Figure 15:
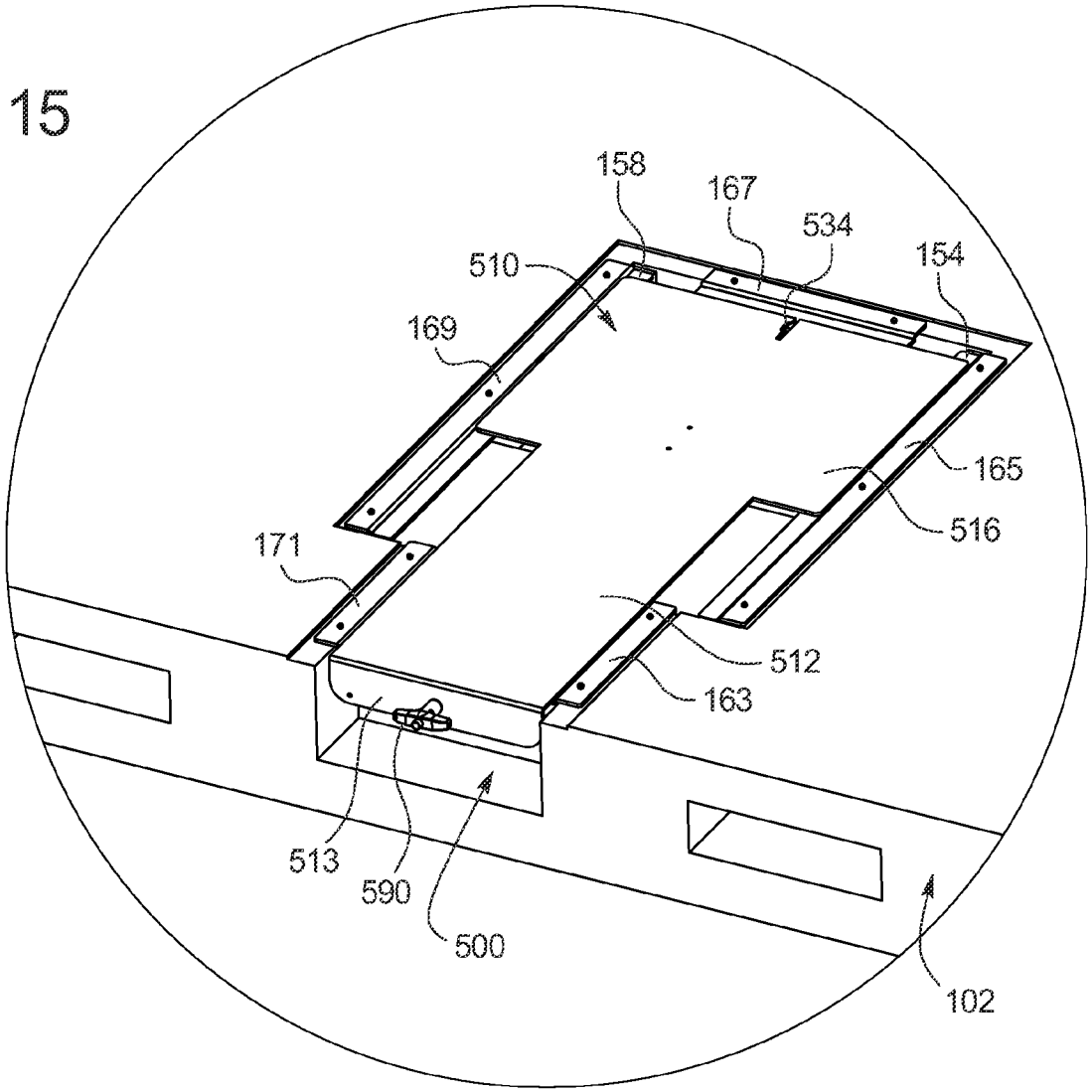
FIG. 15 is an enlarged top fragmentary perspective view of a part of the central portion of the pallet of the shipping container of FIG. 1, shown removed from the container and illustrating the guide rails and the gate of the material unloading assembly detached from the bottom compartment, in a partially open position with the blade of the knife extending partially upwardly through the gate, and in the position at which they rest on and are supported by the pallet.
Figure 16:
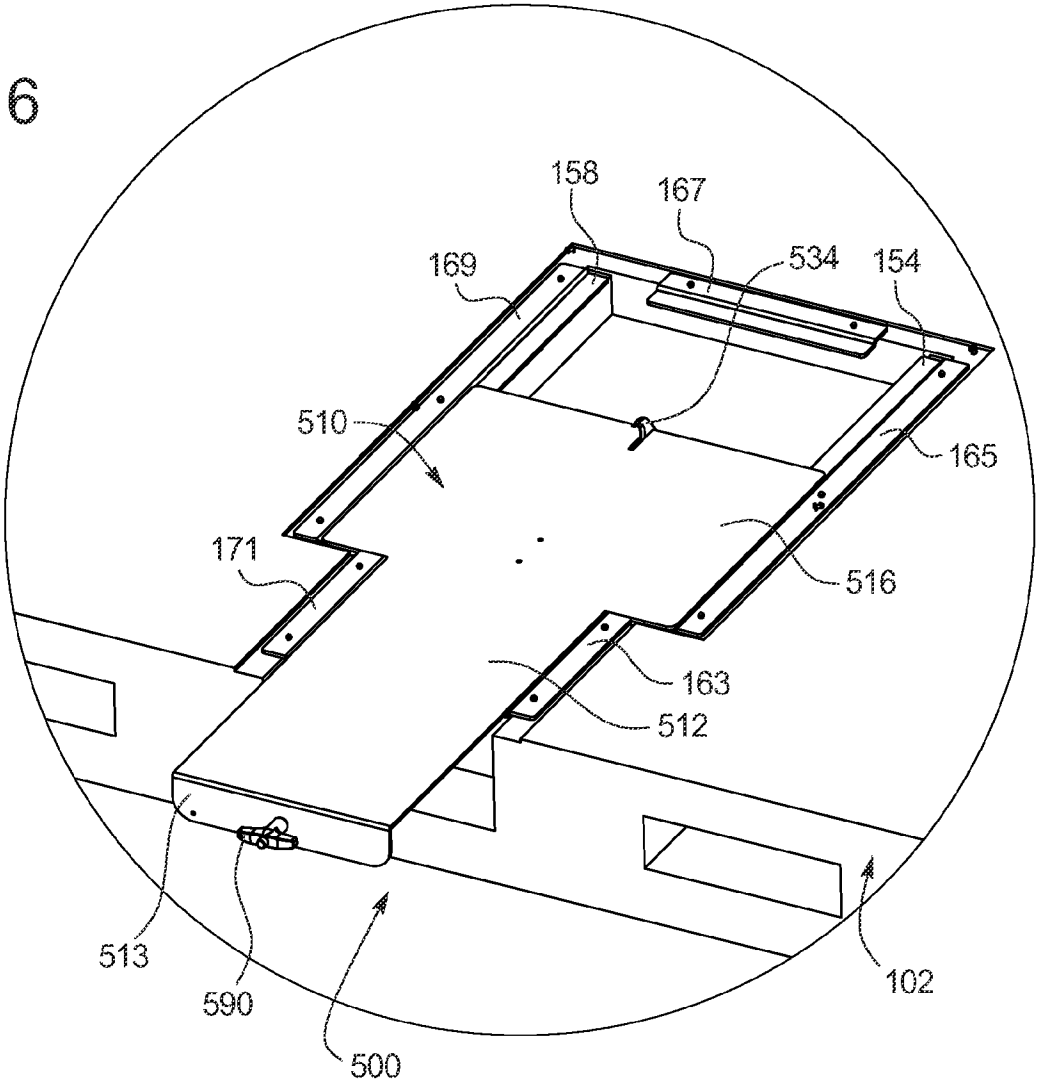
FIG. 16 is an enlarged top fragmentary perspective view of a part of the central portion of the pallet of the shipping container of FIG. 1, shown removed from the container and illustrating the guide rails and the gate of the material unloading assembly detached from the bottom compartment, in a fully open position with the blade of the knife extending fully upwardly through the gate, and in the position at which they rest on and are supported by the pallet.
Figure 17:
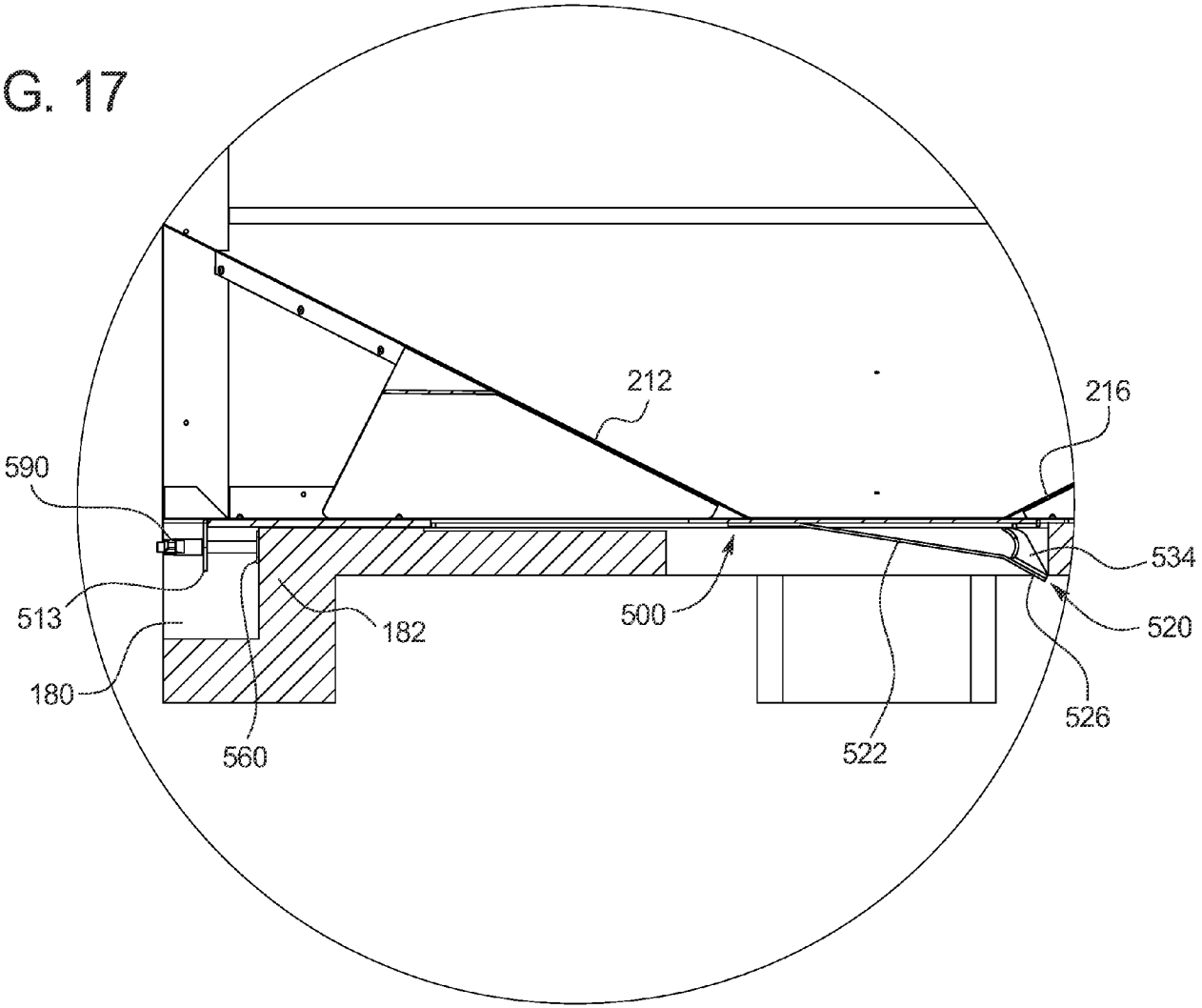
FIG. 17 is an enlarged fragmentary cross-sectional view of a part of the central portion of the pallet and a part of the bottom compartment of the shipping container of FIG. 1, and illustrating the gate of the material unloading assembly in a fully closed position and the blade of the knife in the fully closed and non-extended position.
Figure 17A:
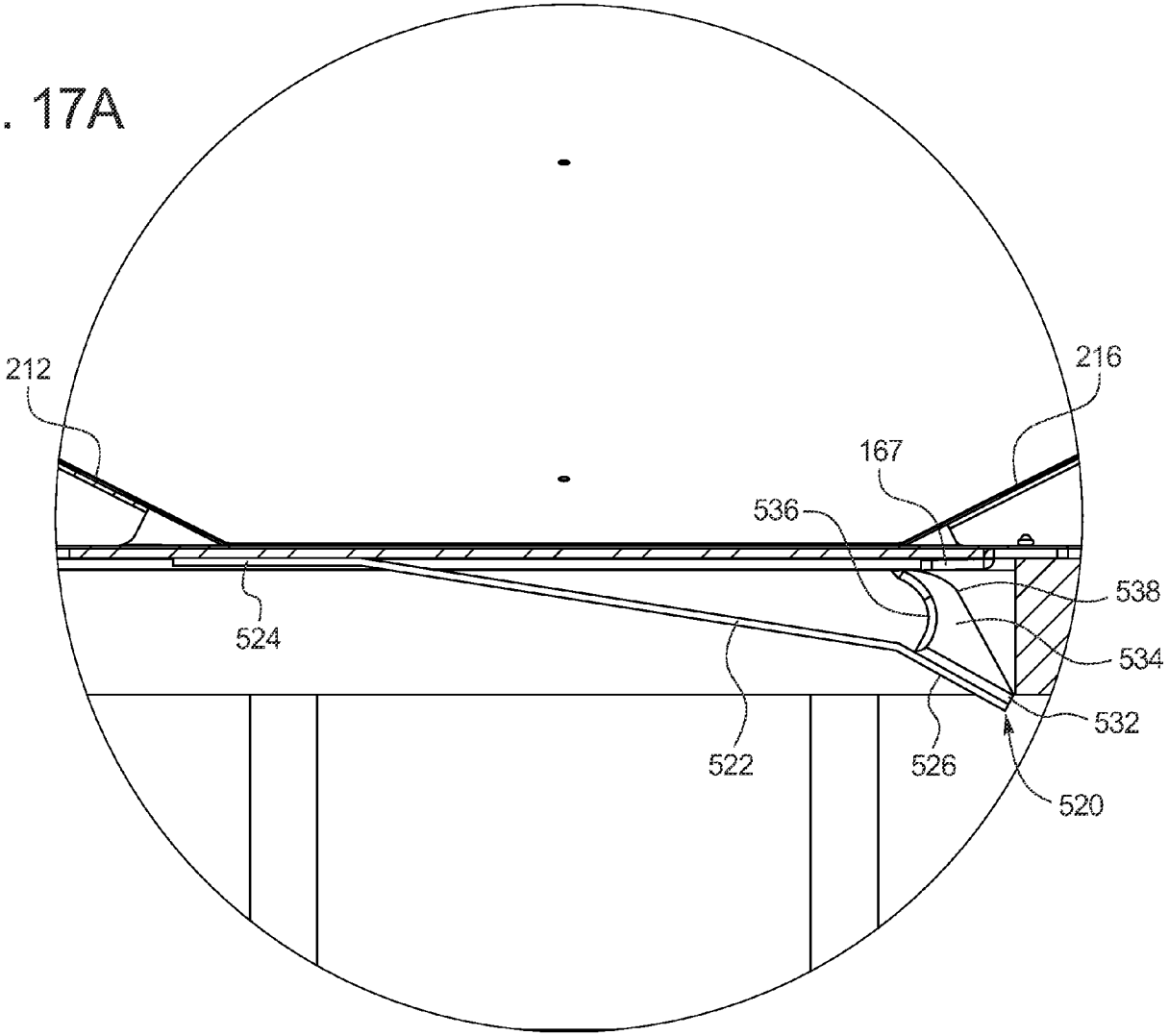
FIG. 17A is an even further enlarged fragmentary cross-sectional view of a part of the central portion of the pallet and a part of the bottom compartment of the shipping container of FIG. 1, and illustrating the gate of the material unloading assembly in a fully closed position and the blade of the knife in the fully closed and non-extended position.
Figure 18:
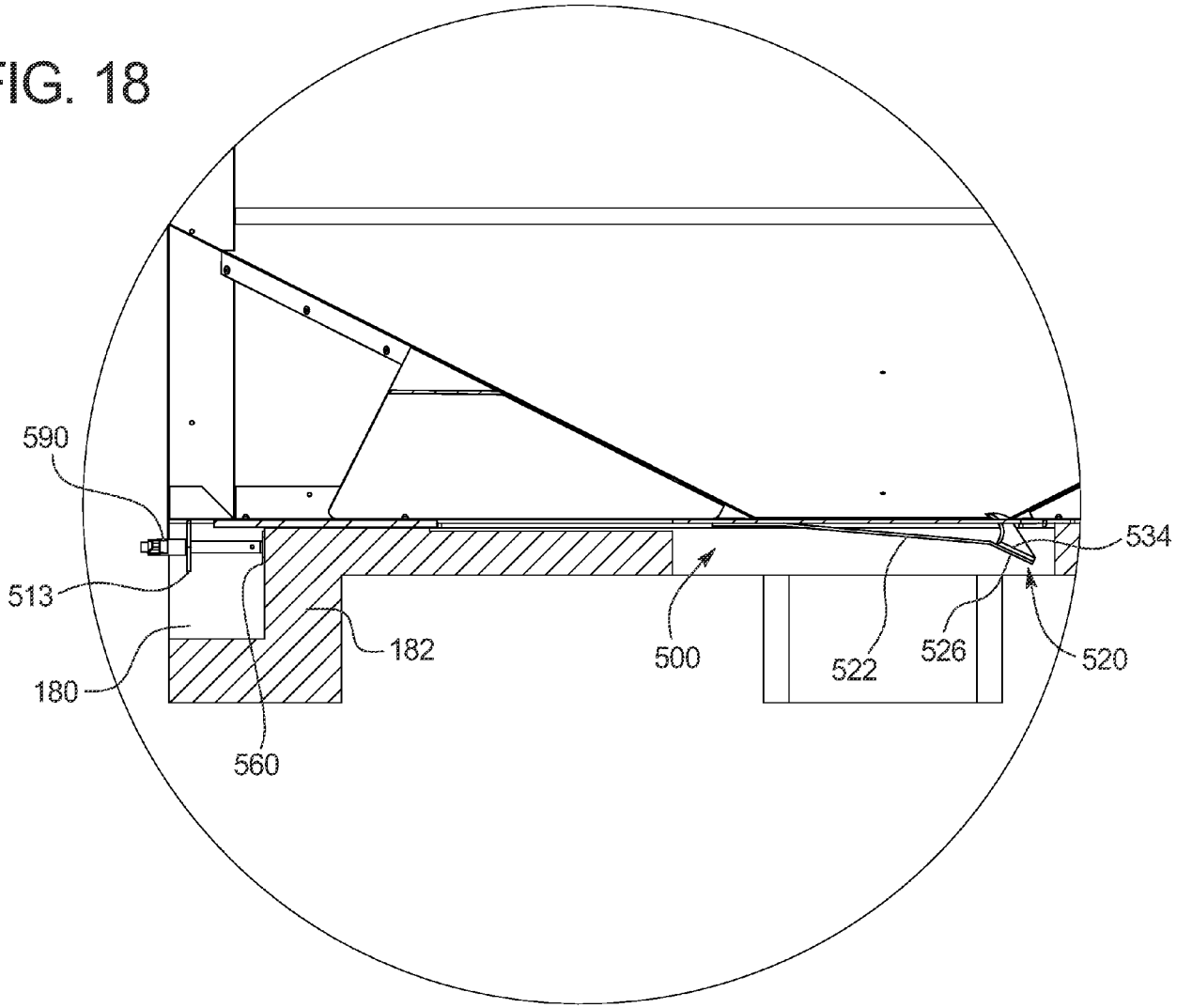
FIG. 18 is an enlarged fragmentary cross-sectional view of a part of the central portion of the pallet and a part of the bottom compartment of the shipping container of FIG. 1, and illustrating the gate of the material unloading assembly in a partially open position and the blade of the knife extending partially upwardly through the gate.
Figure 18A:
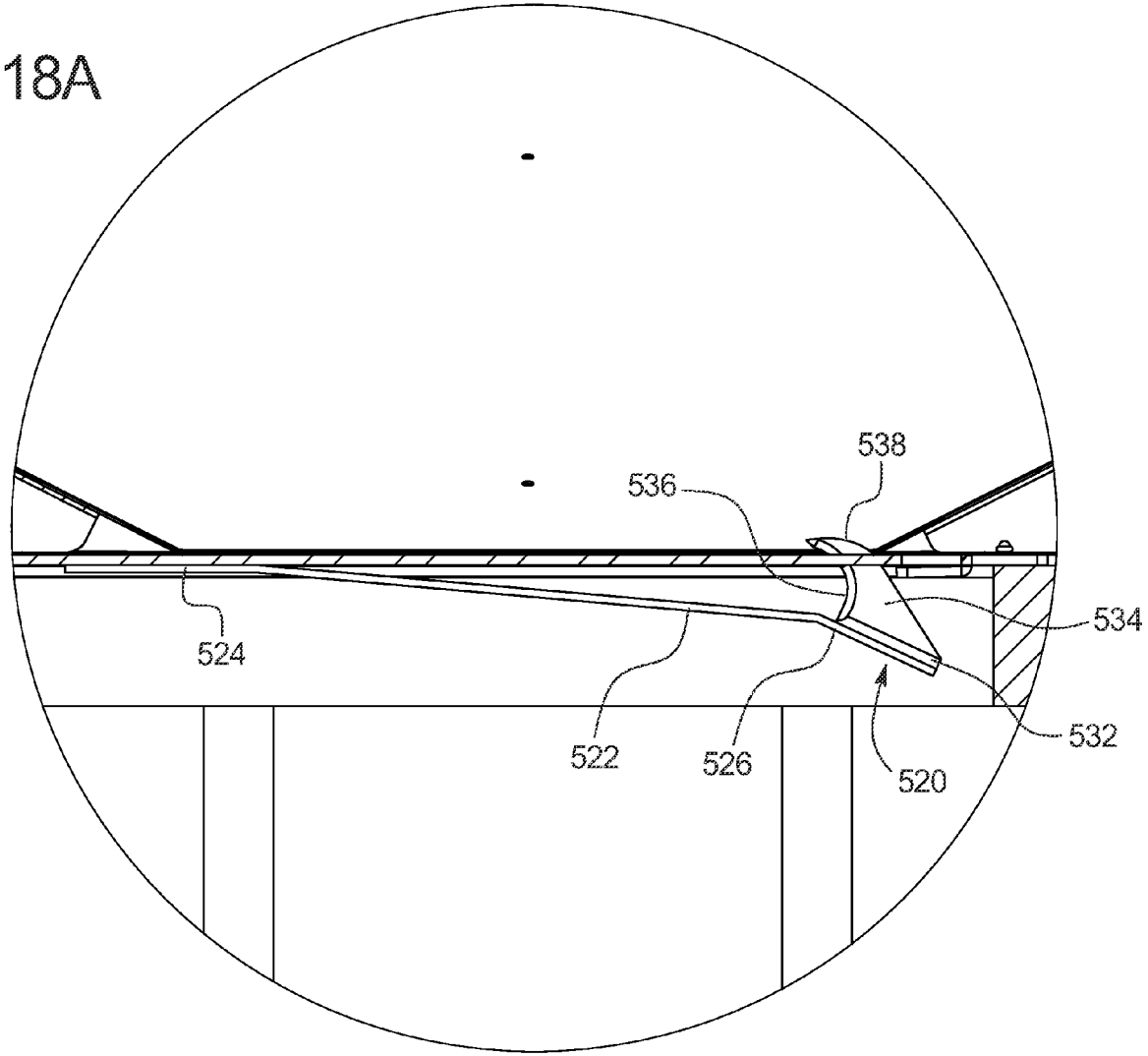
FIG. 18A is an even further enlarged fragmentary cross-sectional view of a part of the central portion of the pallet and a part of the bottom compartment of the shipping container of FIG. 1, and illustrating the gate of the material unloading assembly in a partially open position and the blade of the knife extending partially upwardly through the gate.
Figure 19:
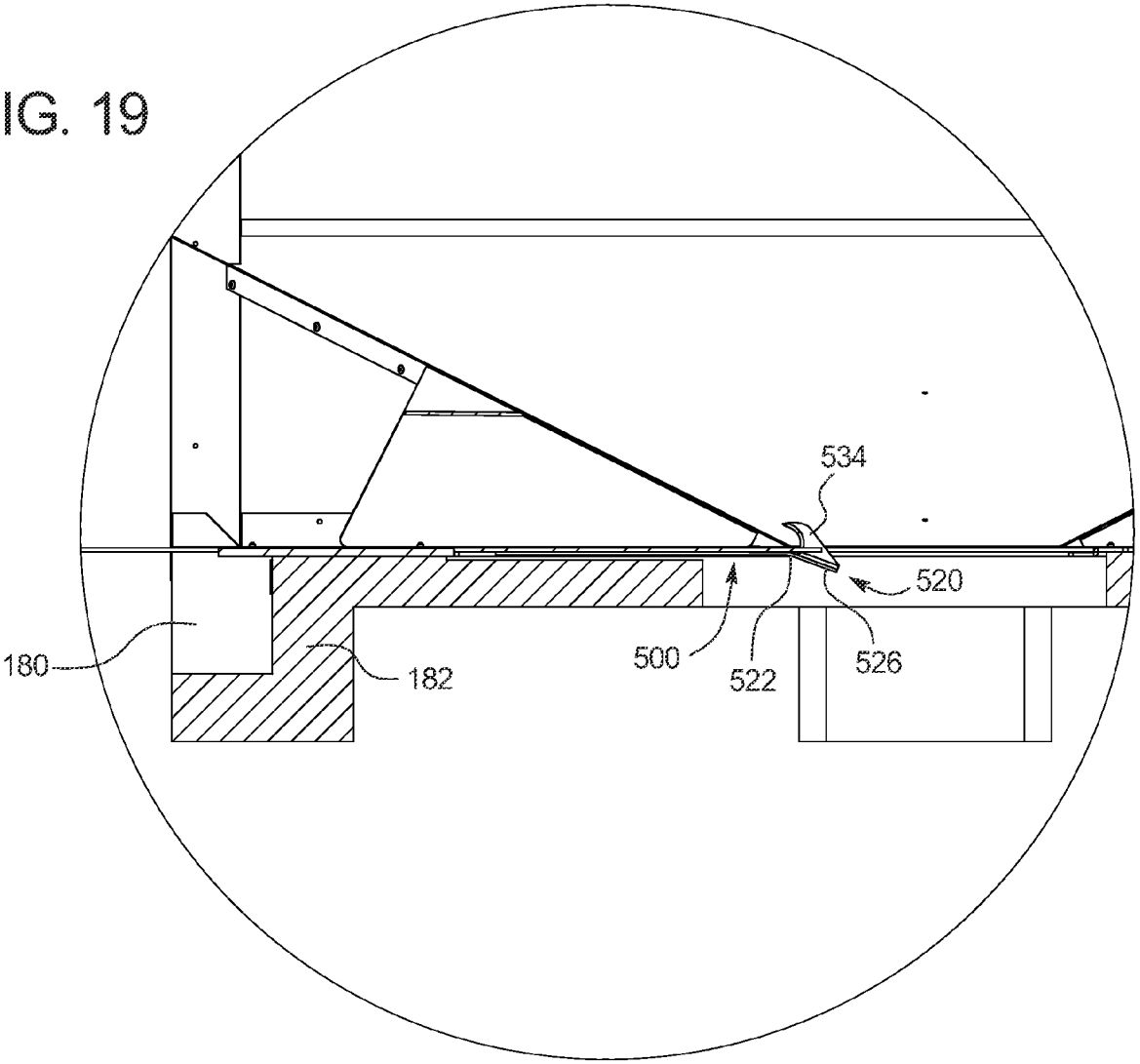
FIG. 19 is an enlarged fragmentary cross-sectional view of the central portion of the pallet and a part of the bottom compartment of the shipping container of FIG. 1, and illustrating the gate of the material unloading assembly in a fully open position and the blade of the knife extending fully upwardly through the gate.
Figure 19A:
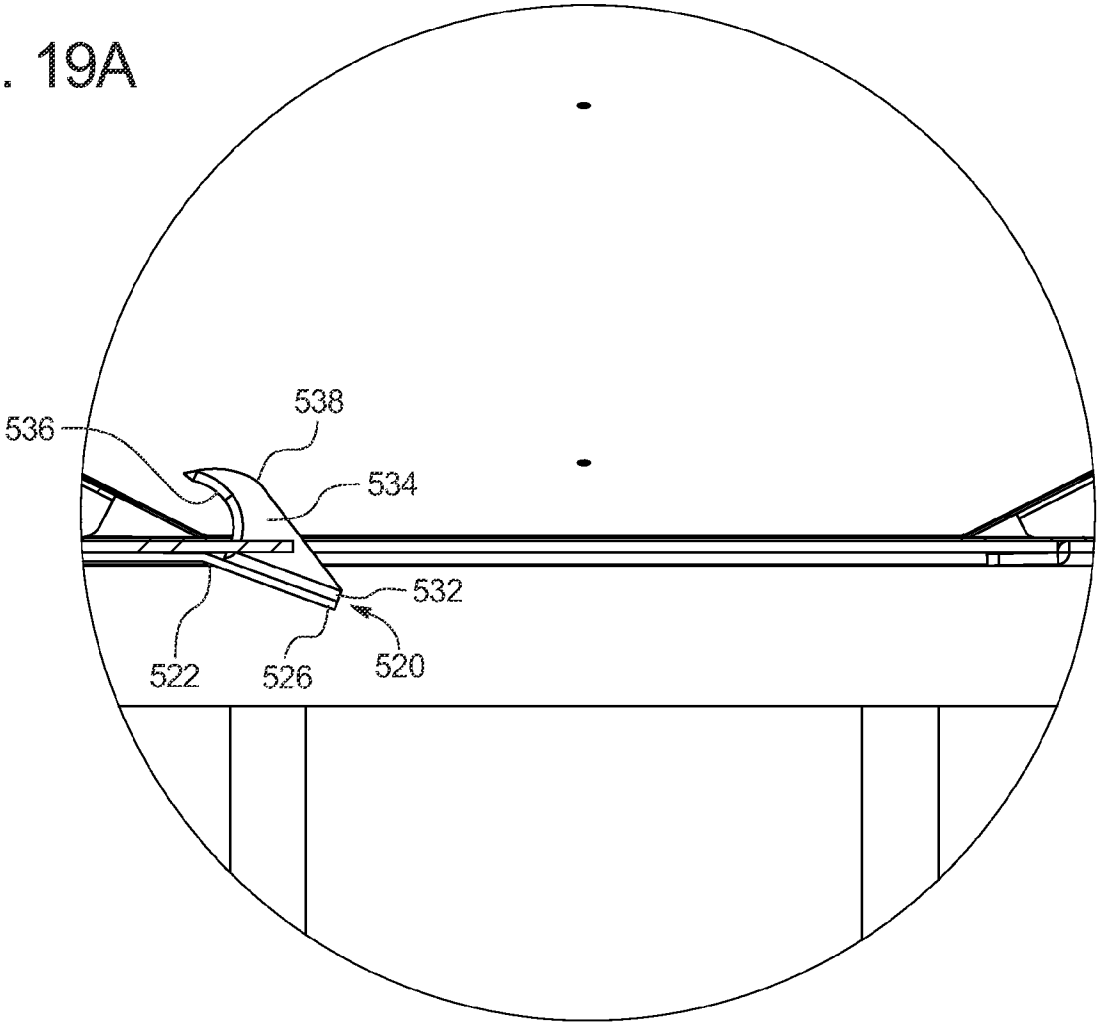
FIG. 19A is an even further enlarged fragmentary cross-sectional view of the central portion of the pallet and a part of the bottom compartment of the shipping container of FIG. 1, and illustrating the gate of the material unloading assembly in a fully open position and the blade of the knife extending fully upwardly through the gate.

The knife 520 (including the leaf spring 522 and the blade 530) moves as the gate 510 moves, and specifically is configured to move from a retracted position as shown in FIGS. 14, 17, 17A, and 20D to a plurality of different extended positions such as the partially extended position shown in FIGS. 15, 18, and 18A and to a fully extended position shown in FIGS. 16, 19, and 19A. The gate 510 is configured to be opened by an unloader such that pulling the handle portion 512 of the gate (and particularly the handle 513) from the closed position to an open position, causes the blade 530 of the cutting member 534 of the knife 520 to extend through the slot 518 and to engage the bottom of the bag (not shown) in the container 50 which holds the material, and to cut a hole in the bottom of the bag to release the material in the bag.

When the gate 510 is in the fully closed position, the cutting member 534 of the blade 530 rests below the guide rail 167 as shown in FIGS. 9C, 9D, 17, and 17A. When the gate 510 is in the fully open position, the cutting member 534 of the blade 530 is adjacent to the front section 212 of the interior bottom wall 210 as shown in FIGS. 19 and 19A. It should further be appreciated that as the gate 510 is moved from the fully open position to the closed position, the knife 520 (including the leaf spring 522 and the blade 530) moves with the gate 510 from the fully extended position to a partially retracted position to a fully retracted position. More specifically, the back edge 538 of the cutting member 534 is configured such that when the back edge 538 of the cutting member 534 contacts the bottom of the guide rail 167, the entire blade 520 and the free end 526 of the leaf spring 522 is forced downwardly against the upward bias of the leaf spring 522 and back into the retracted position as shown in FIGS. 9C, 9D, 17, and 17A. It should also be appreciated that the knife 520 does not interfere with the opening of the gate in the embodiments where a bag is not employed to hold the materials in the container.

Figure 20A:
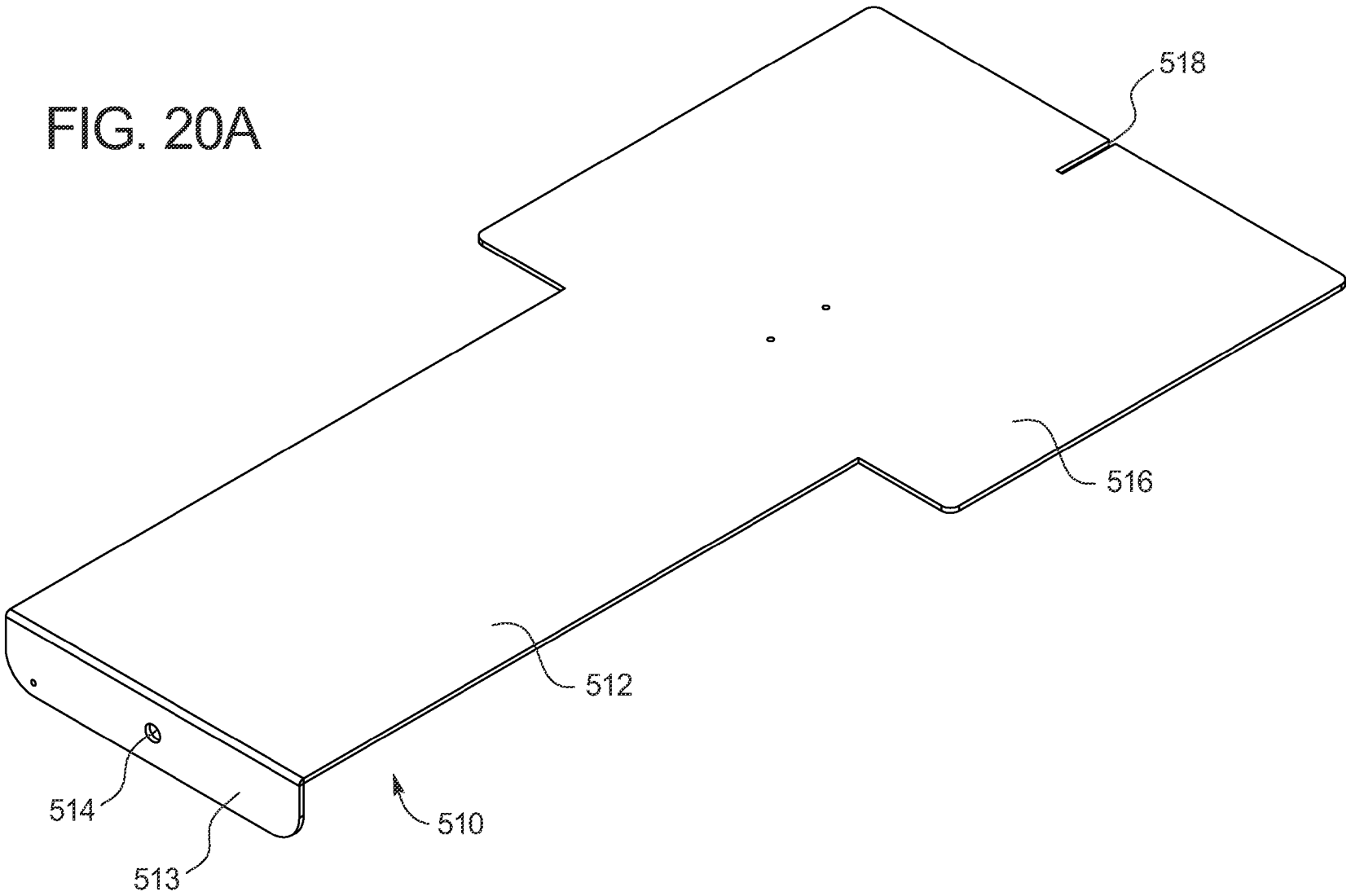
FIG. 20A is an enlarged perspective view of the gate of the material unloading assembly of the shipping container of FIG. 1.
Figure 20B:
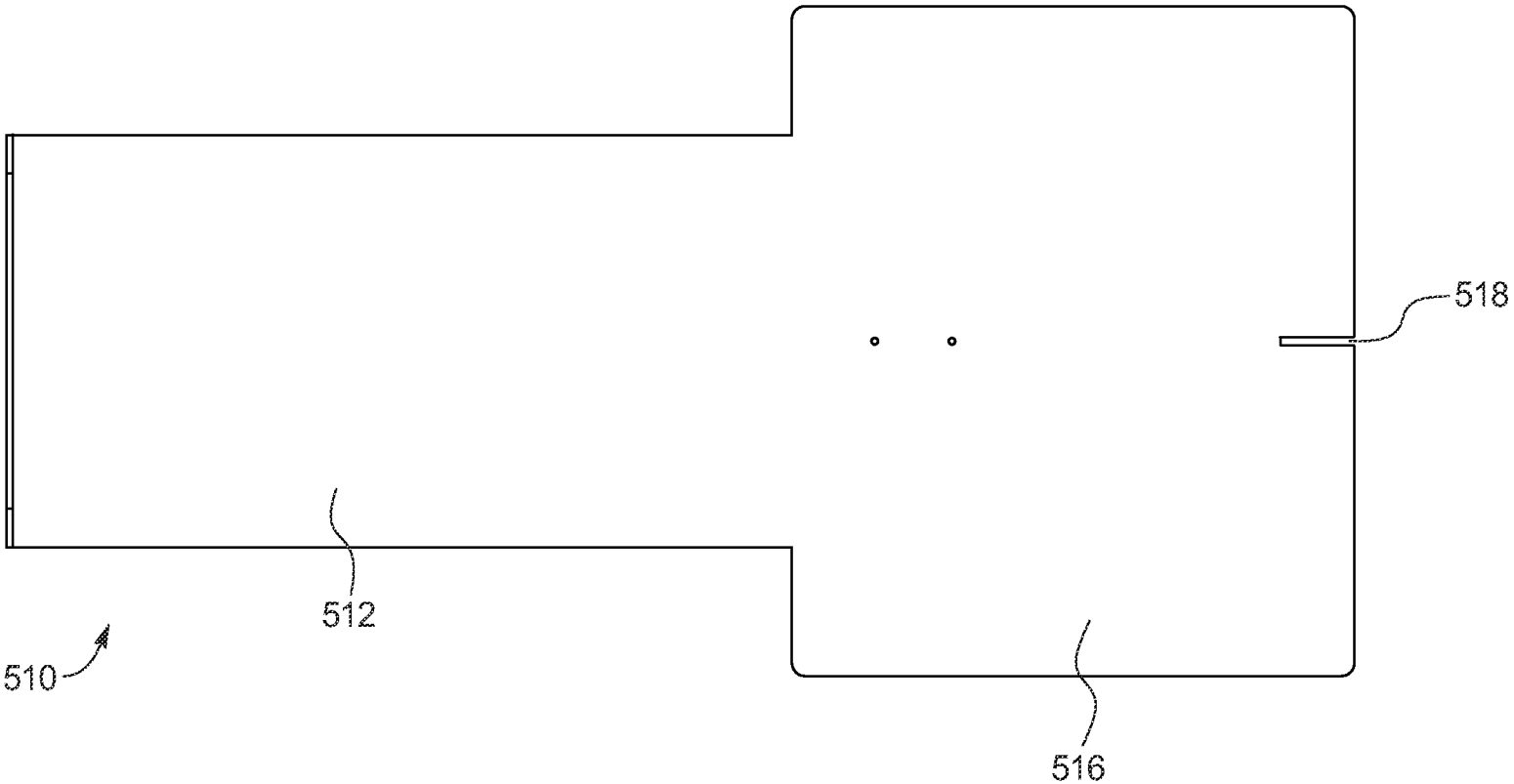
FIG. 20B is an enlarged top plan view of the gate of the material unloading assembly of the shipping container of FIG. 1.
Figure 20C:
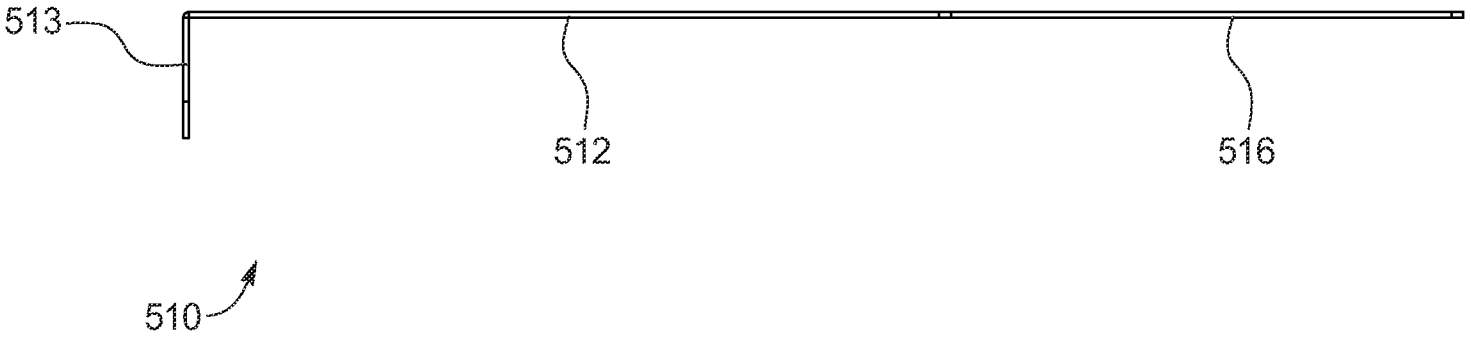
FIG. 20C is an enlarged side view of the gate of the material unloading assembly of the shipping container of FIG. 1.
Figure 20D:
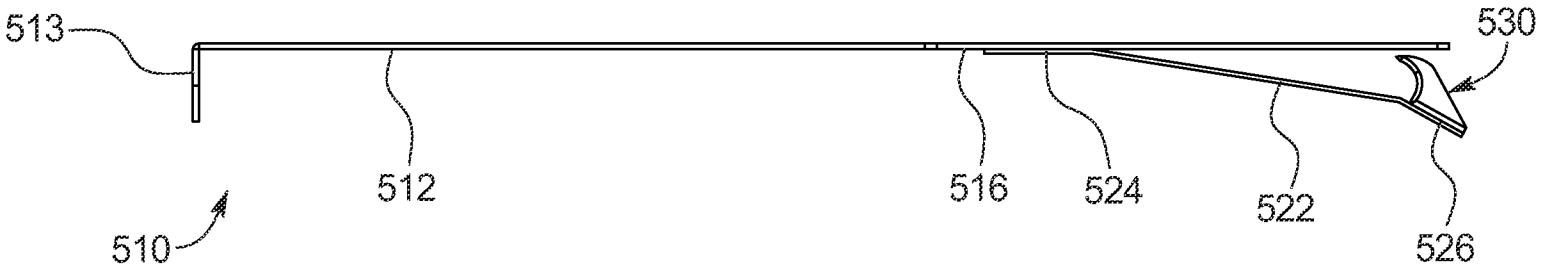
FIG. 20D is an enlarged side view of the gate and knife of the material unloading assembly of the shipping container of FIG. 1.
Figure 21:
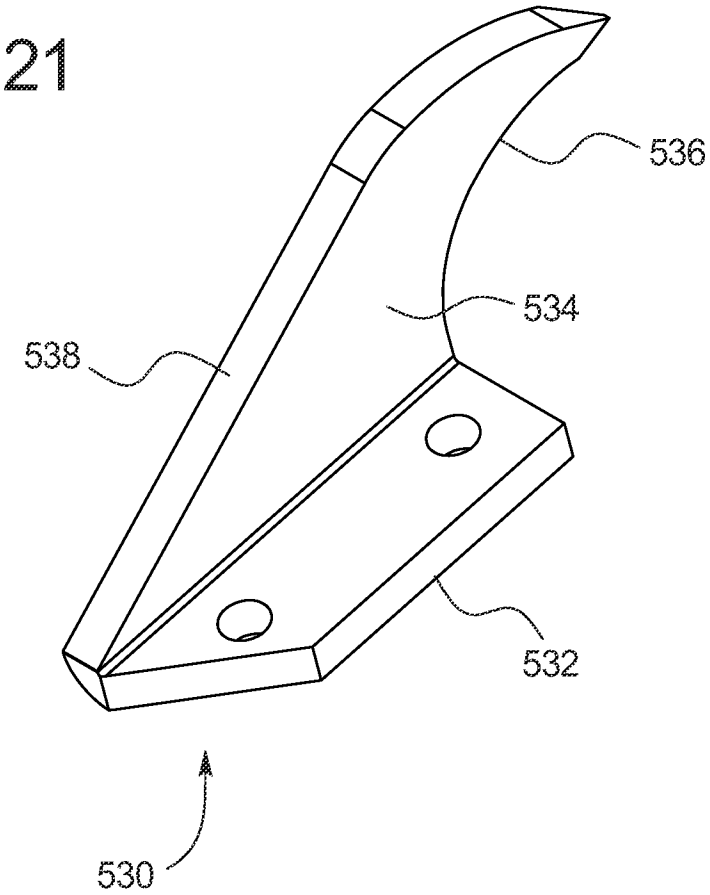
FIG. 21 is an enlarged rear perspective view of the knife of the material unloading assembly of the shipping container of FIG. 1.
Figure 22:
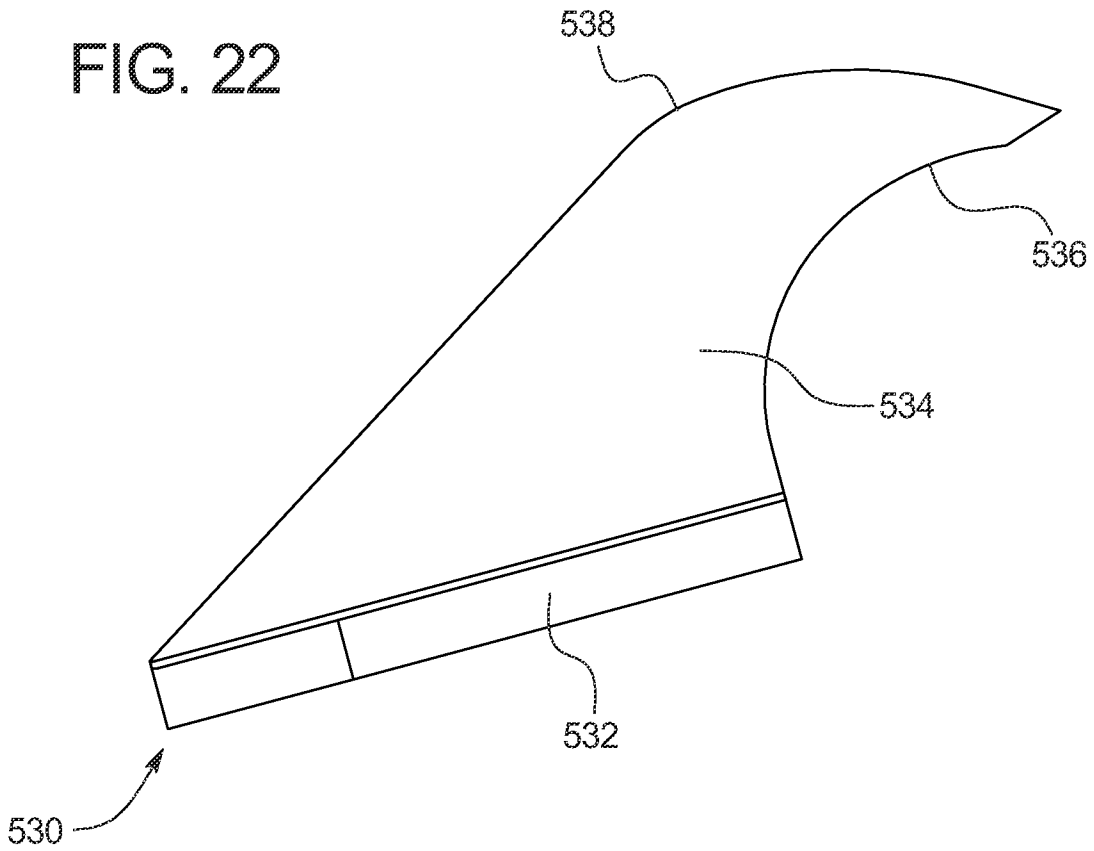
FIG. 22 is an enlarged right side view of the knife of the material unloading assembly of the of the shipping container of FIG. 1
Figure 23:
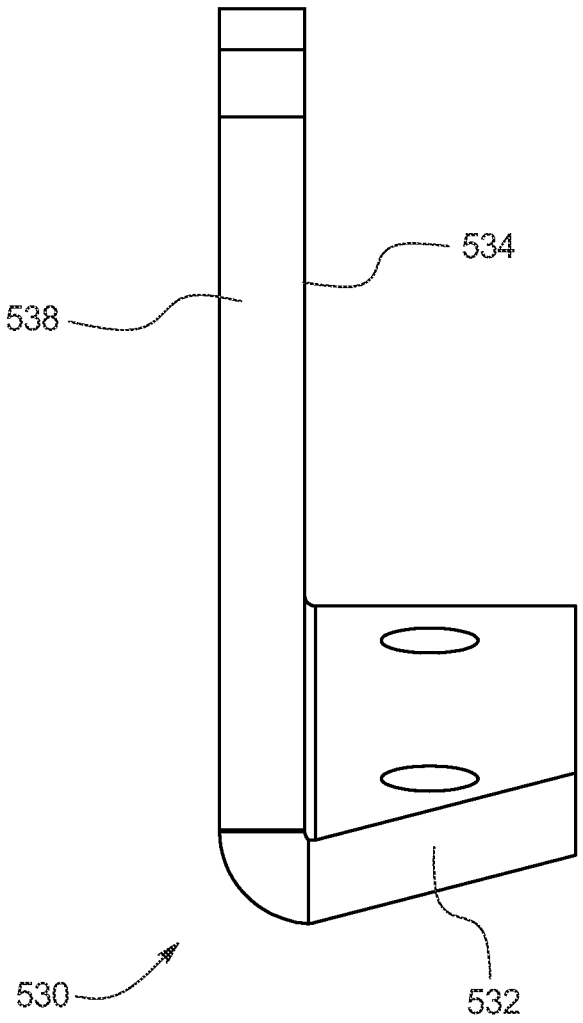
FIG. 23 is an enlarged end view of the cutting edge of the knife of the material unloading assembly of the shipping container of FIG. 1.
Figure 24:
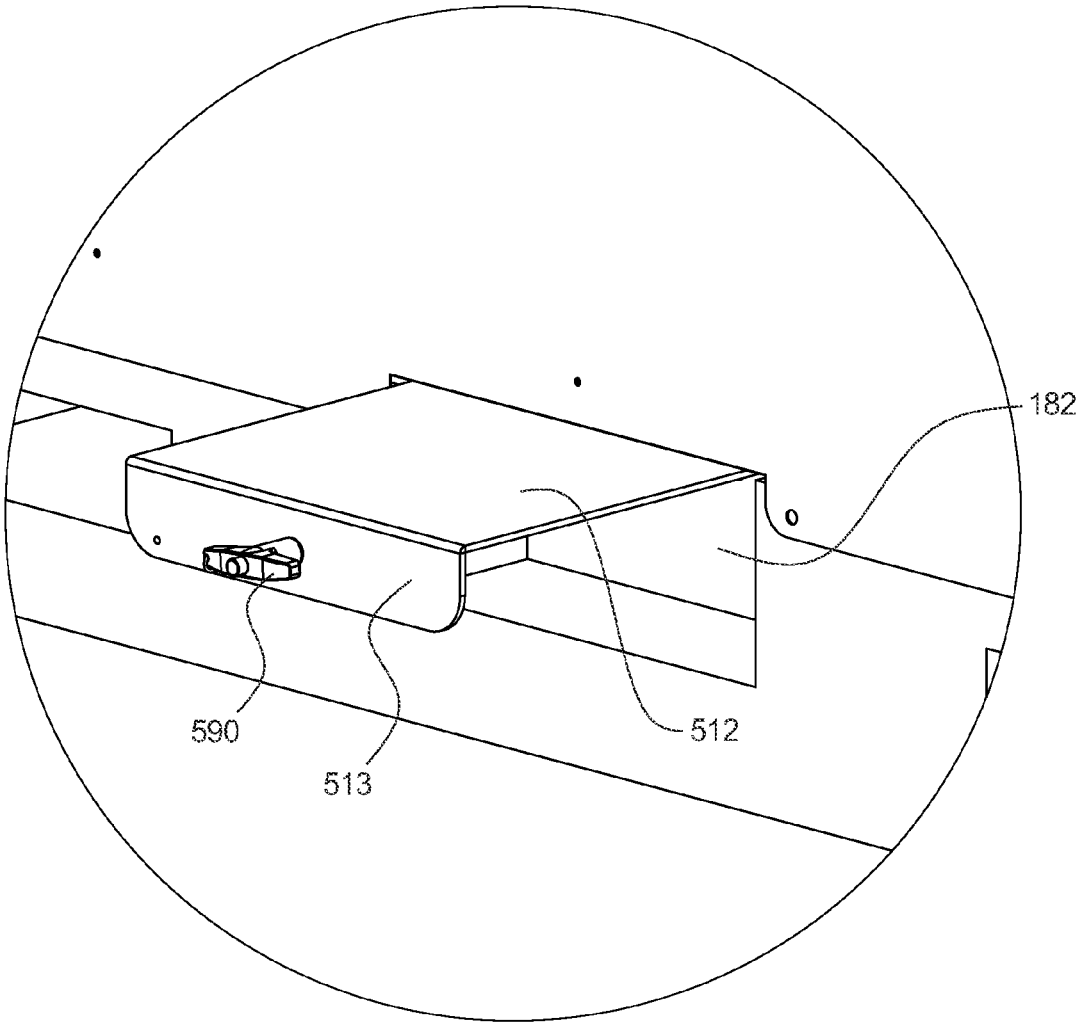
FIG. 24 is an enlarged fragmentary perspective view of the central portion of the pallet and a part of the bottom compartment of the shipping container of FIG. 1, and illustrating the locking pin and the handle of the gate of the material unloading assembly in an open position.
Figure 25:
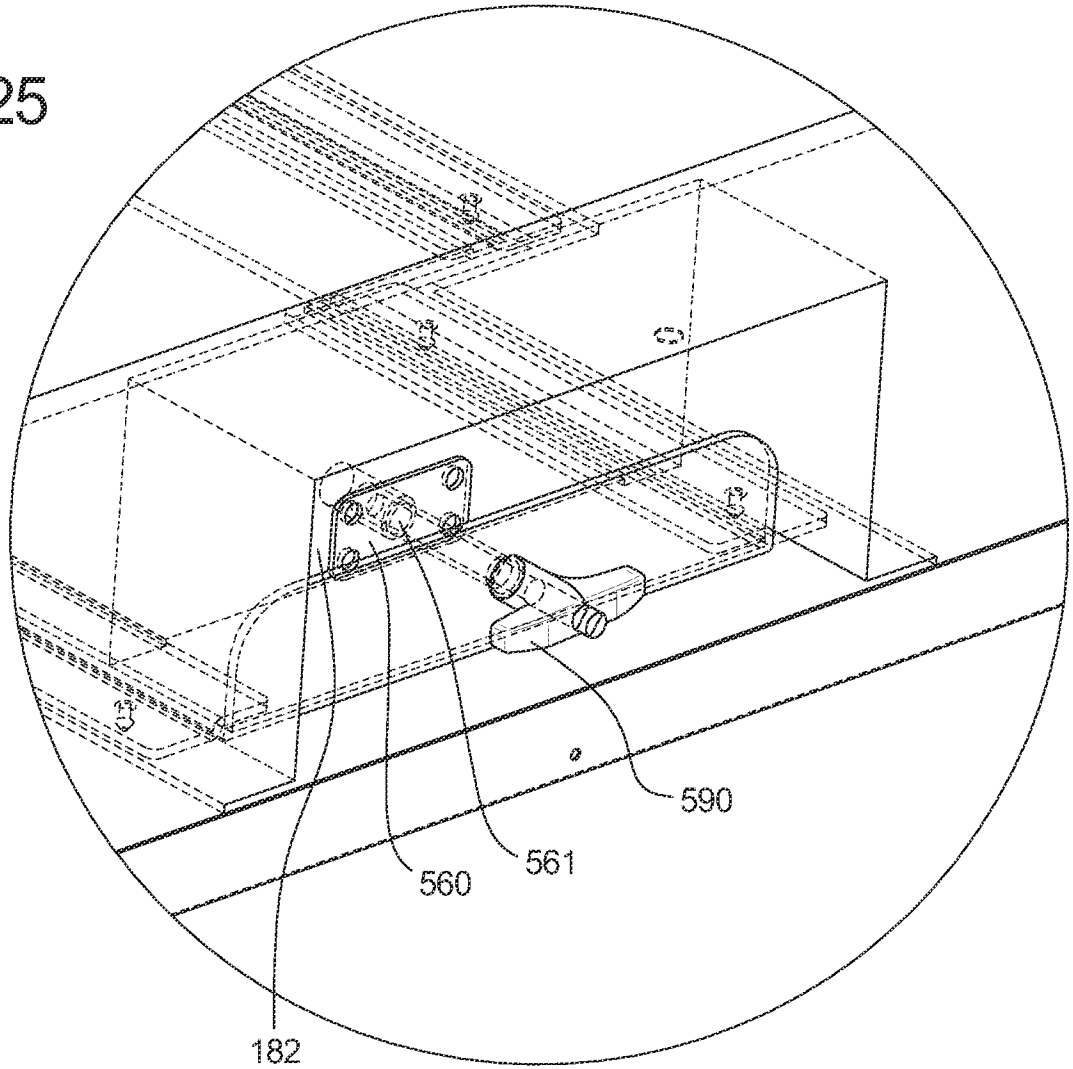
FIG. 25 is an enlarged fragmentary perspective view of the central portion of the pallet and a part of the bottom compartment of the shipping container of FIG. 1, and illustrating the locking pin of the handle of the gate of the material unloading assembly.
Figure 26:
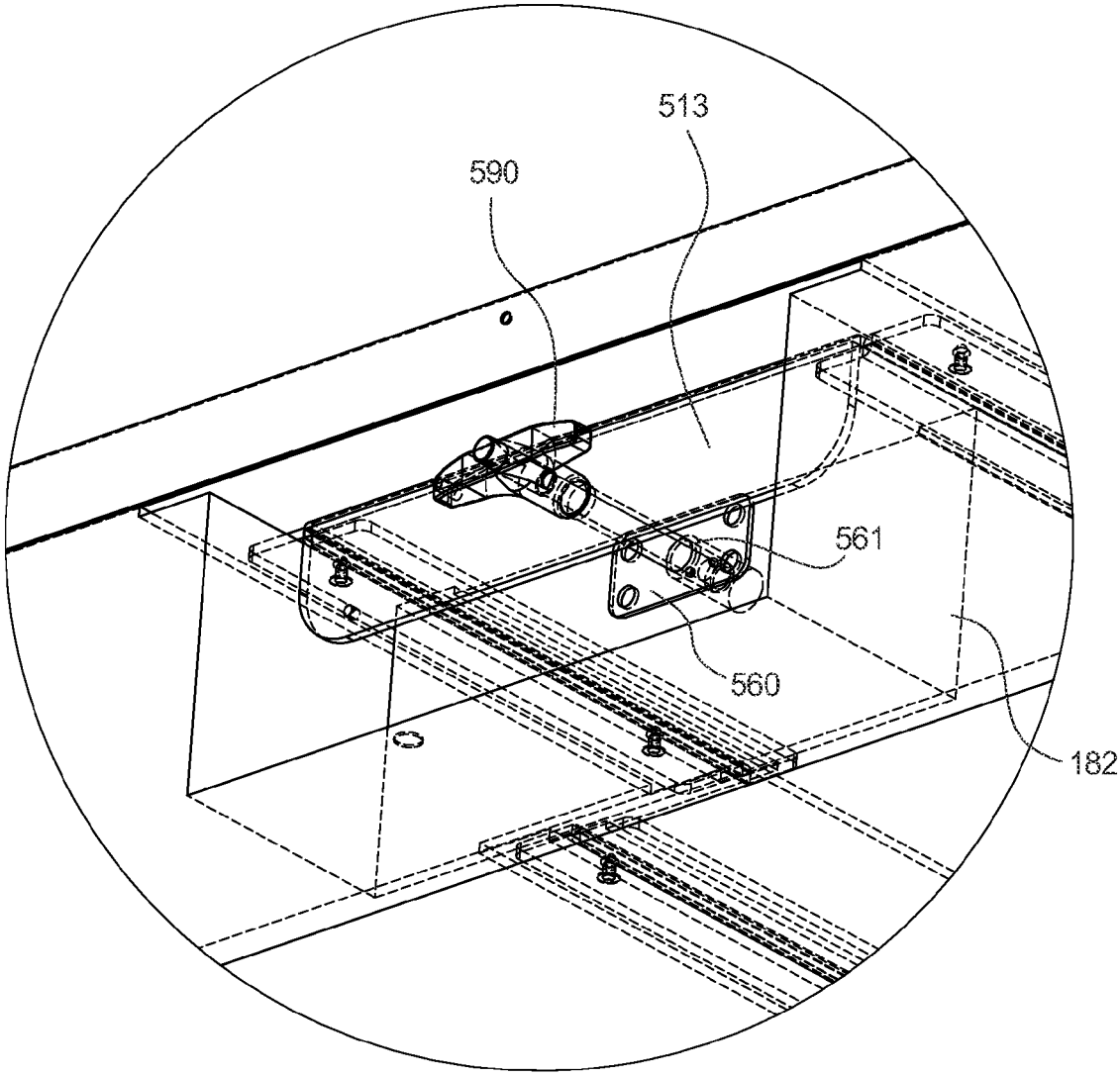
FIG. 26 is an enlarged fragmentary perspective view of the central portion of the pallet and a part of the bottom compartment of the shipping container of FIG. 1, and illustrating the locking pin of the handle of the gate of the material unloading assembly.

The material unloading assembly 500 also includes a locking assembly 550 configured to enable a user to lock the gate 510, and specifically the handle portion 512 of the gate 510 to the stopping wall 182 of the pallet 510 to prevent the handle portion 512 and the gate 510 from being accidentally opened at undesired points in time such as: (a) during loading of the container 50; (b) during transit of the container 50; or (c) at any other point in time prior to an unloader opening the gate 510. More specifically, as best seen in FIGS. 10A, 11, 12, 14, 15, 16, 17, 18, 20A, 20B, 20C, 20D, 24, 25, and 26, the handle portion 512 of the gate 510 includes a downwardly extending handle 513 which is configured to be gripped by a user to open and close the gate 510. The downwardly extending handle 513 defines a centrally located opening 514 (as best shown in FIG. 20A). The material unloading assembly 500 also includes a stopping plate 560 attached to the outside surface of the stopping wall 182. The stopping plate 560 includes an opening 561 aligned with the centrally located opening 514 of the handle 513 of the handle portion 512 of the gate 510. The stopping wall 182 also includes a hole which is larger than the hole 561 in the stopping plate 560 and is configured to receive a locking pin 590. More specifically, the material unloading assembly 500 further includes a locking pin 590 configured to be inserted through: (a) the centrally located opening 514 of the handle 513 of the handle portion 512 of the gate 510; (b) the opening 561 in the stopping plate 560; and (c) an opening 183 in the stopping wall 182, when the gate 510 is in the closed position. This locking pin 590 engages the rear surface of the stopping plate 560 to prevent unwanted opening of the gate 510. When the user desires to open the gate 510, the user activates the locking pin 590 and fully or partially removes the locking pin 590 from the stopping wall 182 and the stopping plate 560. It should be appreciated that as shown in the various figures, the locking pin 590 can be left in the handle 513 of the gate 510. It should also be appreciated that the locking pin can be placed in a different hole in the handle of the gate 510. It should further be appreciated, that although not shown, the material unloading assembly can further include one or more guides for holding the locking pin 590 level or otherwise in position for easy re-insertion when the gate 510 is in a fully open or partially open position. It should be appreciated that the locking pin can be commercially obtained from MCMASTER-CARR, and that any other suitable locking pin may be employed.

It should also be appreciated that by pushing the handle back toward the closed position, the chute can be closed or partially closed. It should also be appreciated that placing the handle in a partially open or partially closed positioned enables the user to control the rate of emptying the materials from the container 50.

Turning now to FIGS. 1, 2, 3, 4, 5, 8, 28, 29, 30, 31, and 32, the top compartment 300 is supported by a plurality of top compartment supporting assemblies 400*a*, 400*b*, 400*c*, and 400*d* which are each configured to support a different one of the corners of the top compartment 300 and to hold the top compartment 300 in the expanded position. In the illustrated embodiment, each top compartment support assembly 400*a*, 400*b*, 400*c*, and 400*d* is identical; however, it should be appreciated that two or more of these support assemblies may be different. Support assembly 400*a* is discussed herein as an example.

Figure 31:
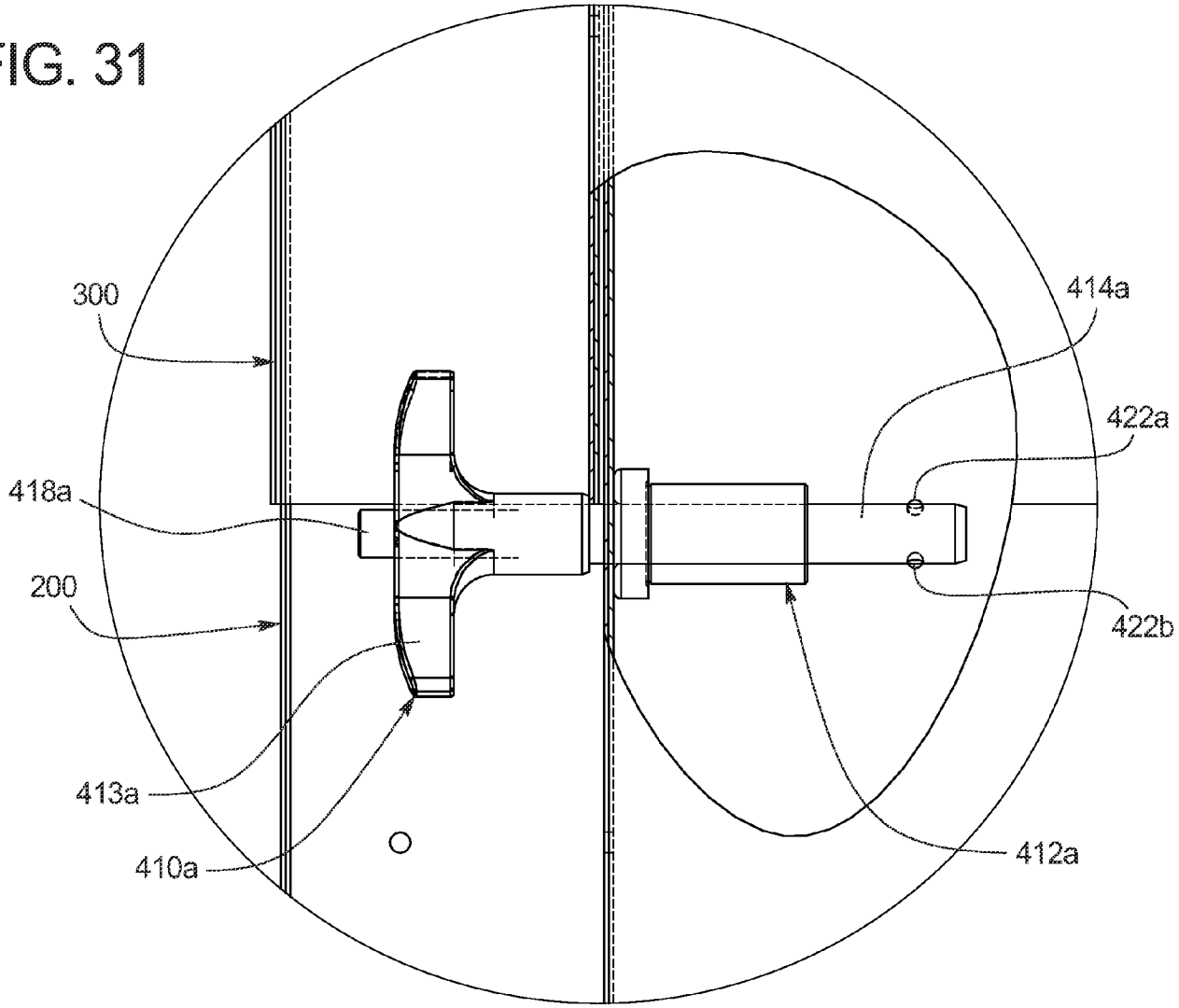
FIG. 31 is an enlarged fragmentary partially cut away view of one of the locking pins of one of the top compartment support assemblies inserted in a pin receipt of one of the corners of the bottom compartment of the shipping container of FIG. 1, and illustrating the locking pin in a locked position and supporting the corner of the top compartment.
Figure 32:
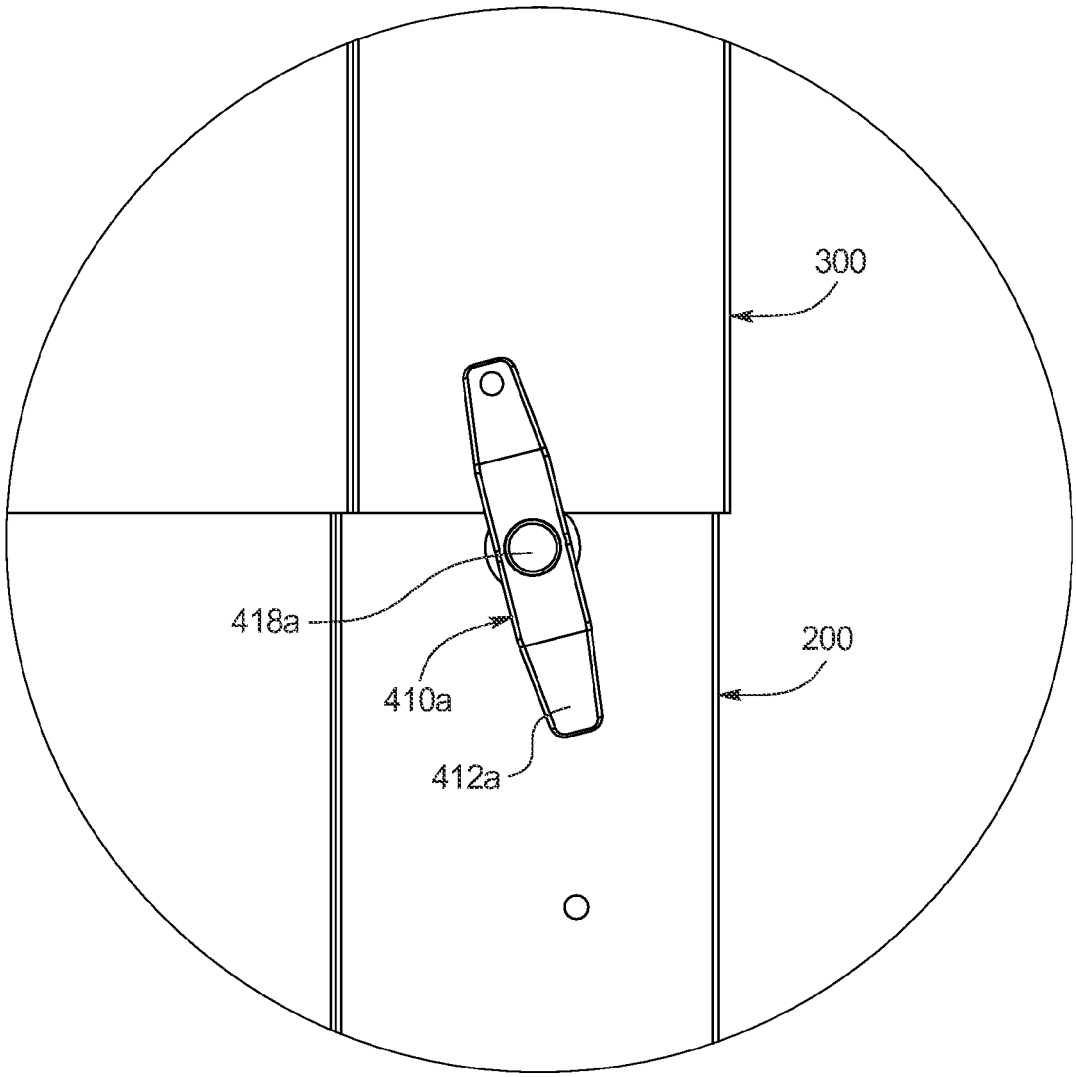
FIG. 32 is an enlarged fragmentary view of one of the locking pins of one of the top compartment support assemblies inserted in a pin receipt of one of the corners of the bottom compartment of the shipping container of FIG. 1.

Support assembly 400*a* includes a support pin 410*a* configured to be inserted through a pin receipt or pin receipt hole 450*a* (at least shown in FIGS. 8 and -27B) in the corner of the bottom compartment 200 and into a tubular support pin receiver or sleeve 412*a* of the support assembly 400*a* which is suitably attached (such as by welding) to the inside of the corner of the bottom compartment 200 as best illustrated in FIG. 31. It should be appreciated that the configuration and size of the support pin receiver can vary in accordance with the present disclosure. For example, the support pin receiver can be in the form of a flat plate (not shown) attached to the inside of the corner of the bottom compartment.

The support assembly 400*a* further includes a support pin holder 430*a* and a tether 460*a* attaching the support pin 420*a* to the support pin holder 430*a*. It should be appreciated that the support pin holder 430*a* and the tether 460*a* are employed to prevent the support pin 410*a* from being lost and to hold the support pin 410*a* out of the way of the bottom compartment 200 when the support pin 410*a* is not in use, and that in alternative embodiments, the shipping container of the present disclosure does not employ the support pin holders or the tethers. It should also be appreciated that FIGS. 1, 2, 3, 4, 5, 8, 34, 41, 42, 43, 44, 45, and 46 either have a line representing the tether or that the tether is removed from these figures for ease of illustration.

More specifically, in the illustrated embodiment, the support pin holder 430*a* includes an L-shaped body having a mounting member 432*a* attached to the corner of the top compartment 300 and a pin holder 434*a* connected to the mounting member 432*a*. The pin holder 464*a* defines a first hole 436*a* for attachment of the one end of the tether 430*a* and a second hole 438*a* for removably holding the support pin 410*a* when the support pin 410*a* is not in use. This support pin holder 430*a* is made from stainless steel or galvanized steel, and welded to the corner of the top compartment 300. It should be appreciated that the pin holder 434*a* could be made from other suitable materials, could be suitably attached to the top compartment in other suitable manners or locations and could be alternatively configured. In this illustrated embodiment, the pin holder is made of stainless steel or galvanized steel to: (a) facilitate attachment or connection of this part by welding and/or suitable fasteners to the top compartment; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, the pin holder can be made from other suitable materials and attached or connected to the top compartment in other suitable manners The tether 460*a* includes two end loops 462*a* and 464*a*. End loop 462*a* is attached to the support pin holder 430*a* and end loop 464*b* is attached to the support pin 410*a*. The tether 460*a* may be any suitable length and made from any suitable material such as steel or a high strength plastic.

The support pin 410*a* in the illustrated embodiment includes a handle 413*a*, a tubular body 414*a* attached to the handle 412*a*, and a locking mechanism 416*a* extending through the handle 413*a* and tubular body 414*a*. The locking mechanism 416*a* includes a release button 418*a* in and extending from the handle 413*a*, an actuation shaft (not shown) connected to the release button 418*a*, and a plurality of locking balls 422*a* and 422*b* extending transversely from the from the tubular body 414*a* adjacent to the end of the tubular body 414*a* opposite the handle 413*a*. The locking mechanism 416*a* is configured such that the locking balls 422*a* and 422*b* are normally biased by a spring (not shown) toward the outwardly extending locked position as shown in FIG. 31, and such that when the release button 418*a* is pressed, the locking balls 422*a* and 422*b* are allowed to recede inwardly into the tubular member 414*a* and specifically into cavities (not shown) in the actuation shaft 420*a* to enable the support pin 410*a* to be removed. The locking balls 422*a* and 422*b* are configured to engage the inner surface of the tubular support pin receiver 412*a* of the support assembly 400*a* to prevent the support pin 410*a* in the locked position from being easily removed or removed without actuation of the locking mechanism 416*a* and specifically the release button 418*a*. Pins of this type are readily commercially available such as from MCMASTER-CARR. It should be appreciated that other suitable support pins may be employed with the container in accordance with the present disclosure.

The container 50 includes an extension assembly 700 which enables a user or loader to move the top compartment from the retracted position to the expanded position to enable insertion of these support pins as further described below.

Figure 33:
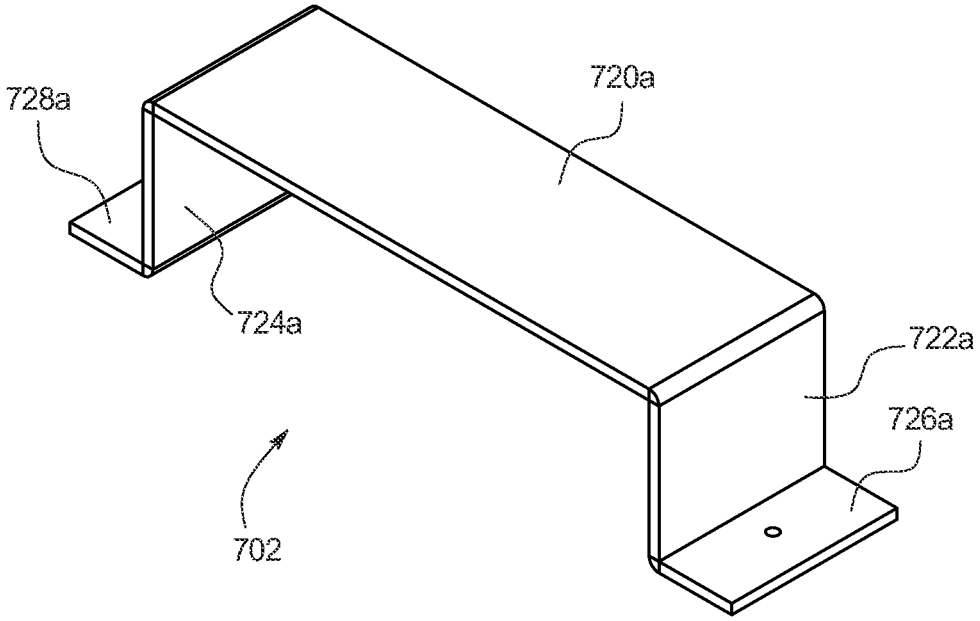
FIG. 33 is an enlarged perspective view of one of the fork lift receiving tines or lifting brackets of the extension assembly of the shipping container of FIG. 1.
Figure 34:
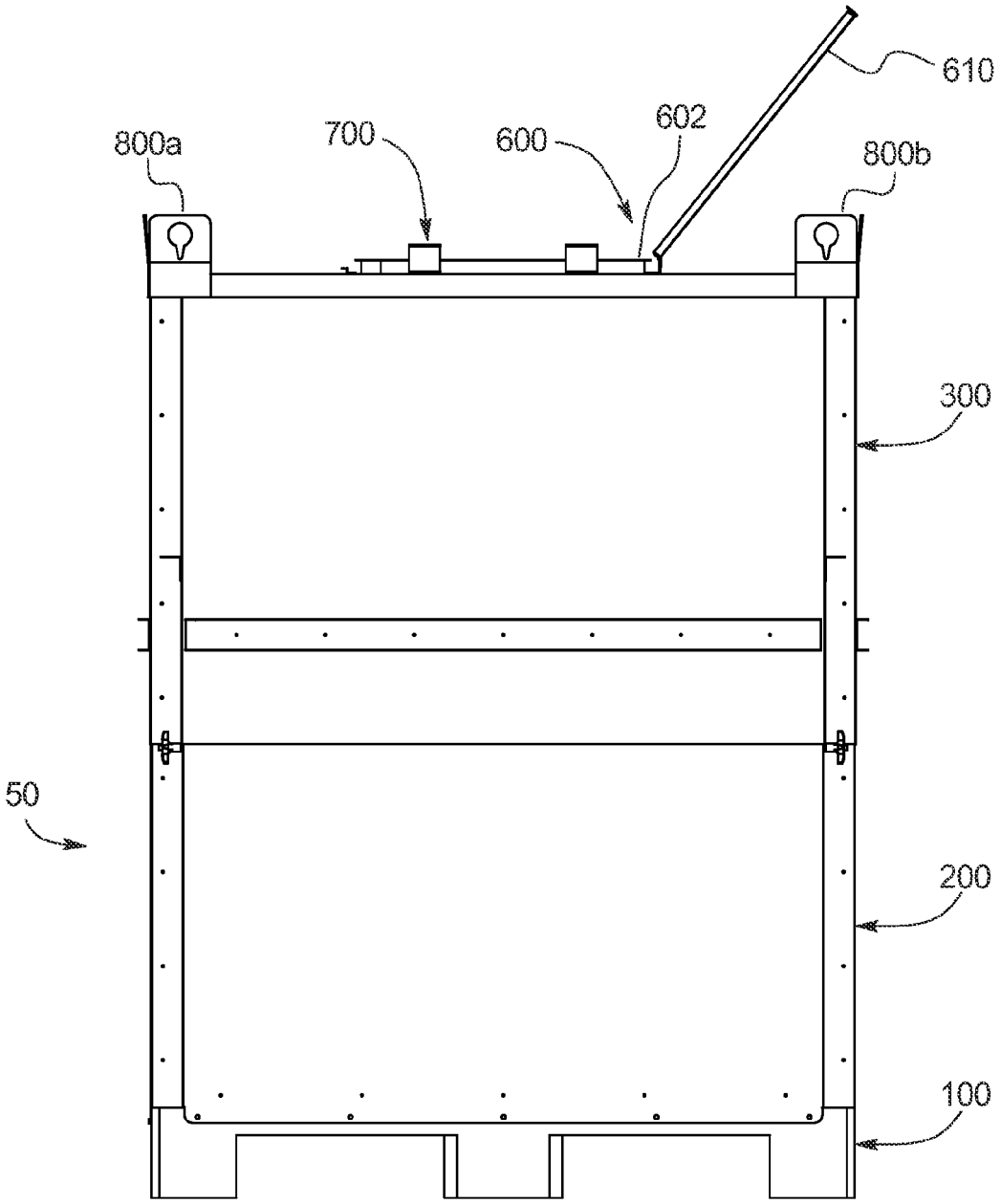
FIG. 34 is a left side view of the shipping container of FIG. 1, illustrating the top compartment in the expanded position relative to the bottom compartment, and the cover of the material unloading assembly in an open position.
Figure 35:
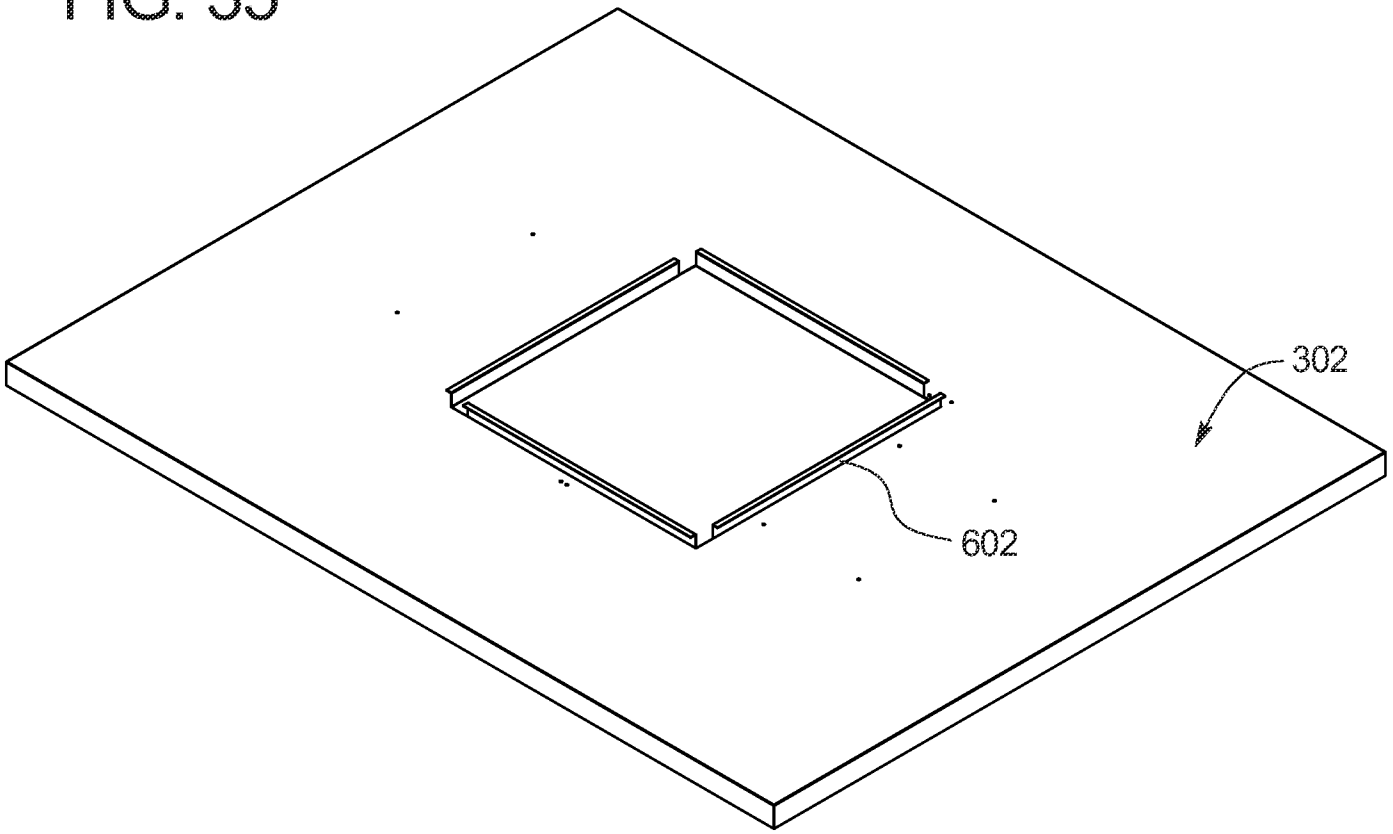
FIG. 35 is a top perspective view of the top wall of the top compartment of the shipping container of FIG. 1, shown removed from the top compartment and illustrating the opening in the top wall and the lip of the material loading assembly extending from the top wall and which is configured to be securely engaged by the cover of the material loading assembly.
Figure 36:
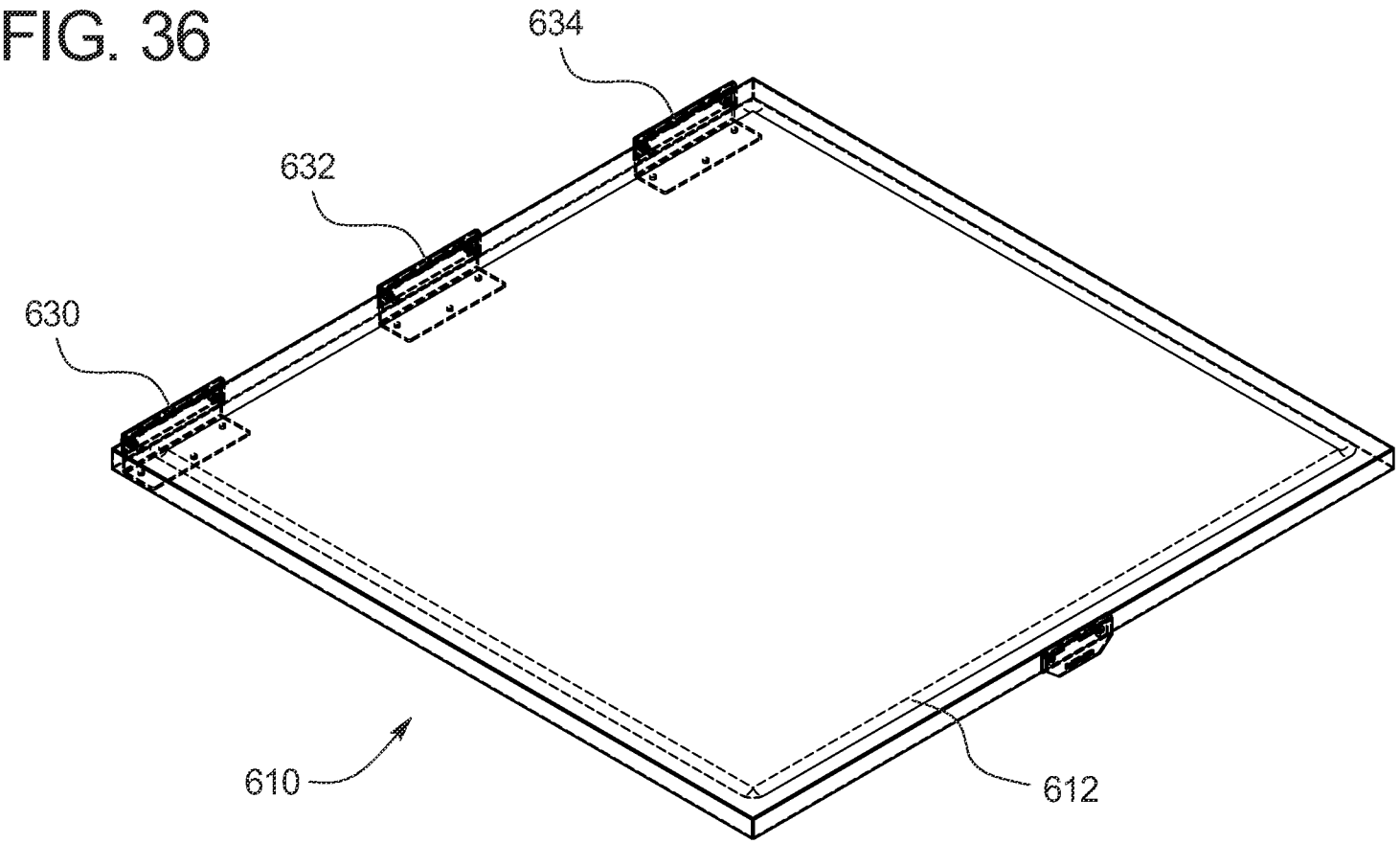
FIG. 36 is a top perspective view of the cover of the material loading assembly of the shipping container of FIG. 1, shown removed from the top compartment and illustrating in phantom the channel of the cover which is configured to receive the lip of the of the material loading assembly attached to the top compartment for secure engagement by the cover.
Figure 37:
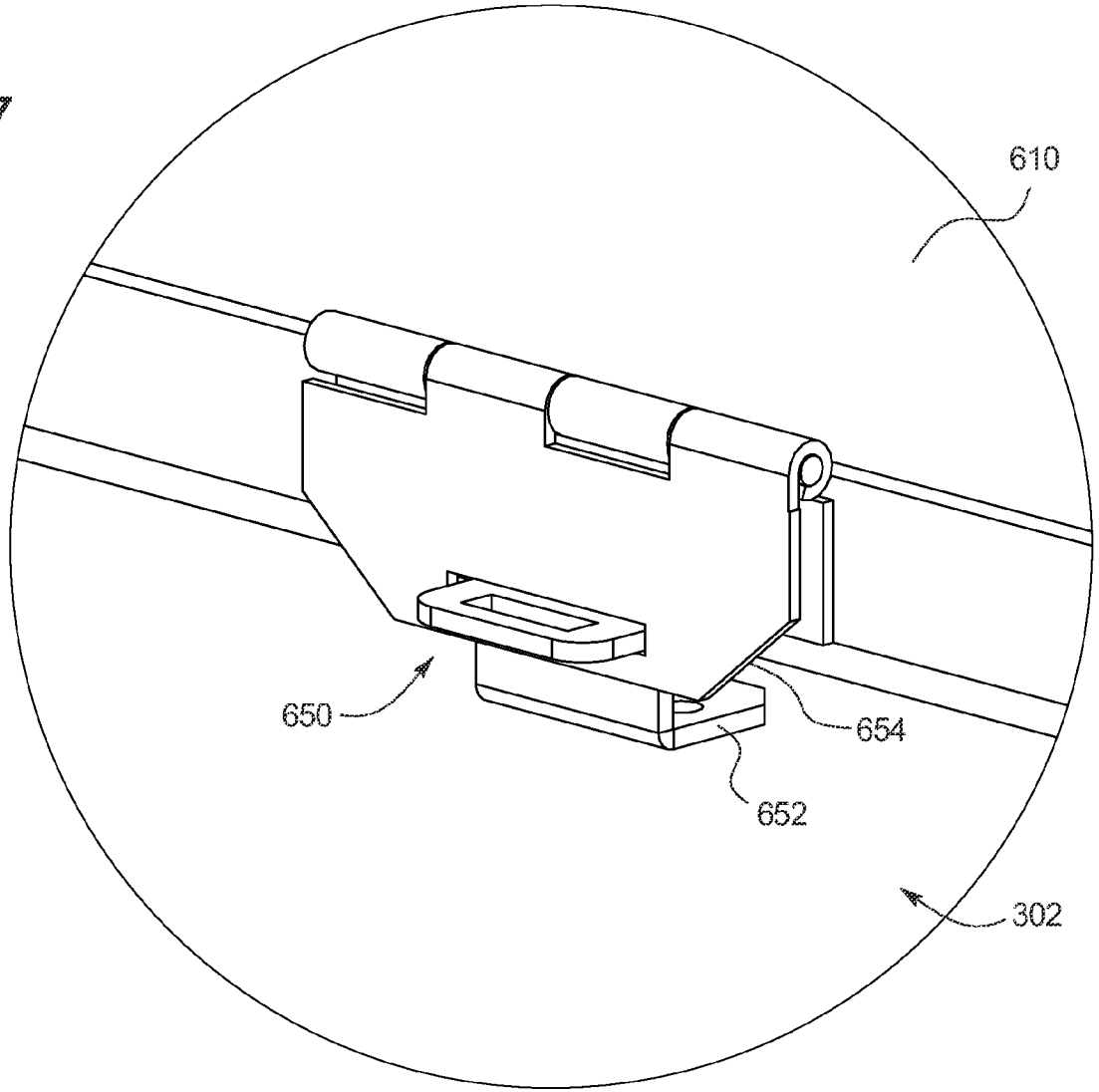
FIG. 37 is an enlarged fragmentary perspective view of the locking assembly of the material loading assembly of the shipping container of FIG. 1, shown in the closed position.

Turning now to FIGS. 1, 4, 5, 6, 8, and 33, the extension assembly 700 of the container 50 includes a first set of aligned fork lift tine receiving loops or lifting brackets 702 and 704 and a second set of aligned forklift tine receiving loops or lifting brackets 706 and 708. Each of the lift tine receiving loops or lifting brackets 702, 704, 706, and 708 are identical in this illustrated embodiment, but it should be appreciated that these components can be different. FIG. 33 illustrate example fork lift tine receiving loop or lifting bracket 702, which includes a crossbar 720*a*, end bars 722*a* and 724*a* attached to the opposite ends of the crossbar 720*a* and mounting bars 726*a* and 728*a* respectively attached to the opposite ends of the end bars 722*a* and 724*a*. In this embodiment, these loops or lifting brackets are made of stainless steel or galvanized steel and the mounting bars are each suitably welded to the top wall 302 of the top compartment 300. The loops or lifting brackets are suitably aligned to form two slots configured to receive forklift forks or tines. These loops enable a loader operating a fork lift to insert the forks of the forklift through the loops and to lift the top compartment from the retracted position to the expanded position. These aligned slots enable a forklift to lift the top compartment of the container from either the front or back. It should be appreciated that the outside surfaces of the container can include suitable markings to indicate to the loader the appropriate expanded position of the top compartment. As mentioned above, in this illustrated embodiment, these loop are all made of stainless steel or galvanized steel to: (a) facilitate attachment or connection of these parts by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these loops can be made from other suitable materials and that these components can be attached or connected in other suitable manners.

As further described below, when the operator lifts the top compartment upwardly from the retracted position to the expanded position, the locking assemblies described above can then be employed to support and lock the top compartment in the expanded position and to prevent the top compartment from moving back into the retracted position. More specifically, when a user such as a loader of the shipping container 50 desires to move the top compartment from the retracted position to the expanded position, the user uses a fork lift or other lifting apparatus to engage the extension assembly 700 to lift the top compartment 300 such that the bottom corners of the top compartment 300 are above the pin receipt holes in the four corners of the bottom compartment 200. The user then sequentially takes each support pin out of the respective pin holder, presses the button on the support pin and inserts the support pin in the respective pin receipt hole. It should be appreciated that this is easily and quickly performed by a single person. Thus, it should be appreciated that: (a) a single loader can move the top compartment into the expanded position by lifting the top compartment (using a fork lift); (b) the single loader can engage the support pins of the top compartment supporting assemblies to lock the top compartment in the expanded position; and (c) that prior to unloading the materials, a single un loader can disengage the support pins from the bottom compartment to un-lock the top compartment from the expanded position and release the top compartment from the expanded position, which enables the top compartment to slowly move to the retracted position as the materials empties from the top and bottom compartments. This also prevents the top compartment from rapidly dropping if the support pins are released when no materials are in the compartments. It should further be appreciated that enabling a single person to perform this operation provide a significant advantage in terms of time and cost over certain prior known bulk material shipping containers.

Turning now to FIGS. 1, 4, 5, 6, 8, 34, 35, 36, and 37, the material loading assembly 600 is generally attached to the top compartment 300 and generally includes: (a) an upwardly extending lip 602 attached to and extending from the top wall 302 of the top compartment 300; (b) a cover 610 configured to securely engage the upwardly extending lip 602 and pivotally attached to the top wall 302 of the top compartment 300 by a plurality of hinges 630, 632, and 634; (c) a lock assembly 650 including a first portion 652 attached to the top wall 302 of the top compartment 300 and a second portion or lid latch 654 pivotally attached to the cover 610; (d) and a gasket (not shown) mounted in the cover 610 to seal out contaminants. The cover 610 defines a channel 612 configured to receive the lip 602. The gasket is mounted in the channel 612 to facilitate the seal between the cover 610 and the lip 602. It should be appreciated that although the illustrated lip 602 is shown in sections with spaces there between, additional material is preferably welded to the illustrated sections of the lip 602 to form a continuous lip. The locking assembly 650 includes a suitable lock (not shown) which is used to lock the cover 610 in the closed position, and specifically to lock the second portion or lid latch 654 attached to the cover to the first portion 652 attached to the top wall 302 of the top compartment 300. It should be appreciated that any suitable lock may be employed and that alternative configurations for the locking assembly may be employed in accordance with the present disclosure. In this illustrated embodiment, these components (except the gasket and the lock) are all made of stainless steel or galvanized steel to: (a) facilitate attachment or connection of these parts by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these components can be made from other suitable materials and that these components can be attached or connected in other suitable manners. It should further be appreciated that the shape of the cover may vary in accordance with the present disclosure.

Figure 38:
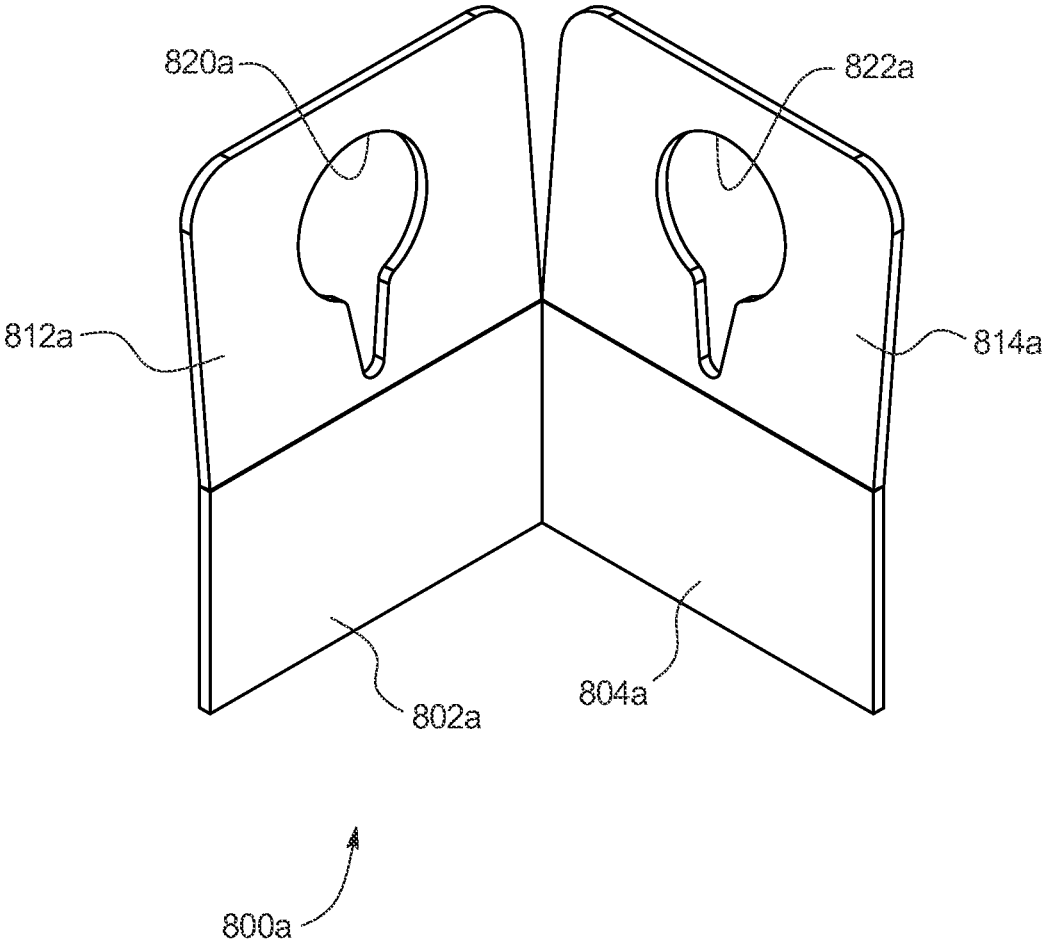
FIG. 38 is an enlarged perspective view of one of the nesting or stacking guides of the shipping container of FIG. 1, shown removed from the top compartment and illustrating the bag end holders defined by the nesting or stacking guides.
Figure 39:
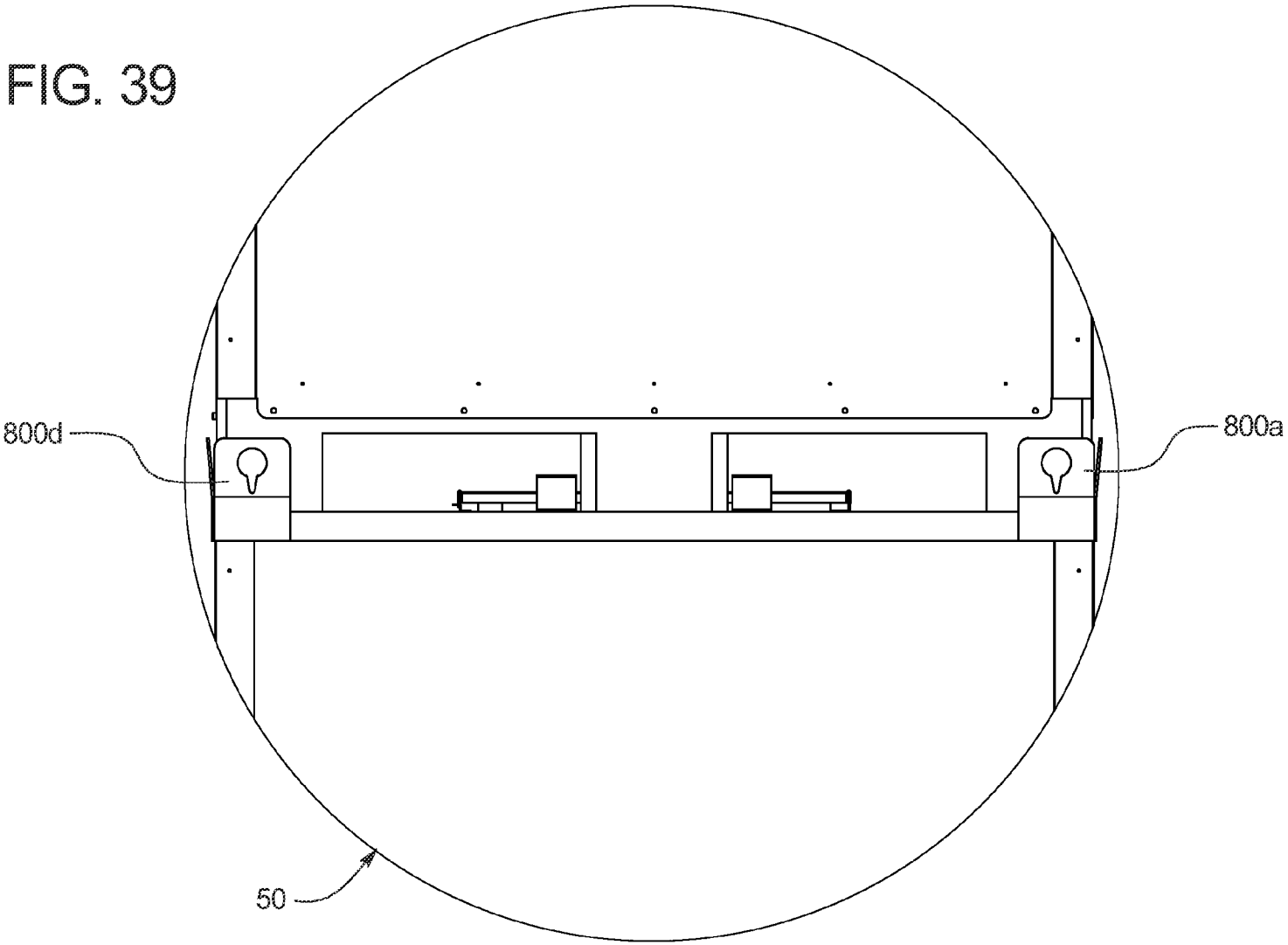
FIG. 39 is an enlarged fragmentary side view of a portion of the top compartment of a first shipping container of FIG. 1 and a portion of the pallet and lower compartment of a second shipping container of FIG. 1 shown stacked on the top compartment of the first shipping container.
Figure 40:
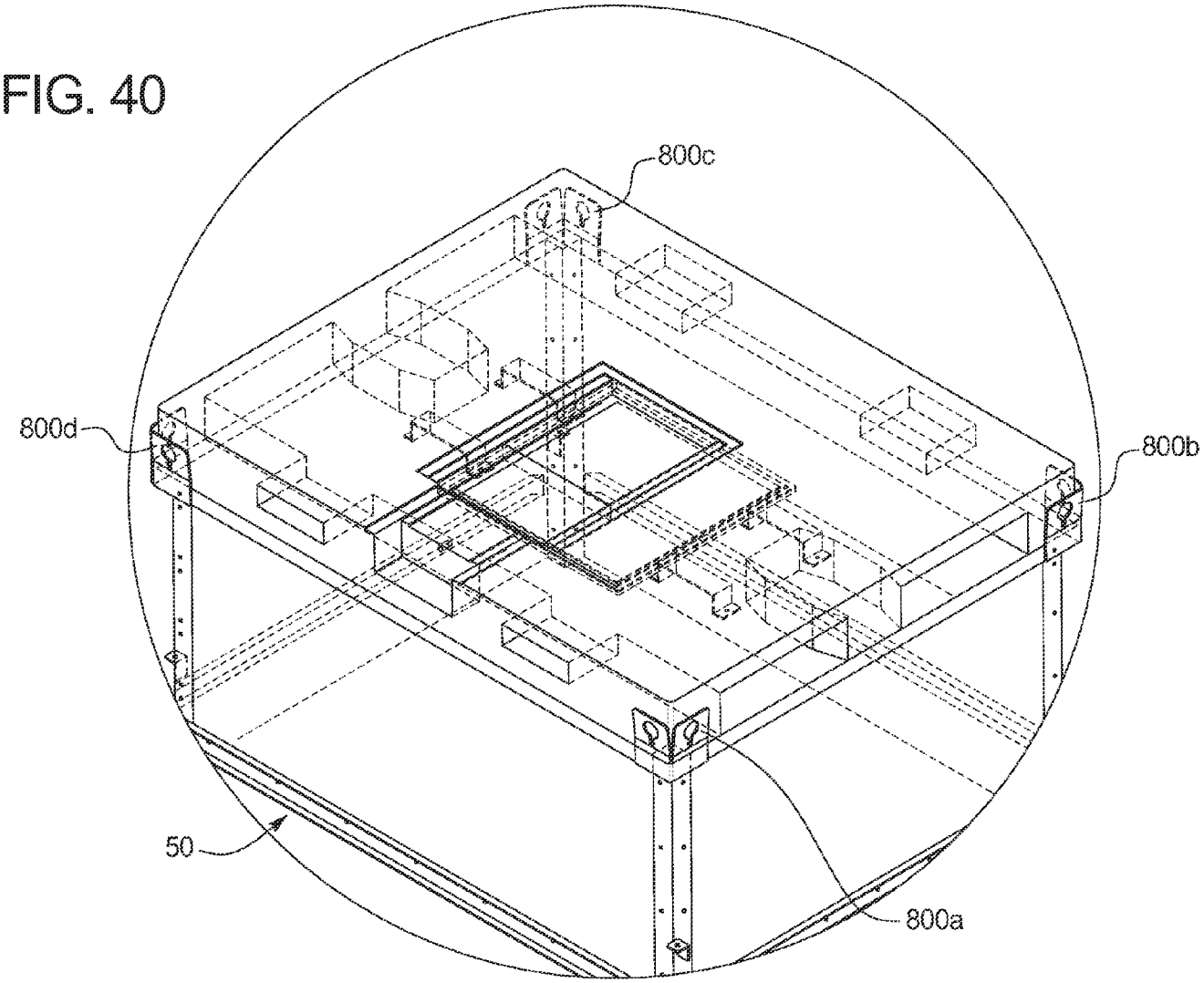
FIG. 40 is an enlarged fragmentary perspective view of a portion of the top compartment of a first shipping container of FIG. 1 and a pallet of a second shipping container of FIG. 1 shown stacked on the top compartment of the first shipping container.

Turning now to FIGS. 1, 3, 4, 5, 6, 8, 34, 38, 39, and 40, the container 50 includes a plurality of nesting or stacking or guides 800*a*, 800*b*, 800*c*, and 800*d* which are configured to facilitate secure stacking of the containers of the present disclosure as well as stacking of other known bulk material containers. In the illustrated embodiment, each of the stacking guides 800*a*, 800*b*, 800*c*, and 800*d* is identical; however, it should be appreciated that two or more of these stacking guides may be different. As generally shown in FIGS. 39 and 40, the stacking guides assist in positioning one container of the present disclosure on top of another container of the present disclosure.

Figure 42:
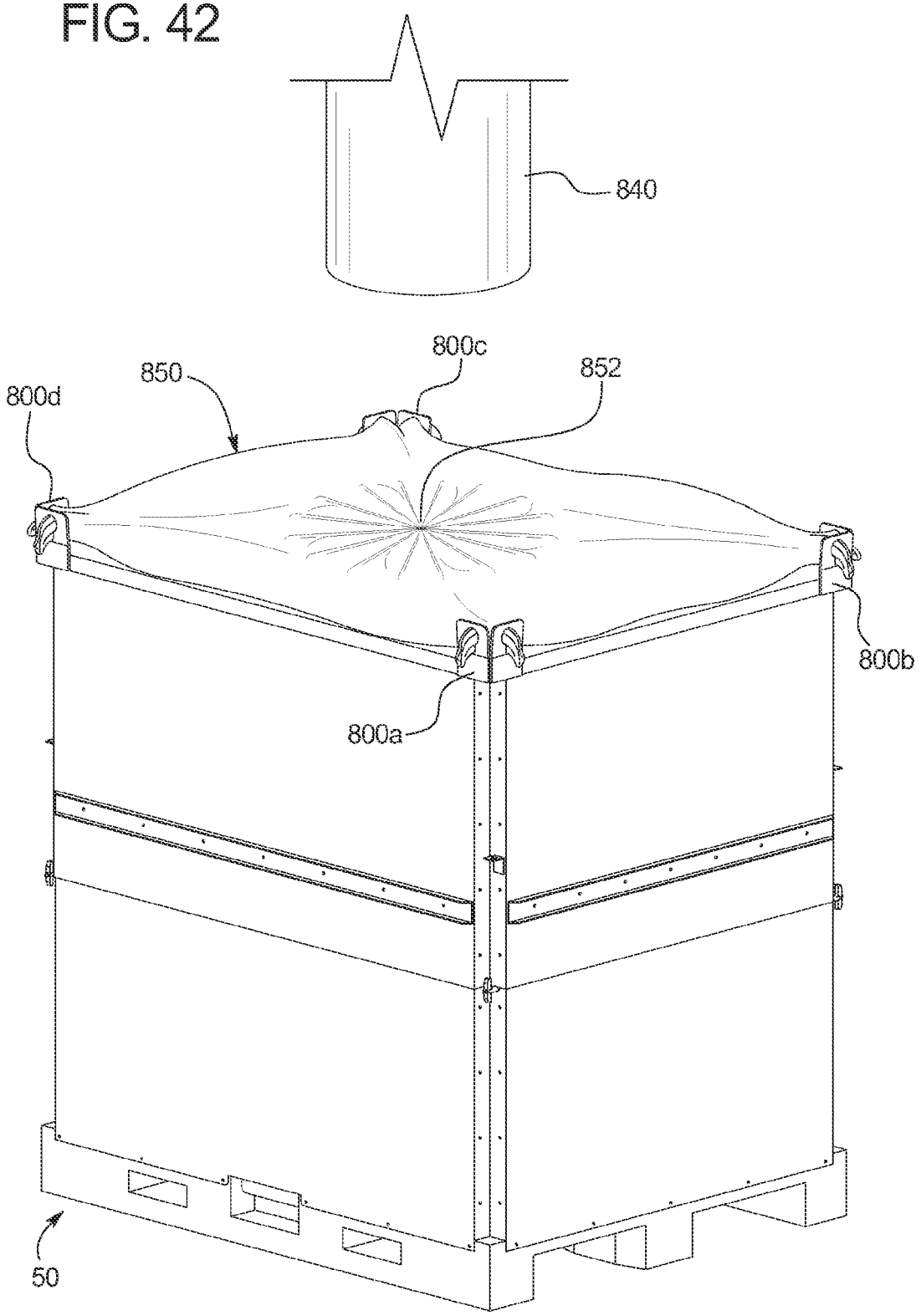
FIG. 42 is a perspective view of the shipping container of FIG. 1 and a bag positioned with its ends extending through the stacking guides, and with the cover of the material loading assembly removed for ease of illustration.

More specifically, stacking guide 800*a* is discussed herein as an example stacking guide. As best shown in FIG. 38, stacking guide 800*a* include mounting walls 802*a* and 804*a* configured to be attached to the corner of the top compartment 300 and guide wall 812*a* and 814*a* respectively attached to and extend from the mounting walls 802*a* and 804*a*. In this illustrated embodiment, the guide wall 812*a* and 814*a* each respectively define bag holding slots 820*a* and 822*a*. These slots are configured to receive and hold a top section of a bag during the filling process to secure the bag in the desired position as the loader fills the bag and the container with materials to the desired height (as generally illustrated in FIG. 42 and as further described below). In this illustrated embodiment, the stacking guides are all made of stainless steel to: (a) facilitate attachment or connection of these parts to the top compartment by welding and/or suitable fasteners; (b) provide structural strength and rigidity; (c) facilitate ease of cleaning; (d) facilitate ease of repair; (e) prevent rusting; (f) minimize overall weight of the container; and (g) prevent contamination. However, it should be appreciated that in alternative embodiments, one or more of these stacking guides can be made from other suitable materials and that these components can be attached or connected in other suitable manners.

It should be appreciated that the container 50 and the nesting or stacking guides 800*a*, 800*b*, 800*c*, and 800*d* of the container 50 are configured to receive or be stacked with known bulk material containers such as the known bulk material container described in the background section of this document. It should be appreciated that as shown in FIGS. 39 and 40, the container of the present disclosure is configured such that a fork lift can be employed to place one container on top of another container and to lift one container from another container without damaging the material loading assembly attached to the top compartment of the lower container, and without damaging the extension assembly attached to the top compartment of the lower container.

Figure 41:
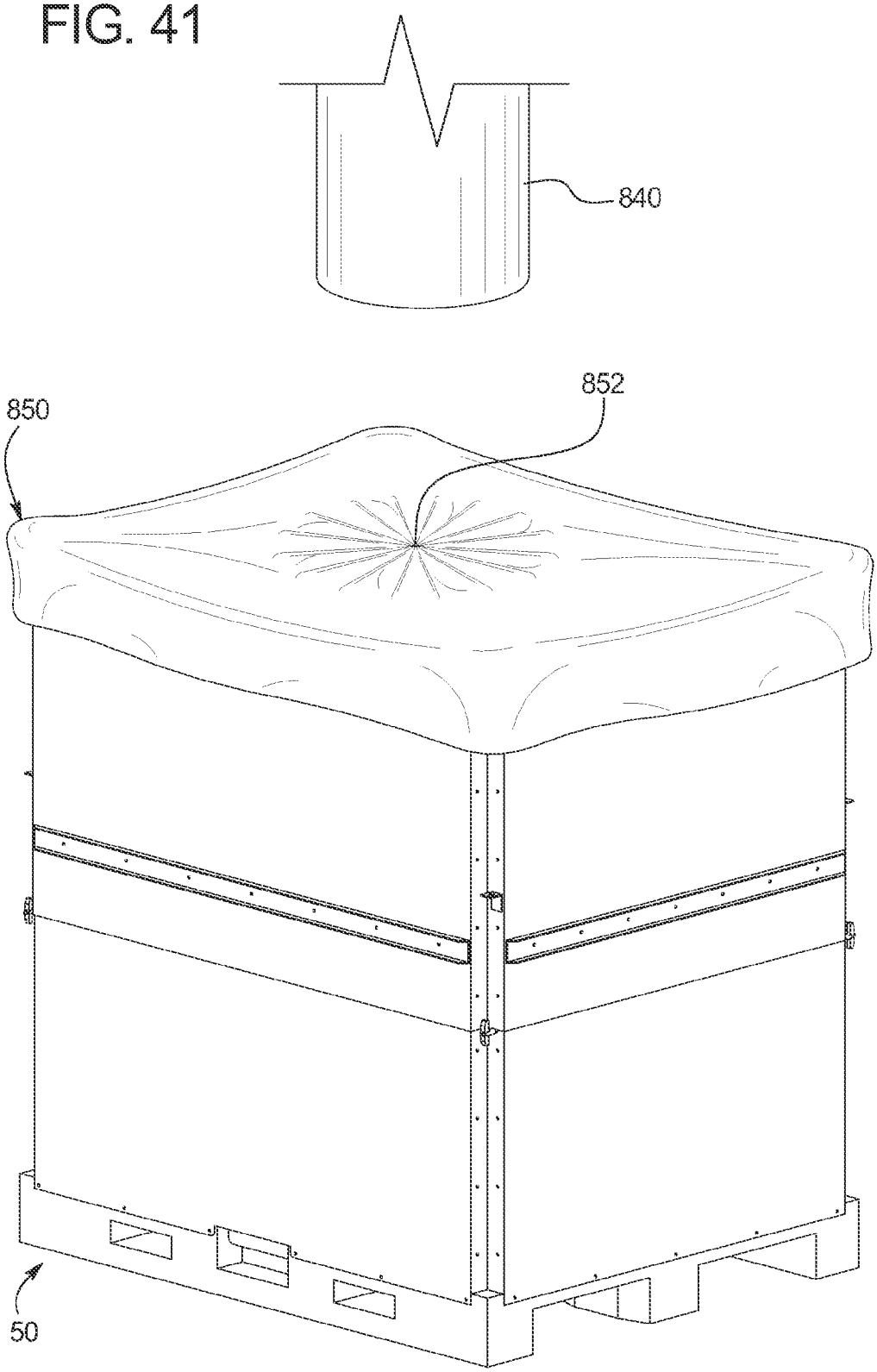
FIG. 41 is a perspective view of the shipping container of FIG. 1 and a bag positioned over the stacking guides, and with the cover of the material loading assembly removed for ease of illustration.

Turning now to FIG. 41, the container 50 is illustrated with a bag 850 shown draped over the stacking guides 800*a*, 800*b*, 800*c*, and 800*d*. The stacking guides 800*a*, 800*b*, 800*c*, and 800*d* act as holders and guides for the bag 850 during the loading process. It should be appreciated that the center of the bag 852 is positioned over the opening in the top compartment and under a loading tube 890. It should also be appreciated that the cover of the material loading assembly has been removed for ease of illustration.

Turning now to FIG. 42, the container 50 is illustrated with a bag 850 shown with each end respectively extending through the stacking guides 800*a*, 800*b*, 800*c*, and 800*d*. The stacking guides 800*a*, 800*b*, 800*c*, and 800*d* act as holders and guides for the bag 850 during the loading process. Again, in this FIG. 42, the center of the bag 852 is positioned over the opening in the top compartment and under a loading tube 890. It should be appreciated that the cover of the material loading assembly has been removed for ease of illustration.

Figure 43:
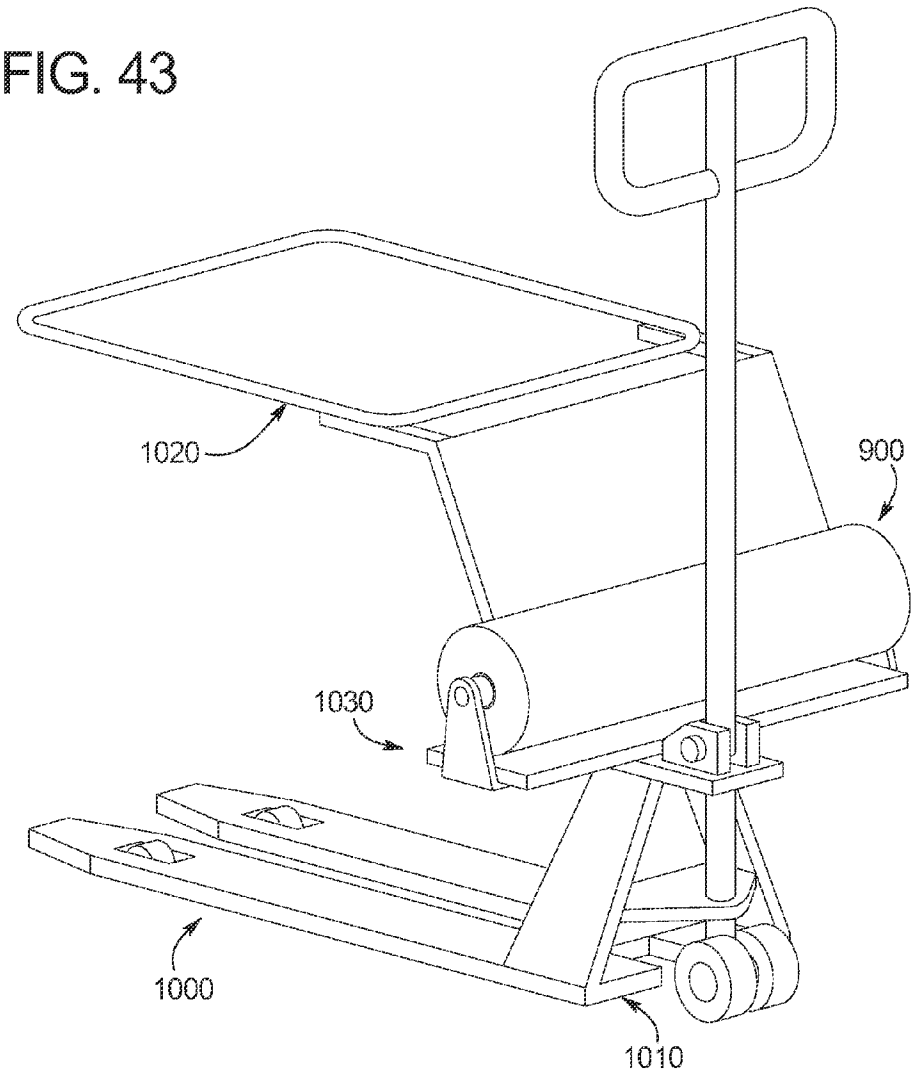
FIG. 43 is a perspective view of the shipping container of FIG. 1 and a bag holder of one embodiment of the present disclosure which is configured to hold a roll of bags.
Figure 43:
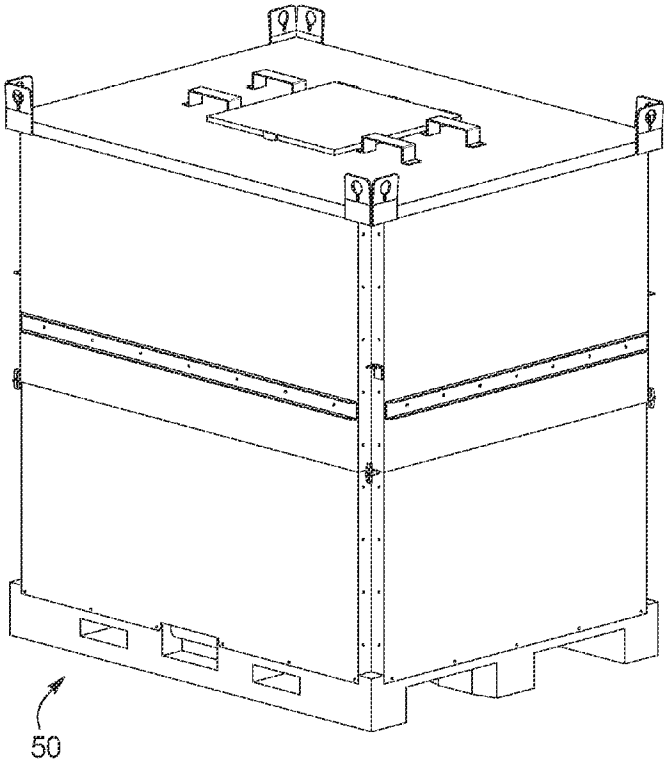
Figure 44:
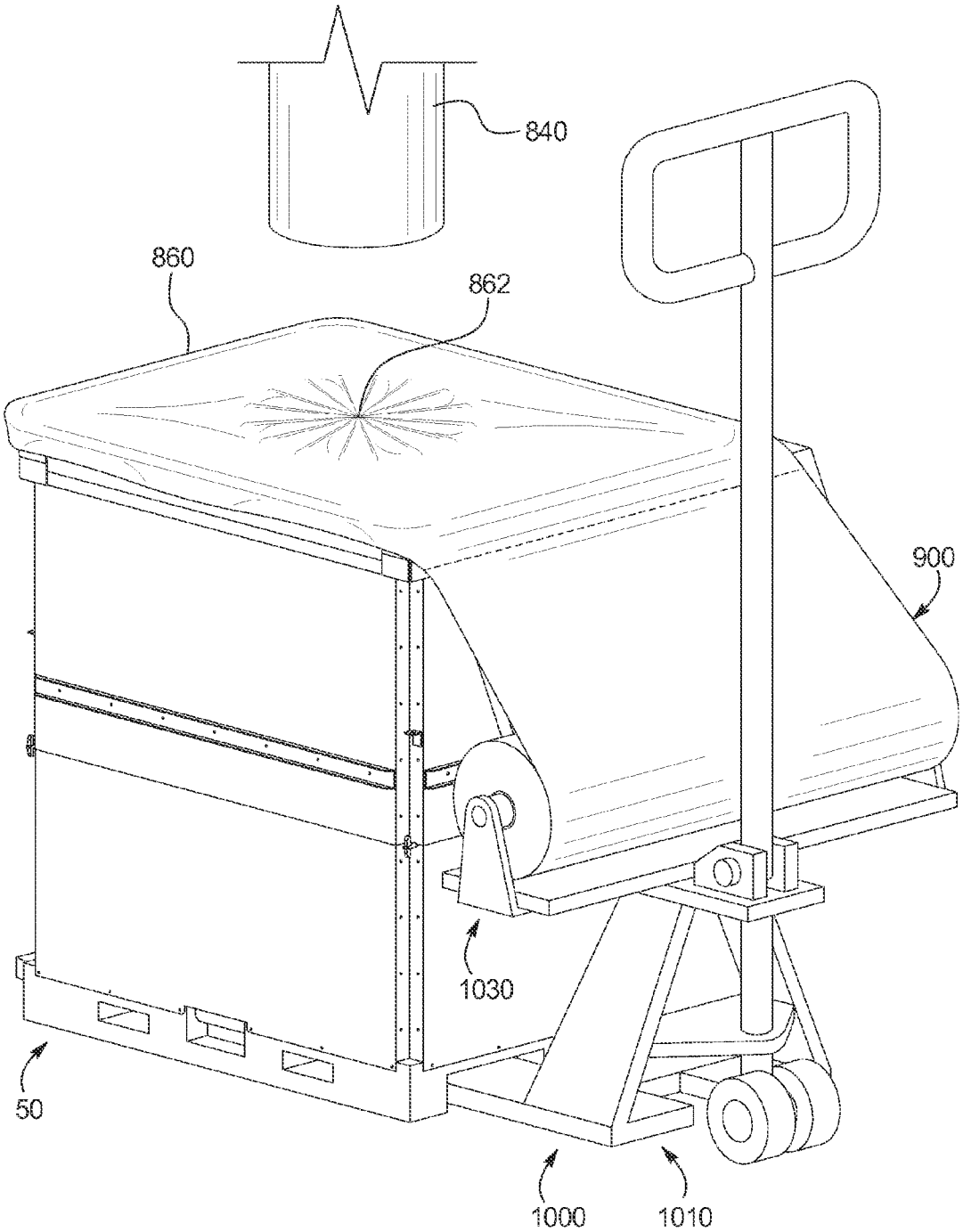
FIG. 44 is a perspective view of the shipping container of FIG. 1 and the bag holder of FIG. 43, and illustrating how the bag holder of FIG. 41 holds one of the bags over the shipping container during the material loading process, and with the cover of the material loading assembly removed for ease of illustration.

Turning now to FIGS. 43 and 44, one example embodiment of a bag holder of the present disclosure is generally illustrated and indicated by numeral 1000. The bag holder 1000 is configured to hold a supply roll of bags 900 and to sequentially provide each of the bags from the supply roll 900 for positioning over the shipping container during the material loading processes. The first bag 860 of the supply roll of bags 900 is shown draped over the stacking guides 800*a*, 800*b*, 800*c*, and 800*d*. The stacking guides 800*a*, 800*b*, 800*c*, and 800*d* act as holders and guides for the bag 860 during the loading process. The center 862 of the bag 860 is positioned over the opening in the top compartment and under a loading tube 890. The bag holder 1000 in this embodiment includes a pallet jack 1010, a bag guide 1020 connected to and supported by the pallet jack 1010, and a supply roll support holder 1030 connected to and supported by the pallet jack 1010. The bag guide 1020 is sized and configured to hold a bag over the container 50 during the loading process and to prevent the bag from engaging the various components of the container and thus prevent the bag from catching on or ripping from contact with the components of the container. In FIG. 44, the bag holder 1000 holds the bag 860 over the container 50 with the center of the bag 862 positioned over the opening in the top compartment and under a loading tube 890. It should be appreciated with respect to FIG. 44 that the cover of the material loading assembly has been removed for ease of illustration.

Figure 45:
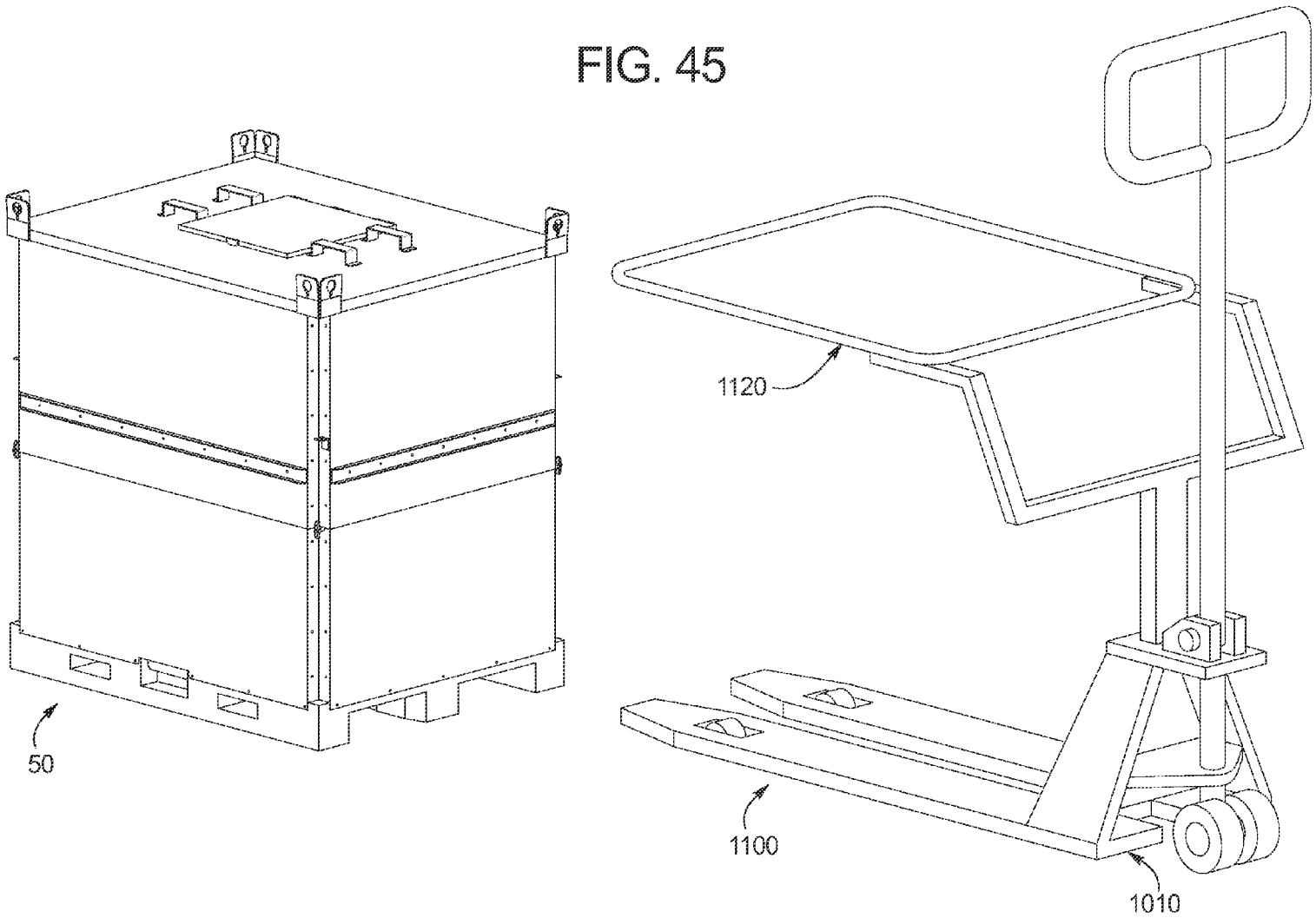
FIG. 45 is a perspective view of the shipping container of FIG. 1 and another embodiment of a bag holder of the present disclosure.
Figure 46:
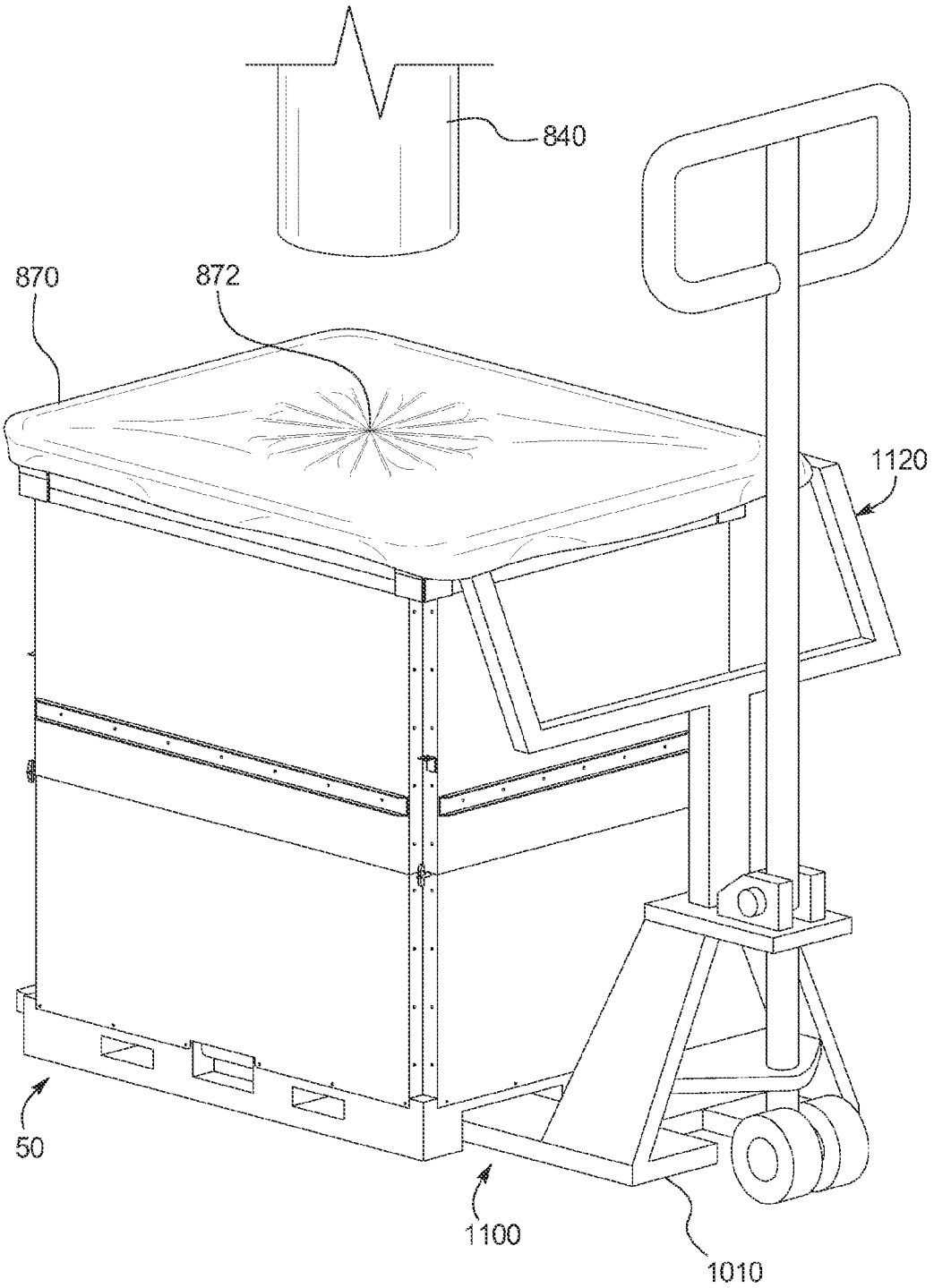
FIG. 46 is a perspective view of the shipping container of FIG. 1 and the bag holder of FIG. 45, and illustrating how the bag holder of FIG. 43 holds one of the bags over the shipping container during the material loading process, and with the cover of the material loading assembly removed for ease of illustration.
Figure 47:
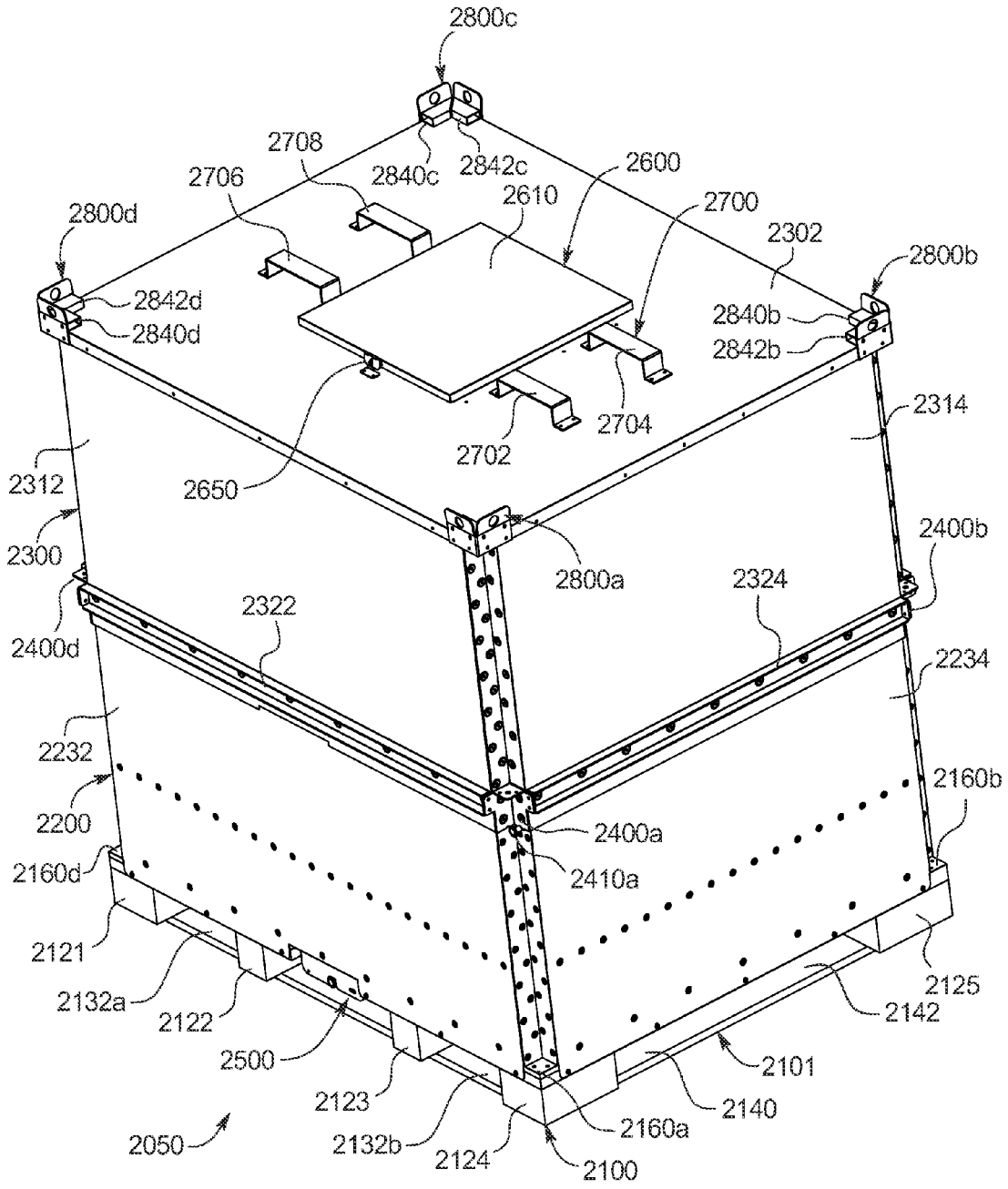
FIG. 47 is a perspective view of another example embodiment of the shipping container of the present disclosure, illustrating the top compartment in the expanded position relative to the bottom compartment.

Turning now to FIGS. 45 and 46, another example embodiment of a bag holder of the present disclosure is generally illustrated and indicated by numeral 1100. The bag holder 1100 is similar to the bag holder 1000 in that it is configured to hold a bag over the shipping container 50 during the material loading process. However, unlike bag holder 1000, bag holder 1100 is not configured to hold a roll of bags and does not include a supply roll support holder. The bag holder 1100 in this embodiment includes a pallet jack 1010 and a bag guide 1120 connected to and supported by the pallet jack 1010. The bag guide 1120 is sized and configured to hold a bag over the container 50 during the loading process and to prevent the bag from engaging the various components of the container and thus prevent the bag from catching on or ripping from contact with the components of the container. In FIG. 46, the bag holder 1000 holds the bag 870 over the container 50 with the center of the bag 872 positioned over the opening in the top compartment and under a loading tube 890. It should be appreciated with respect to FIG. 46 that the cover of the material loading assembly has been removed for ease of illustration.

It should be appreciated that in both of these bag holder embodiments, the pallet jack 1010 is configured to be positioned underneath the container 50, and specifically that the forks are positioned in the pallet jack tine receiving channels defined by the pallet. It should also be appreciated that the bag holder could alternatively include a fork lift instead of a pallet jack and that in such embodiments, the forks are preferably positioned in the fork lift tine receiving channels defined by the pallet. It should further be appreciated that in alternative embodiments, the bag guides and supply roll support holder can be alternatively supported and positionable. It should be appreciated that the bag guide and supply roll support holder are made from any suitable materials.

It should also be appreciated that the present disclosure contemplates alternative embodiments (not shown) where the bulk material shipping container is not expandable or retractable. In one such embodiment, the shipping container includes (a) a pallet; (b) a bottom compartment mounted on the pallet; (c) a top compartment securely mounted on the bottom compartment; (d) a material unloading assembly supported by bottom compartment and the pallet; and (e) a material loading assembly attached to the top compartment. In this embodiment, the top compartment is fixed such as by welding to the bottom compartment. This embodiment does not include the plurality of top compartment supporting assemblies or the extension assembly attached to the top compartment. In this embodiment, the bulk material shipping container of the present disclosure can be used with a bag or without a bag.

In another embodiment (not shown) where the bulk material shipping container is not expandable or retractable, the shipping container includes: (a) a pallet; (b) a single compartment mounted on the pallet; (c) a material unloading assembly supported by the bottom compartment and the pallet; and (d) a material loading assembly attached to the top compartment. Since this embodiment includes a single compartment, this embodiment does not need to include the plurality of compartment supporting assemblies or the extension assembly attached to the top compartment. In this embodiment, the bulk material shipping container of the present disclosure can also be used with a bag or without a bag.

It should be appreciated that suitable instructional marking or labels may be placed on or attached to the container of the present disclosure to instruct the users on how to load, unload, move, retract, and/or expand the container. It should also be appreciated that suitable reflective tape strips can be attached to the container. It should further be appreciated that the container of the present disclosure can be suitably coated such as by painting with a clear or colored protective coating. It should be appreciated that such coating may include a UV protective agent. It should also be appreciated that one or more sections of the container may be reinforced with a suitable plating to provide additional protection and strength. It should further be appreciated that the attachment of the various components of the container can be preformed in any suitable way such as by welding (including but not limited to laser welding) and by suitable fasteners (such as but not limited to rivets).

Figure 48:
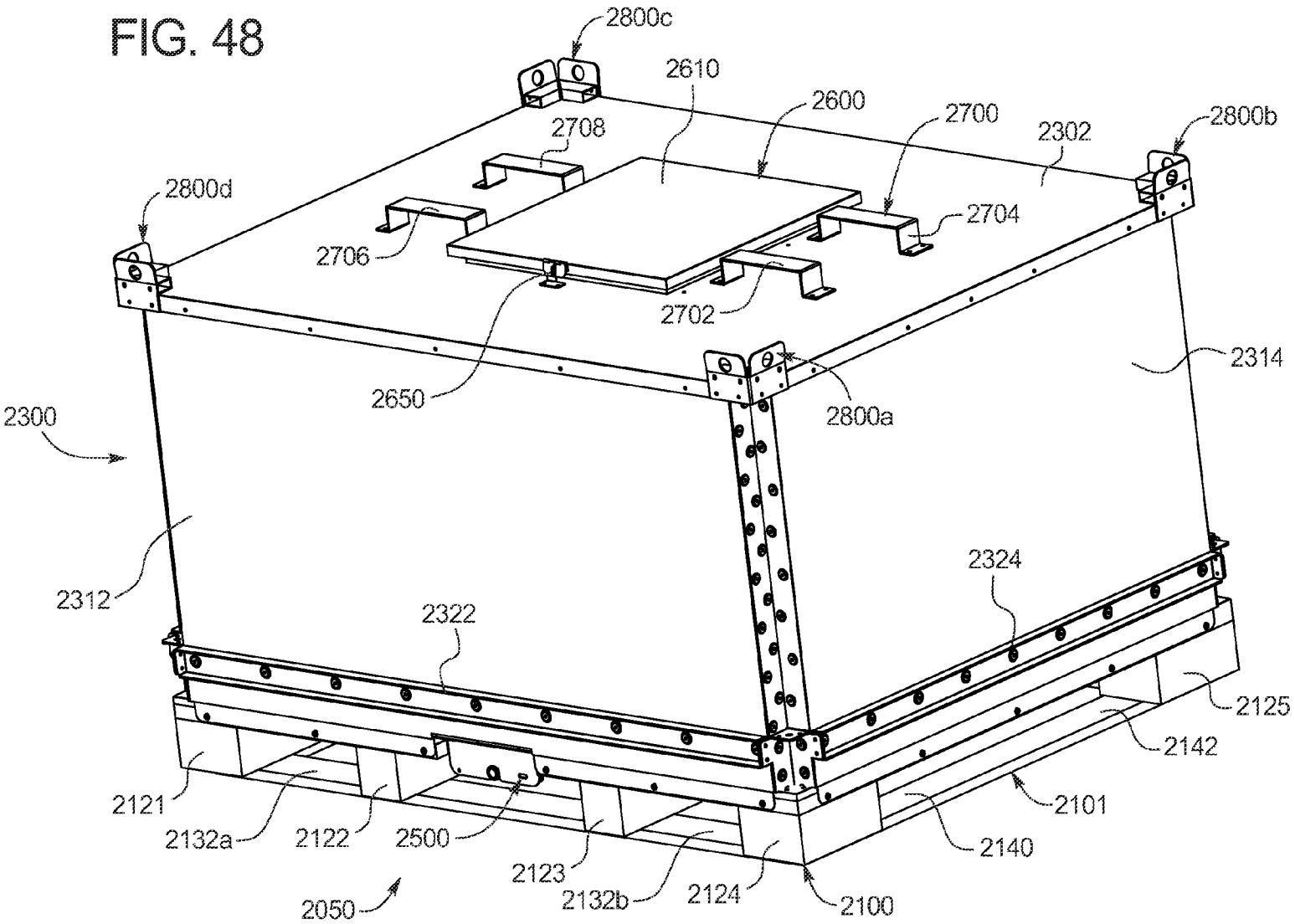
FIG. 48 is a top perspective view of the shipping container of FIG. 47, illustrating the top compartment in the retracted or collapsed position relative to the bottom compartment.
Figure 49:
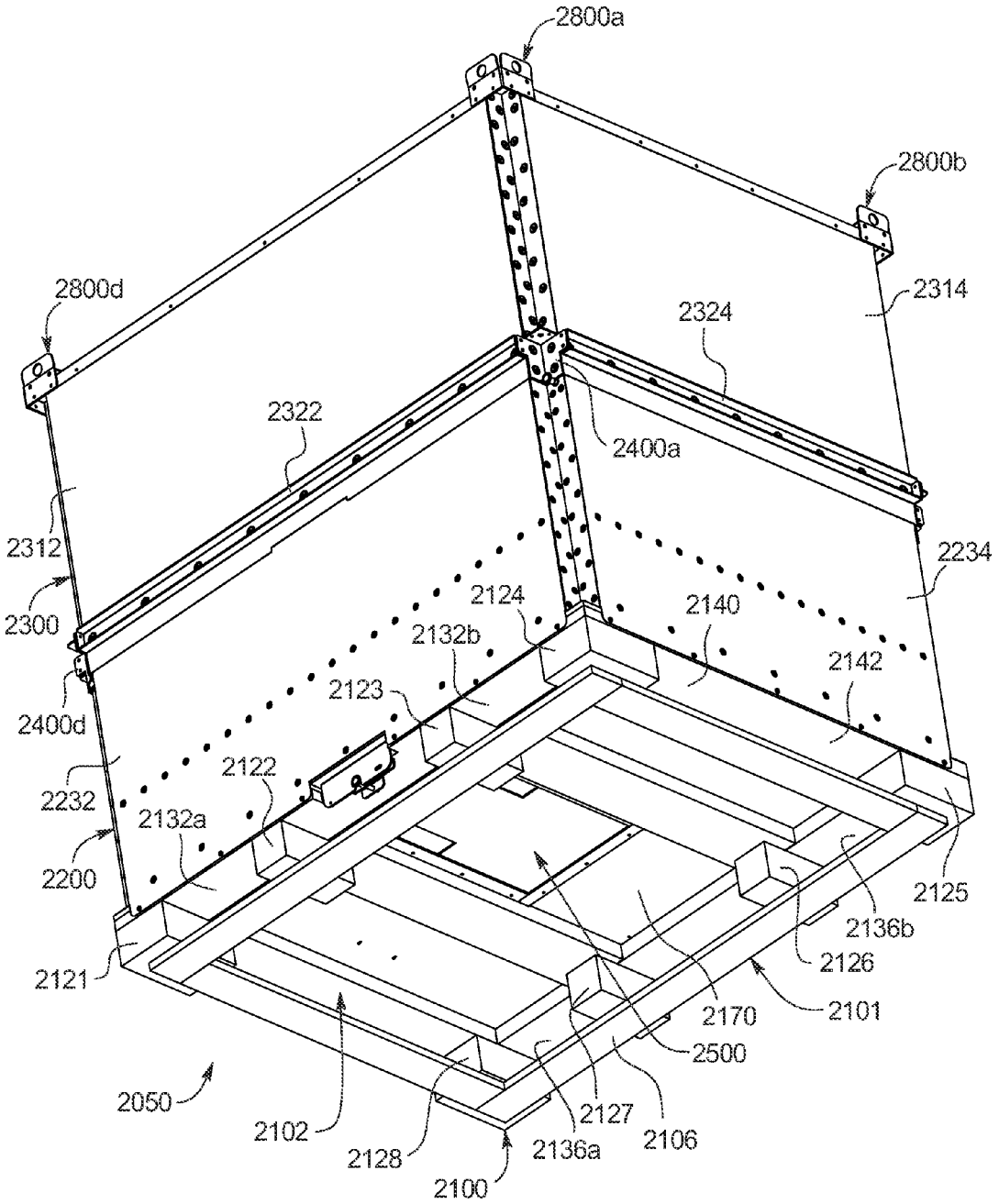
FIG. 49 is a bottom perspective view of the shipping container of FIG. 47, illustrating the top compartment in the expanded position relative to the bottom compartment, and illustrating the pallet of this embodiment of the shipping container of FIG. 47.
Figure 50:
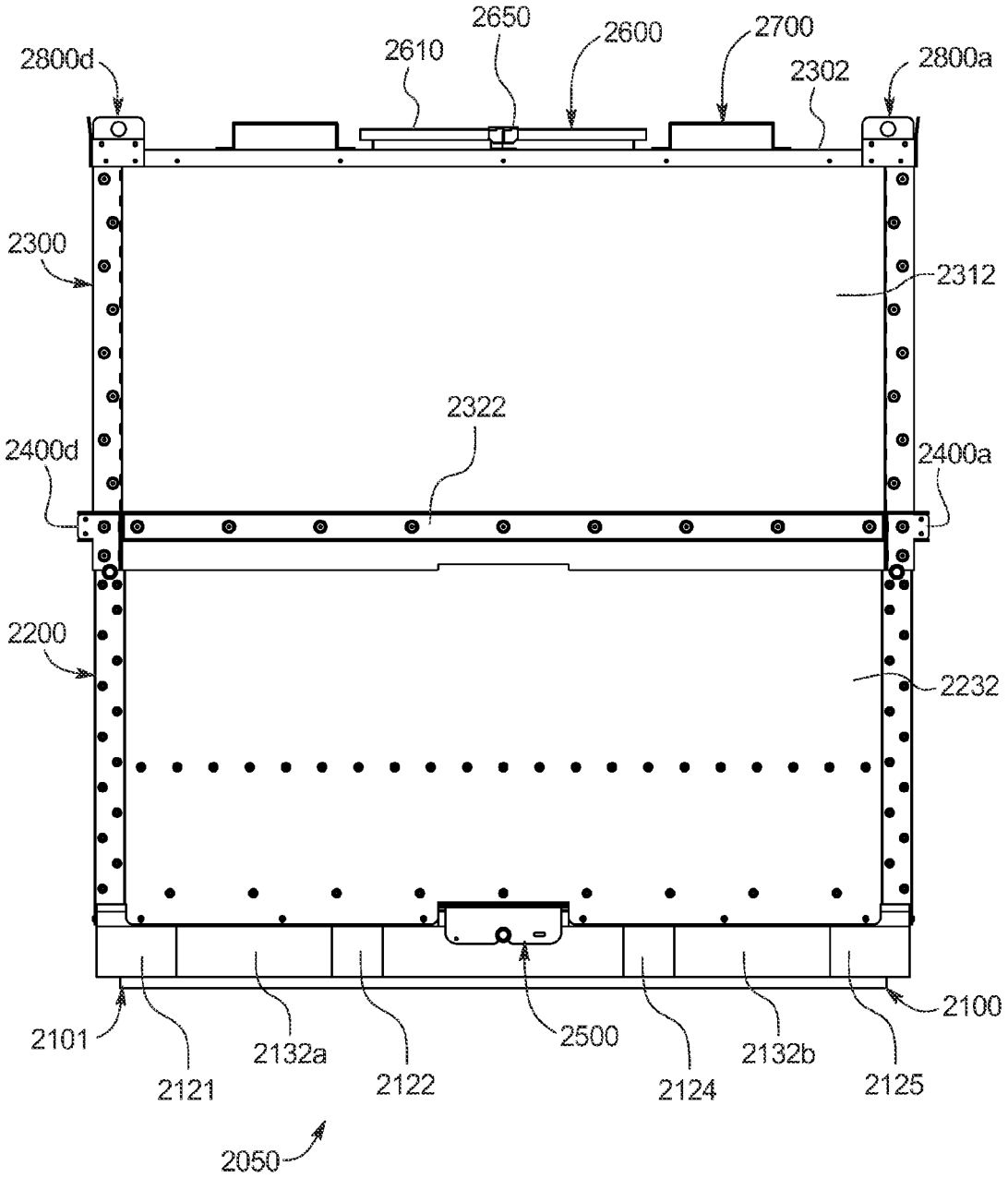
FIG. 50 is a front view of the shipping container of FIG. 47, illustrating the top compartment in the expanded position relative to the bottom compartment.
Figure 51:
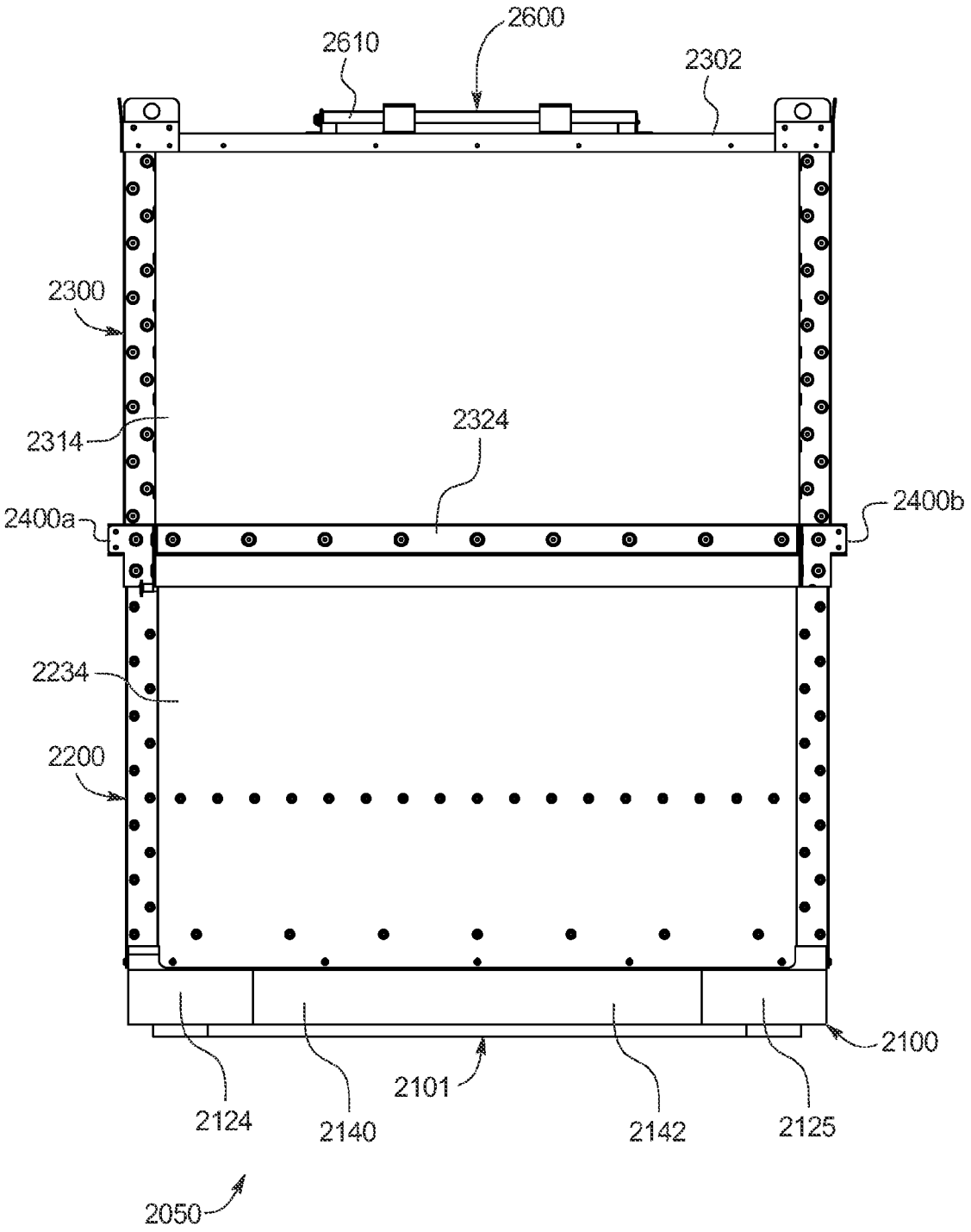
FIG. 51 is a left side view of the shipping container of FIG. 47, illustrating the top compartment in the expanded position relative to the bottom compartment.
Figure 52:
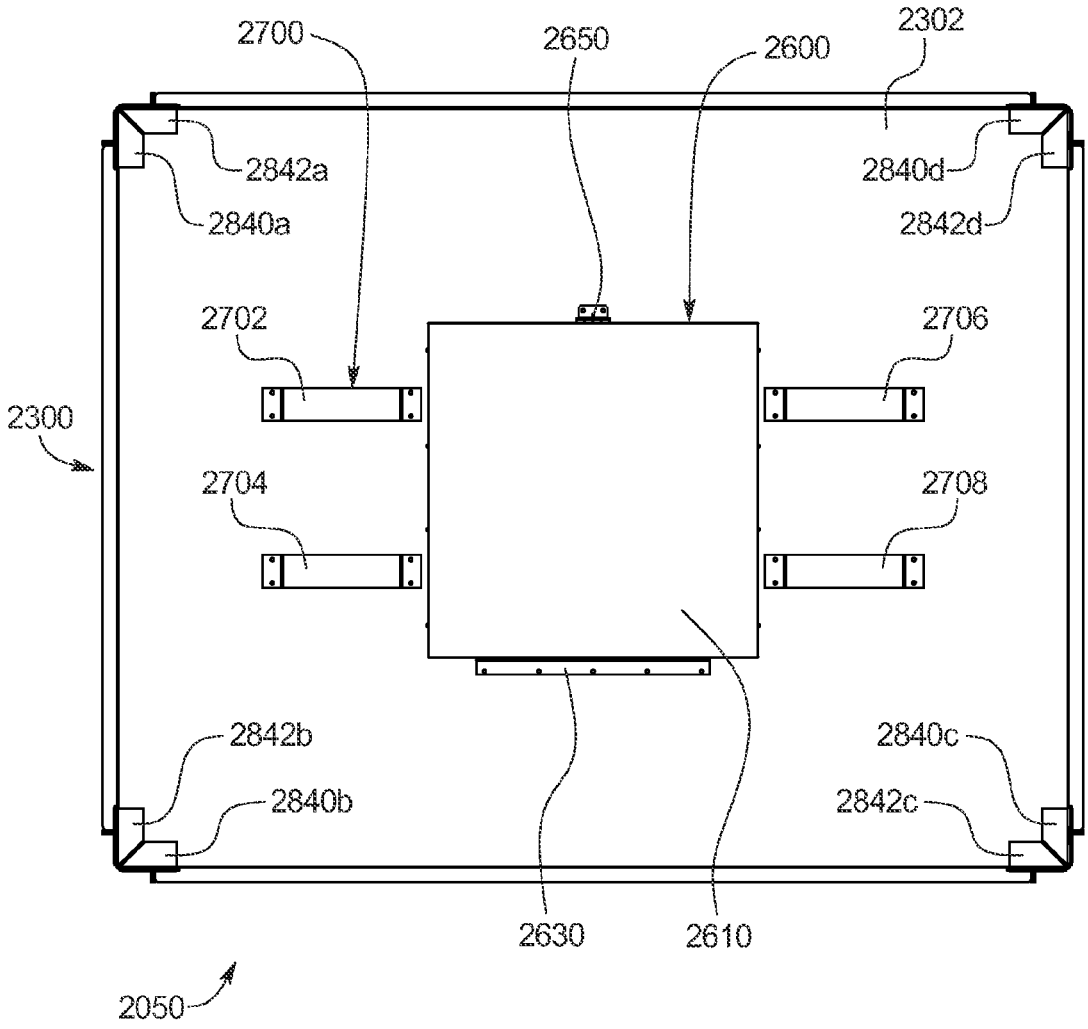
FIG. 52 is a top view of the shipping container of FIG. 47, illustrating the cover of the material loading assembly of the shipping container in the closed position and the extension assembly attached to the top compartment.
Figure 53:
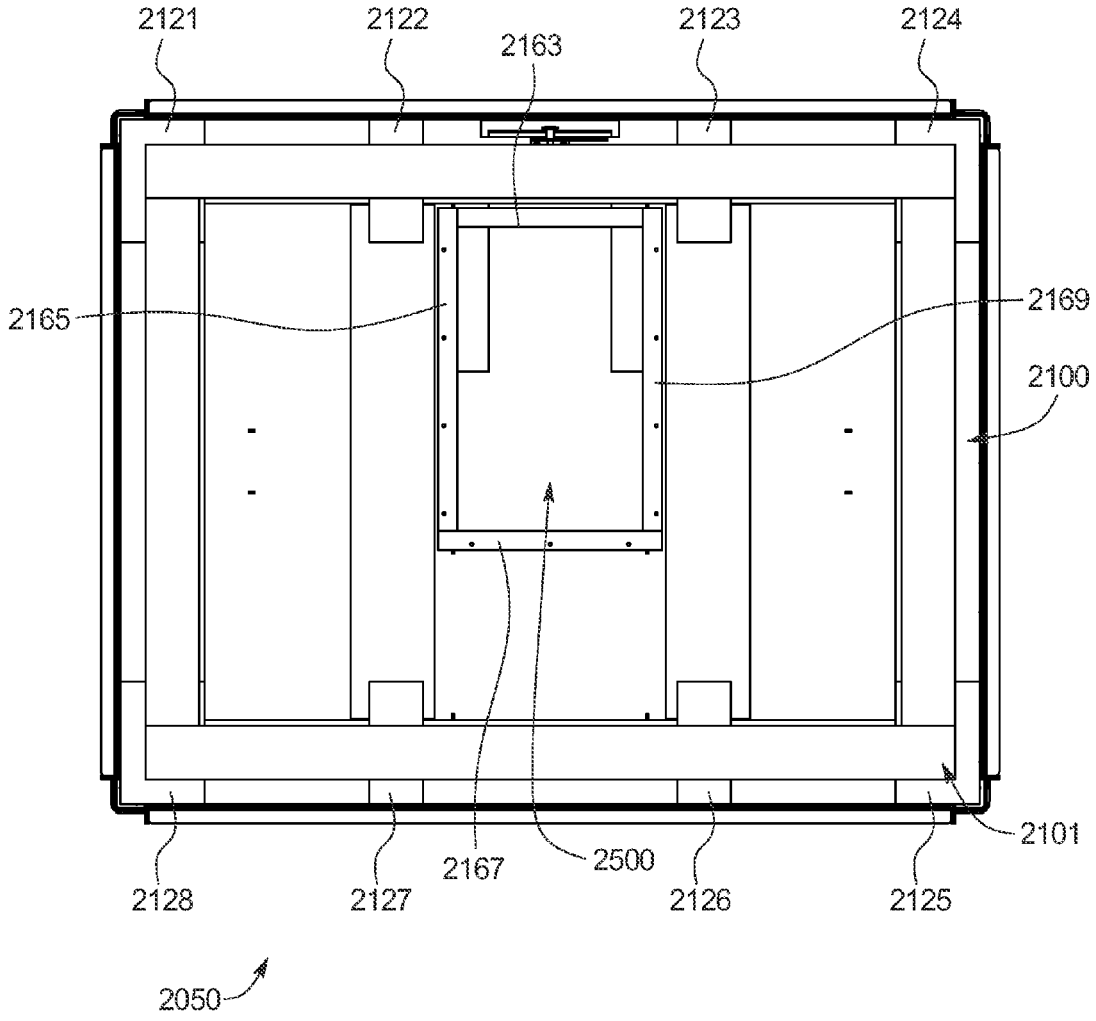
FIG. 53 is a bottom view of the shipping container of FIG. 47, illustrating the pallet, and further illustrating the chute door or gate of the material unloading assembly in the closed position.
Figure 54:
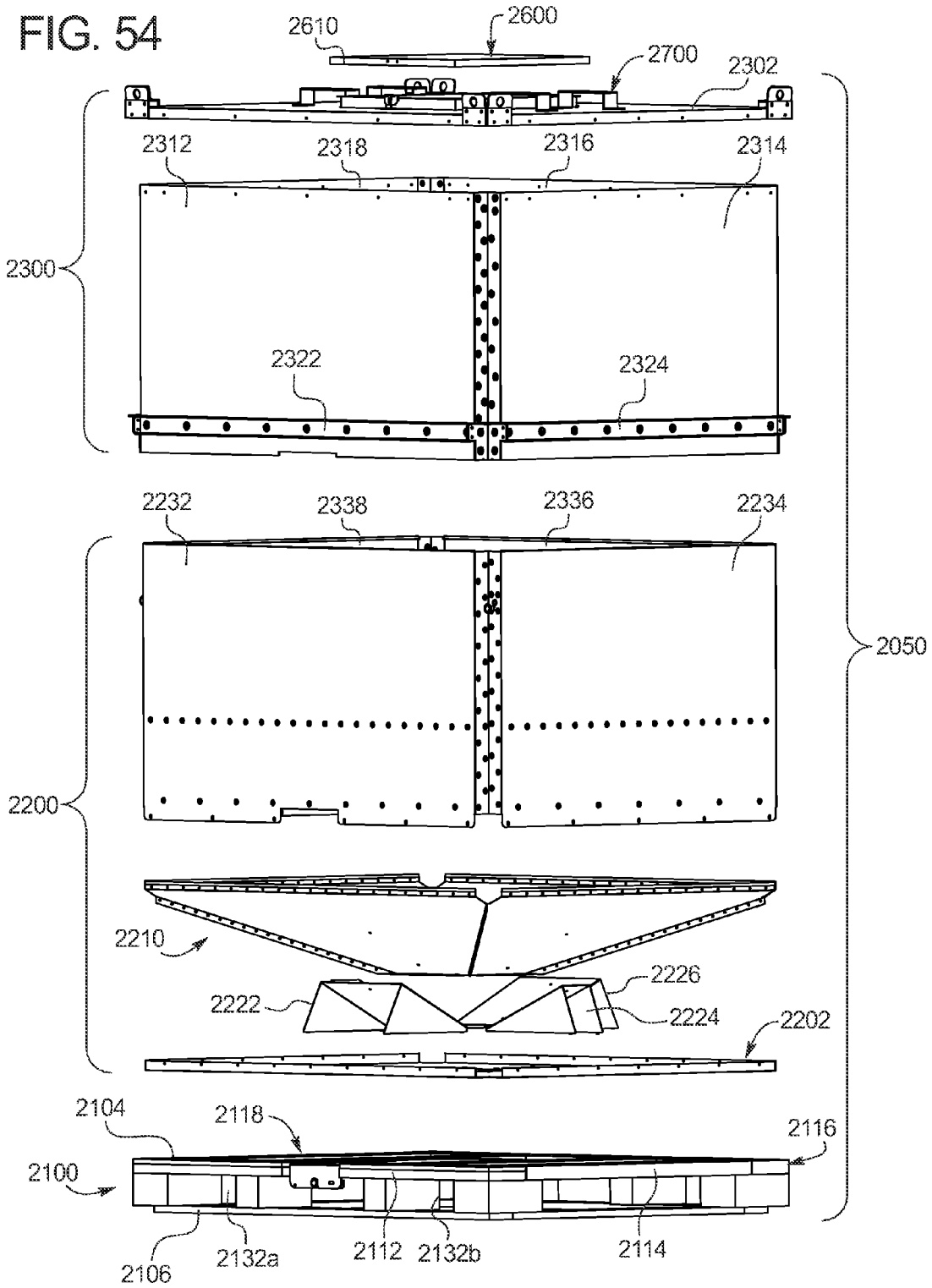
FIG. 54 is an exploded perspective view of the shipping container of FIG. 47 with certain of the smaller components removed for ease of illustration.
Figure 55:
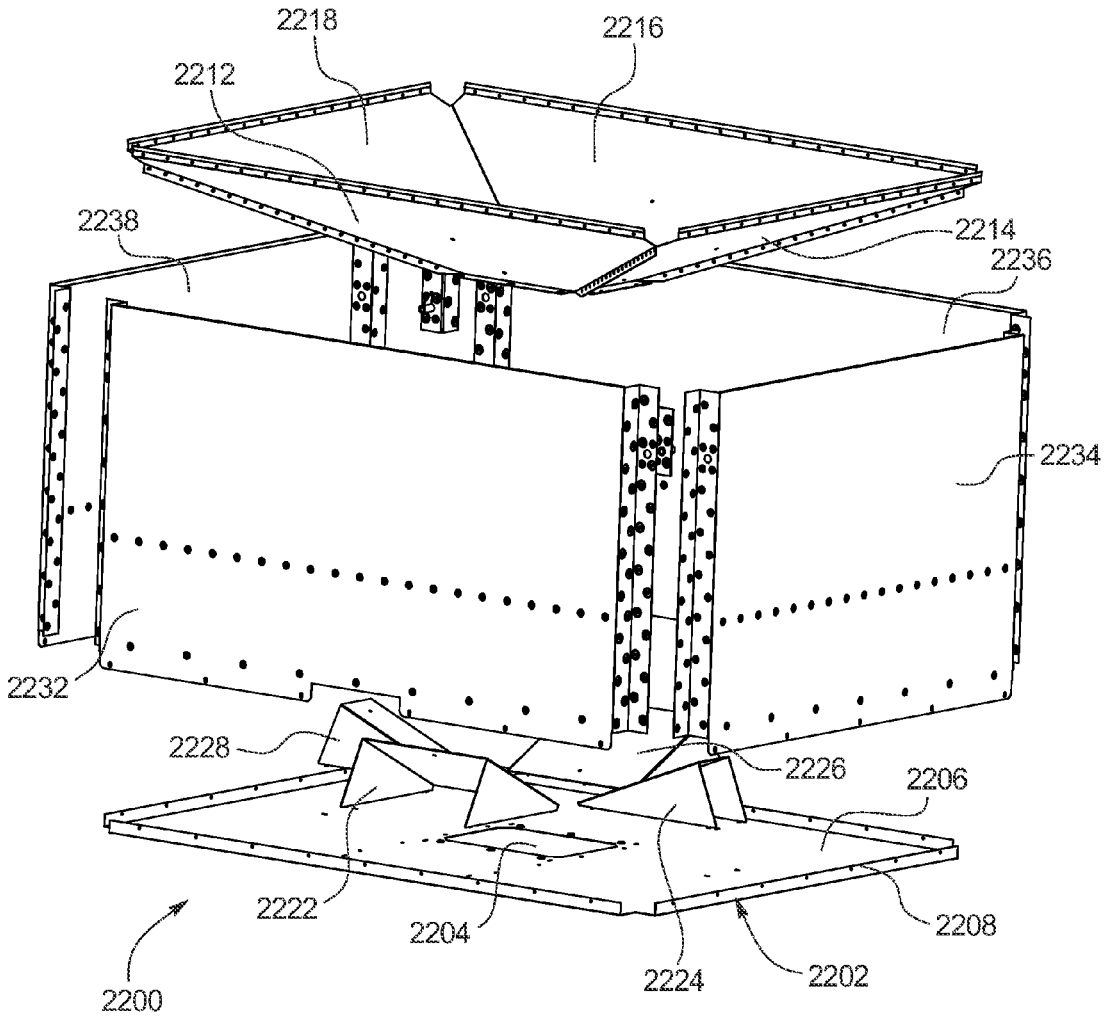
FIG. 55 is an enlarged exploded perspective view of the bottom compartment of the shipping container of FIG. 47.
Figure 56:
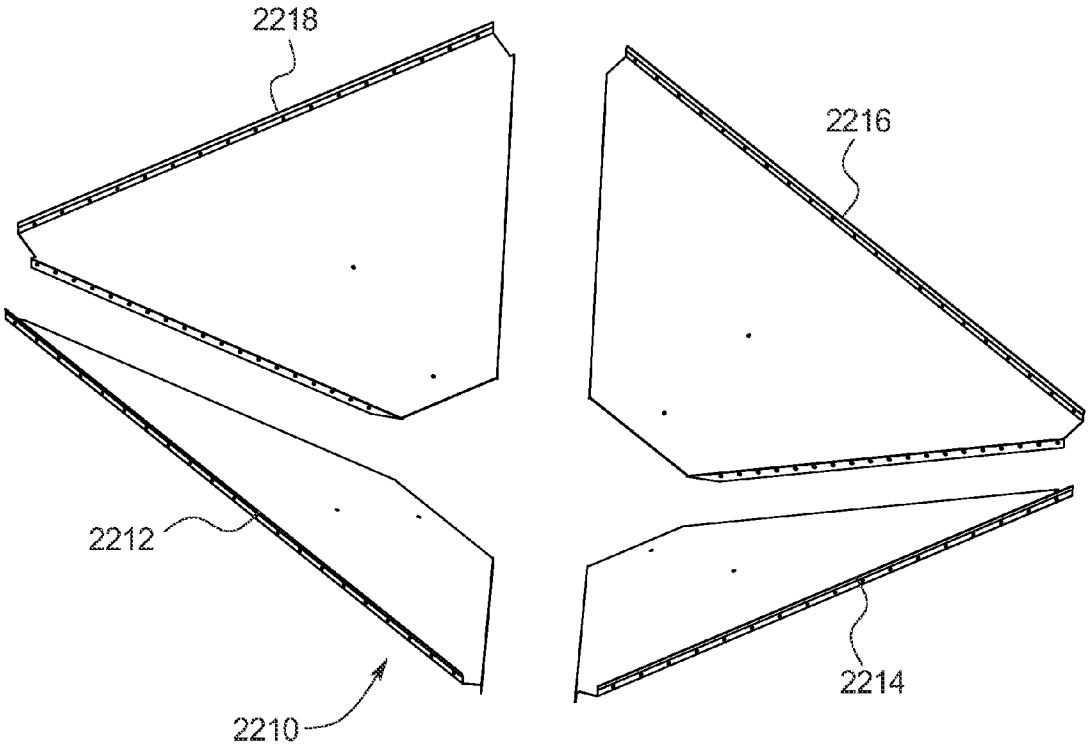
FIG. 56 is an enlarged exploded top perspective view of the sections of the upper interior bottom wall of the bottom compartment of the shipping container of FIG. 47.
Figure 57:
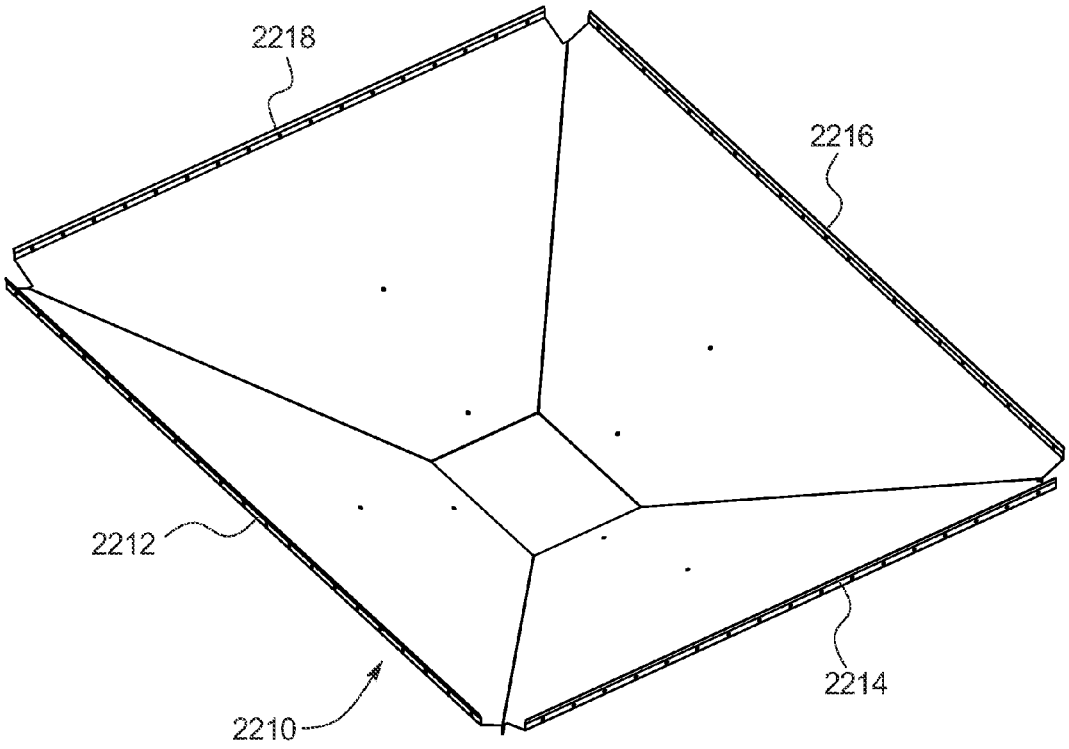
FIG. 57 is an enlarged top perspective view of the attached sections of the upper interior bottom wall of the bottom compartment of the shipping container of FIG. 47.
Figure 58:
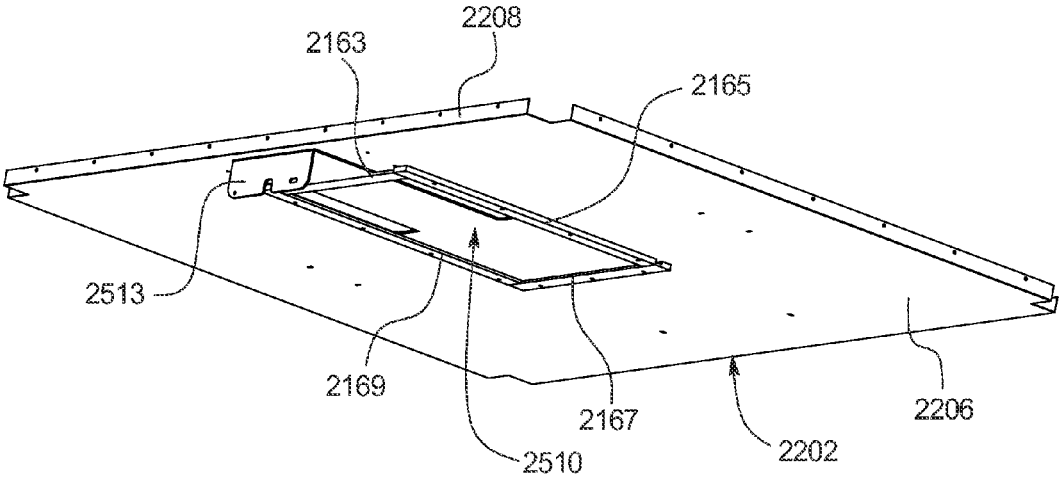
FIG. 58 is an enlarged bottom perspective view of the lower exterior bottom wall of the bottom compartment of the shipping container of FIG. 47, and illustrating the material unloading assembly attached to the bottom of the lower exterior bottom wall.
Figure 59:
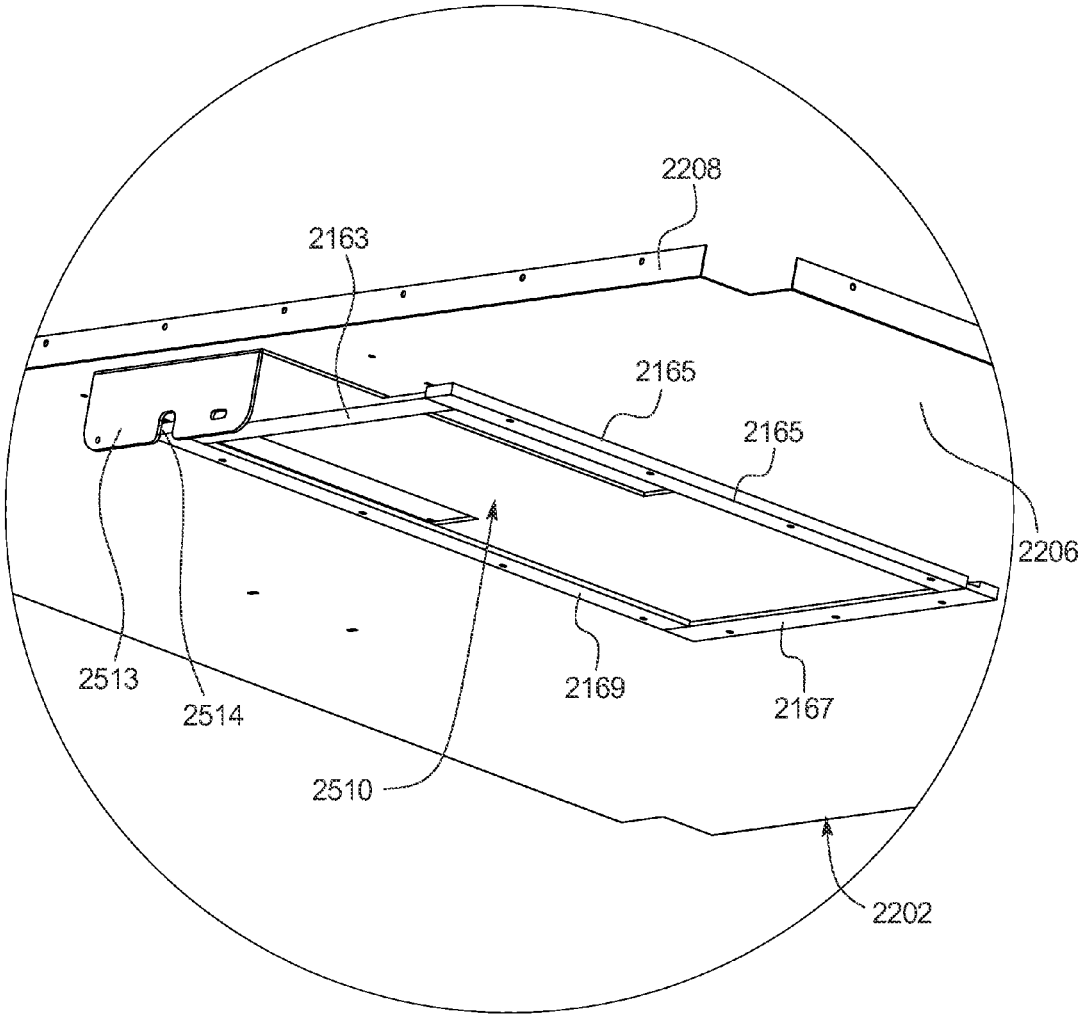
FIG. 59 is a further enlarged fragmentary bottom perspective view of the lower exterior bottom wall of the bottom compartment of the shipping container of FIG. 47, and illustrating the material unloading assembly attached to the bottom of the lower exterior bottom wall.
Figure 60:
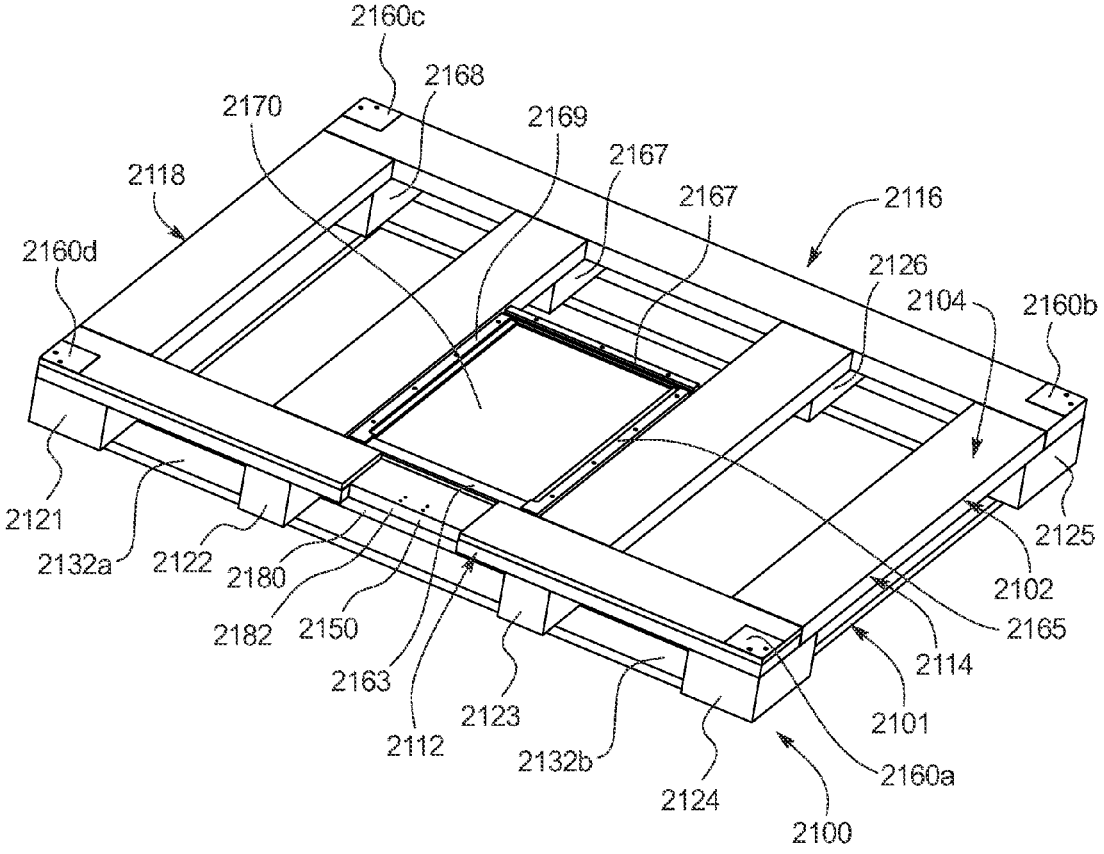
FIG. 60 is an enlarged top perspective view of the pallet of the shipping container of FIG. 47, shown removed from the bottom compartment of the container and without the gate of the material unloading assembly, but with the guide rails of the material unloading assembly shown in their position relative to the pallet.
Figure 61:
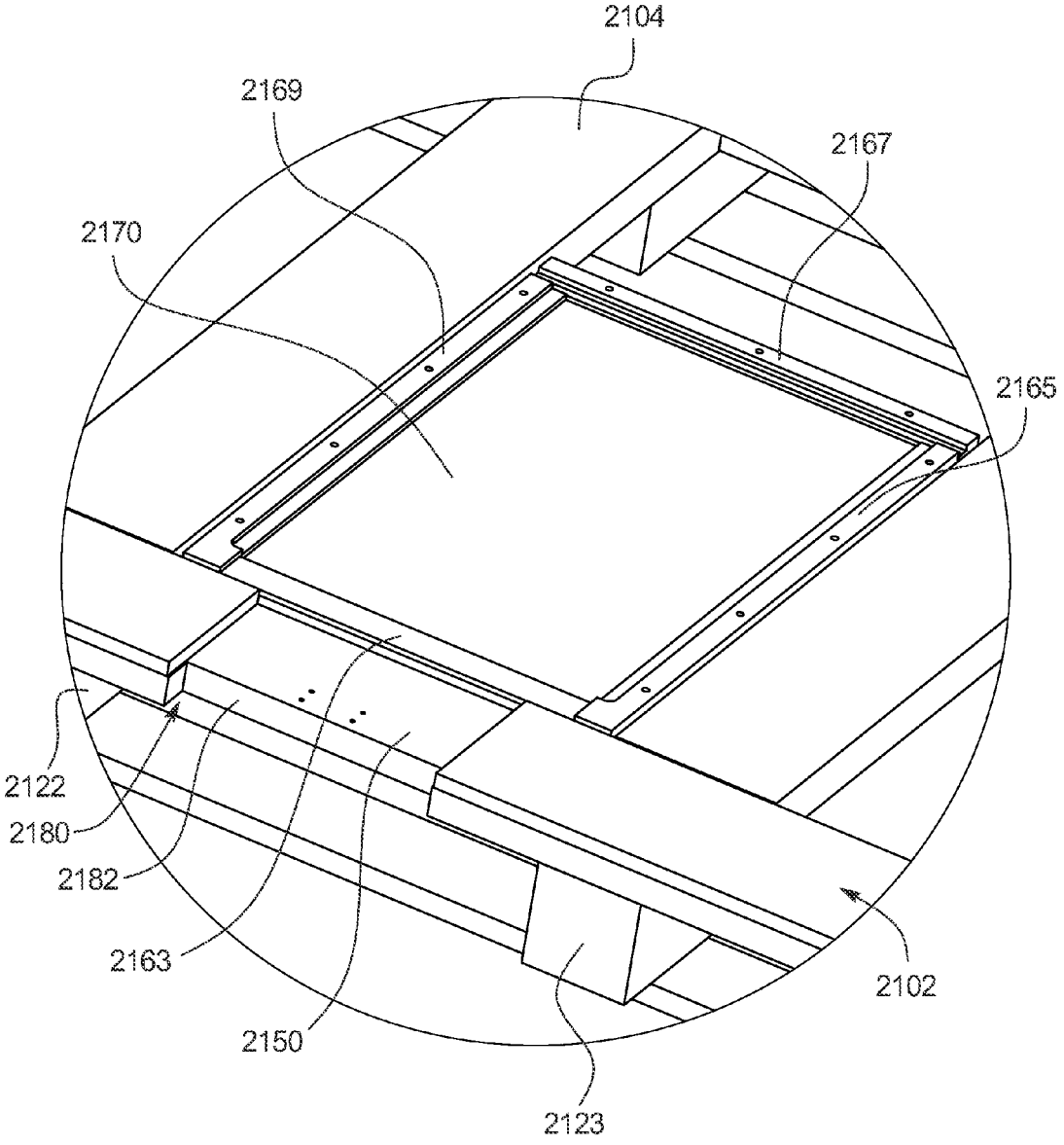
FIG. 61 is an enlarged fragmentary top perspective view of the pallet of the shipping container of FIG. 47, shown removed from the bottom compartment of the container and without the gate of the material unloading assembly, but with the guide rails of the material unloading assembly shown in their position relative to the pallet.
Figure 62:
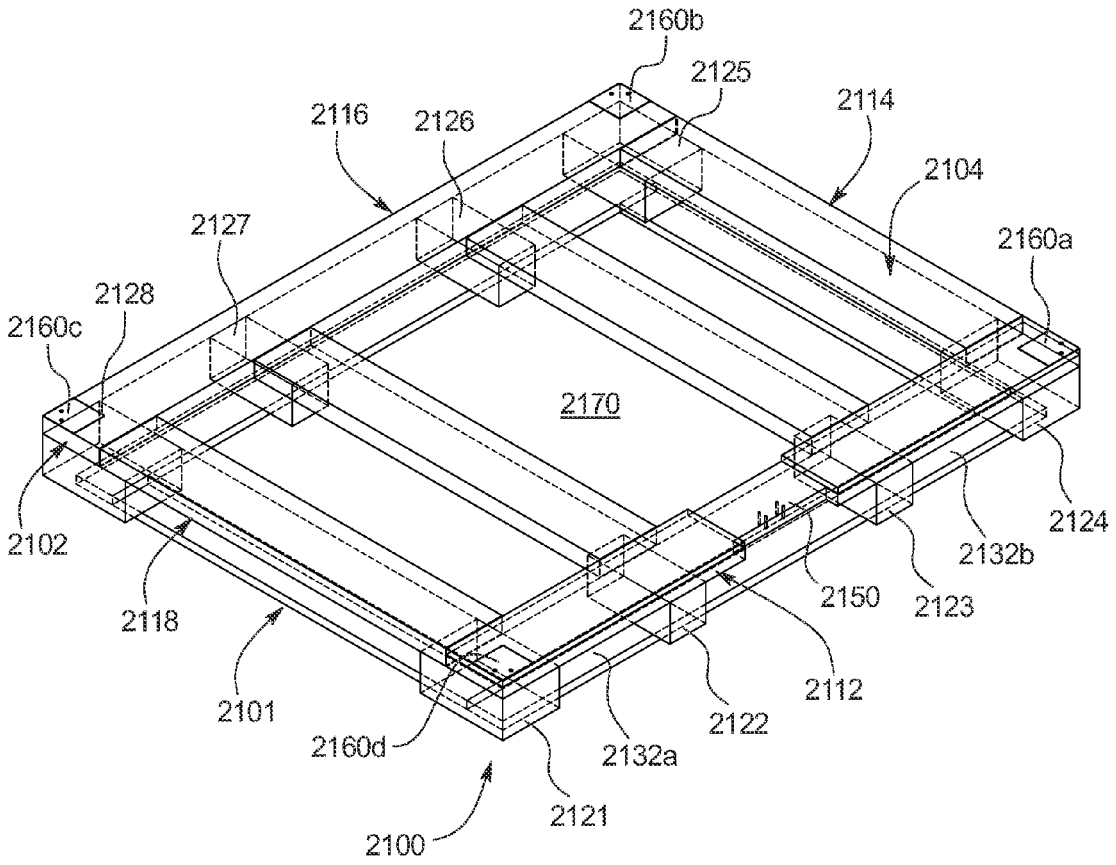
FIG. 62 is an enlarged top perspective view of the pallet of the shipping container of FIG. 47, shown removed from the bottom compartment of the container, and illustrating certain portions of the pallet in phantom.
Figure 63:
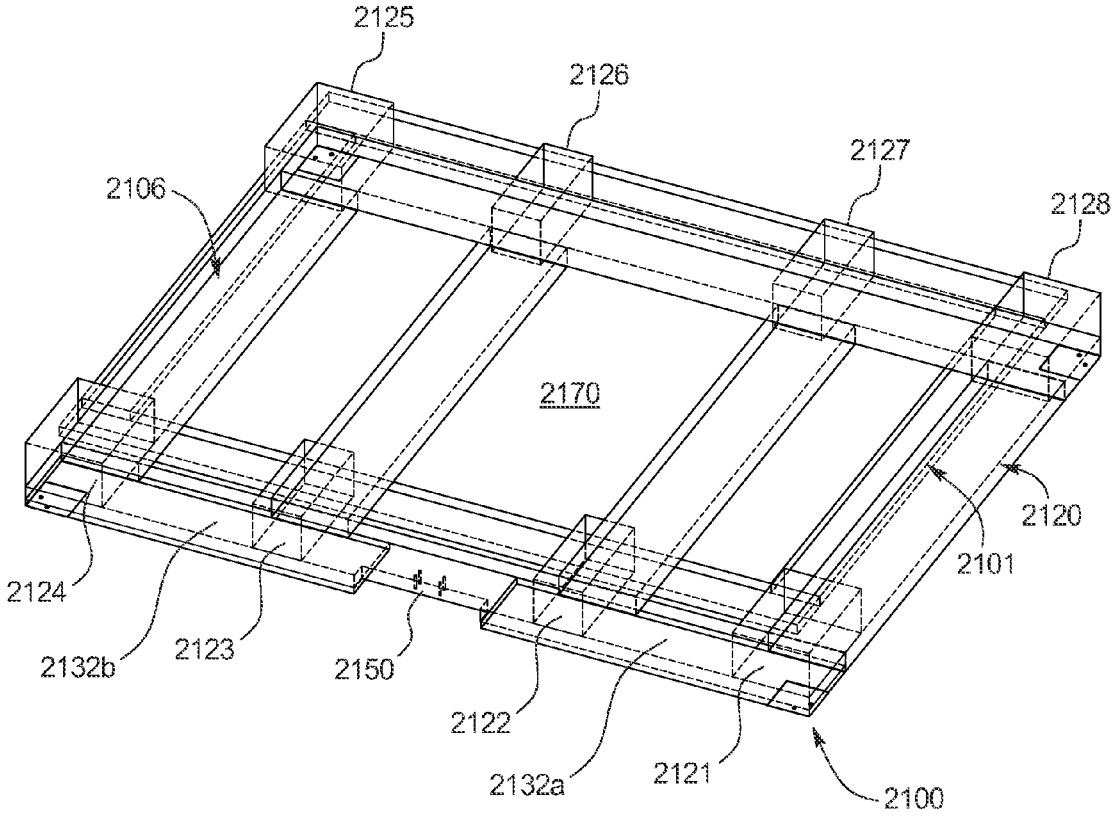
FIG. 63 is an enlarged bottom perspective view of the pallet of the shipping container of FIG. 47, shown removed from the bottom compartment of the container and flipped upside down, and illustrating the certain portions of the pallet in phantom.
Figure 64:
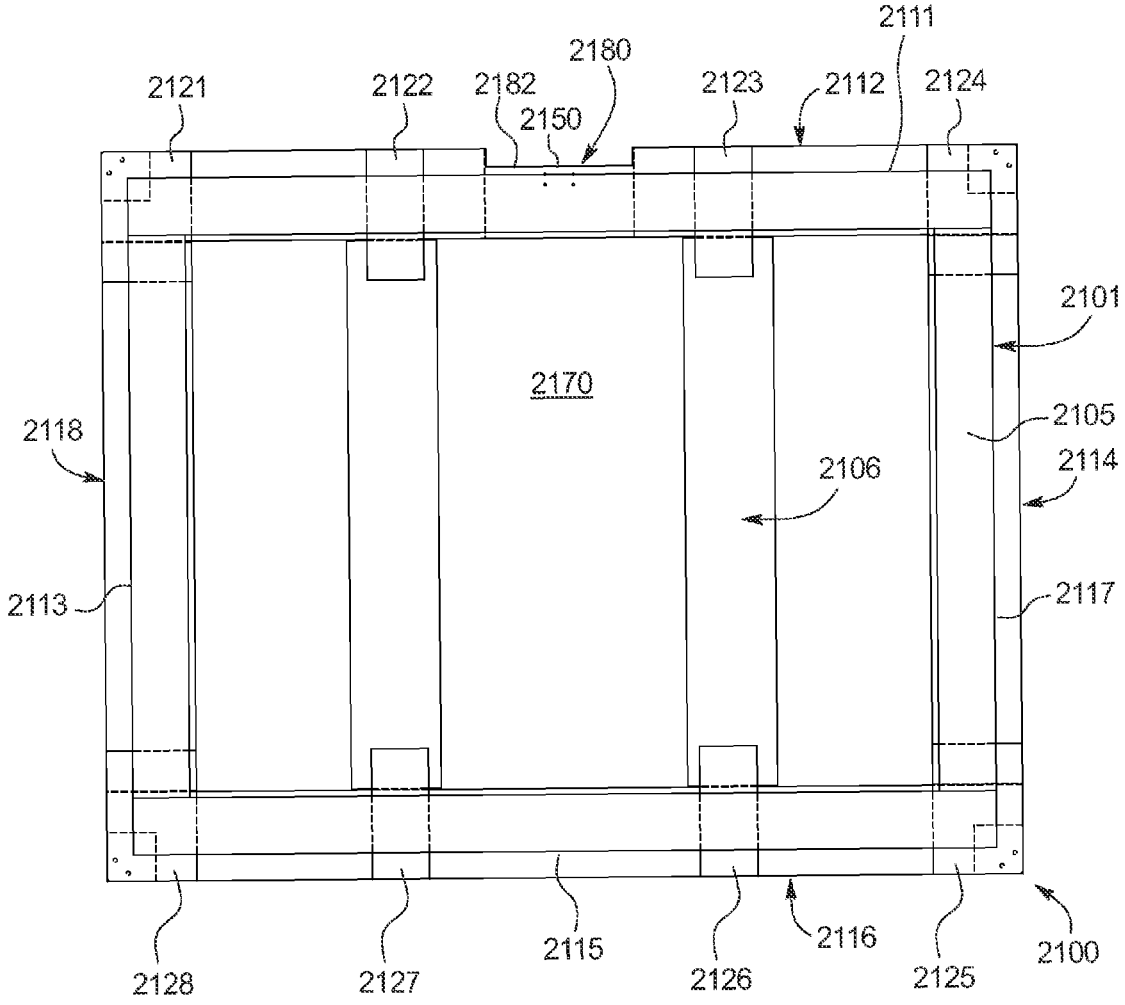
FIG. 64 is an enlarged bottom view of the pallet of the shipping container of FIG. 47, shown removed from the bottom compartment of the container.

FIGS. 47 to 96B illustrate another example embodiment of the bulk material shipping container of the present disclosure. Similar to the example container 50 described above, this illustrated example shipping container, which is generally indicated by numeral 2050, has an expanded position for holding materials during shipping and a retracted position for efficient shipping when the container 2050 is not holding materials or when the container 2050 is holding a smaller amount of materials. More specifically, FIG. 48 generally illustrates the shipping container 2050 in the retracted or collapsed position, and FIGS. 47, 49, 50, and 51 generally illustrate the shipping container 2050 in the expanded position.

In this illustrated embodiment, the shipping container 2050 generally includes: (a) a pallet 2100 which is different than pallet 100 as further described below; (b) a bottom compartment 2200 which is different than bottom compartment 200 as further described below; (c) a top compartment 2300 which is different than top compartment 300 as further described below; (d) a plurality of top compartment support assemblies 2400*a*, 2400*b*, 2400*c* (not shown), and 2400*d* which are different than top compartment support assemblies 400*a*, 400*b*, 400*c*, and 400*d* as further described below; (e) a material unloading assembly 2500 which is different than material unloading assembly 500 as further described below; (f) a material loading assembly 2600 which is substantially similar to material loading assembly 600 described above; and (g) a top compartment extension assembly 2700 which is substantially similar to top compartment extension assembly 700 described above. It should be appreciated that the following description of the shipping container 2050 will primarily focus on these respective differences.

In this illustrated embodiment: (a) the pallet 2100 is approximately 56 inches (142.24 centimeters) by approximately 44 inches (111.76 centimeters) by approximately 6 inches (15.24 centimeters); (b) the bottom compartment 2200 is approximately 56 inches (142.24 centimeters) by approximately 44 inches (111.76 centimeters) by approximately 27 inches (68.58 centimeters); and (c) the top compartment 2300 is approximately 56 inches (142.24 centimeters) by approximately 44 inches (111.76 centimeters) by approximately 27 inches (68.58 centimeters).

In this illustrated embodiment, when the container 2050 is in the retracted position, the container is approximately 56 inches (142.24 centimeters) by approximately 44 inches (111.76 centimeters) by approximately 35 inches (88.90 centimeters).

In this illustrated embodiment, when the container 2050 is in the expanded position, the container is approximately 56 inches (142.24 centimeters) by approximately 44 inches (111.76 centimeters) by approximately 62 inches (157.48 centimeters). It should be appreciated that this alternative container of the present disclosure can be made in other suitable dimensions.

More specifically, turning now to FIGS. 47, 48, 49, 50, 51, 53, 54, 60, 61, 62, 63, 64, 65, 66, 67, 90, 91, 92, and 93, the pallet 2100 of this illustrated embodiment of the container 2050 of the present disclosure includes: (a) a rectangular body 2102 having an upper surface 2104, a lower surface 2106, a front edge 2112, a back edge 2116, and opposite side edges 2114 and 2118; (b) a plurality of legs 2121, 2122, 2123, 2124, 2125, 2126, 2127, and 2128 attached to and extending downwardly from the body 2102; (c) a footing 2101 attached to and extending downwardly from each of the legs 2121, 2122, 2123, 2124, 2125, 2126, 2127, and 2128, and having an upper surface 2103, a lower surface 2105, a front edge 2111, a back edge 2115, and opposite side edges 2113 and 2117; (d) a gate head 2150 formed at the front of the body 2102; and (e) a plurality of compression guards or plates 2160*a*, 2160*b*, 2160*c*, and 2160*d* respectively attached to the corners of the upper surface 2104 of the body 2102. As further described below, the body 2102 of the pallet 2100 functions to directly support the bottom compartment 2200 and indirectly the top compartment 2300.

In this illustrated embodiment, the body, legs, and footing of the pallet are each formed from multiple pieces of a suitable wood to: (a) provide structural strength and rigidity; and (b) minimize the overall weight of the pallet and the container. More specifically, in this illustrated embodiment: (a) the rectangular body 2102 is constructed from several individual pieces of wood (such as 2×4s in this example illustrated embodiment); (b) the legs 2121,2122,2123, 2124, 2125, 2126, 2127, and 2128 are each an individual piece of wood (such as 4×4s and 4×6s in this example illustrated embodiment); and (c) the footing 2101 is constructed from several individual pieces of wood (such as 2×2s in this example illustrated embodiment). In this example illustrated embodiment, these individual pieces of wood are suitably attached by fastening mechanisms such as adhesive, nails, and screws. It should be appreciated that these parts may alternatively be formed from more or less pieces, may be formed from other materials, and may be otherwise suitably attached. It should also be appreciated that the pallet may be painted or otherwise protected by other suitable coatings.

The gate head 2150 is formed at the front of the body 2102. In this illustrated example embodiment, the front portion of the body 2102 is formed from three pieces of wood including a bottom piece with a cut-out and two spaced-apart top pieces such that the cut-out and the space between the two pieces provide room for the handle of the gate and which limit movement of the gate as further discussed below and as best seen in FIGS. 54, 60, 61, 62, 63, 64, 65, 66, 67, 77, 78, and 79. More specifically, the gate head 2150 of the pallet 2100 includes a handle chamber 2180 and a stopping wall 2182 for the handle 2513 of the gate 2510 material unloading assembly 2500. The handle chamber 2180 and the stopping wall 2182 of the pallet 2100 are further discussed below in more detail in conjunction with the discussion of the material unloading assembly 2500.

The pallet 2100 further includes or defines: (a) a first set of aligned fork lift tine receiving channels 2132*a* and 2136*a*, respectively; (b) a second set of aligned fork lift tine receiving channels 2132*b* and 2136*b*, respectively; (c) a first pallet jack tine receiving channel 2140 extending across the pallet 2500 from side to side; and (d) a second pallet jack tine receiving channel 2142 extending across the pallet 2500 from side to side. Similar to the pallet 100 described above, the first set of fork lift tine receiving channels 2132*a* and 2136*a* and the second set of fork lift tine receiving channels 2132*b* and 2136*b* are positioned and spaced apart such that when the forks or tines of a fork lift are inserted into these channels of the pallet 2100 of the container 2050 which is stacked on top of another container, the tines or forks do not engage the material loading assembly on the top compartment of the lower container or the extension assembly on the top compartment of the lower container. It should thus be appreciated that the pallet 2100 is configured to enable a fork lift to move these containers when one container is stacked on another container without damaging the lower container, and particularly the cover or the extension assembly of the lower container. Also, similar to the pallet 100 described above, the first pallet jack tine receiving channel 2140 and the second pallet jack tine receiving channel 2142 are positioned such that when the forks or tines of a pallet jack are inserted into these channels defined by the pallet 2100 of the container 2050, they can lift and move the container. As mentioned above, a typical pallet jack does not operate like a fork lift so that the pallet jack will only be used when the container is on the floor or ground and not with stacked containers. Therefore, the tines or forks of a pallet jack will not be in a position to engage the material loading assembly or the extension assembly on the top compartment of the lower container of a set of stacked containers. It should also be appreciated that this illustrated embodiment does not include any legs between the first pallet jack tine receiving channel 2140 and the second pallet jack tine receiving channel 2142, but that alternative embodiments could include one or more legs or separators between these two channels.

Figure 89:
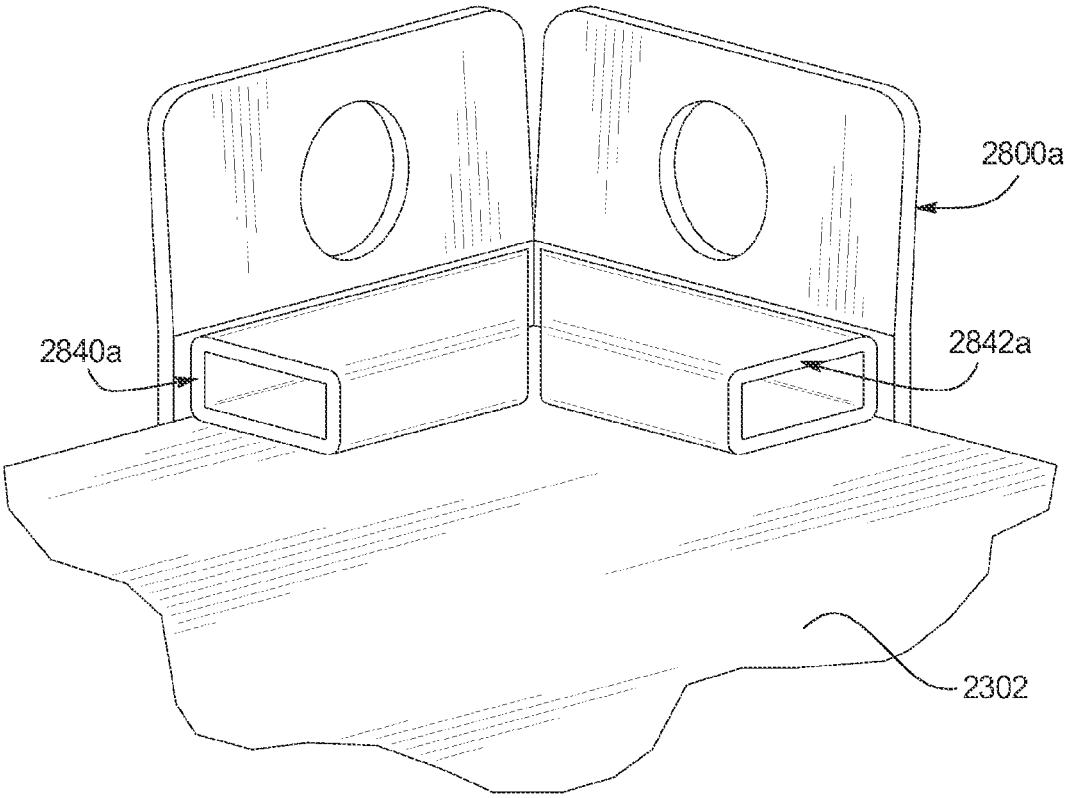
FIG. 89 is an enlarged fragmentary perspective view of one of the corners of the top compartment of the shipping container of FIG. 47, and illustrating the nesting or stacking guide and the nesting supports attached at that corner.
Figure 90:
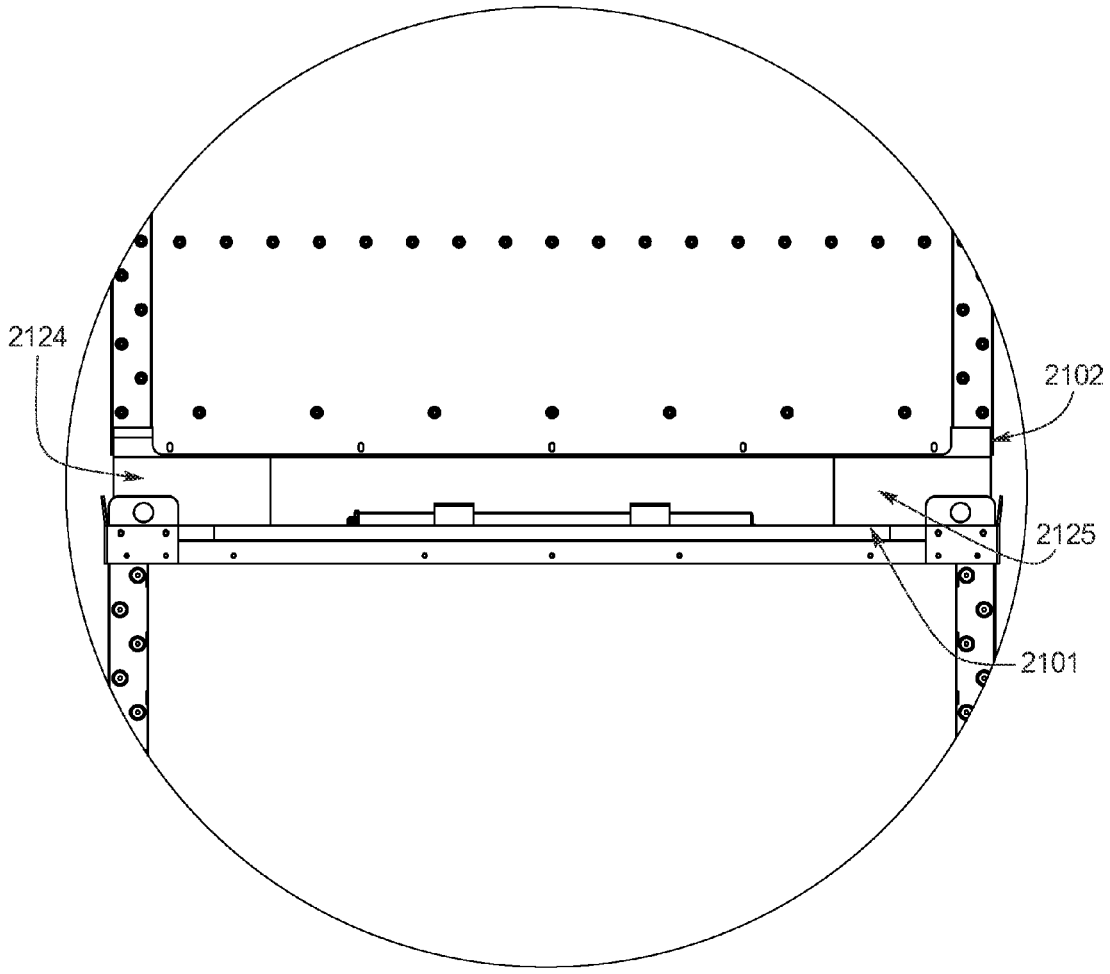
FIG. 90 is an enlarged fragmentary side view of a portion of the top compartment of a first shipping container of FIG. 47 and a portion of the pallet and bottom compartment of a second shipping container of FIG. 47, where the portion of the pallet is shown stacked on the top compartment of the first shipping container.
Figure 91:
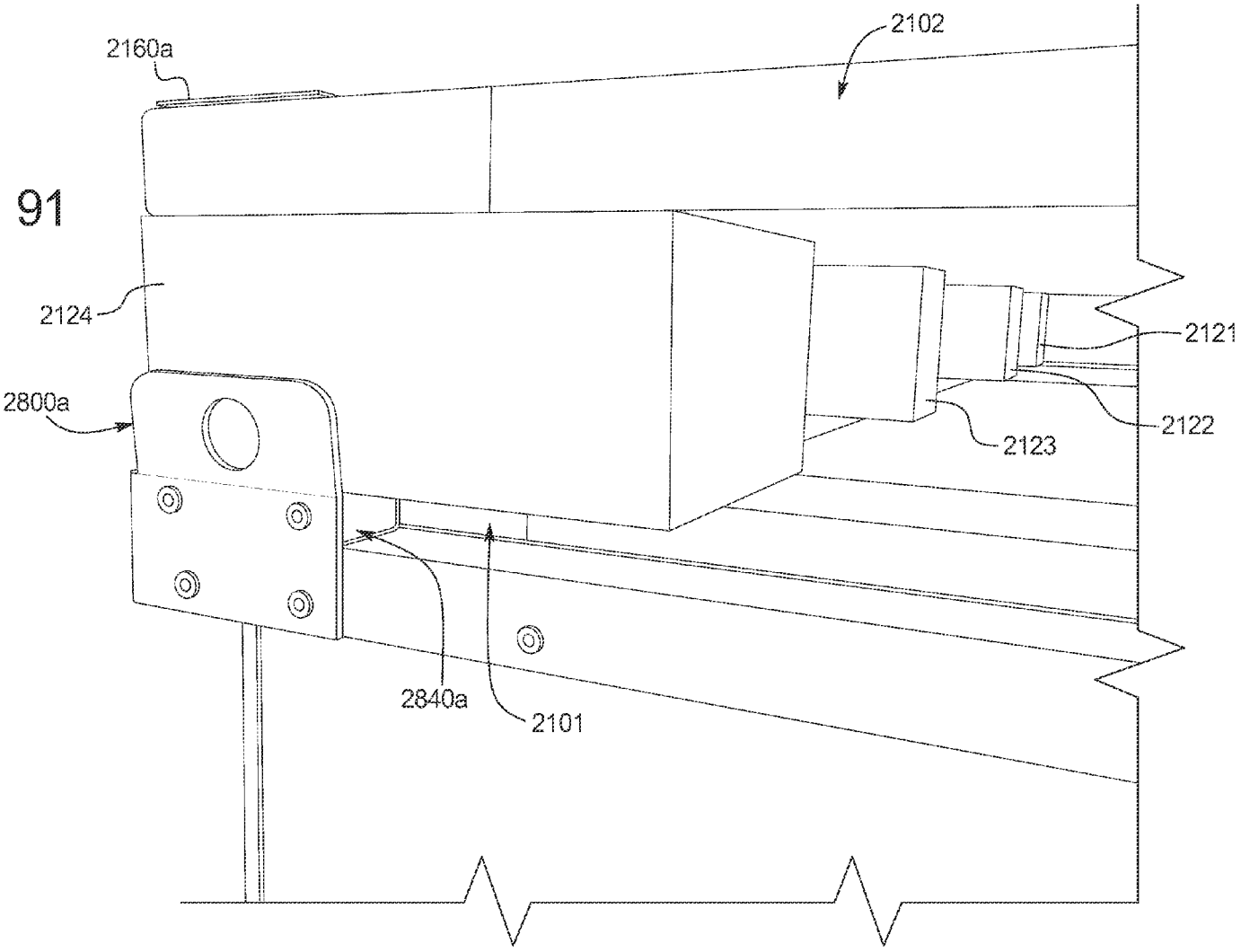
FIG. 91 is a further enlarged fragmentary perspective view of the top compartment of a first shipping container of FIG. 47 and a portion of the pallet of a second shipping container of FIG. 47, where the portion of the pallet is shown stacked on the top compartment of the first shipping container.

It should further be appreciated that in this illustrated embodiment the footing 2101 has a smaller rectangular footprint than the body 2102 and the legs 2121, 2122, 2123, 2124, 2125, 2126, 2127, and 2128 to enable the pallet 2100, and specifically legs 2121, 2124, 2125, and 2128 of the pallet 2100, to sit on another container, and specifically to respectively sit on the nesting supports 2840*a*, 2842*a*, 2840*b*, 2842*b*, 2840*c*, 2842*c*, 2840*d*, and 2842*d* of the top compartment 2300 of another container as best illustrated in FIGS. 89, 90, and 91 and as further described in detail below.

Figure 92:
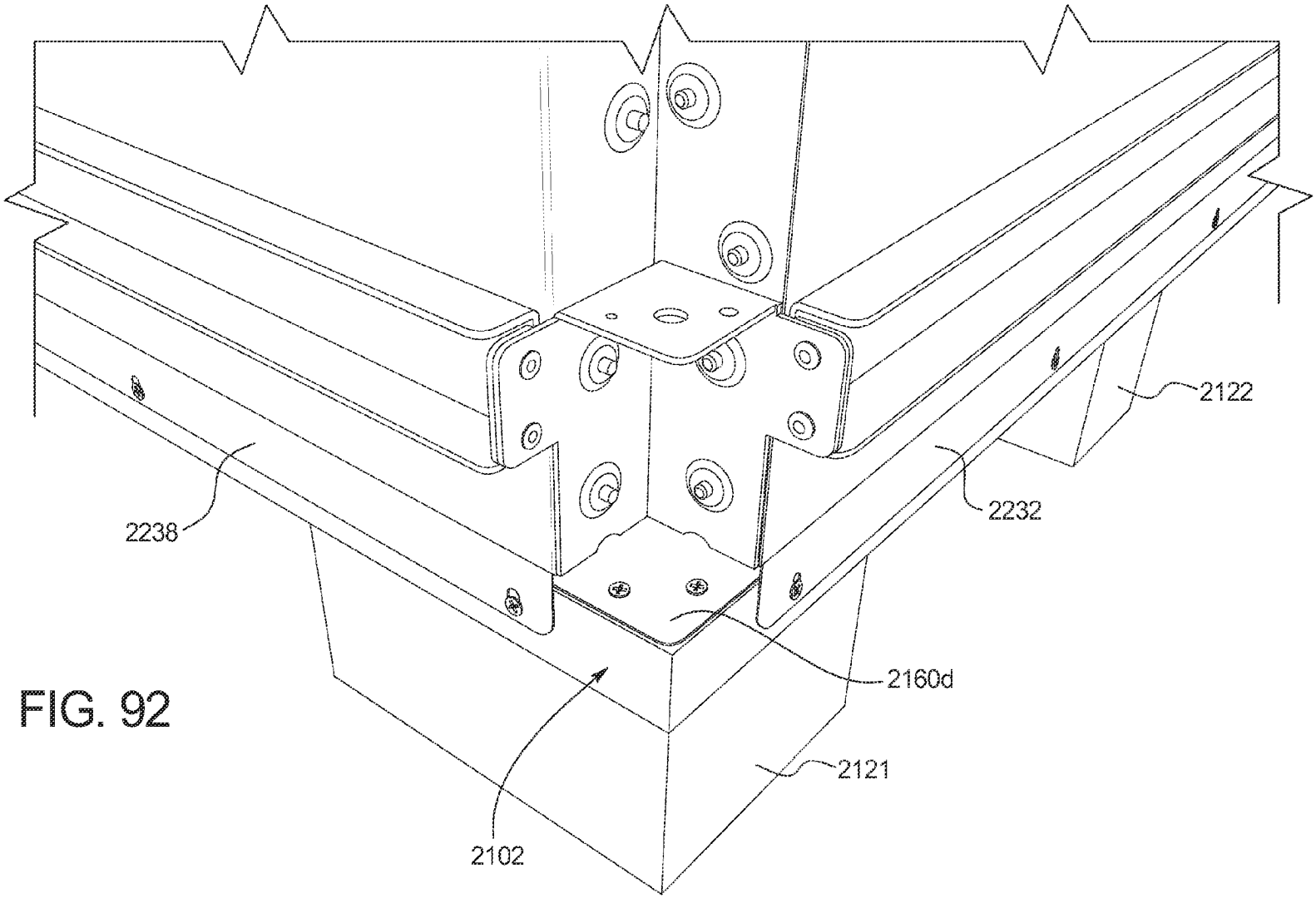
FIG. 92 is an enlarged fragmentary side perspective view of a corner of the bottom compartment of the shipping container of FIG. 47 resting on a corner of pallet of the shipping container of FIG. 47, where the top compartment of the shipping container is in the retracted or collapsed position and the shipping container is empty.
Figure 93:
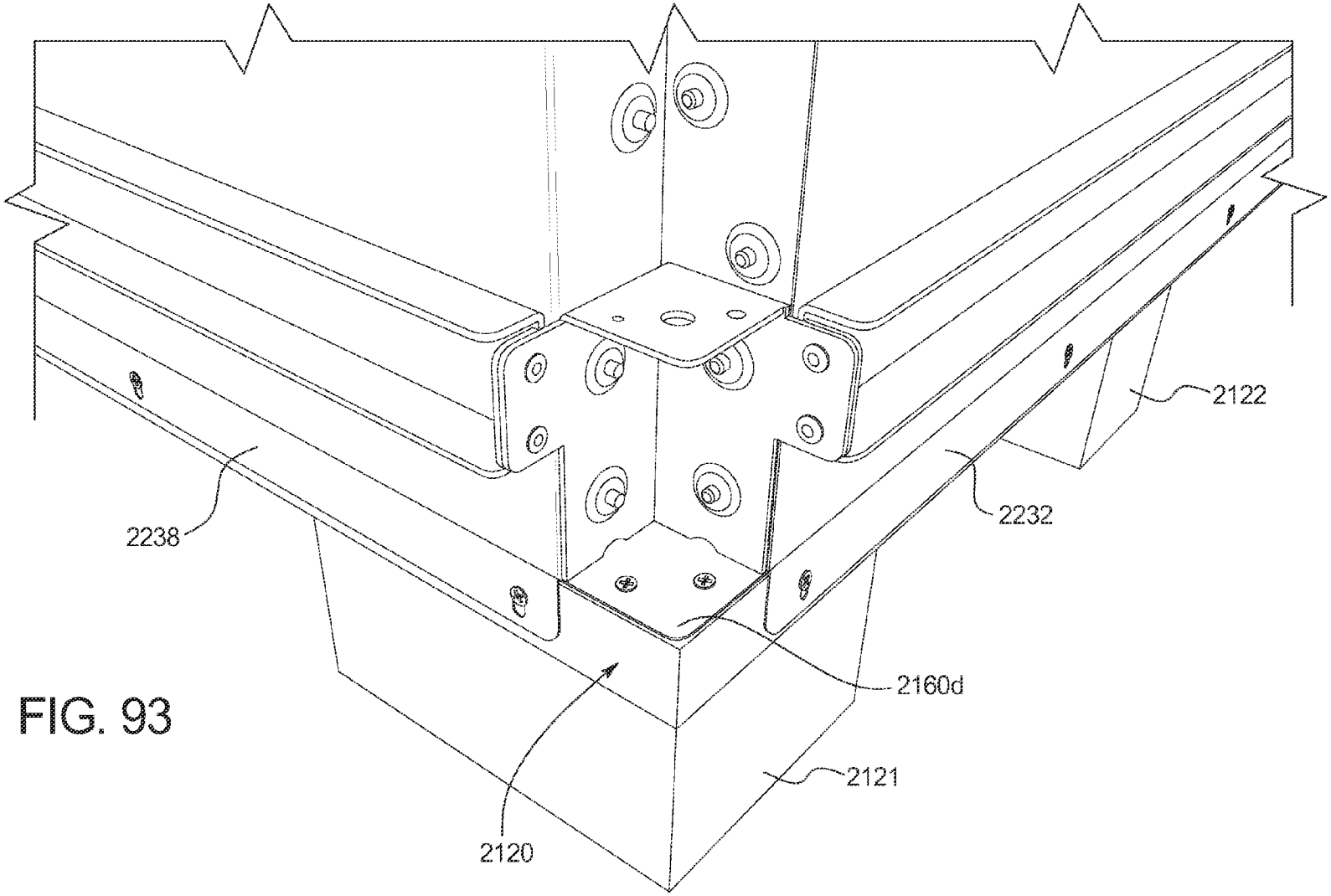
FIG. 93 is an enlarged fragmentary side perspective view of a corner of the bottom compartment of the first shipping container of FIG. 47 resting on a corner of pallet of the shipping container of FIG. 47, where the top 19 compartment of the shipping container is in the retracted or collapsed position and the shipping container is empty.
Figure 94:
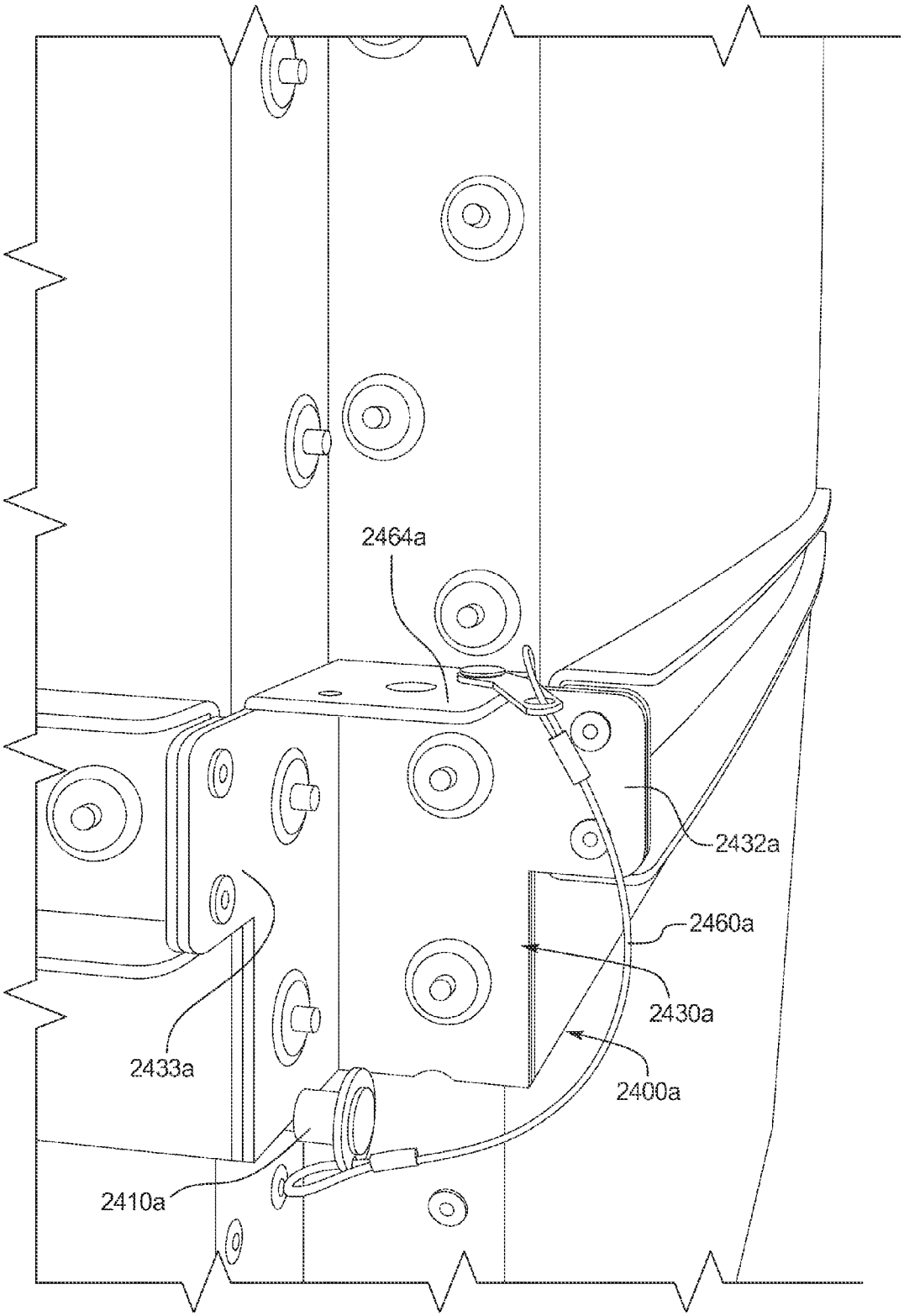
FIG. 94 is an enlarged fragmentary side perspective view of a corner and side wall of the bottom compartment, a corner and side wall of the top compartment, and a side wall of the top compartment of the shipping container of FIG. 47, where the shipping container is full, and the side walls are bowed outwardly.

The plurality of compression guards or plates 2160*a*, 2160*b*, 2160*c*, and 2160*d* are attached to the respective corners of the body 2102 and are each formed from a suitable stainless steel in this illustrated embodiment. It should be appreciated that the compression guards or plates may alternatively be formed from other suitable materials and in other suitable sizes and configurations. The plurality of compression guards or plates 2160*a*, 2160*b*, 2160*c*, and 2160*d* prevent the corners of the bottom compartment 2200 from digging into the body 2102 of the pallet 2100 as best illustrated in FIGS. 92 and 93.

It should also be appreciated that this configuration of the pallet enables the pallet (and thus the entire container) to sit on top of known commercially available containers such as the one or more of commercially available Buckhorn containers which are generally described above.

The bottom compartment 2200 of this example illustrated embodiment includes: (a) a lower exterior bottom wall or panel 2202 defining a material release opening or chute 2204; (b) an upper interior bottom wall 2210 defined by four attached downwardly angled sections or chute ramps 2212, 2214, 2216, and 2218; (c) four wedge shaped interior bottom wall supports or gussets 2222, 2224, 2226, and 2228; (d) spaced apart first and second or front and back exterior walls 2232 and 2236; and (e) spaced apart third and fourth or left and right exterior side walls 2234 and 2238, as generally illustrated in FIGS. 47, 49, 50, 51, 52, 54, 55, 56, 57, 58, and 59. The four sections 2212, 2214, 2216, and 2218 of the upper interior bottom wall 210, the front and back exterior walls 232 and 236, and the exterior side walls 2234 and 2238 define a bottom compartment material holding area or cavity which extends downwardly toward and to the material release opening or chute 2204. In this illustrated embodiment, the lower exterior bottom wall 2202, the upper interior bottom wall 2210, the interior bottom wall supports 2222, 2224, 2226, and 2228, the front and back exterior walls 2232 and 2236, and the exterior side walls 2234 and 2238 are all made of stainless steel or galvanized steel, and are attached by rivets. However, it should be appreciated that in alternative embodiments, one or more of these components can be made from other suitable materials and that these components can be attached or connected in other suitable manners. The exterior bottom wall 2202 of the bottom compartment 2200 is suitably attached to the pallet 2100 of the container 2050 by suitable fasteners as further described below; however, it should be appreciated that the exterior bottom wall can be attached in other suitable manners.

More specifically, the lower exterior bottom wall 2202 includes: (a) a rectangular substantially flat base 2206 which defines the centrally located rectangular material release opening or chute 2204; and (b) an upwardly extending lip 2208 extending upwardly from each of outer edges of the base 2206. The material release opening or chute 2204 enables materials in the top and bottom compartments to flow out of bottom compartment 2200 when the chute door or gate 2510 of the material unloading assembly for the opening or chute 2204 is opened as further discussed below. The opening 2204 in this illustrated embodiment is approximately 8 inches (20.32 centimeters) by approximately 11 inches (27.94 centimeters), although it should be appreciated that the opening may be of other suitable sizes. The opening has four corners which each may have a suitable radius or curve. This size of the opening relative to the size of the bottom and top compartments maximizes the rate of unloading of the material from the top and bottom compartments without sacrificing structure or strength of the bottom compartment.

The interior bottom wall supports 2222, 2224, 2226, and 2228 are attached in spaced apart locations to the top of the base 2206 by rivets, although they can also or alternatively be otherwise attached. Each of the interior bottom wall supports or gussets 2222, 2224, 2226, and 2228 are of a wedge shape such that they are configured to be engaged by and support a respective one of the downwardly angled sections 2212, 2214, 2216, and 2218 of the upper interior bottom wall 2210. The gusset 2222 is wider than the other gussets 2224, 2226, and 2228 in this illustrated embodiment to distribute the weight of the materials supported by gusset 2222 to the pallet 2100 at further spaced apart locations which are not directly over the gate 2510 of the material unloading assembly 2500 (which is further described below). The upper interior bottom wall 2210, and specifically the four downwardly angled sections 2212, 2214, 2216, and 2218 are respectively attached to the interior bottom wall supports or gussets 2222, 2224, 2226, and 2228 by rivets, although they can also or alternatively be otherwise attached. The interior bottom wall supports or gussets 2222 and 2226 are some what shorter than the interior bottom wall supports or gussets 2224 and 2288 to prevent too much weight from being placed on the material unloading assembly 500 and particularly on the gate 2510. The four downwardly angled sections 2212, 2214, 2216, and 2218 each have a lower edge such that when such sections are attached, such sections form an opening 2211 adjacent to and slightly smaller than but generally substantially aligned with the opening 2204 of the base wall 2206. In particular, the lower edges of the four downwardly angled sections 2212, 2214, 2216, and 2218 extend downwardly slightly further than the material release opening or chute 2204 of the base wall 2206 of the bottom compartment 2200. FIGS. 68, 69, 70, 71, 72, and 73 best illustrate that the lower edges of the four downwardly angled sections 2212, 2214, 2216, and 2218 define a slightly smaller opening than the opening 2204 defined by the base wall 2206. This prevents materials stored in the container from getting trapped or positioned between the upper bottom wall and the lower bottom wall.

The upper interior bottom wall 2210, and specifically upper portions of the four downwardly angled sections 2212, 2214, 2216, and 2218 are also respectively attached to and supported by the exterior walls 2232, 2234, 2236, and 2238. It should thus be appreciated that the upper interior bottom wall 210 of the bottom compartment 2200 is supported at multiple locations including multiple points of support by the various different portions of the pallet 2100. More specifically, the sections 2212, 2214, 2216, and 2218 of the upper interior bottom wall 2210 are supported: (a) at their top ends by the exterior walls 2232, 2234, 2236, and 2238 of the bottom compartment 2200; (b) centrally by interior bottom wall supports or gussets 2222, 2224, 2226, and 2228; (c) by attachment to each other; and (d) overall by the pallet 2100.

As seen in FIGS. 47, 48, 49, 50, 51, 54, 55, 77, and 90, and as best seen in FIGS. 92 and 93, the exterior walls 2232, 2234, 2236, and 2238 of the bottom compartment 2200 also each includes a skirt that extends downwardly along a respective different side of the pallet 2100. Each skirt includes a plurality of fastener slots or oval screw holes which are configured to facilitate movement of each exterior wall and particularly the skirt relative to the fasteners. More specifically, as seen in FIGS. 92 and 93, suitable fasteners such as screws are used to attach each skirt to the respective side of the pallet 2100 and particularly the body 2102 of the pallet 2100 to support these exterior walls. In FIG. 92, the container 2050 is collapsed and is empty and the skirt is positioned such that the screws are respectively at the bottom of the slots. In FIG. 93, the container 2050 is collapsed and is filled and the skirt has moved downwardly relative to the body 2102 of the pallet 2100 and is positioned such that the screws are at the top of the slots. The skirts of the exterior walls, and thus the entire the exterior walls of the bottom container have moved downwardly relative to the pallet and particularly relative to the body 2102 of the pallet 2100. It should be appreciated that the bottom compartment is thus configured to move relative to the pallet when filled. It should also be appreciated that the slots may be of different sizes such that in these positions, the screws are adjacent to but not at the tops or bottoms of the slots.

As generally illustrated in FIGS. 47, 48, 49, 50, 51, 52, 53, 54, 55 and as best illustrated in FIGS. 80, 81, 82, 83, 95A, 95B, 96A, and 96B, each of the exterior walls 2232, 2234, 2236, and 2238 of the bottom compartment 2210 each include a rectangular panel and two L-shaped corner sections attached to opposite ends of the rectangular panel. Each L-shaped corner section of each panel of each exterior wall is configured to mate with the L-shaped corner of an adjacent exterior wall. These L-shaped corner sections of each of the exterior side wall: (a) are preferably connected rivets; (b) add structural rigidity to the bottom compartment; and (c) in conjunction with the top compartment support assemblies (discussed below) provide support for the top compartment when the top compartment is in the expanded position as further described below.

More specifically, as illustrated in FIGS. 80, 81, 82, 83, 95A, 95B, 96A, and 96B, exterior side wall 2232 includes panel 2252 and corner 2262 which includes corner sections 2262*a* and 2262*b*, and exterior side wall 2234 includes panel 2254 and corner 2264 which includes corner sections 2264*a* and 2264*b*. Corner sections 2264*a* is mated with and attached to corner section 2262*a*, and corner section 2264*b* is mated with and attached to corner section 2262*b* to form this corner of the bottom compartment 2200. It should be appreciated that each corner of the bottom compartment is preferably configured in a similar manner. In this illustrated embodiment, each of the exterior walls 2232, 2234, 2236, and 2238 of the bottom compartment 2210 also includes a top edge which is curled or bent over to provide extra strength to the bottom compartment and to minimize interference with movement of the top compartment 2300 relative to the bottom compartment 2200. These corners and the top compartment support assemblies are further described below.

Turning now to FIGS. 47, 48, 50, 51, 52, and 54, the top compartment 2300 of the container 2050 includes an exterior top wall 2302, spaced apart exterior front and back side walls 2312 and 2316, spaced apart exterior side walls 2316 and 2318, and exterior wall support brackets 2322, 2324, 2326, and 2328 respectively attached to the exterior side walls 2312, 2314, 2316, and 2318. In this illustrated embodiment, the exterior top wall 2302, exterior side walls 2312, 2314, 2316, and 2318, and exterior wall support brackets 2322, 2324, 2326, and 2328 are also all made of stainless steel or galvanized steel. The upper interior base wall 2306 is suitably attached to the upper portions of the exterior walls 2312, 2314, 2316, and 2318 by rivets. The exterior wall support brackets 2322, 2324, 2326, and 2328 are respectively attached to the exterior side walls 2312, 2314, 2316, and 2318 by rivets. However, it should be appreciated that in alternative embodiments, one or more of these components can be made from other suitable materials and attached or connected in any suitable manner. The upper interior base wall 2306 and the exterior walls 2312, 2314, 2316, and 2318 define a top compartment material holding area or cavity which extends downwardly to the bottom compartment material holding area or cavity.

As with container 50, the exterior top wall 2302 of container 2050 includes a rectangular substantially flat base which defines the centrally located rectangular material receipt or loading opening or chute (not shown in FIGS. 47 to 96B). This material receipt or loading opening or chute enables materials to flow into the top and bottom compartments when the cover of the material loading assembly is opened. The opening in this embodiment is 18 inches (45.72 centimeters) by 18 inches (45.72 centimeters), although it should be appreciated that the opening may be of other suitable sizes.

As best illustrated in FIGS. 95A, 95B, 96A, and 96B, similar to the configuration of the bottom compartment, each of the exterior walls 2312, 2314, 2316, and 2318 of the top compartment 2300 include a rectangular panel and two L-shaped corner sections attached to opposite ends of the panel. Each L-shaped corner section of each panel of each exterior wall is configured to mate with the L-shaped corner of the adjacent exterior wall similar to the bottom compartment. These L-shaped corner sections of each of the exterior side wall of the top compartment are preferably connected by welding and add structural rigidity to the top compartment.

More specifically, as illustrated in FIGS. 95A, 95B, 96A, and 96B, exterior side wall 2312 includes panel 2352 and corner 2362 which includes corner sections 2362*a* and 2362*b*, and exterior side wall 2314 includes panel 2354 and corner 2364 which includes corner sections 2364*a* and 2364*b*. Corner sections 2364*a* is mated with and attached to corner section 2362*a*, and corner section 2364*b* is mated with and attached to corner section 2362*b* to form this corner of the top compartment 2300. It should be appreciated that each corner of the top compartment is preferably configured in a similar manner. In this illustrated embodiment, each of the exterior walls 2312, 2314, 2316, and 2318 of the bottom compartment 2210 also includes a top edge which is curled or bent over to provide extra strength to the top compartment 2300.

Figure 95A:
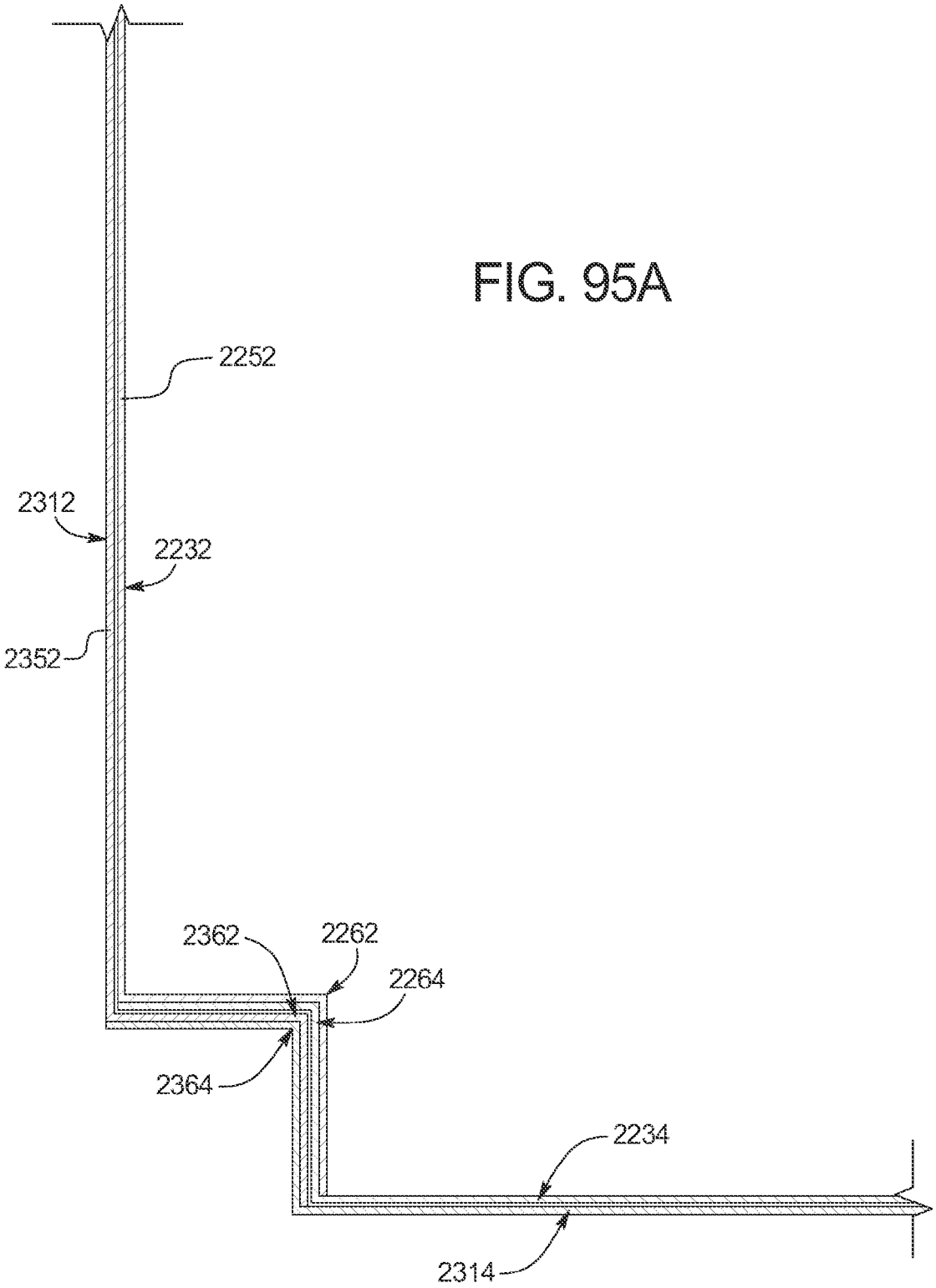
FIG. 95A is a fragmentary cross section view of two of the side walls and the corner between those side walls of the bottom compartment, and two of the side walls and the corner between those side walls of the top compartment of the shipping container of FIG. 47, where the shipping container is empty.
Figure 96A:
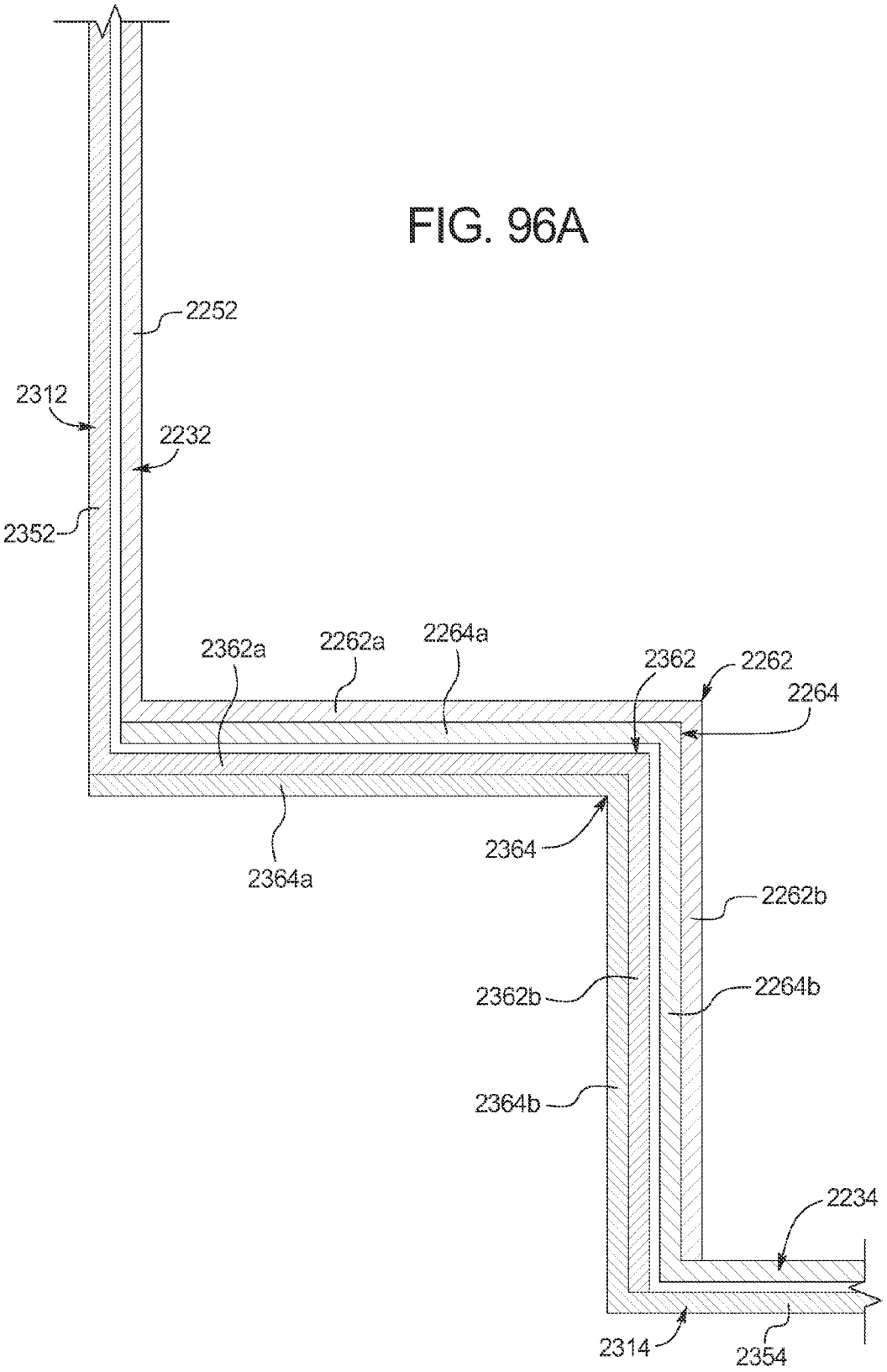
FIG. 96A is an enlarged fragmentary cross section view of two of the side walls and the corner between those side walls of the bottom compartment, and two of the side walls and the corner between those side walls of the top compartment of the shipping container of FIG. 47, where the shipping container is empty.

FIGS. 95A and 96A illustrate the position of these walls and corners of the top and bottom compartments when the container is empty and the container is in the expanded position. It should be appreciated that the exact amount of the space between the corners of the top and bottom compartments can vary in accordance with the present disclosure and in accordance with manufacturing tolerances. The figures illustrate that when the container 2050 is empty, the corner of the top compartment can relatively easily move vertically relative to the corner of the bottom compartment.

Figure 95B:
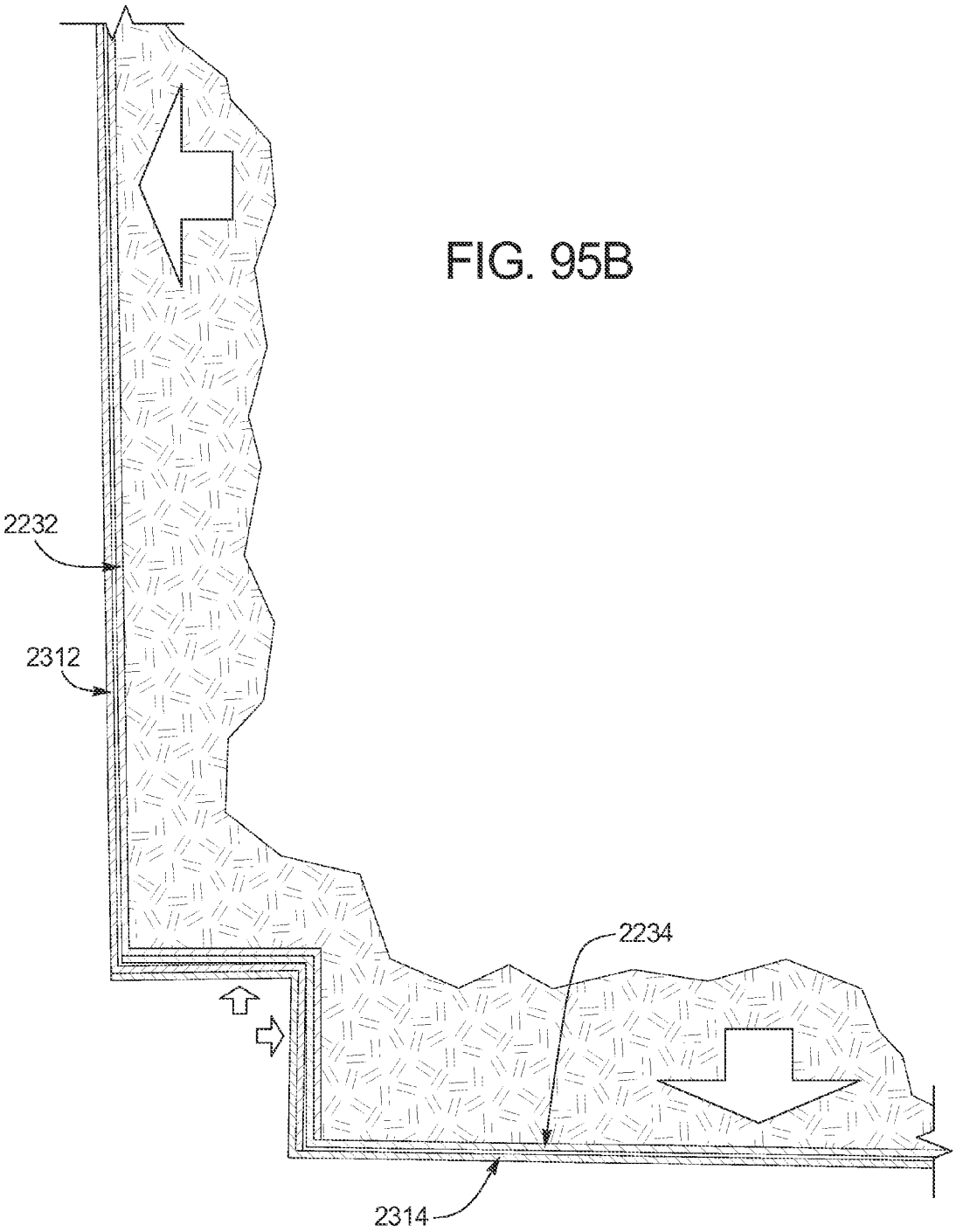
FIG. 95B is a fragmentary cross section view of two of the side walls and the corner between those side walls of the bottom compartment, and two of the side walls and the corner between those side walls of the top compartment of the shipping container of FIG. 47, where the shipping container is full and the side walls are bowed outwardly.
Figure 96B:
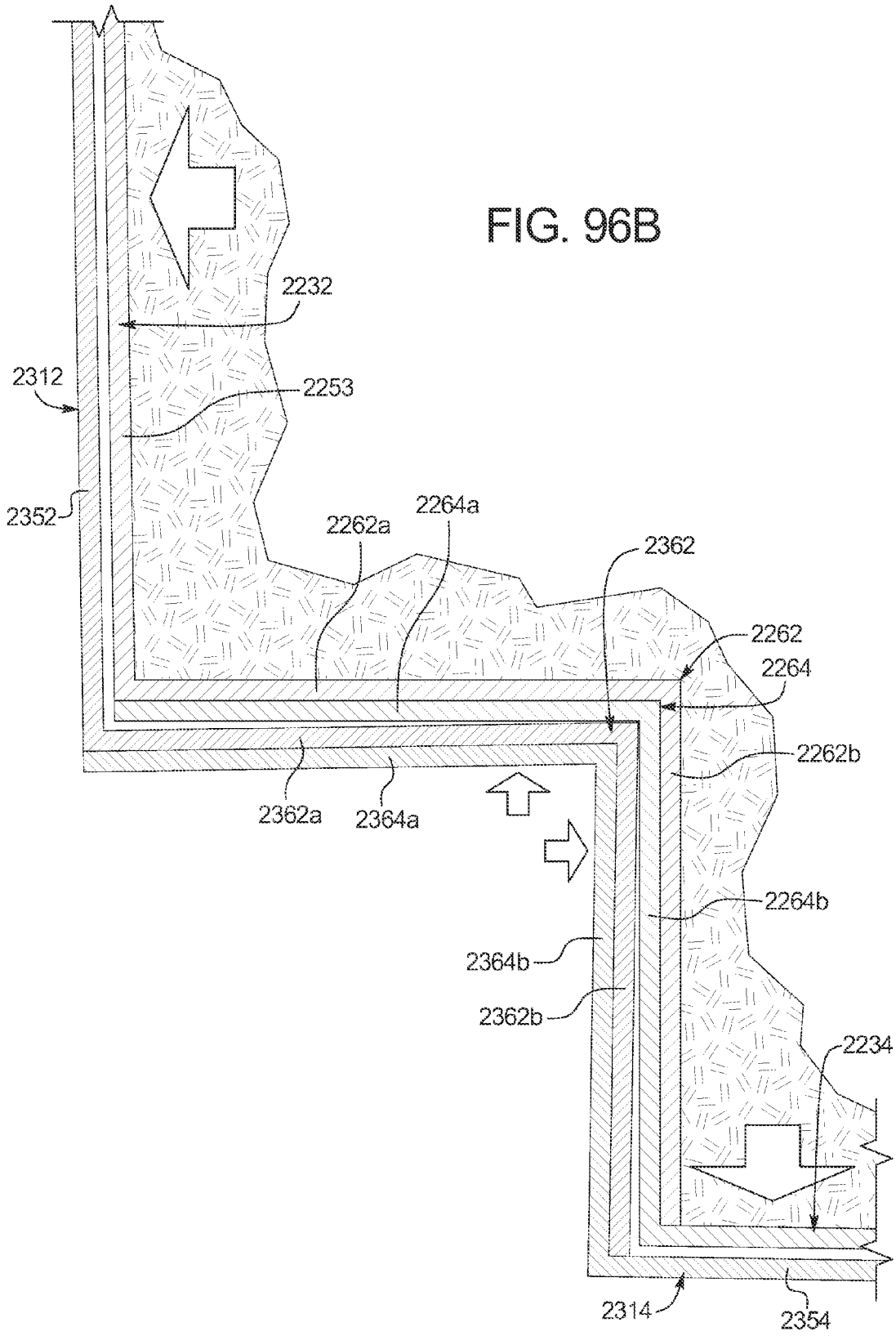
FIG. 96B is an enlarged fragmentary cross section view of two of the side walls and the corner between those side walls of the bottom compartment, and two of the side walls and the corner between those side walls of the top compartment of the shipping container of FIG. 47, where the shipping container is full and the side walls are bowed outwardly.

FIGS. 95B and 96B illustrate the position of these walls and corners of the top and bottom compartments when the container is full and the container is in the expanded position. These figures illustrate that when the container 2050 is full, the wall panels of the top and bottom compartment are configured to bow outwardly as very generally illustrated in FIG. 94 and that an engagement is created or formed between the sections of the corners of the top and bottom compartments as generally illustrated in FIGS. 95B and 96B. This engagement of the corners causes the corners of the top compartment to engage and grip the corners of the bottom compartment, which holds the relative position of the top compartment to the bottom compartment (in addition to the support provided by the top compartment support assemblies as further discussed below.) It should also be appreciated that this top corner to bottom corner engagement may happen at one corner, more than one corner, or all of the corners of the container. It should also be appreciated that this corner engagement may occur in the embodiment of FIGS. 1 to 46 described above.

Turing now to FIGS. 47, 48, 49, 50, 53, 54, 58, 59, 60, 61, 65, 66, 67, 68, 69, 70, 71, 72, 73, 74, 75, 76, 77, 78, and 79, the material unloading assembly 2500 of the container 2050 is supported by the bottom wall 2206 of the bottom compartment 2200 adjacent to the opening or chute 2204 in the bottom compartment 2200 and above the opening 2170 in the pallet 2100. The material unloading assembly 2500 generally includes a chute door or gate 2510 slidably positioned on the guide rails 2163, 2165, 2167, and 2169. In this illustrated embodiment, the gate 2510 and the guide rails are 2163, 2165, 2167, and 2169 are made of stainless steel or galvanized steel. However, it should be appreciated that in alternative embodiments, the gate and the guide rails can be made from other suitable materials.

Figure 65:
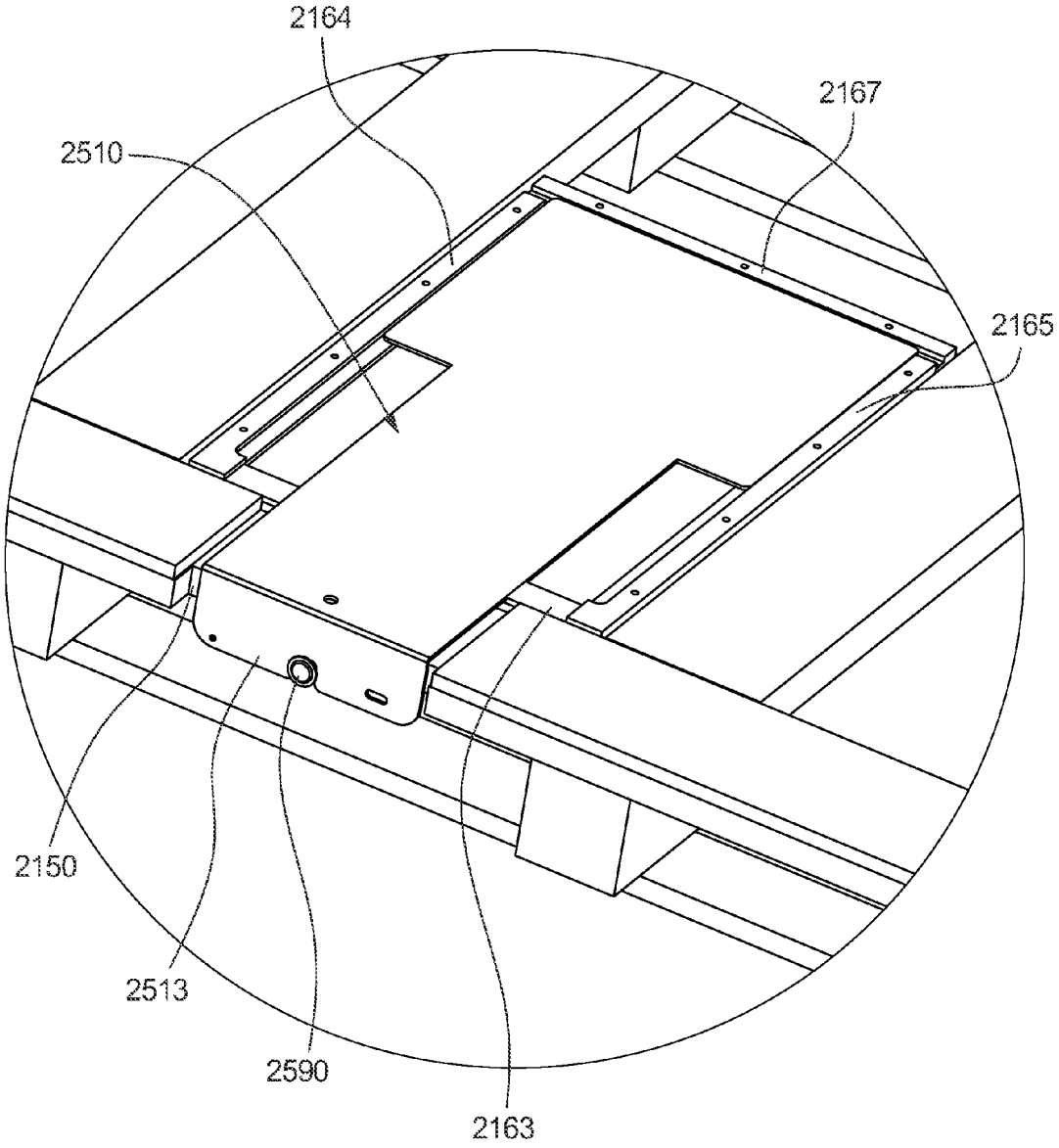
FIG. 65 is an enlarged fragmentary top perspective view of a part of the central portion of the pallet of the shipping container of FIG. 47, shown removed from the bottom compartment of the container, and illustrating the position of the guide rails and the gate of the material unloading assembly detached from the bottom compartment and with the gate in the closed position.
Figure 66:
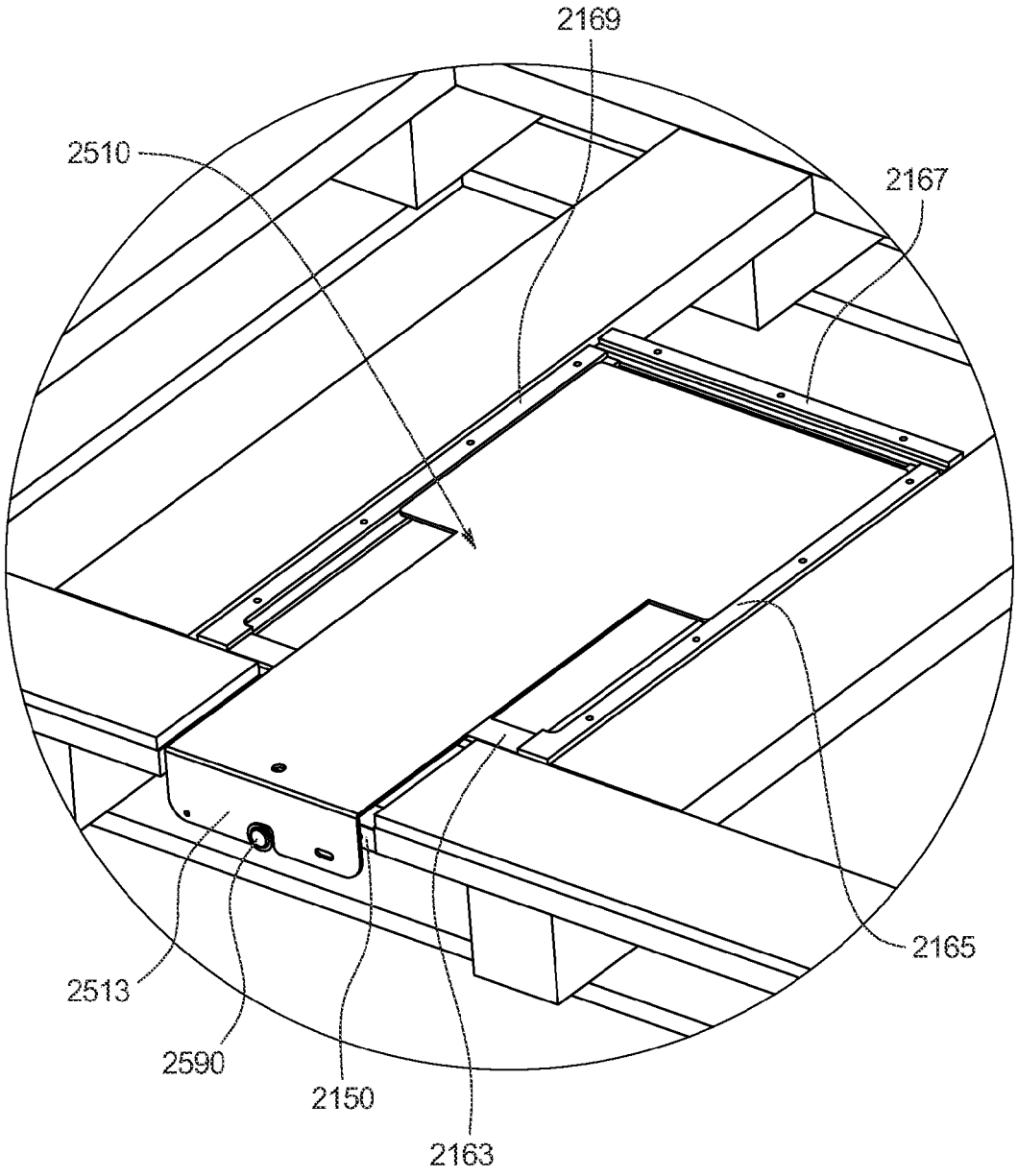
FIG. 66 is an enlarged fragmentary top perspective view of a part of the central portion of the pallet of the shipping container of FIG. 47, shown removed from the bottom compartment of the container and illustrating the guide rails and the gate of the material unloading assembly detached from the bottom compartment and with the gate in a partially open position.
Figure 67:
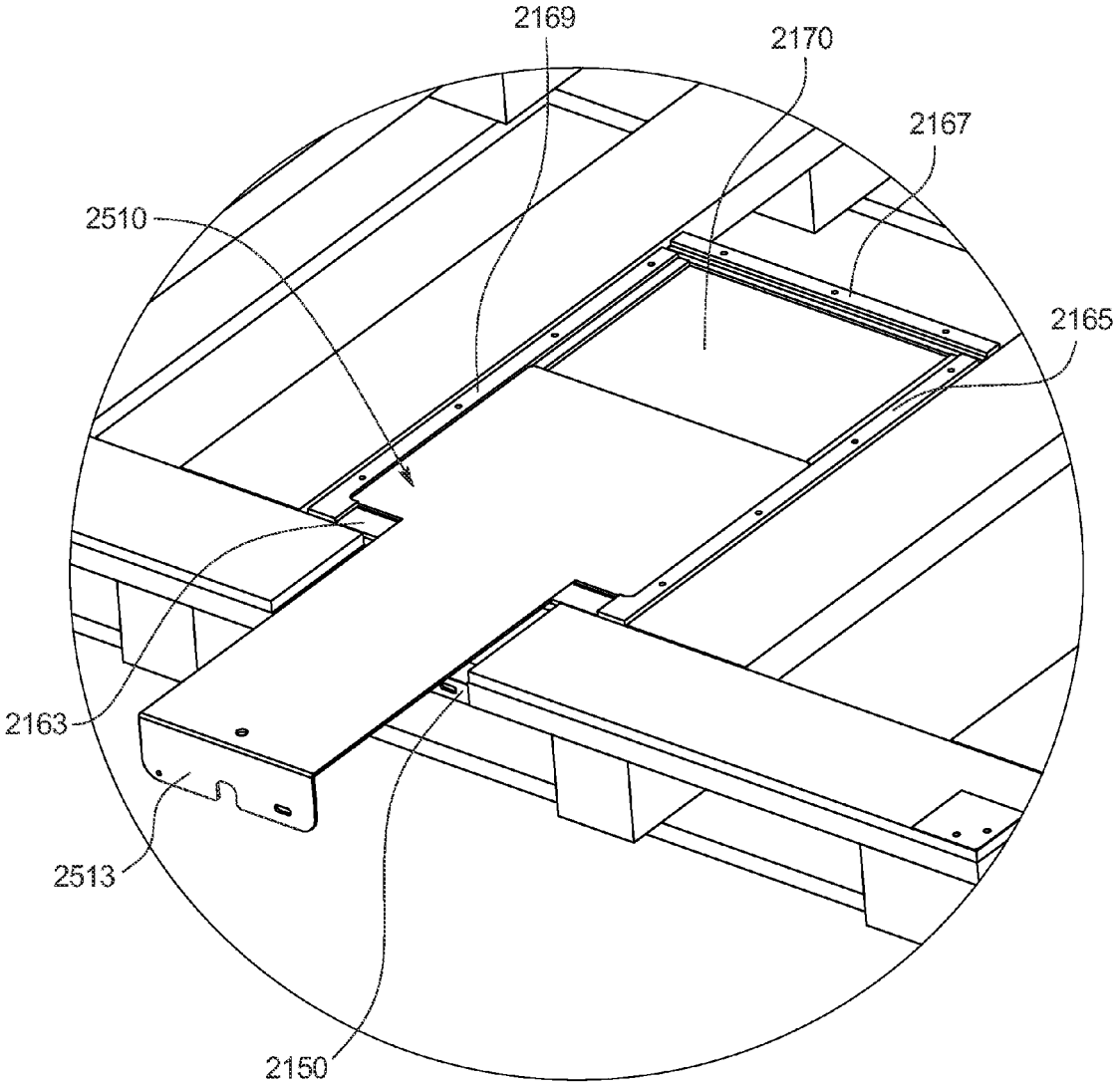
FIG. 67 is an enlarged fragmentary top perspective view of a part of the central portion of the pallet of the shipping container of FIG. 47, shown removed from the bottom compartment of the container and illustrating the guide rails and the gate of the material unloading assembly detached from the bottom compartment and with the gate in a fully open position.

The guide rails 2163, 2165, 2167, and 2169 are each respectively attached to the bottom exterior surface of the bottom wall 2206. It should be appreciated that FIGS. 60, 61, 65, 66, and 67 illustrate these guide rails 2163, 2165, 2167, and 2169 detached from or without the exterior bottom wall 2206 to show how they are positioned with respect to the pallet 2100 and the opening 2170 defined by the pallet 2100. The guide rails 2163, 2165, 2167, and 2169, support and guide the movement of closure portion 2516 and the handle portion 2512 of the chute door or gate 2510. The gate 2510 slides or moves above and on these guide rails 2163, 2165, 2167, and 2169, and these guide rails prevent the downward movement of the chute door or gate when the container is full and also prevent loose materials being held in the top and bottom compartments from accumulating on or adjacent to the chute door or gate. The guide rails 2165 and 2169 include stops or stopping members which prevent the gate from moving outwardly too far and are generally illustrated in FIGS. 65, 66, and 67.

Figure 74:
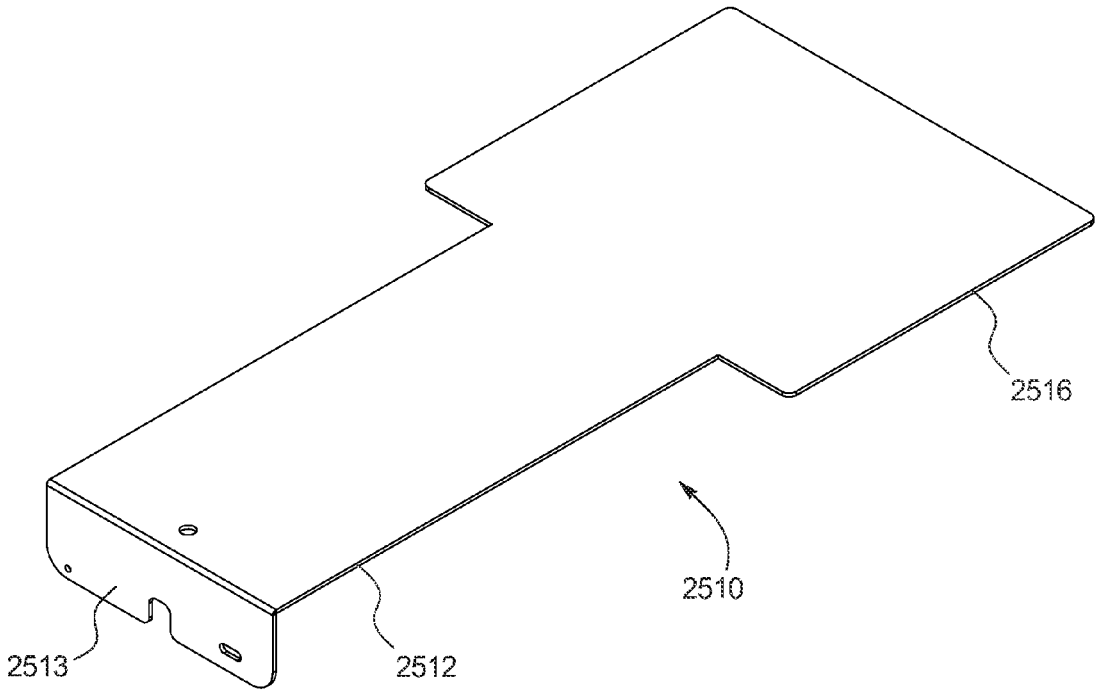
FIG. 74 is an enlarged perspective view of the gate of the material unloading assembly of the shipping container of FIG. 47.
Figure 75:
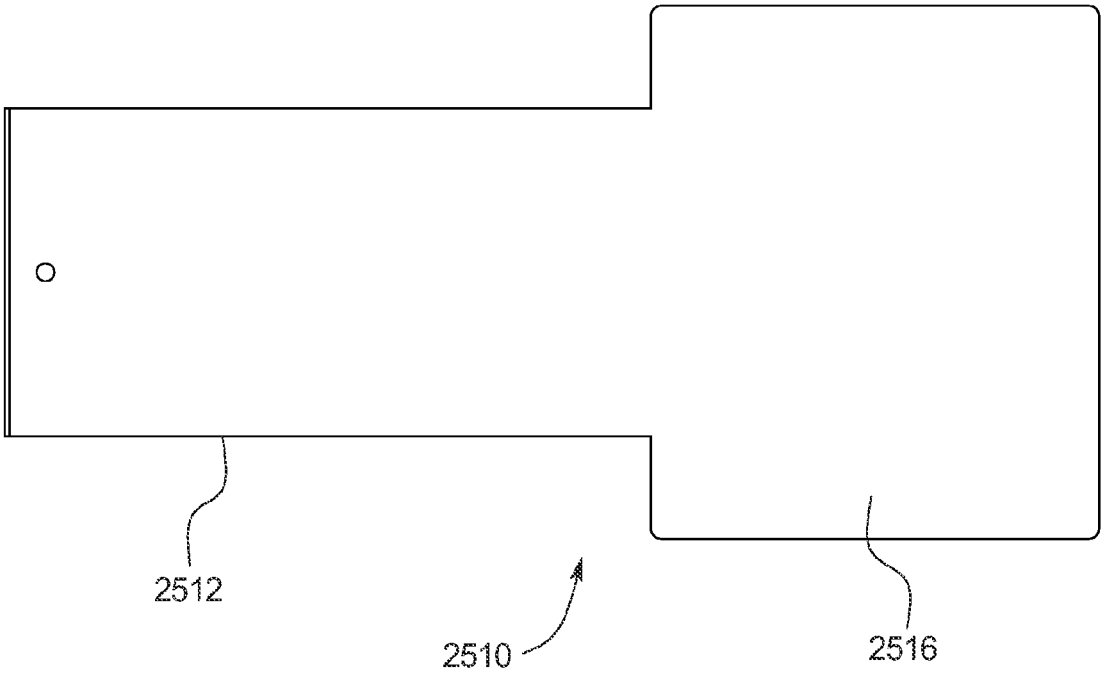
FIG. 75 is an enlarged top view of the gate of the material unloading assembly of the shipping container of FIG. 47.
Figure 76:
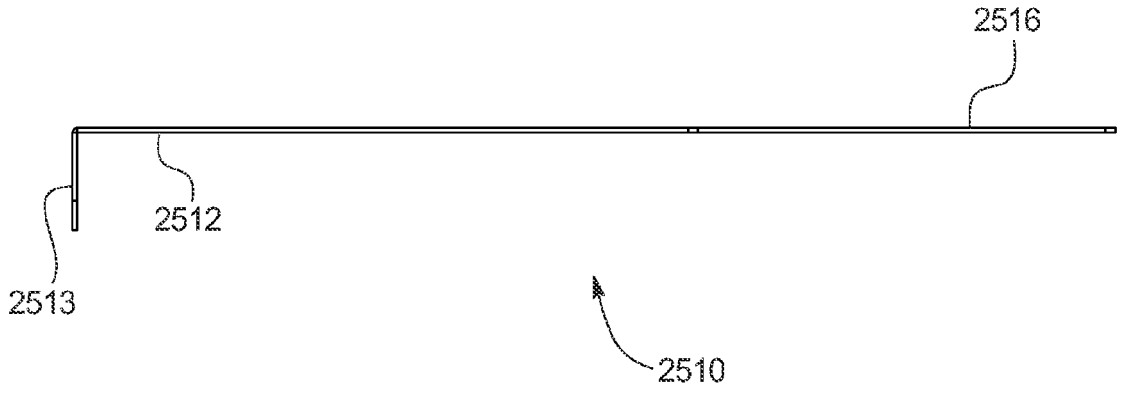
FIG. 76 is an enlarged side view of the gate of the material unloading assembly of the shipping container of FIG. 47.
Figure 77:
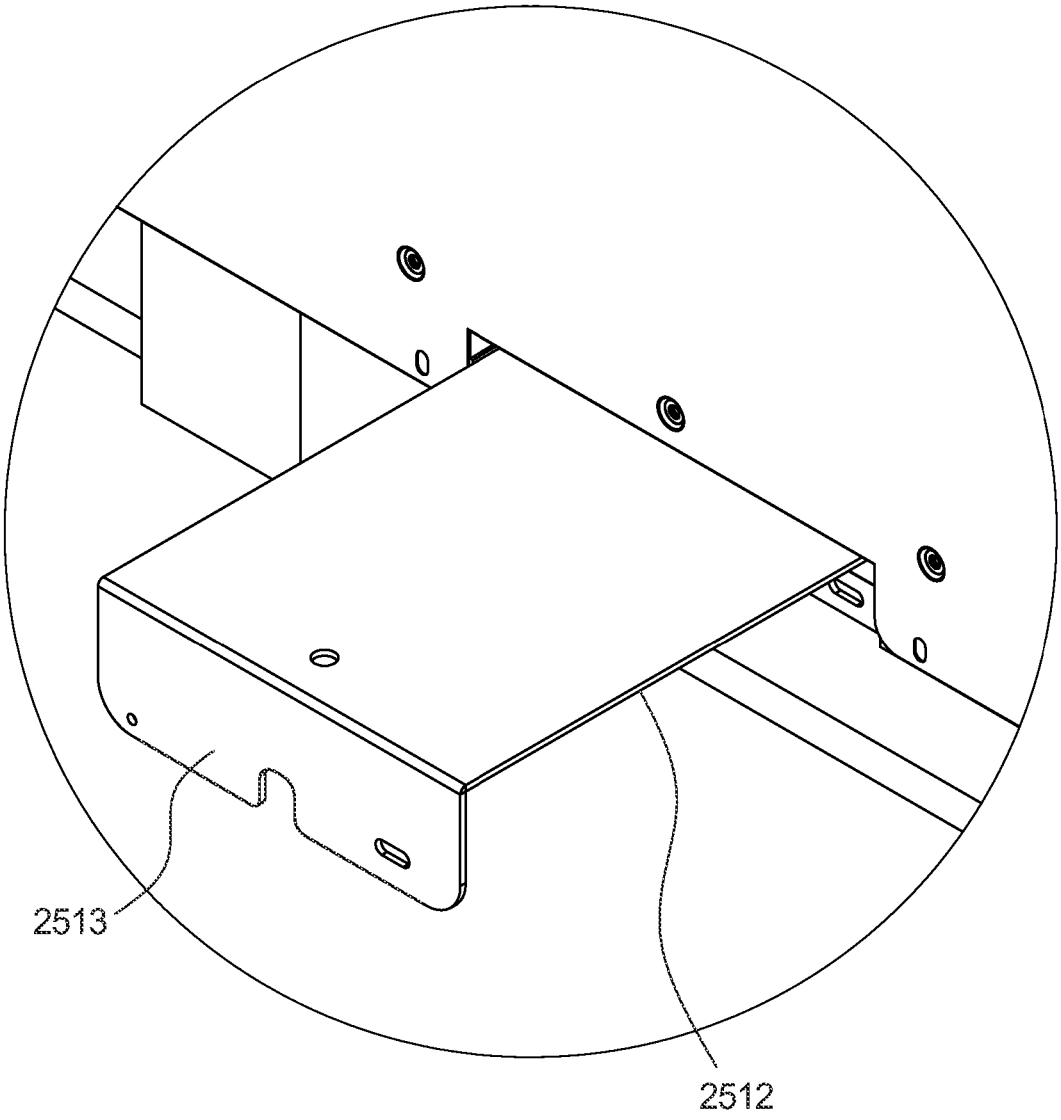
FIG. 77 is an enlarged fragmentary perspective view of the central portion of the pallet and a part of the bottom compartment of the shipping container of FIG. 47, and illustrating the locking pin and the handle of the gate of the material unloading assembly in an open position.
Figure 78:
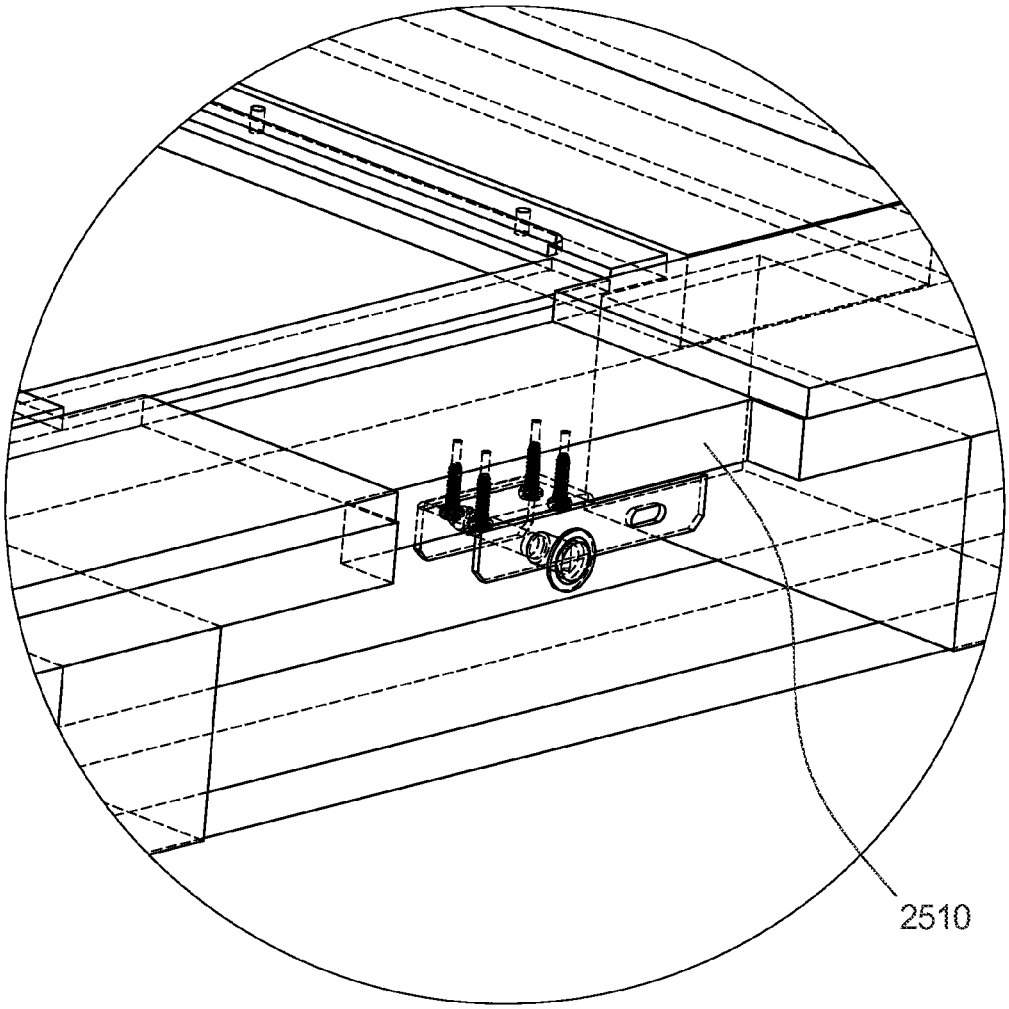
FIG. 78 is an enlarged fragmentary front perspective view of the central portion of the pallet and a part of the bottom compartment of the shipping container of FIG. 47, and illustrating the locking pin of the handle of the gate of the material unloading assembly.
Figure 79:
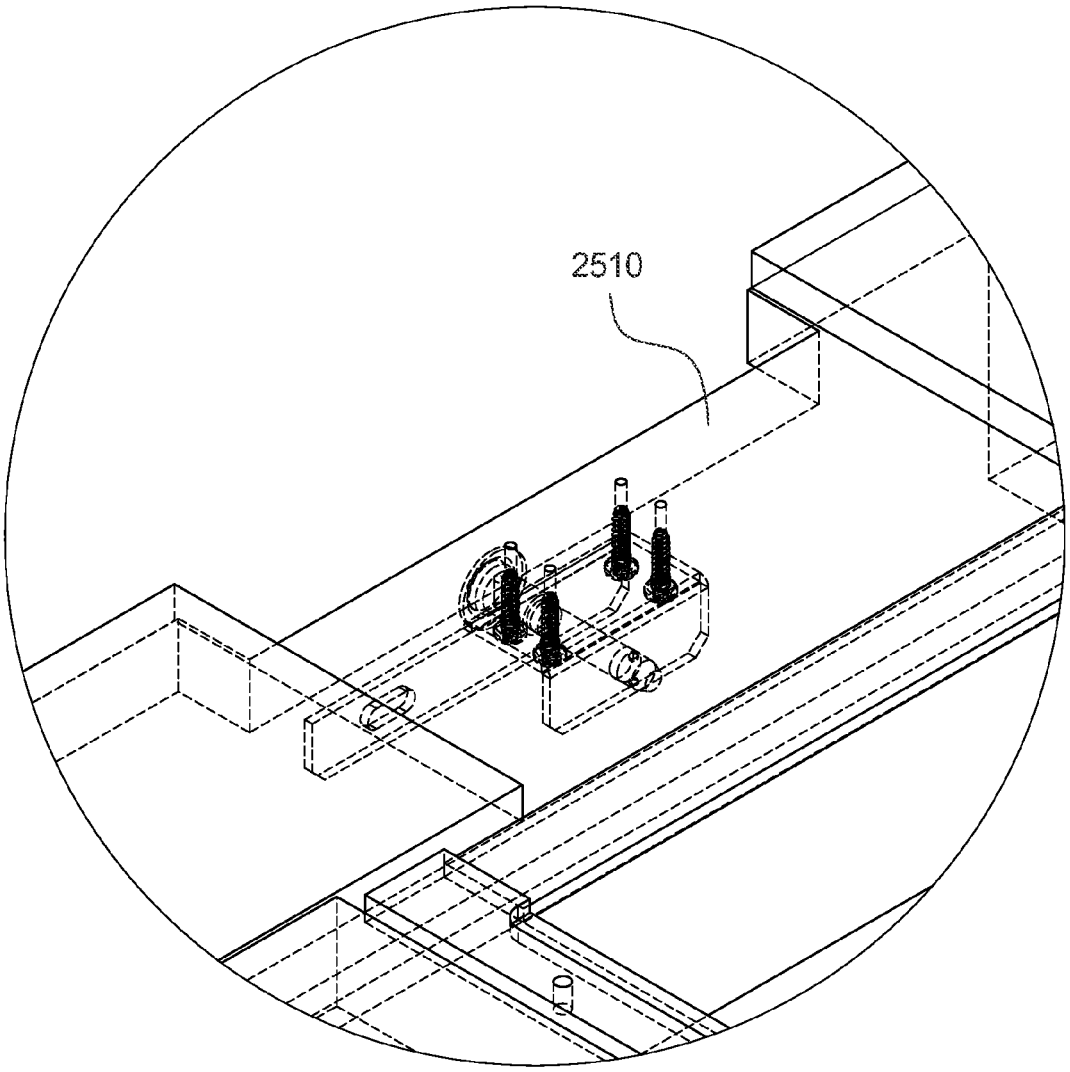
FIG. 79 is an enlarged fragmentary rear perspective view of the central portion of the pallet and a part of the bottom compartment of the shipping container of FIG. 47, and illustrating the locking pin of the handle of the gate of the material unloading assembly.
Figure 80:
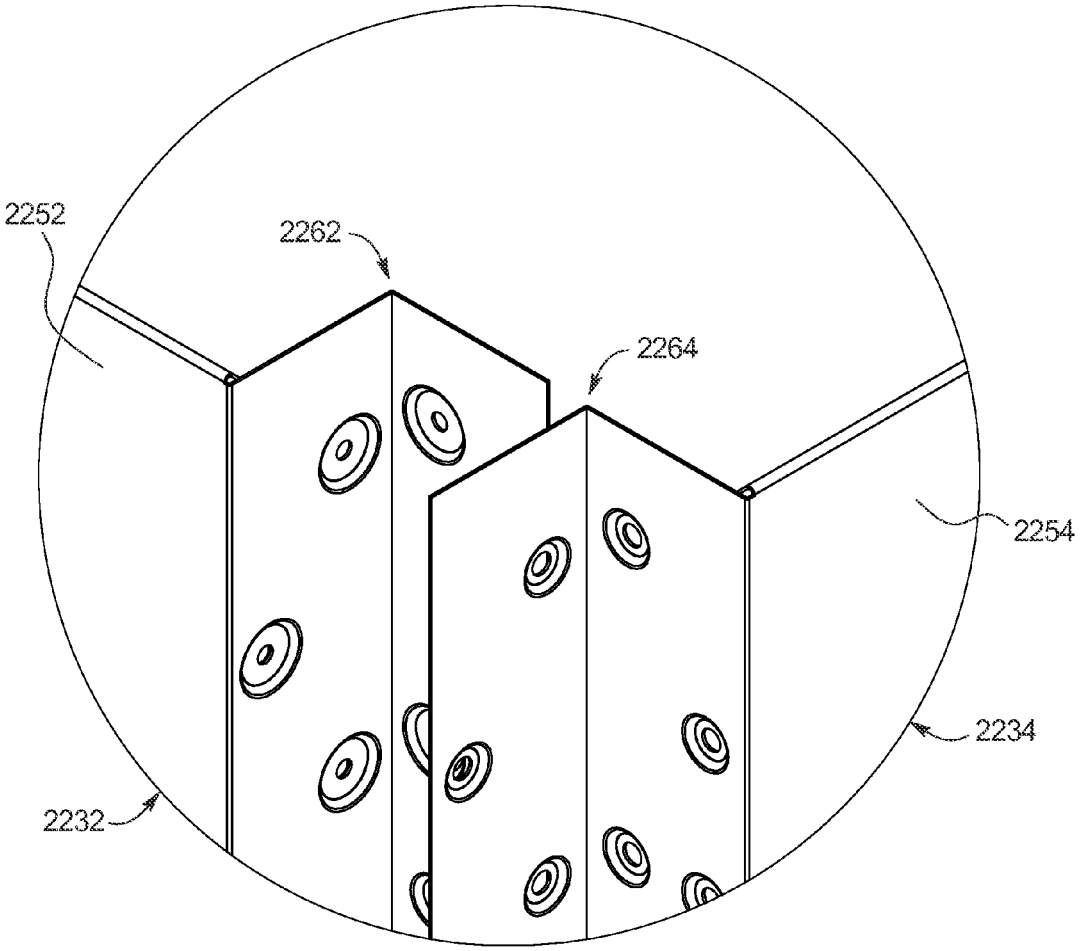
FIG. 80 is an enlarged fragmentary exploded perspective view of the corner wall construction of one of the corners of the bottom compartment of the shipping container of FIG. 47, and illustrating the sections of the corner before being attached.
Figure 81:
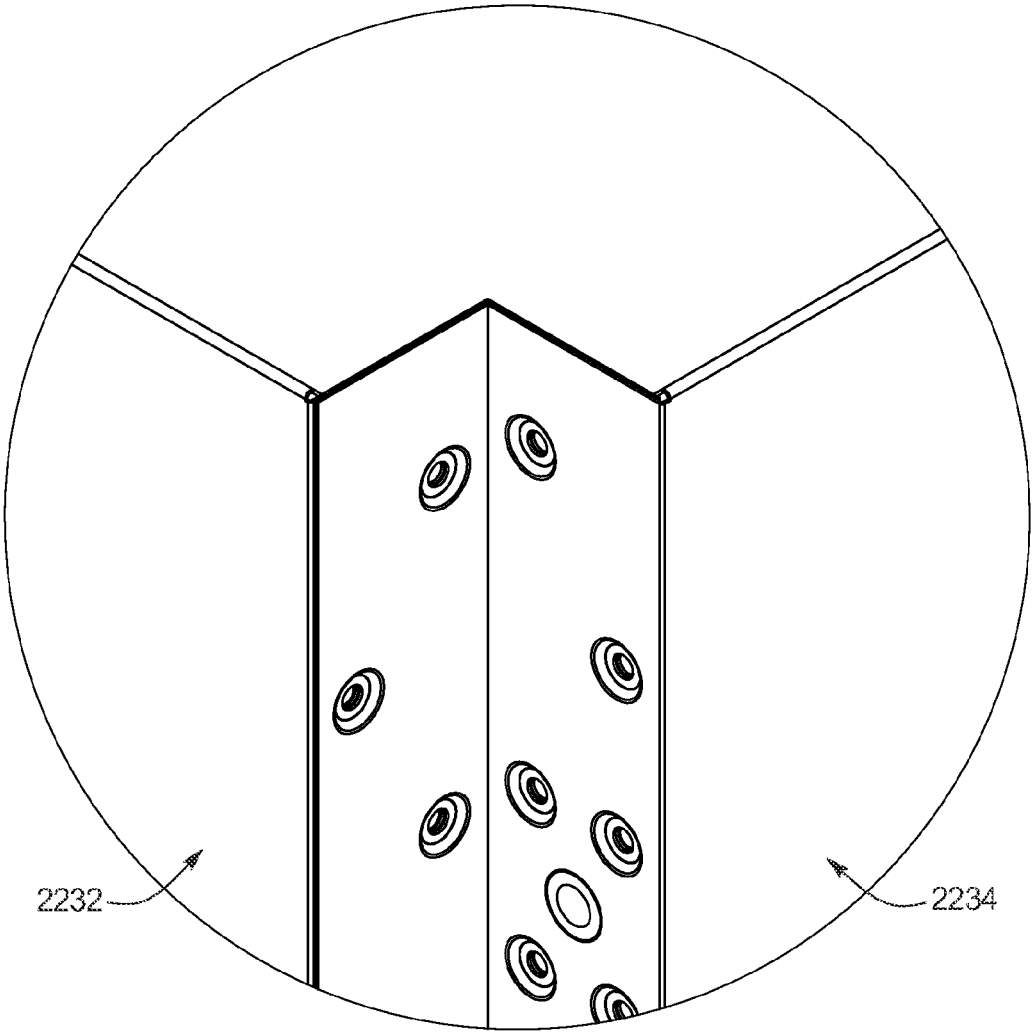
FIG. 81 is an enlarged fragmentary perspective view of the corner wall construction of one of the corners of the bottom compartment of the shipping container of FIG. 47, and illustrating sections of the corner after being attached.
Figure 82:
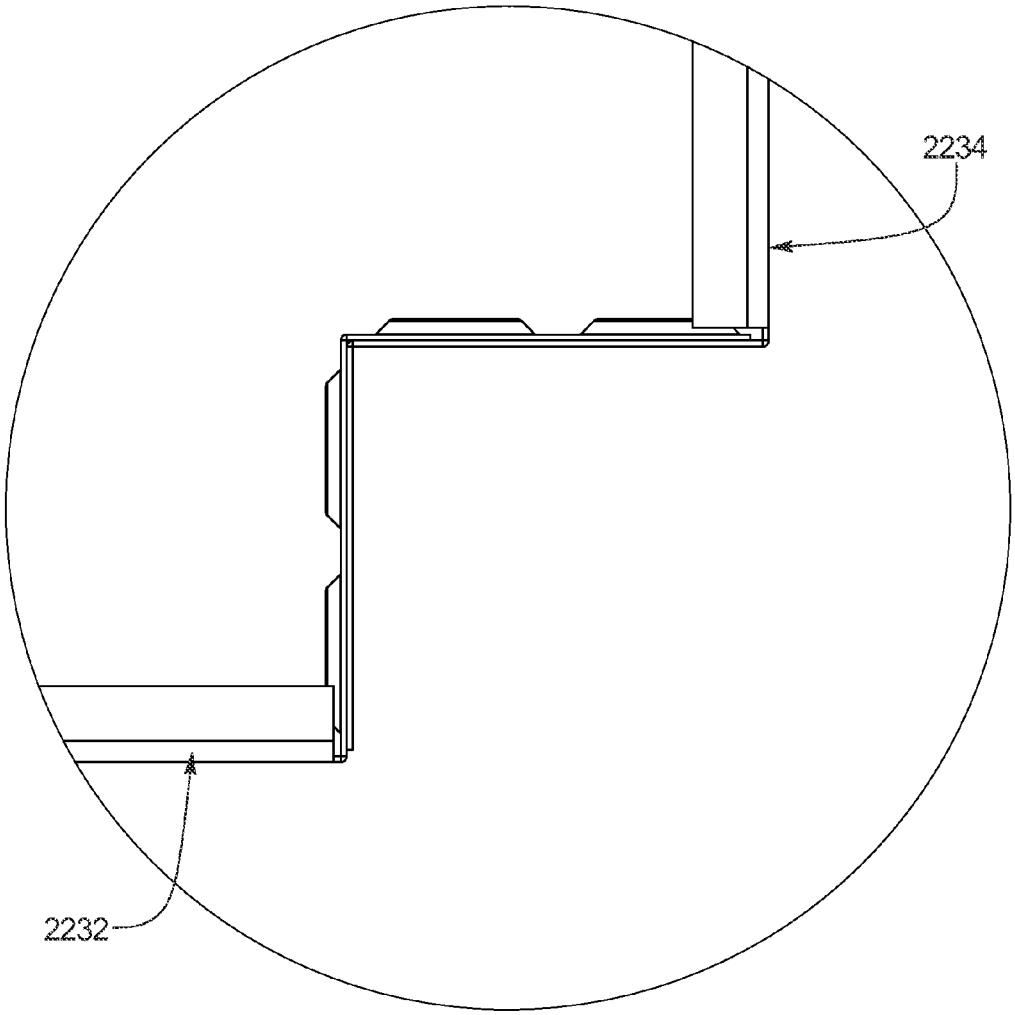
FIG. 82 is an enlarged fragmentary top view of the corner wall construction of one of the corners of the bottom compartment of the shipping container of FIG. 47, and illustrating the sections of the corner after being attached.
Figure 83:
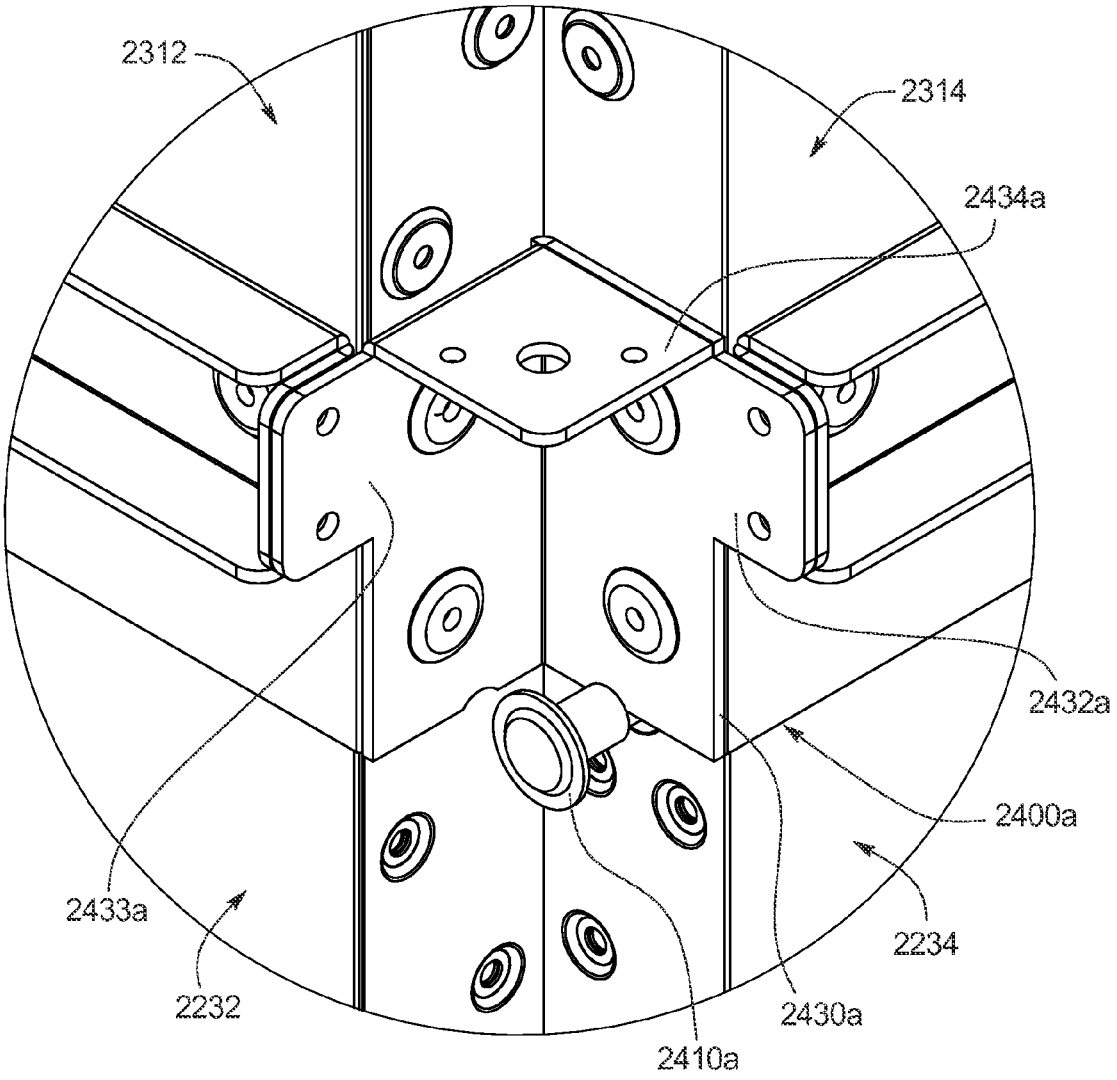
FIG. 83 is an enlarged fragmentary perspective view of part of one of the top compartment support assemblies of the shipping container of FIG. 47, and illustrating the locking pin of the assembly inserted in the pin receipt in a corner of the bottom compartment.
Figure 84:
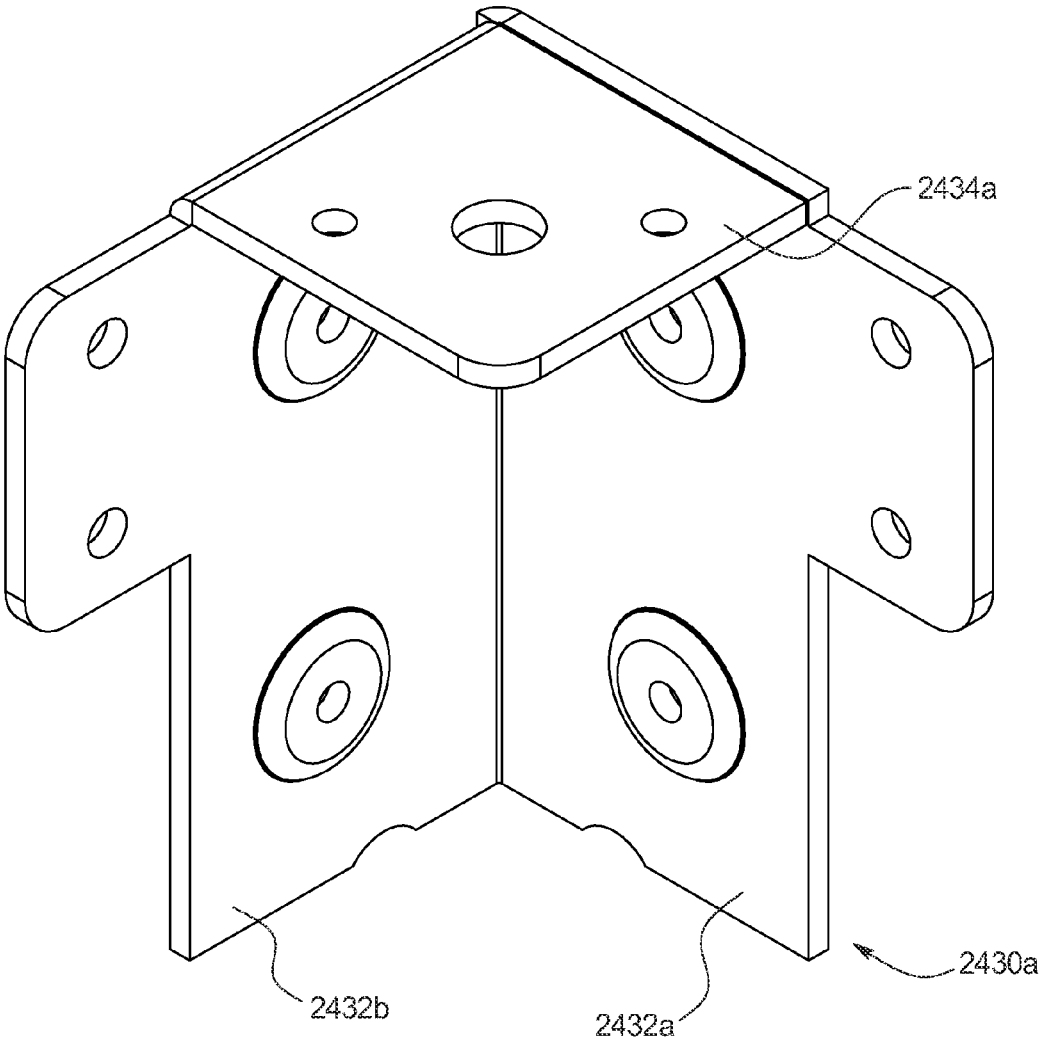
FIG. 84 is an enlarged perspective view of one of the combined support bracket and pin holders of one of the top compartment support assemblies of the shipping container of FIG. 47, shown removed from the top compartment of the container.

The gate 2510 includes a handle member or portion 2512 and a closure member or portion 2516 extending from the handle member or portion 2512 as best illustrated in FIGS. 74, 75, and 76. The gate 2510 is movable or slidable from a closed position as shown in FIGS. 47, 48, 49, 50, 53, 54, 58, 59, 65, 68, and 69, to a plurality of different partially open positions (such as the partially open position shown in FIGS. 66, 70, and 71), and then to a fully open position shown in FIGS. 67, 72, and 73. It should be appreciated that in this illustrated embodiment, the gate does not rest on the pallet, but that in other embodiments, the gate or portions of the gate may rest on portions of the pallet.

It should also be appreciated that the body 2102 of the pallet 2100 also defines a plurality of stopping walls (as best seen in FIGS. 65, 66 and 67) that would prevent the gate 2510 from moving too far outwardly and which also secondarily keep the handle portion 2512 of the gate 2510 relatively close to the pallet 2100. It should further be appreciated that the body 2102 of the pallet 2100 also provides a stopping walls 2182 that prevents the gate 2510 from moving too far inwardly.

It should be appreciated that this illustrated example embodiment of the material unloading assembly 2500 does not include a knife as in the embodiments described above. However, it should be appreciated that an alternative of this embodiment could alternatively include one or more knives.

Figure 68:
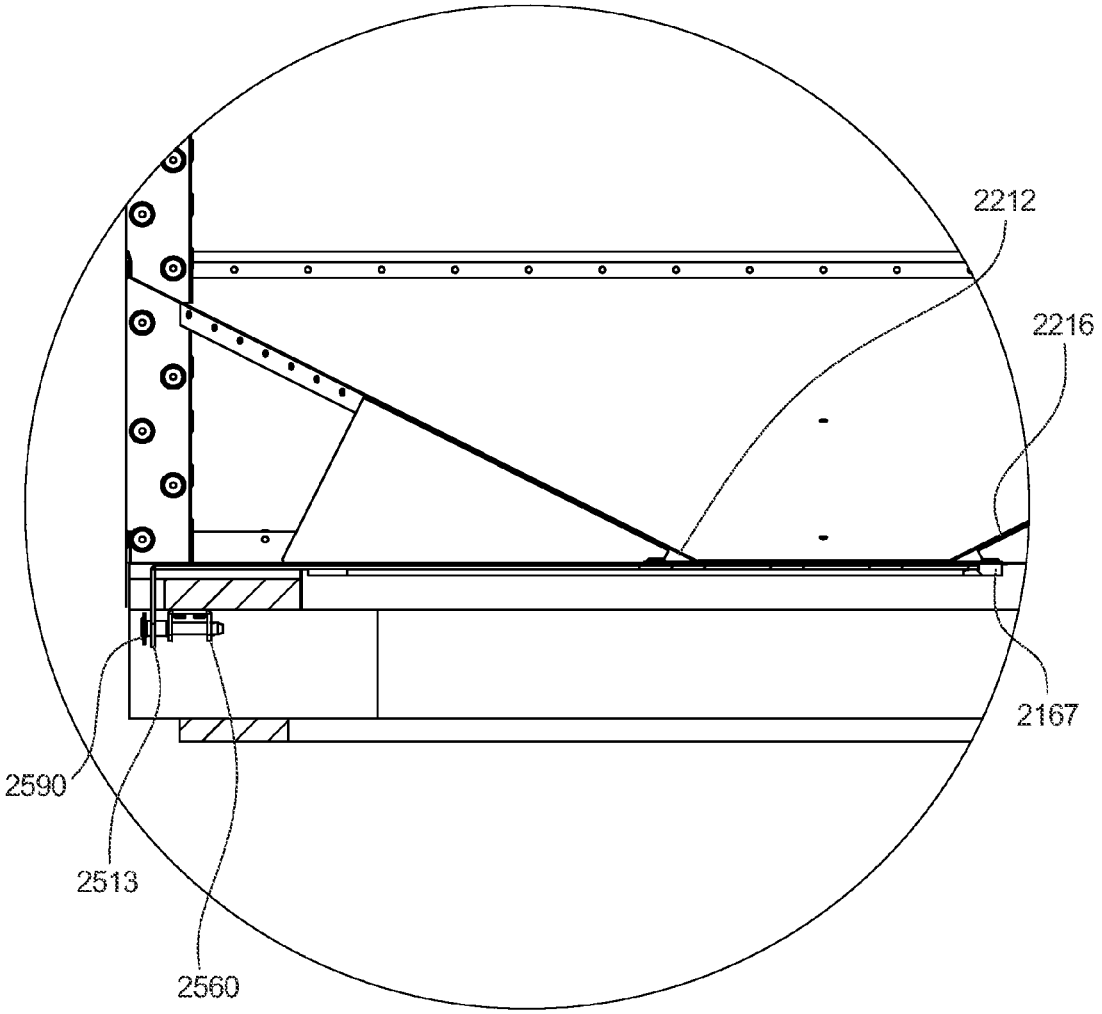
FIG. 68 is an enlarged fragmentary cross-sectional view of a part of the central portion of the pallet and a part of the bottom compartment of the shipping container of FIG. 47, and illustrating the gate of the material unloading assembly in a fully closed position.
Figure 69:
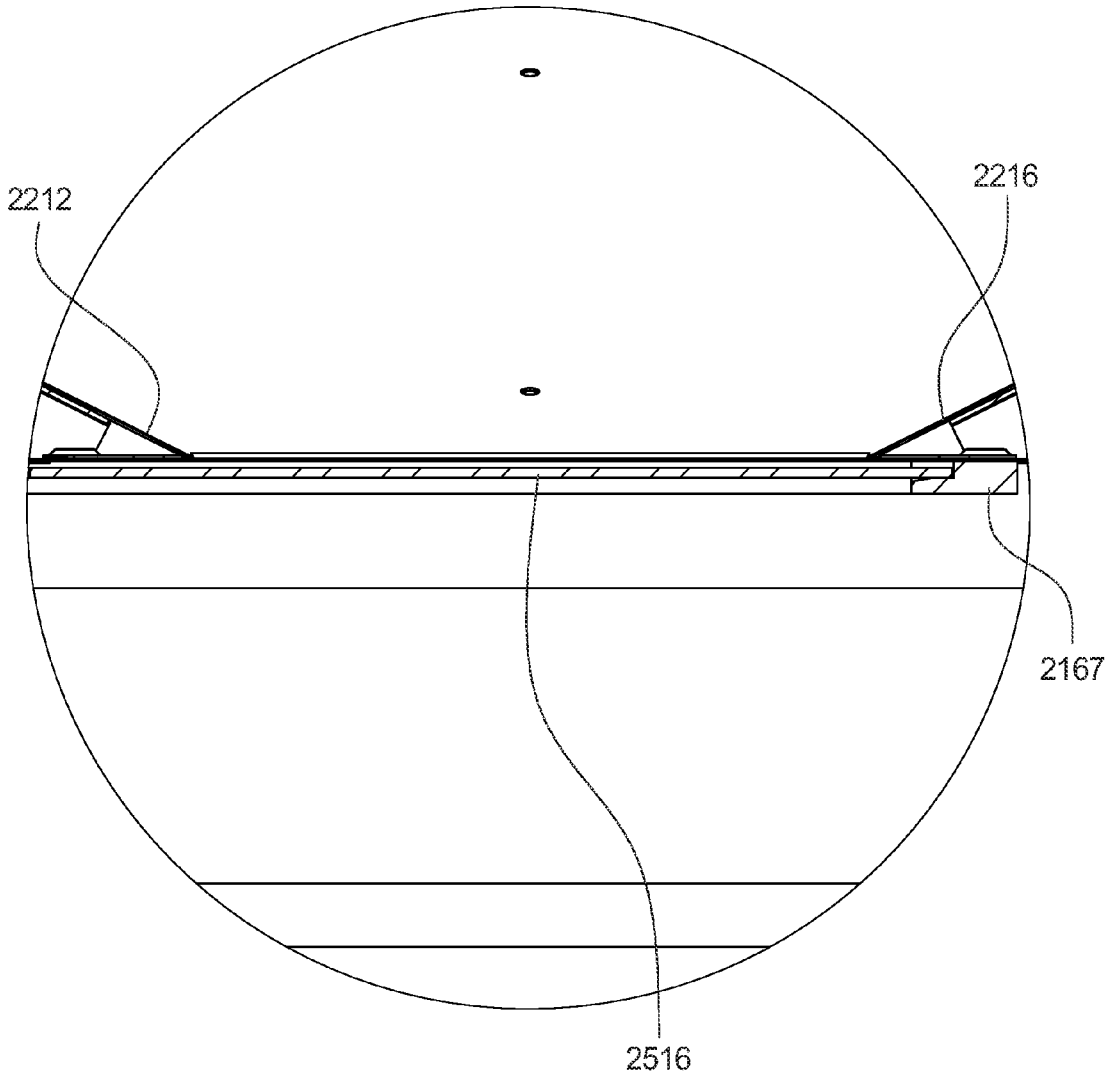
FIG. 69 is an even further enlarged fragmentary cross-sectional view of a part of the central portion of the pallet and a part of the bottom compartment of the shipping container of FIG. 47, and illustrating the gate of the material unloading assembly in a fully closed position.
Figure 70:
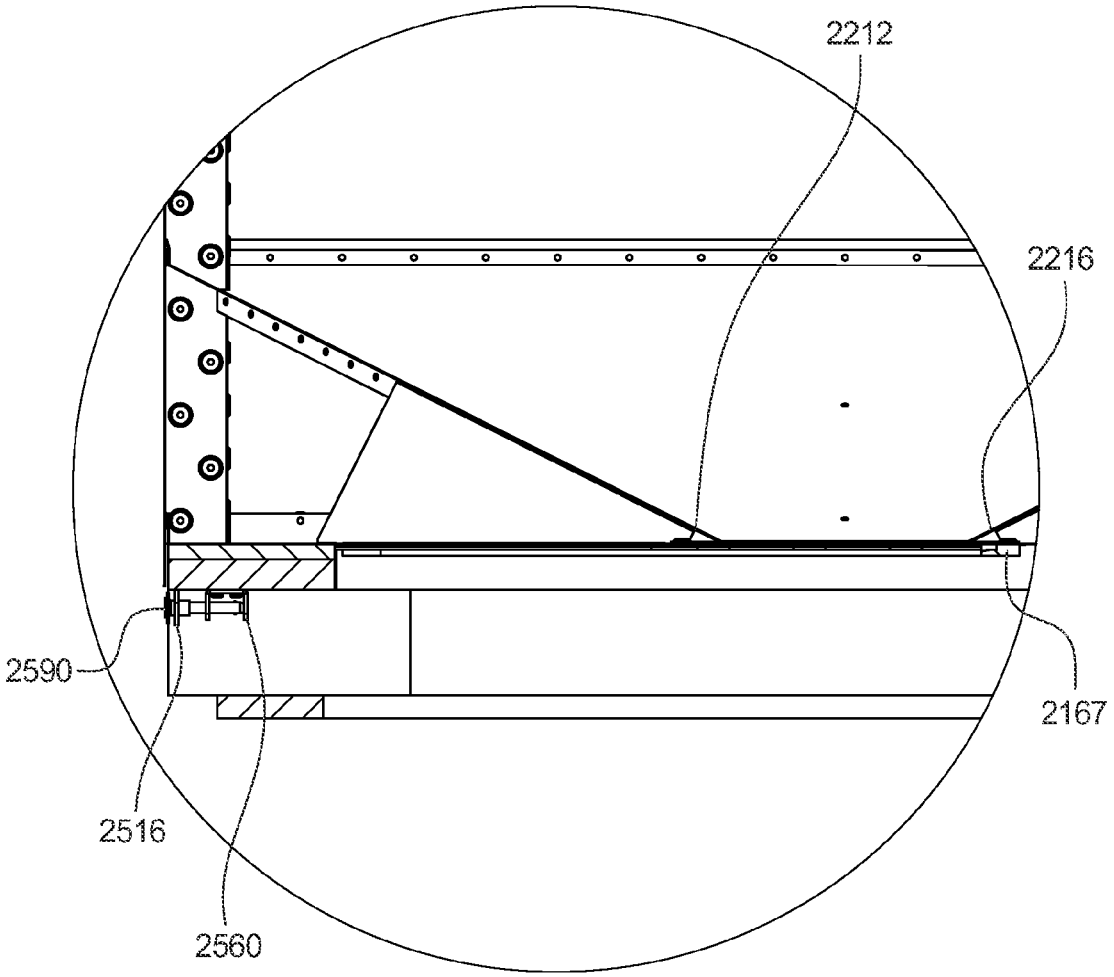
FIG. 70 is an enlarged fragmentary cross-sectional view of a part of the central portion of the pallet and a part of the bottom compartment of the shipping container of FIG. 47, and illustrating the gate of the material unloading assembly in a partially open position.
Figure 71:
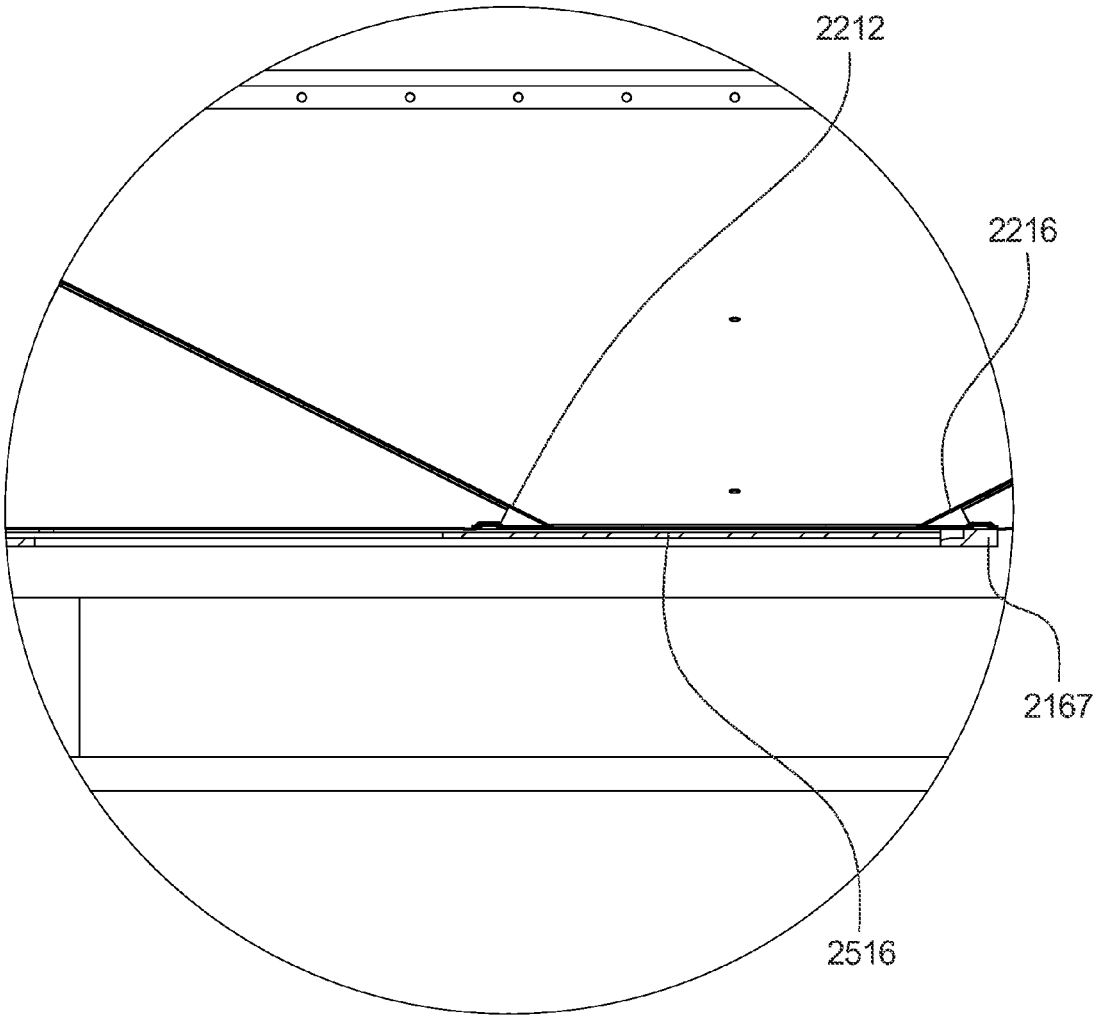
FIG. 71 is an even further enlarged fragmentary cross-sectional view of a part of the central portion of the pallet and a part of the bottom compartment of the shipping container of FIG. 47, and illustrating the gate of the material unloading assembly in a partially open position.
Figure 72:
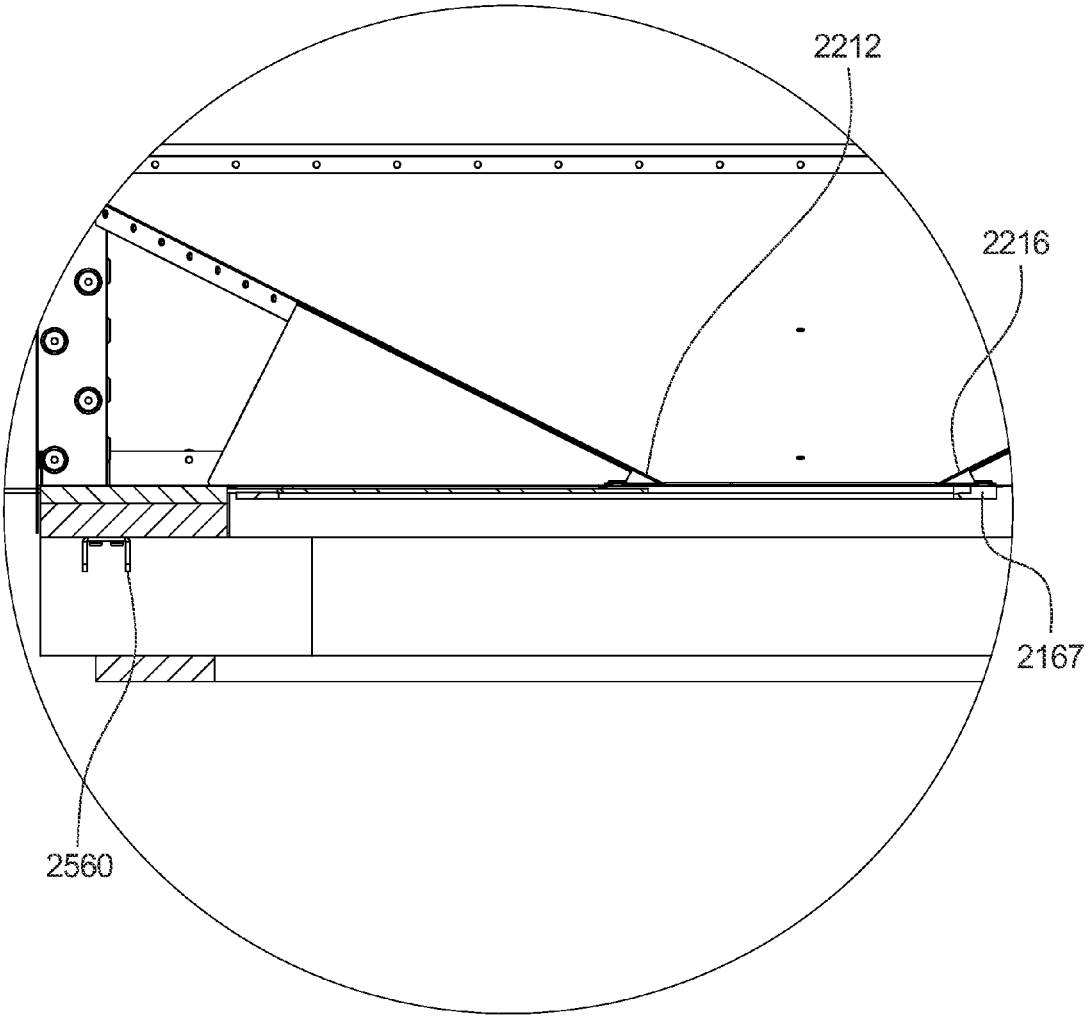
FIG. 72 is an enlarged fragmentary cross-sectional view of the central portion of the pallet and a part of the bottom compartment of the shipping container of FIG. 47, and illustrating the gate of the material unloading assembly in a fully open position.
Figure 73:
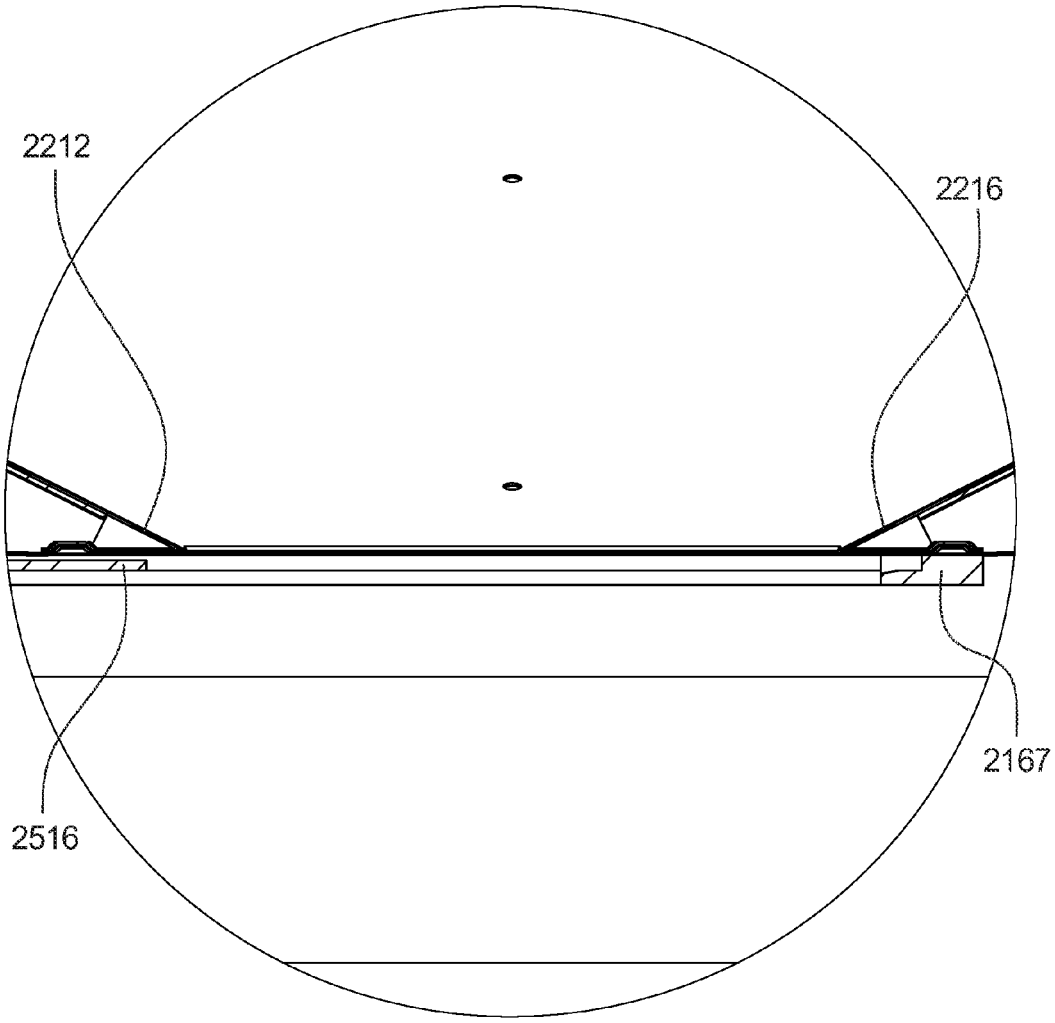
FIG. 73 is an even further enlarged fragmentary cross-sectional view of the central portion of the pallet and a part of the bottom compartment of the shipping container of FIG. 47, and illustrating the gate of the material unloading assembly in a fully open position.

The material unloading assembly 2500 also includes a locking assembly 2550 configured to enable a user to lock the gate 2510, and specifically the handle portion 2512 of the gate 2510 to the stopping wall 2182 of the pallet 2510 to prevent the handle portion 2512 and the gate 2510 from being accidentally opened at undesired points in time such as: (a) during loading of the container 2050; (b) during transit of the container 2050; or (c) at any other point in time prior to an unloader opening the gate 2510. More specifically, as seen in FIGS. 47, 48, 49, 50, 53, 54, 58, 59, 65, 66, 67, 68, 70, 74, 76, 77, 78 and 79, the 60 handle portion 2512 of the gate 2510 includes a downwardly extending handle 2513 which is configured to be gripped by a user to open and close the gate 2510. The downwardly extending handle 2513 defines a locking pin slot or opening 2514 (best seen in FIGS. 59, 67, and 77) configured such the locking pin 2590 can extend through the locking pin opening or slot 2514. The material unloading assembly 2500 also includes a stopping bracket 2560 attached to the bottom surface of the stopping wall 2182 as best seen in FIGS. 68, 70 and 72. The stopping bracket 2560 includes an opening aligned with the opening 2514 of the handle 2513 of the handle portion 2512 of the gate 2510. More specifically, the material unloading assembly 2500 further includes a locking pin 2590 configured to be inserted through: (a) the locking pin slot or opening 2514 of the handle 2513 of the handle portion 2512 of the gate 2510; and (b) the opening in the stopping bracket 2560 when the gate 2510 is in the closed position. This locking pin 2590 engages the stopping bracket 2560 to prevent unwanted opening of the gate 2510. When the user desires to open the gate 2510, the user activates the locking pin 590 and removes the locking pin 2590 from the stopping bracket 2560. It should be appreciated that although not shown, the locking pin 2590 can be tethered to the handle 2513 of the gate 2510 by a suitable tether (not shown). It should also be appreciated that the locking pin can be placed in a different hole in the handle of the gate 2510. It should further be appreciated, that although not shown, the material unloading assembly can further include one or more guides for holding the locking pin 2590 level or otherwise in position for easy re-insertion when the gate 2510 is in a fully open or partially open position. It should be appreciated that the locking pin can be any suitable locking pin. It should also be appreciated, that although not shown a suitable tether can be employed to maintain the locking pin attached to the gate or container.

It should also be appreciated that by pushing the handle back toward the closed position, the chute can be closed or partially closed. It should also be appreciated that placing the handle in a partially open or partially closed positioned enables the user to control the rate of emptying the materials from the container 2050. It should also be appreciated that the pallet or bottom container can include a loop or hole that corresponds to a hole in the handle 2513 for receiving a tamper identification seal or lock.

As mentioned above, the top compartment 2300 is supported by a plurality of top compartment supporting assemblies 2400*a*, 2400*b*, 2400*c* (not shown), and 2400*d* which are each configured to support a different one of the corners of the top compartment 2300 and to hold the top compartment 2300 in the expanded position as illustrated in FIGS. 47, 49, 50, 51, 83, 84, 85, 86, and 84. In the illustrated embodiment, each top compartment support assembly 2400*a*, 2400*b*, 2400*c*, and 2400*d* is identical; however, it should be appreciated that two or more of these support assemblies may be different. Support assembly 2400*a* is discussed herein as an example.

Figure 85:
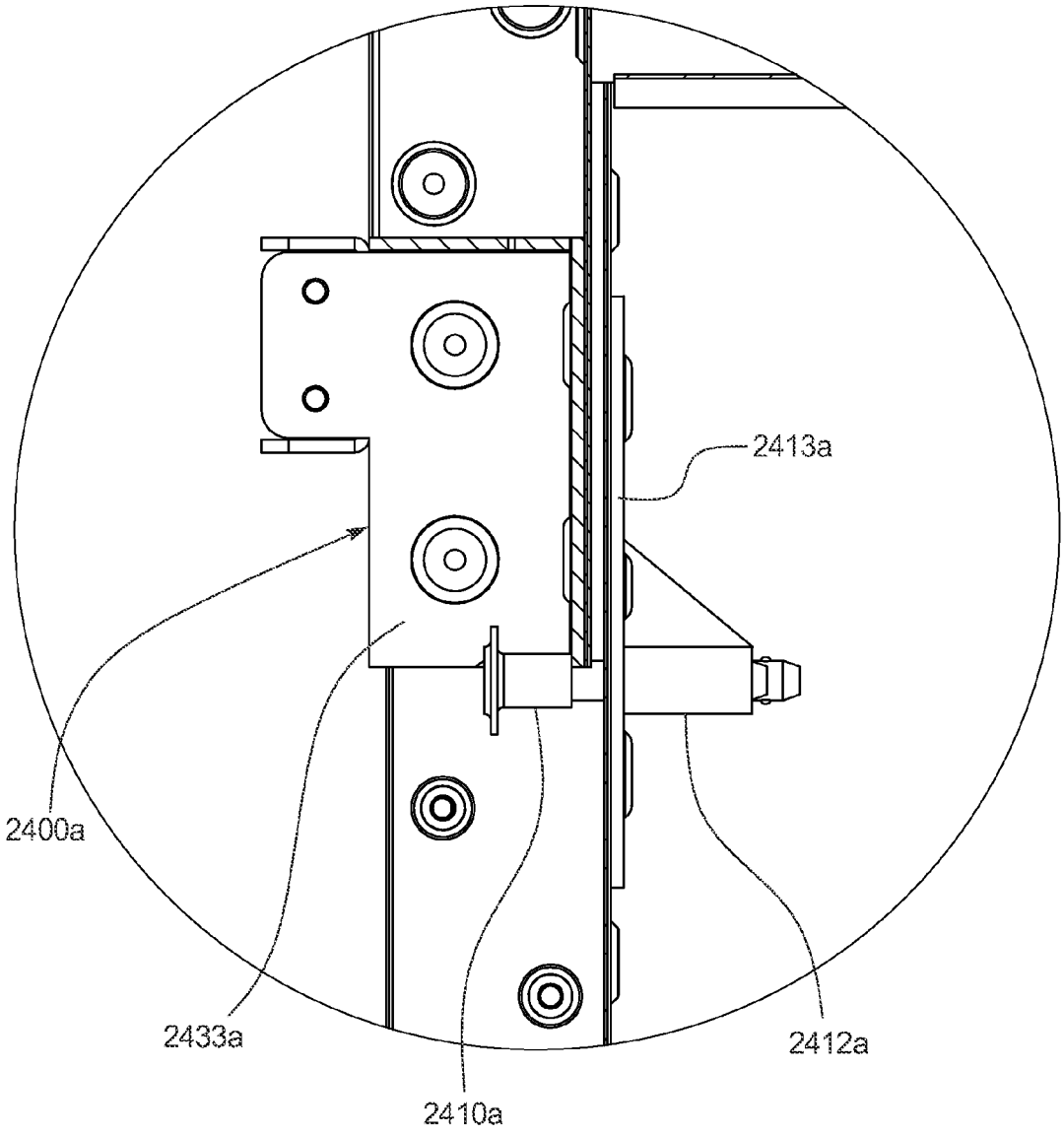
FIG. 85 is an enlarged fragmentary partially cut away side view of one of the locking pins of one of the top compartment support assemblies inserted in a pin receipt of one of the corners of the bottom compartment of the shipping container of FIG. 47, and illustrating the locking pin in a locked position and supporting the corner of the top compartment.
Figure 86:
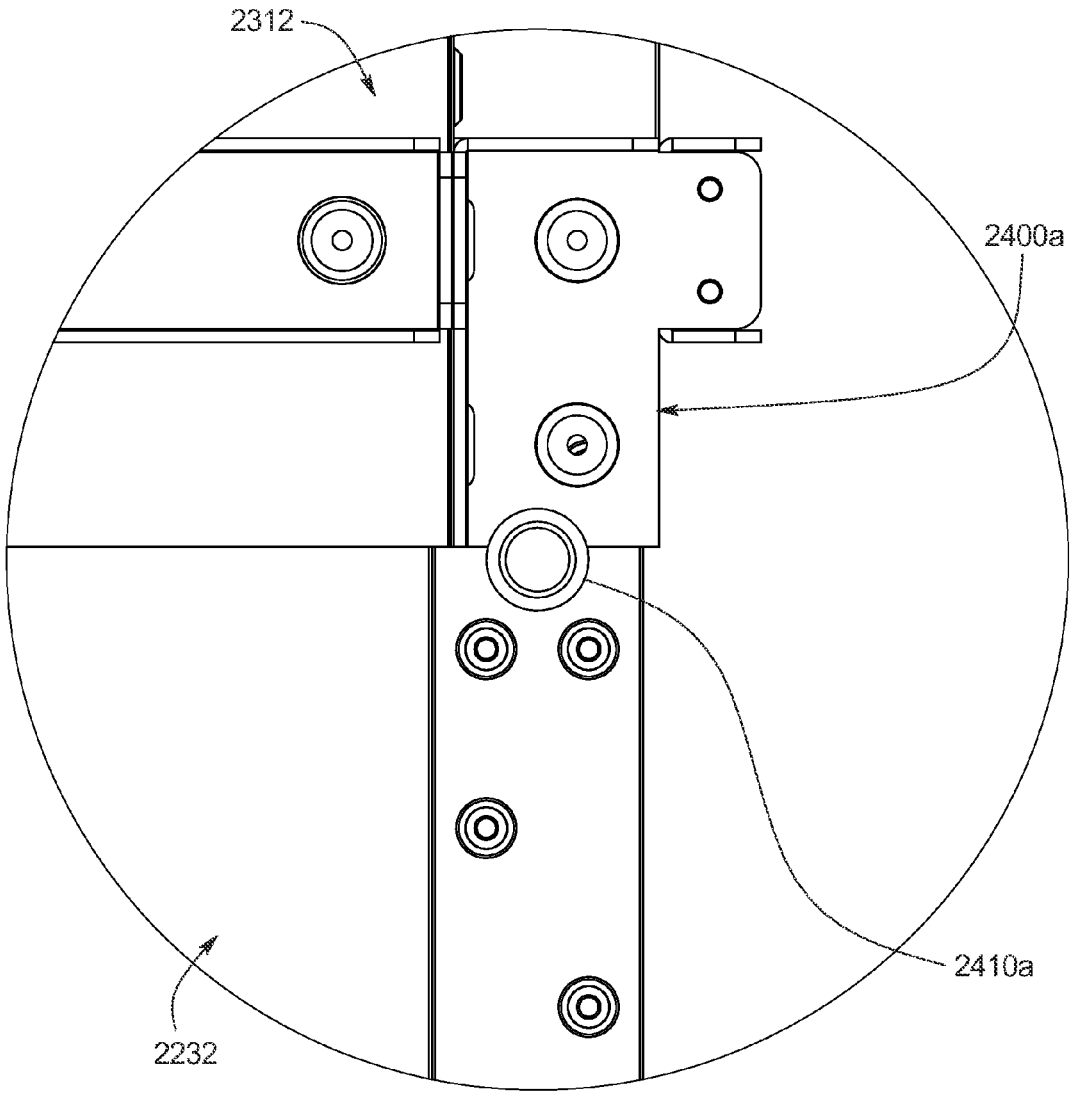
FIG. 86 is an enlarged fragmentary side view of one of the locking pins of one of the top compartment support assemblies inserted in a pin receipt of one of the corners of the bottom compartment of the shipping container of FIG. 47, and illustrating the locking pin in a locked position and supporting the corner of the top compartment.

Support assembly 2400*a* includes a support pin 2410*a* configured to be inserted through a pin receipt or pin receipt hole (not shown) in the respective corner of the bottom compartment 2200 and into a tubular support pin receiver or sleeve 2412*a* of the support assembly 2400*a* which is attached to a support bracket 2413*a* which is suitably attached (such as by welding) to the inside of the corner of the bottom compartment 2200 as best illustrated in FIG. 85. The illustrated support pin 2410*a* includes a head, a collar attached to the head and a body extending from the collar, and a locking mechanism with a push button disposed in the head. The bottom edges of the corners of the top compartment are configured to rest on the bodies of these support pins. However, it should be appreciated that other support pins may be employed in accordance with the present disclosure.

The support assembly 2400*a* further includes a combined support bracket and pin holder 2430*a* and a tether 2460*a* (shown in FIG. 94) attaching the pin 2420*a* to the combined support bracket and holder 2430*a*. It should be appreciated that the combined support bracket and pin holder 2430*a* and the tether 2460*a* are partially employed to prevent the support pin 2410*a* from being lost and to hold the support pin 2410*a* out of the way of the bottom compartment 2200 when the support pin 2410*a* is not in use.

More specifically, in the illustrated embodiment, the combined support bracket and pin holder 2430*a* is substantially more robust than the support pin holder 430*a* of container 50 described above. Combined support bracket and pin holder 2430*a* includes two mounting members 2432*a* and 2433*a* suitably attached to the corner of the top compartment 2300 and a pin holder 2434*a* connected to the mounting members 2432*a* and 2433*a*. The pin holder 2434*a* defines a first hole for attachment of the one end of the tether and a second hole for removably holding the support pin when the support pin is not in use. The combined support bracket and pin holder 2430*a* is made from stainless steel or galvanized steel, and riveted to the corner of the top compartment 2300. It should be appreciated that the combined support bracket and holder could be made from other suitable materials, could be suitably attached to the top compartment in other suitable manners and could be alternatively configured. It should also be appreciated that each combined support bracket and pin holder is configured to provide additional support for the top compartment when the top compartment rest on the support pins.

Similar to tether 460*a* described above, tether 2460*a* includes one end loop is attached to the combined support bracket and holder 2430*a* and another end loop is attached to the support pin. Each tether may be any suitable length and made from any suitable material such as steel or a high strength plastic.

The support pin 2410*a* in the illustrated embodiment is similar to the pin described above. It should be appreciated that other suitable support pins may be employed with the container in accordance with the present disclosure.

As mentioned above, the container 2050 includes an extension assembly 2700 which enables a user or loader to move the top compartment from the retracted position to the expanded position to enable insertion of the support pins. The extension assembly 2700 of the container 2050 is identical to the extension assembly 700 of the container 50, and thus will only generally be described. Generally, as illustrated in FIGS. 47, 48, 50, 52, and 54, the extension assembly 2700 includes a first set of aligned fork lift tine receiving loops or lifting brackets 2702 and 2704 and a second set of aligned forklift tine receiving loops or lifting brackets 2706 and 2708. Each of the lift tine receiving loops or lifting brackets 2702, 2704, 2706, and 2708 are identical in this illustrated embodiment, but it should be appreciated that these components can be different. In this embodiment, these loops or lifting brackets are made of stainless steel or galvanized steel and the mounting bars are each suitably riveted to the top wall 2302 of the top compartment 2300. The loops or lifting brackets are suitably aligned to form two slots configured to receive forklift forks or tines. It should be appreciated that these brackets can be made of other suitable materials and attached in other suitable manners.

The material loading assembly 2600 is similar to the material loading assembly 600 of container 50 and thus will only be generally described. FIGS. 47, 48, 50, 51, 52, and 54, generally illustrate that the material loading assembly 2600 is attached to the top compartment 2300 and generally includes: (a) an upwardly extending lip (not shown) attached to and extending from the top wall 2302 of the top compartment 2300; (b) a cover 2610 configured to securely engage the upwardly extending lip and pivotally attached to the top wall 2302 of the top compartment 2300 by hinge 2630; (c) a lock assembly 2650 including a first portion attached to the top wall 2302 of the top compartment 2300 and a second portion or lid latch pivotally attached to the cover 2610; (d) and a gasket (not shown) mounted in the cover 2610 to seal out contaminants. The locking assembly 2650 includes a suitable lock (not shown) which is used to lock the cover 2610 in the closed position, and specifically to lock the second portion or lid latch attached to the cover to the first portion attached to the top wall 2302 of the top compartment 2300.

Figure 88:
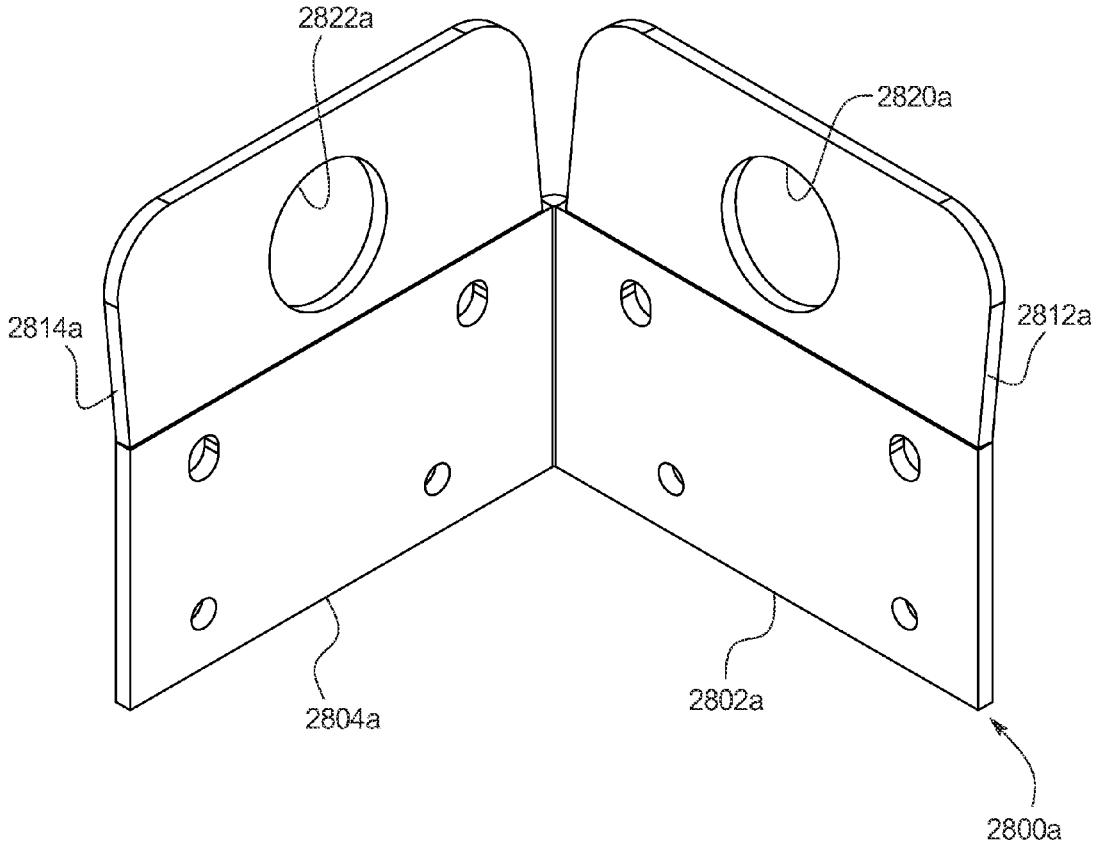
FIG. 88 is an enlarged perspective view of one of the nesting or stacking guides of the shipping container of FIG. 47, shown removed from the top compartment.

As mentioned above, the container 2050 and specifically the top compartment 2300 includes a plurality of nesting or stacking or guides 2800*a*, 2800*b*, 2800*c*, and 2800*d* which are configured to facilitate secure stacking of the containers of the present disclosure as well as stacking of other known bulk material containers as illustrated in FIGS. 47, 48, 49, 50, 51, 52, 54, 88, 89, 90, and 91. In the illustrated embodiment, each of the stacking guides 2800*a*, 2800*b*, 2800*c*, and 2800*d* is identical; however, it should be appreciated that two or more of these stacking guides may be different. More specifically, stacking guide 2800*a* is discussed herein as an example stacking guide. As best shown in FIG. 88, stacking guide 2800*a* includes mounting walls 2802*a* and 2804*a* configured to be attached to the corner of the top compartment 2300 and guide wall 2812*a* and 2814*a* respectively attached to and extend from the mounting walls 2802*a* and 2804*a*. In this illustrated embodiment, the guide wall 2812*a* and 2814*a* each respectively define openings 2820*a* and 2822*a*. As generally shown in FIGS. 90 and 91, the stacking guides assist in positioning one container of the present disclosure on top of another container of the present disclosure.

FIG. 89 illustrates one corner of the top compartment 2300 of the container 2050 with a nesting guide 2800*a* and two nesting supports 2840*a* and 2842*a* adjacent to and attached to the nesting guide 2800*a*. In this illustrated example, the nesting supports 2840*a* and 2842*a* are each made from a steel tubular material and are attached by rivets to the nesting guide 2800*a*. It should be appreciated that the nesting supports can be made from other suitably strong materials and can be attached to the nesting guide in other suitable manners such as by welding. When a second container sits on a first container as generally illustrated in FIGS. 90 and 91, the pallet of the second or top container rests on the nesting supports 2840*a* and 2842*a* of the first or bottom container which are configured to support the pallet and specifically the legs of the pallet of the second container. The nesting supports direct the weight of the second or top container that sits on those nesting supports to the corners of the first or bottom container rather than the entire side walls or edges of the first or bottom container. This prevents the weight of the second or top container from damaging the walls of the top compartment of the first or bottom container and provides for a better nesting of compatible containers.

FIG. 91 shows the leg 2124 of the pallet 2100 sitting on the nesting supports 2842*a* and 2840*a* adjacent to the nesting guide 2800*a*. FIG. 91 also shows a small gap under the footing 2101 attached to the bottom of the legs of the pallet 2100 and that the footing does not rest on the nesting supports and does not rest on the top wall of the top compartment. This configuration prevents too much weight from the second or top pallet from being placed on the top wall of the top compartment of the first or bottom pallet.

This example embodiment of the shipping container of the present disclosure is configured to directly hold materials or to receive and hold a large plastic bag or a sleeve which holds the materials in the interior areas defined by bottom and top compartments. In one embodiment, the same bag as the bag described above can be employed. When a bag is employed with this container 2050, it is expected that a knife will also be employed in the material unloading assembly.

Figure 87:
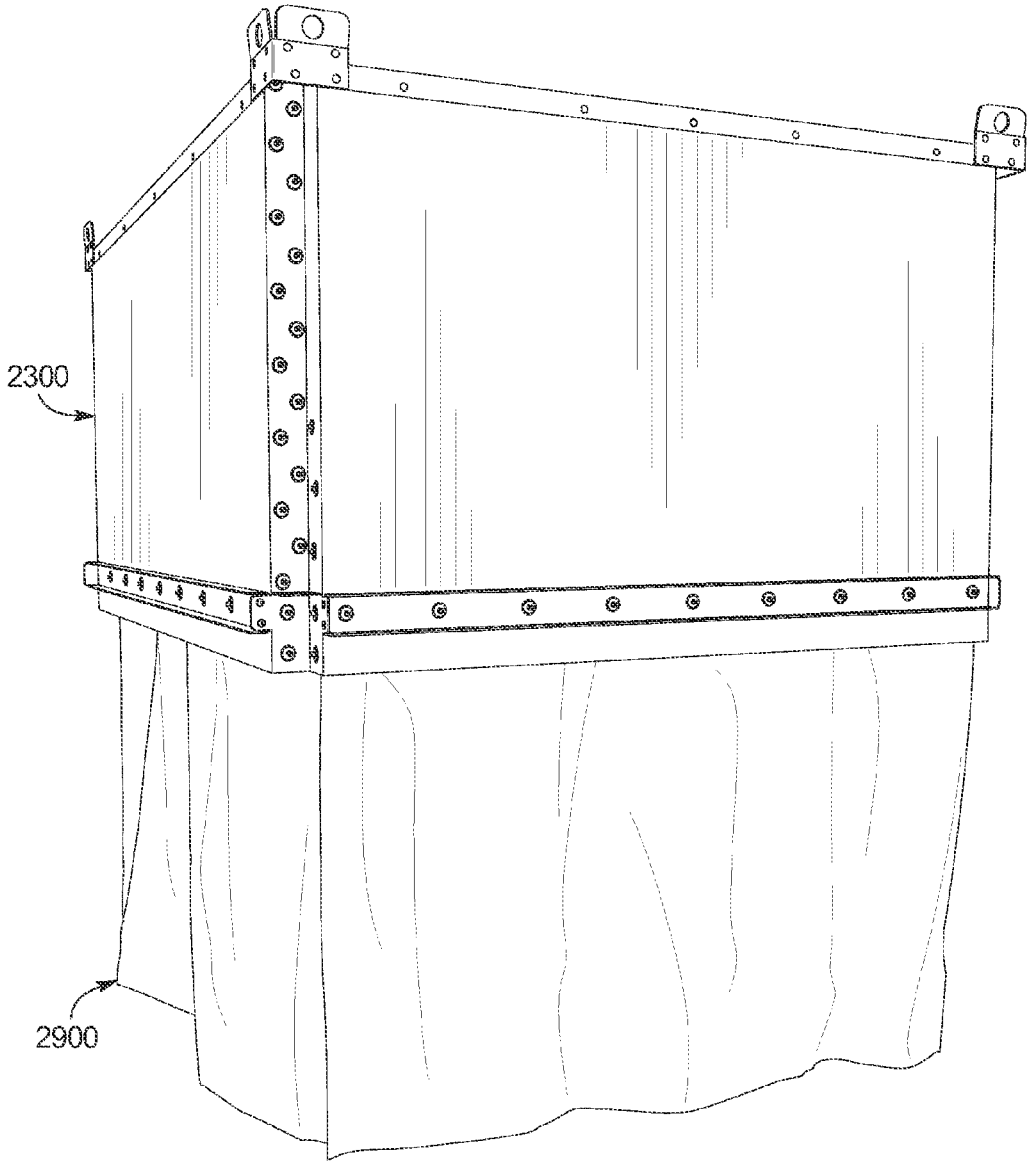
FIG. 87 is a perspective view of the top compartment of the shipping container of FIG. 47, shown removed from the bottom compartment and with a sleeve attached to the interior surfaces of the top compartment.

In other embodiments, instead of a bag, a sleeve is employed as generally illustrated in FIG. 87. In one such embodiment, the sleeve includes four connected walls where each wall is approximately 45 inches (114.30 centimeters) by approximately 56 inches (142.24 centimeters). In one embodiment, the sleeve has no bottom or top walls. In one embodiment, the sleeve: (a) is FDA compliant; (b) has an approximately 2 millimeter thickness; (e) is opaque or gray; and (f) is made from a low density recyclable polyethylene plastic. In one alternative embodiment, the sleeve is also or alternatively bio-degradable. It should be appreciated that in various embodiments the sleeve will be appropriately folded so that the sleeve can be unfolded and positioned in the top and bottom compartments of the container. FIG. 87 shows the top compartment 2300 removed from the bottom compartment and the generally rectangular sleeve 2900 extending downwardly from the top compartment 2300. This sleeve 2900 includes double-sided tape (not shown) on the outside walls of its top end for attachment of the sleeve to the inner surfaces of the walls of the top compartment. In practice, to install a sleeve, an operator would: (a) remove the top compartment from the bottom compartment; (b) clean the interior walls of both top and bottom compartments if necessary; (c) unfold the sleeve, and attach the sleeve to the inner wall surfaces of the top compartment; (d) move the top compartment with the sleeve hanging down over the bottom compartment; and (e) lower the sleeve into the bottom compartment and reconnect the top compartment to the bottom compartment such the sleeve is in the bottom and top compartments.

In another embodiment (not shown), the bulk material shipping container is similar to container 2050 but is not expandable or retractable. This example shipping container includes: (a) a pallet similar to pallet 2100; (b) a single compartment mounted on the pallet; (c) a material unloading assembly supported by the bottom compartment and similar to material unloading assembly 2500; and (d) a material loading assembly attached to the top of the compartment similar to material loading assembly 2600. Since this embodiment includes a single compartment, this embodiment does not need to include the plurality of top compartment supporting assemblies or the extension assembly. In this embodiment, the bulk material shipping container of the present disclosure can also be used with a bag, with a sleeve, or without a bag or sleeve.

Figure 97:
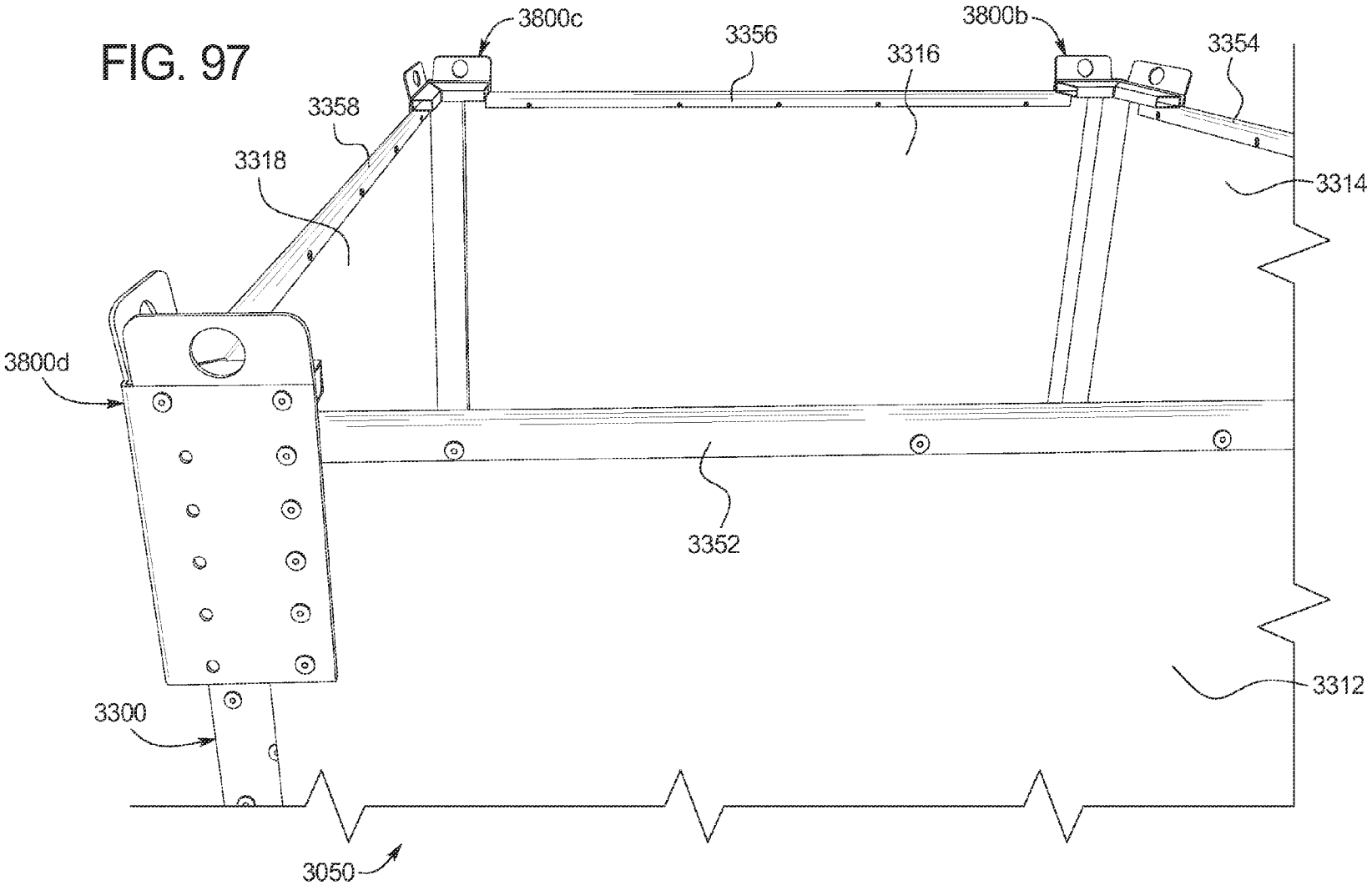
FIG. 97 is a fragmentary perspective view of another example embodiment of the shipping container of the present disclosure.

In another embodiment partially shown in FIG. 97, the bulk material shipping container is not expandable or retractable and does not include a top wall. In this embodiment, the shipping container 3050 includes: (a) a pallet (not shown) similar to pallet 2100; (b) a single compartment 3300 mounted on the pallet; and (c) a material unloading assembly (not shown) supported by the bottom compartment and similar to material loading assembly 2500. Since this embodiment includes a single compartment, this embodiment does not need to include the plurality of top compartment supporting assemblies or the extension assembly. In this embodiment, the bulk material shipping container of the present disclosure can also be used with a bag, with a sleeve, or without a bag or a sleeve. Additionally, in this illustrated embodiment, the compartment is formed without a top wall. End caps or channels 3352, 3354, 3356, and 3358 are respectively positioned over the top edges of the side walls 3312, 3314, 3316, and 3318 to protect and strengthen the top edges of the compartment. The nesting guides 3800*a* (not shown), 3800*b*, 3800*c*, and 3800*d* are configured to provide additional engagements with the corners of the top of the compartment to sufficiently support the nesting supports. In this embodiment, multiple containers with open top ends can be stacked on each other and unloaded together when the material unloading assemblies are all opened with the containers stacked on each other.

It should be appreciated that the present disclosure contemplates the elimination or reduction of sharp edges in the compartment and that any sharp edges can be curved or formed with a suitable radius.

It should be understood that modifications and variations may be effected without departing from the scope of the novel concepts of the present disclosure, and it should be understood that this application is to be limited only by the scope of the appended claims.

The invention is claimed as follows:

1. A material shipping container comprising:

a pallet;

a compartment mounted on and supported by the pallet, the compartment including:

(a) a top wall having first, second, third, and fourth corners, (b) a front exterior wall, (c) a back exterior wall, (d) a first exterior side wall, (e) a second exterior side wall, (f) a front exterior wall support bracket connected to an exterior side of the front exterior wall, (g) a back exterior wall support bracket connected to an exterior side of the back exterior wall, (h) a first side exterior wall support bracket connected to an exterior side of the first exterior side wall, (i) a second side exterior wall support bracket connected to an exterior side of the second exterior side wall, (j) a plurality of wedge shaped interior bottom wall supports including: (i) a front wedge shaped bottom wall support, (ii) a back wedge shaped bottom wall support, (iii) a first side wedge shaped bottom wall support, and (iv) a second side wedge shaped bottom wall support;

(k) an interior bottom wall defined by a plurality of attached downwardly angled sections including: (i) a front downwardly angled section including opposing spaced apart side edges, (ii) a back downwardly angled section including opposing spaced apart side edges, (iii) a first side downwardly angled section including opposing spaced apart side edges, and (iv) a second side downwardly angled section including opposing spaced apart side edges, each of the downwardly angled sections having a lower edge which at least partially forms a material release opening at a bottom of the compartment, the downwardly angled sections attached to and supported by:

(i) the front exterior wall, (ii) the back exterior wall, (iii) the first exterior side wall, (iv) the second exterior side wall, and (v) the plurality of wedge shaped interior bottom wall supports, wherein: (i) the front wedge shaped bottom wall support supports the front downwardly angled section between the opposing spaced apart side edges of the front downwardly angled section, (ii) the back wedge shaped bottom wall support supports the back downwardly angled section between the opposing spaced apart side edges of the back downwardly angled section, (iii) the first side wedge shaped bottom wall support supports the first side downwardly angled section between the opposing spaced apart side edges of the first side downwardly angled section, and (iv) the second side wedge shaped bottom wall support supports the second side downwardly angled section between the opposing spaced apart side edges of the second side downwardly angled section, (l) a first tubular nesting support positioned above the first corner, (m) a second tubular nesting support positioned above the second corner, (n) a third tubular nesting support positioned above the third corner, and (p) a fourth tubular nesting support positioned above the fourth corner, the first, second, third, and fourth tubular nesting supports configured to at least partially support a pallet of another same material shipping container;

a material unloading assembly positioned at a bottom of the compartment, the material unloading assembly including: (i) a plurality of spaced apart guide rails connected to and supported by the pallet; and (ii) a slidable gate movable from a closed position to an open position, the slidable gate partially supported by the spaced apart guide rails; and a material loading assembly attached to the top wall of the compartment, the material loading assembly including a cover attached to the top wall of the compartment and moveable from a closed position to an open position, wherein in the closed position, the cover engages a lip extending upwardly from the top wall of the compartment, and wherein in the open position the cover remains attached to the top wall of the compartment.

2. The material shipping container of claim 1, wherein each of the tubular nesting supports includes a generally rectangular tubular section.

3. The material shipping container of claim 1, wherein:

(a) the front exterior wall has a first corner section and a second corner section, (b) the back exterior wall has a first corner section and a second corner section, (c) the first side exterior wall has a first corner section and a second corner section, the first corner section of the first side exterior wall connected to the first corner section of the front exterior wall, the second corner section of the first side exterior wall connected to the first corner section of the back exterior wall, and (d) the second side exterior wall has a first corner section and a second corner section, the first corner section of the second side exterior wall connected to the second corner section of the front exterior wall, the second corner section of the second side exterior wall connected to the second corner section of the back exterior wall.

4. The material shipping container of claim 1, wherein:

(a) the front exterior wall and the first side exterior wall form a W-shaped first corner section, (b) the front exterior wall and the second side exterior wall form a W-shaped second corner section, (c) the back exterior wall and the first side exterior wall form a W-shaped third corner section, and (b) the back exterior wall and the second side exterior wall form a W-shaped fourth corner section.

5. The material shipping container of claim 1, wherein the cover of the material loading assembly is hingedly attached to the top wall of the compartment.

6. The material shipping container of claim 1, wherein the compartment is entirely supported by the pallet.

* * * * *